US011129436B2

(12) United States Patent
Bell et al.

(10) Patent No.: US 11,129,436 B2
(45) Date of Patent: Sep. 28, 2021

(54) GOLF SHOE WITH NATURAL MOTION STRUCTURES

(71) Applicant: NIKE, Inc., Beaverton, OR (US)

(72) Inventors: Thomas G. Bell, Portland, OR (US); Tobie D. Hatfield, Lake Oswego, OR (US); Chip Jones, Beaverton, OR (US); Brooke P. Rapf, Lake Oswego, OR (US); Ricardo Salinas, Jr., Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 1117 days.

(21) Appl. No.: 15/189,281

(22) Filed: Jun. 22, 2016

(65) Prior Publication Data

US 2016/0302513 A1 Oct. 20, 2016

Related U.S. Application Data

(63) Continuation of application No. 13/564,605, filed on Aug. 1, 2012, now Pat. No. 9,414,638.
(Continued)

(51) Int. Cl.
*A43B 5/00* (2006.01)
*A43B 13/14* (2006.01)
(Continued)

(52) U.S. Cl.
CPC ..... *A43B 5/001* (2013.01); *A43B 7/142* (2013.01); *A43B 13/122* (2013.01);
(Continued)

(58) Field of Classification Search
CPC ..... A43B 13/141; A43B 13/22; A43B 13/223; A43B 13/122; A43B 13/125
See application file for complete search history.

(56) References Cited

U.S. PATENT DOCUMENTS 3,218,734 A 11/1965 O'Brien
3,311,999 A 4/1967 MacNeill
(Continued)

FOREIGN PATENT DOCUMENTS

CN 101404905 A 4/2009
CN 101404906 A 4/2009
(Continued)

OTHER PUBLICATIONS

International Search Report in International Patent Application No. PCT/US2012/049300 dated Nov. 14, 2012.
(Continued)

*Primary Examiner* — Megan E Lynch
(74) *Attorney, Agent, or Firm* — Banner & Witcoff, Ltd.

(57) ABSTRACT

Golf shoes include one or more of the following: (a) a foot stabilizer system that interacts with a shoe securing system to securely engage and/or wrap around a foot of a wearer; (b) a natural motion sole, optionally including flex grooves that allow a weight transfer from back-to-front and/or from side-to-side; (c) a six cleat configuration (e.g., four cleats in a forefoot region, two cleats in a heel region, and no cleats located directly under a big toe); (d) a forefoot moderator plate positioned to moderate or reduce user feel of the forefoot cleats; (e) a lateral half heel counter extending from a rear heel area to a lateral midfoot or lateral forward heel area of the shoe; and/or (f) one or more medial, forefoot, sidewall traction elements at or near a big toe area of the sole.

20 Claims, 63 Drawing Sheets

Related U.S. Application Data

(60) Provisional application No. 61/514,468, filed on Aug. 2, 2011.

(51) Int. Cl.

| | |
|---|---|
| ***A43B 13/12*** | (2006.01) |
| ***A43B 7/14*** | (2006.01) |
| ***A43B 13/22*** | (2006.01) |
| ***A43B 23/02*** | (2006.01) |
| ***A43C 15/02*** | (2006.01) |
| ***A43C 15/16*** | (2006.01) |

(52) U.S. Cl.

CPC ..... *A43B 13/141* (2013.01); *A43B 13/223* (2013.01); *A43B 23/027* (2013.01); *A43B 23/0235* (2013.01); *A43B 23/0245* (2013.01); *A43B 23/0265* (2013.01); *A43C 15/02* (2013.01); *A43C 15/161* (2013.01)

(56) References Cited

U.S. PATENT DOCUMENTS 4,067,123 A 1/1978 Minihane
4,149,324 A 4/1979 Lesser et al.
4,161,829 A 7/1979 Wayser
4,167,071 A 9/1979 Koransky
4,194,310 A 3/1980 Bowerman
4,335,529 A 6/1982 Badalamenti
4,402,145 A 9/1983 Dassler
4,407,079 A 10/1983 Chiroff
4,506,460 A 3/1985 Rudy
4,527,345 A 7/1985 Lopez
4,559,724 A * 12/1985 Norton ..... A43B 5/06 36/114
4,637,600 A 1/1987 Bartimes et al.
4,642,917 A 2/1987 Ungar
4,704,809 A 11/1987 Ballard
4,754,561 A 7/1988 Dufour
4,790,083 A 12/1988 Dufour
4,875,683 A 10/1989 Wellman et al.
4,885,851 A 12/1989 Peterson
4,937,954 A 7/1990 Clement
4,953,311 A 9/1990 Bruggemeier
5,012,597 A * 5/1991 Thomasson ..... A43B 13/143 36/114
5,029,869 A 7/1991 Veasey
5,150,903 A 9/1992 Percic
5,301,442 A 4/1994 Williams
5,381,614 A 1/1995 Goldstein
5,384,973 A * 1/1995 Lyden ..... A43B 13/12 36/102
5,699,628 A 12/1997 Boatwalla
5,711,094 A 1/1998 Grossman
5,932,336 A 8/1999 Allen et al.
6,018,893 A 2/2000 Workman
6,065,230 A 5/2000 James
6,289,611 B1 * 9/2001 Patterson ..... A43B 5/001 36/127
6,295,742 B1 10/2001 Bathum
6,354,022 B2 3/2002 Gelsomini
6,412,196 B1 * 7/2002 Gross ..... A43B 13/026 36/102
6,430,847 B2 8/2002 Fusco et al.
6,474,005 B2 11/2002 Kobayashi
D466,272 S 12/2002 Erickson
6,792,698 B2 9/2004 Kobayashi et al.
6,834,446 B2 12/2004 McMullin
6,845,575 B1 1/2005 Hwang
6,912,802 B2 7/2005 Cooper
6,990,755 B2 1/2006 Hatfield et al.
7,171,767 B2 2/2007 Hatfield et al.
7,290,357 B2 11/2007 McDonald et al.
D560,885 S 2/2008 Lane
D571,090 S 6/2008 Fujita
7,392,605 B2 7/2008 Hatfield et al.
D581,146 S 11/2008 Lane, III
7,607,241 B2 10/2009 McDonald et al.
7,650,707 B2 1/2010 Campbell
7,707,748 B2 5/2010 Campbell
7,823,301 B2 11/2010 Belluto
7,870,681 B2 1/2011 Meschter
7,941,945 B2 5/2011 Gerber
7,946,058 B2 5/2011 Johnson et al.
8,181,365 B2 5/2012 Cass et al.
D671,725 S 12/2012 Bell
8,327,560 B2 12/2012 Berend
8,418,382 B2 4/2013 Madore
8,776,400 B2 7/2014 James et al.
8,806,776 B2 8/2014 Leick et al.
8,869,435 B2 10/2014 Hatfield
9,414,638 B2 * 8/2016 Hatfield ..... A43B 5/001
2002/0004999 A1 * 1/2002 Caine ..... A43B 13/186 36/129
2002/0144429 A1 * 10/2002 Hay ..... A43B 7/1425 36/25 R
2002/0148142 A1 10/2002 Oorei et al.
2002/0178618 A1 * 12/2002 Pitts ..... A43B 5/001 36/127
2003/0101619 A1 6/2003 Litchfield et al.
2003/0131501 A1 7/2003 Erickson
2005/0262739 A1 * 12/2005 McDonald ..... A43B 3/0057 36/102
2006/0061012 A1 3/2006 Hatfield et al.
2006/0242863 A1 * 11/2006 Patmore ..... A43B 13/26 36/127
2006/0277793 A1 * 12/2006 Hardy ..... A43B 13/181 36/28
2007/0199211 A1 * 8/2007 Campbell ..... A43B 5/001 36/59 R
2007/0199213 A1 * 8/2007 Campbell ..... A43B 3/0057 36/102
2008/0010860 A1 1/2008 Gyr
2008/0016716 A1 1/2008 Battaglino
2008/0052965 A1 * 3/2008 Sato ..... A43B 13/026 36/103
2008/0072458 A1 3/2008 Conneally
2008/0098624 A1 5/2008 Goldman
2008/0216355 A1 9/2008 Becker et al.
2008/0229617 A1 9/2008 Johnson et al.
2009/0013561 A1 * 1/2009 Robinson, Jr. ..... A43B 5/001 36/127
2009/0100716 A1 4/2009 Gerber
2009/0113758 A1 * 5/2009 Nishiwaki ..... A43B 13/10 36/88
2009/0113765 A1 * 5/2009 Robinson, Jr. ..... A43B 3/0078 36/127
2009/0249648 A1 * 10/2009 Brown ..... A43B 5/001 36/91
2009/0249652 A1 10/2009 Gunthel et al.
2009/0249653 A1 10/2009 Gunthel et al.
2009/0260259 A1 10/2009 Berend
2010/0037483 A1 2/2010 Meschter et al.
2010/0043253 A1 2/2010 Dojan et al.
2010/0083539 A1 * 4/2010 Norton ..... A43B 5/001 36/127
2010/0175276 A1 7/2010 Dojan et al.
2010/0186260 A1 7/2010 Colthurst
2010/0199406 A1 8/2010 Dua et al.
2010/0199523 A1 * 8/2010 Mayden ..... A43B 7/144 36/103
2010/0269376 A1 * 10/2010 Flannery ..... A43B 13/125 36/30 R
2010/0287792 A1 * 11/2010 Hide ..... A43B 5/10 36/114
2010/0293816 A1 * 11/2010 Truelsen ..... A43B 5/06 36/30 R
2010/0299965 A1 * 12/2010 Avar ..... A43B 5/06 36/102
2010/0325917 A1 * 12/2010 Cass ..... A43B 13/181 36/88
2011/0056093 A1 3/2011 Ellis, III et al.

(56) References Cited

U.S. PATENT DOCUMENTS

| | | | | |
|---|---|---|---|---|
| 2011/0113648 | A1 | 5/2011 | Leick et al. | |
| 2011/0113650 | A1 | 5/2011 | Hurd et al. | |
| 2011/0113652 | A1 | 5/2011 | Schwarz | |
| 2011/0203140 | A1 | 8/2011 | Robinson, Jr. | |
| 2011/0203142 | A1 | 8/2011 | Scholz | |
| 2011/0214313 | A1 | 9/2011 | James et al. | |
| 2012/0005924 | A1 | 1/2012 | Shiue et al. | |
| 2012/0011744 | A1 | 1/2012 | Bell et al. | |
| 2012/0198720 | A1 | 8/2012 | Farris et al. | |
| 2012/0222332 | A1* | 9/2012 | Greene | A43D 35/00 36/103 |
| 2012/0233886 | A1* | 9/2012 | Madore | A43B 13/141 36/103 |
| 2013/0152428 | A1 | 6/2013 | Bishop et al. | |

FOREIGN PATENT DOCUMENTS

| | | | |
|---|---|---|---|
| CN | 101557733 | A | 10/2009 |
| CN | 102076237 | A | 5/2011 |
| DE | 4417563 | | 11/1995 |
| EP | 2499926 | | 9/2012 |
| FR | 2765082 | | 12/1998 |
| FR | 2775563 | A1 | 9/1999 |
| JP | 2295503 | | 12/1990 |
| JP | H07-28404 | U | 5/1995 |
| JP | H10295404 | A | 11/1998 |
| JP | 2003220162 | A | 8/2003 |
| JP | 2009527326 | A | 7/2009 |
| JP | 2009527327 | A | 7/2009 |
| JP | 2011092310 | A | 5/2011 |
| JP | 2012196429 | A | 10/2012 |
| WO | 8707480 | | 12/1987 |
| WO | 2013019934 | | 2/2013 |

OTHER PUBLICATIONS

International Search Report in International Patent Application No. PCT/US2013/053194 dated Oct. 29, 2013.

* cited by examiner

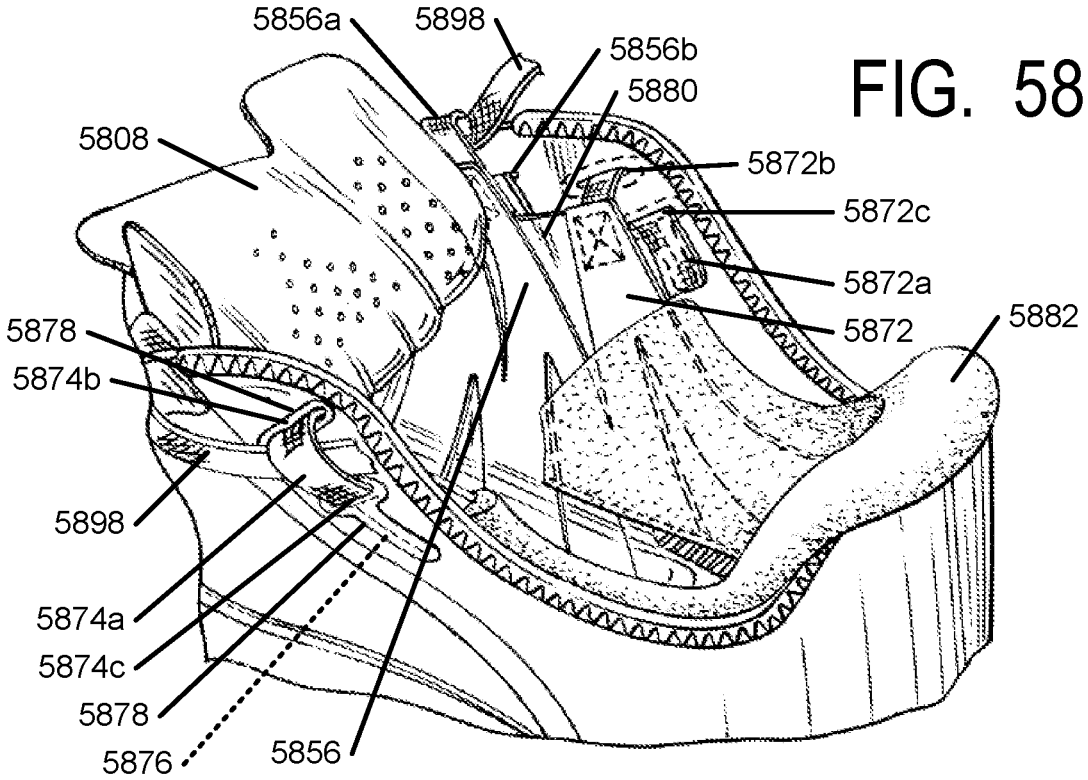
FIG. 58I
FIG. 58J
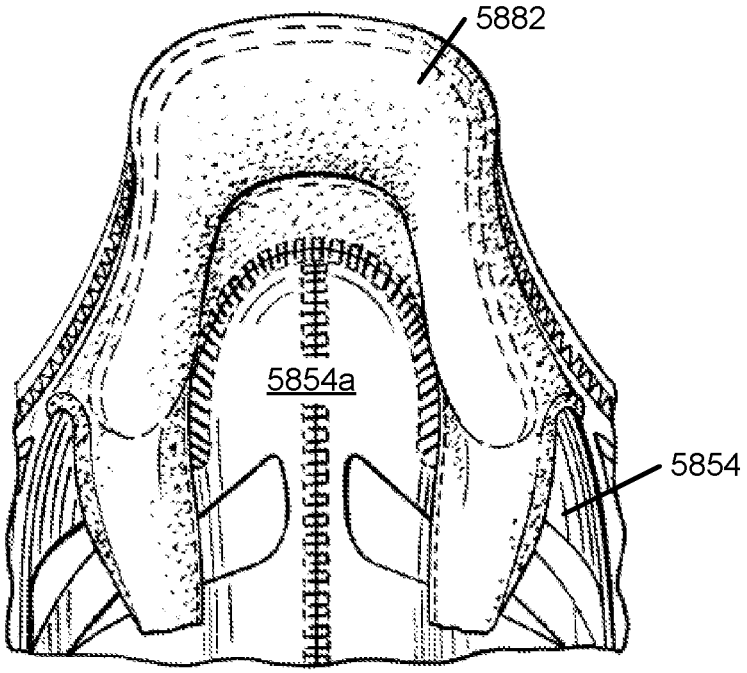

GOLF SHOE WITH NATURAL MOTION STRUCTURES

RELATED APPLICATION DATA

This application is a continuation of U.S. patent application Ser. No. 13/564,605 filed Aug. 1, 2012 and entitled "Golf Shoe with Natural Motion Structures," and further this application claims priority benefits based on U.S. Provisional Patent Appln. No. 61/514,468 filed Aug. 2, 2011. Each of U.S. patent application Ser. No. 13/564,605 and U.S. Provisional Patent Appln. No. 61/514,468 is entirely incorporated herein by reference.

BACKGROUND OF THE INVENTION

1. Field of the Invention

The present invention relates generally to an article of footwear, and, in particular, to a golf shoe having structures to support and enhance the natural motion and feel of the shoe, e.g., more akin to the feel when barefoot.

2. Background

Conventional articles of footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces, the sole structure may provide traction, control foot motions (e.g., by resisting pronation), and impart stability, for example. Accordingly, the upper and the sole structure operate cooperatively to provide a comfortable structure that is suited for a wide variety of activities.

Articles of athletic footwear are designed with a particular purpose in mind. Some articles of athletic footwear are designed to withstand jarring impact. Others are designed to withstand lateral impact. Some are designed to enhance stability. Others are designed to provide enhanced cushioning. The purpose for which a shoe will be used informs the design choices made by the designers.

Typical golf shoes are relatively stiff to provide a stable support base for the golf swing motion. These stiffness features can make the shoes uncomfortable to wear, particularly over the course of several hours during a round of golf, and can adversely impact the wearer's "feel" and contact with the ground.

SUMMARY OF THE INVENTION

This Summary is provided to introduce some concepts relating to this invention in a simplified form that are further described below in the Detailed Description. This Summary is not intended to identify key features or essential features of the invention.

The present invention pertains to a golf shoe including an upper and a sole structure engaged with the upper. The golf shoe may include one or more of the following: (a) a foot stabilizer system that interacts with a shoe securing system to securely engage and/or wrap around a foot of a wearer, optionally including engaging or wrapping around a heel or rear heel of the wearer; (b) a natural motion sole as part of the sole structure, optionally including one or more longitudinal flex grooves and one or more lateral flex grooves, wherein the flex grooves allow an easy and more natural transfer of weight from back-to-front and from side-to-side as a wearer moves in the shoe; (c) a six cleat configuration, optionally with four cleats in a forefoot region of the shoe, two cleats in a heel region, and no cleats located directly under a big toe area of the sole structure; (d) a forefoot moderator plate made from a rigid but flexible material, wherein the forefoot moderator plate is positioned so as to moderate or reduce user feel of one or more forefoot cleats; (e) a lateral half heel counter extending from a rear heel area to a lateral midfoot or lateral forward heel area of the shoe; and/or (f) one or more medial, forefoot, sidewall traction elements at or near a big toe area of a sidewall of the sole structure.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

FIGS. 58A through 58M show various views of an example golf shoe and portions thereof in accordance with some aspects of this invention.

DETAILED DESCRIPTION OF THE INVENTION

Figure 1:
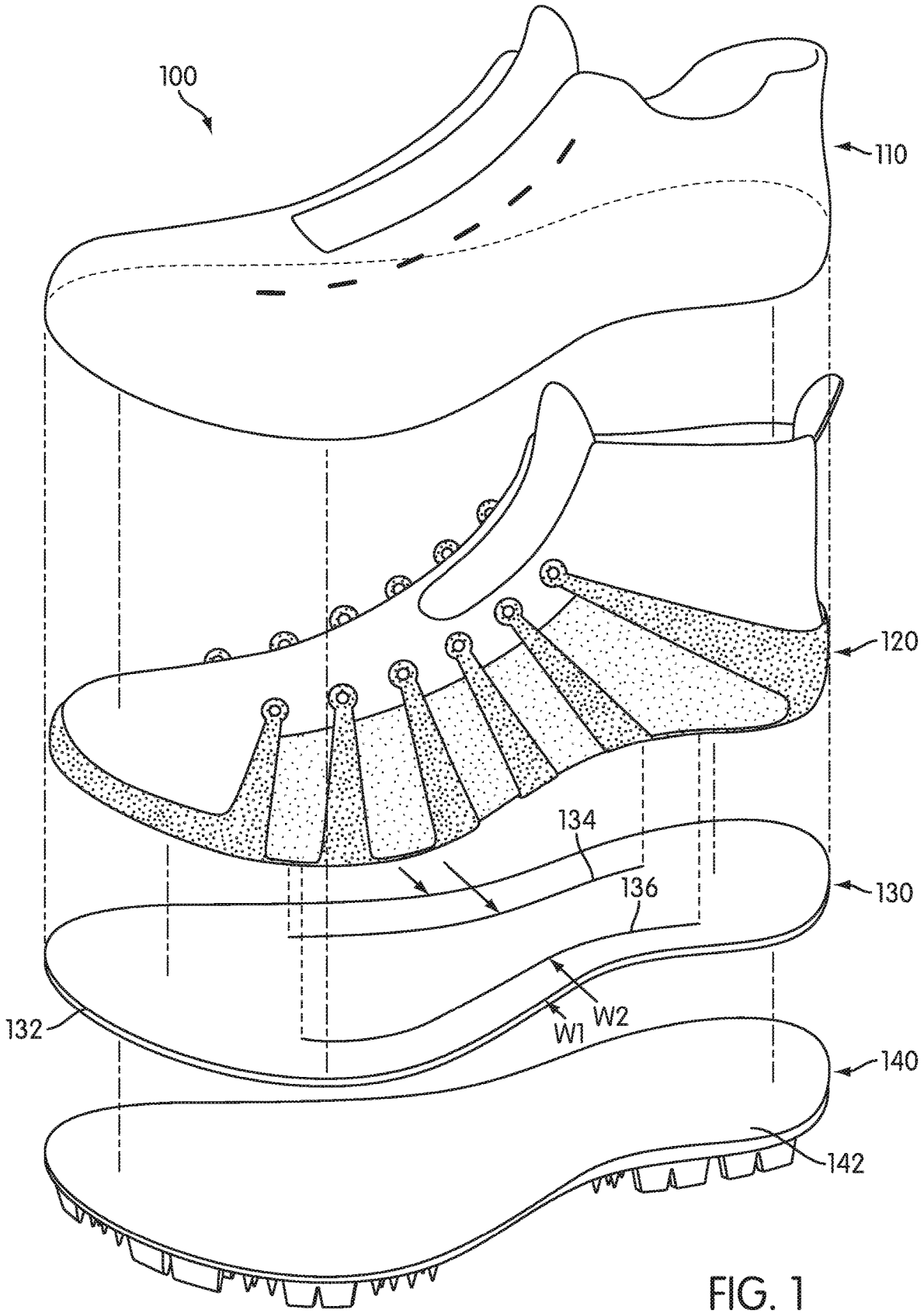
FIG. 1 is an exploded view of an exemplary embodiment of an article of footwear including a decoupled foot stabilizer system.

In the following description of various examples of footwear and foot-receiving device structures and components according to the present invention, reference is made to the accompanying drawings, which form a part hereof, and in which are shown by way of illustration various example structures and environments in which aspects of the invention may be practiced. It is to be understood that other structures and environments may be utilized and that structural and functional modifications may be made from the specifically described structures without departing from the scope of the present invention.

The Figures disclose various exemplary embodiments of an article of footwear, also referred to simply as an "article," with a decoupled foot stabilizer system. A foot stabilizer system may be incorporated into any style of footwear including, for example, athletic footwear. A foot stabilizer system may be configured to provide lateral support to the foot of a user in sports requiring dynamic movement. For clarity, the following detailed description discusses articles of athletic footwear in the form of shoes associated with various sports, including, but not limited to: baseball, basketball, football, running, soccer, tennis, golf, and other sports and activities where movement may be aided by an article of footwear provided with a foot stabilizer system. However, it should be noted that in other embodiments any other type of footwear could be used including, but not limited to: hiking boots, sneakers, as well as other kinds of shoes. Articles of footwear used with a foot stabilizer system may also take the form of any nonathletic shoe, including, but not limited to: dress shoes, loafers, sandals, and boots. An individual skilled in the relevant art will appreciate, therefore, that the concepts disclosed herein apply to a wide variety of footwear styles, in addition to the specific style discussed in the following material and depicted in the accompanying figures.

I. GENERAL DESCRIPTION OF VARIOUS ASPECTS OF THIS INVENTION

Aspects of this invention relate to articles of footwear, including individual components thereof (e.g., an upper, a foot stabilizer system, a midsole, an outsole, combinations of these components, etc.). While aspects relating to the various components of this invention may be used in any desired type of shoe construction, some more specific aspects of this invention may find particular usefulness for shoes used during play of golf.

One more specific aspect of this invention relates to an upper for an article of footwear or an overall article of footwear that includes: an upper at least partially defining a foot-receiving chamber and a foot stabilizer system located at least partially within the foot-receiving chamber, wherein the foot stabilizer system wraps around at least a midfoot area and a heel area of a wearer's foot. The foot stabilizer system of this example may include: (a) a first strap portion including a first free end defining a first securing system engagement component, wherein the first free end extends from within the foot-receiving chamber, around a first side of an instep opening portion of the upper, and into a first opening defined in the upper, wherein the first free end is engaged with the upper and defines a first loop for engaging a footwear securing element (e.g., for engaging a shoe lace), and (b) a second strap portion including a second free end defining a second securing system engagement component, wherein the second free end extends from within the foot-receiving chamber, around a second side of the instep opening portion of the upper, and into a second opening defined in the upper, wherein the second free end is engaged with the upper and defines a second loop for engaging a footwear securing element (e.g., for engaging a shoe lace).

Foot stabilizer systems in uppers and articles of footwear of these types may include additional pairs of strap portions along each side of the instep opening for engaging a footwear securing element (e.g., a shoe lace). One strap portion of each pair may include a free end defining another securing system engagement component that extends from within the foot-receiving chamber, around the first side of the instep opening portion of the upper, and into another opening defined in the upper in the same manner as the first strap portion, to thereby define another loop for engaging a footwear securing element. The other strap portion of the pair may extend around the second side of the instep opening portion in a similar manner to the second strap portion to thereby define another loop for engaging a footwear securing element on the second side of the instep opening portion. Any number of pairs of strap portions may be provided without departing from this invention. Using these structures, tightening the shoe laces causes the foot stabilizer system to engage and wrap around the foot.

As another alternative, if desired, at least some of the strap portions (e.g., the bottommost strap portion pair, located closest to the toe) may include free ends with an opening defined through it for engaging a footwear securing element (e.g., a shoe lace). The foot stabilizer system also may include any of the various different types of shoe lace engaging loops as described in more detail below.

As another example, an upper and/or an article of footwear according to some examples of this invention may include: an upper at least partially defining a foot-receiving chamber and a foot stabilizer system located at least partially within the foot-receiving chamber, wherein the foot stabilizer system wraps around at least a midfoot and heel area of a wearer's foot. In this example structure, the foot stabilizer system includes: a first strap portion including a first free end defining a first securing system engagement component, wherein the first free end extends from within the foot-receiving chamber, through a first opening defined in the upper, along an exterior surface of the upper, and through a second opening defined in the upper, wherein the first free end is engaged with the upper, and wherein an exposed portion of the first strap portion that extends along the exterior surface of the upper defines a first loop for engaging a footwear securing element, and (b) a second strap portion including a second free end defining a second securing system engagement component, wherein the second free end extends from within the foot-receiving chamber, through a third opening defined in the upper, along the exterior surface of the upper, and through a fourth opening defined in the upper, wherein the second free end is engaged with the upper, and wherein an exposed portion of the second strap portion that extends along the exterior surface of the upper defines a second loop for engaging a footwear securing element.

While strap portions of the type provided in this example upper may be provided at any location on a footwear structure, in at least some examples of this invention, the two strap portions described immediately above will be provided as the topmost or rearmost lace engaging components on opposite sides of the shoe (e.g., the lace engaging components closest to the rear heel). Strap portions of this type also may be used in conjunction with any of the different strap portions described above within a single shoe structure, if desired.

Uppers of the types described above may be engaged with a sole structure, including, for example, a cleated sole structure (optionally with one or more permanent or removable cleats), e.g., for a golf shoe, including any of the various specific golf shoe sole structures described in more detail below. Such uppers also may include, for example, a heel pad component engaged with the upper and around an interior heel portion of the foot stabilizer, wherein the heel pad covers a portion of the foot stabilizer system and provides an exposed surface in the heel area of the foot-receiving chamber for directly contacting a wearer's heel. The heel pad may provide a comfortable and non-irritable surface for contacting the wearer's foot at the heel.

Additional aspects of this invention relate to golf shoes that include: (a) an upper having a foot stabilizer system that wraps around at least a midfoot and heel area, wherein the foot stabilizer system includes a first plurality of strap portions defining first securing system engagement components along a first side of an instep portion of the upper and a second plurality of strap portions defining second securing system engagement components along a second side of the instep portion of the upper; and (b) a sole structure engaged with the upper, wherein the sole structure includes:

(1) a midsole member including: (a) a first longitudinal flexion groove extending from a forefoot region to a heel region of the sole structure and (b) a first transverse flexion groove extending from a medial side to a lateral side of the sole structure,
(2) a first outsole component located on a first side of the first longitudinal flexion groove, and
(3) a second outsole component separate from the first outsole component located on a second side of the first longitudinal flexion groove.

In some examples, at least some portions of these flexion grooves (and the other flexion grooves described herein) may extend through at least 15% of an overall thickness of the midsole material over some portion of the flexion groove's overall longitudinal length, and in some examples, the flexion grooves may extend through at least 25%, at least 30%, or even at least 40% of the overall thickness of the midsole material over some portion of its length. Cleat elements may be engaged with the outsole components, optionally in a releasable and/or replaceable manner.

Additional flexion grooves may be provided in the sole structure, if desired, without departing from this aspect of the invention. For example, in some golf shoe structures, the first transverse flexion groove is located in a midfoot area of the sole structure, and the first and second outsole components are located on a forefoot side of this first transverse flexion groove. Such sole structures may further include one or more of: (a) a second longitudinal flexion groove extending at least in a forefoot region of the sole structure; (b) a second transverse flexion groove extending from the medial side to the lateral side of the sole structure; (c) a third outsole component located on a forefoot side of the second transverse flexion groove; (d) a fourth outsole component located on the forefoot side of the second transverse flexion groove; (e) a fifth outsole component located at a heel area of the sole structure and on the first side of the first longitudinal flexion groove; and (f) a sixth outsole component located at the heel area of the sole structure and on the second side of the first longitudinal flexion groove, wherein the first outsole component is located between the first and second transverse flexion grooves, wherein the second outsole component is located between the first and second transverse flexion grooves, wherein the first and third outsole components are located on the first side of the first longitudinal flexion groove, and wherein the second and fourth outsole components are located on a medial side of the second longitudinal flexion groove. At least some of these various additional outsole components may have one or more cleat elements integrally formed or attached thereto (optionally attached in a removable manner). Some golf shoe structures in accordance with some examples of this invention will include a total of six removable cleat elements, with two in the heel area (generally side-by-side) and four in the forefoot area (two on each side of the first longitudinal flexion groove).

If desired, in accordance with at least some examples of this invention, the golf shoe may include a forefoot moderator plate located between the foot stabilizer system and an upper surface of the midsole member, wherein the forefoot moderator plate covers some or all of the forefoot cleat elements to modulate a feel of these cleat elements to a wearer's foot.

Additionally or alternatively, some example golf shoe structures in accordance with this invention will include a heel counter located in a heel area of the upper for supporting a wearer's heel. If desired, the heel counter may have a greater height on a lateral heel side of the heel area than on a medial heel side of the heel area. As yet additional examples, if desired, the shoe may include only a lateral heel counter located in a lateral heel side area of the upper for supporting a lateral side of a wearer's heel, wherein this lateral heel counter does not extend to a medial heel side area of the upper (although it may extend underneath the heel). These more specialized heel counters help provide a stable base for supporting the outside (lateral side) of the foot while allowing more freedom of movement toward the inside (medial) direction of the foot as the user's weight shifts during the course of a golf swing.

The outsole components may be engaged directly with the midsole member, if desired, e.g., using adhesives or cements, using fusing techniques, using mechanical connectors, or the like. Optionally, the midsole member may be molded to include relatively shallow recesses or receptacles therein for receiving the separate outsole components. Flexion grooves may be provided in an exposed surface of the midsole component between adjacent outsole components.

Another example golf shoe structure in accordance with at least some examples of this invention includes: (a) an upper defining at least a portion of an interior chamber for receiving a foot (which optionally may include a foot stabilizer system of the types described above); and (b) a sole structure engaged with the upper, wherein the sole structure includes:

(1) a first longitudinal flexion groove,
(2) a first transverse flexion groove,
(3) a second transverse flexion groove located on a forefoot side of the first transverse flexion groove,
(4) a first medial side outsole component located on a medial side of the first longitudinal flexion groove between the first transverse flexion groove and the second transverse flexion groove, and
(5) a first lateral side outsole component located on a lateral side of the first longitudinal flexion groove between the first transverse flexion groove and the second transverse flexion groove.

In this structure, the first lateral side outsole component is made from a harder material than a material of the first medial side outsole component. The outsole components may be mounted on a midsole component, optionally a polymeric foam midsole component (e.g., made of PHY- LON (an ethylvinylacetate foam material), ethylvinylacetate foam, PHYLITE® foam (an EVA foam/rubber combination (trademark owned by NIKE, Inc. of Beaverton, Oreg.)), polyurethane foam, or other foam materials). The various flexion grooves may be formed, at least in part, in the midsole component.

Optionally, if desired, the sole structure of this example golf shoe may further include: (a) a second medial side outsole component located on the medial side of the first longitudinal flexion groove and on a forefoot side of the second transverse flexion groove, and (b) a second lateral side outsole component located on the lateral side of the first longitudinal flexion groove and on the forefoot side of the second transverse flexion groove. If desired, the second lateral side outsole component may be made from a harder material than a material of the second medial side outsole component. As some more specific examples, the lateral side outsole components may be made of a thermoplastic polyurethane material and the medial side outsole components may be made of a thermoplastic rubber material. In this manner, the lateral side outsole component(s) may be relatively stiff and rigid while the medial side outsole component(s) may be more flexible and pliable.

The sole structure also may have cleat elements, additional outsole components, and/or additional flexion grooves, e.g., as generally described above (and as described in more detail below).

By making one or more of the lateral side outsole component(s) from a harder material than the medial side outsole component(s), the user is well supported on the lateral side during back swing and initiation of the downswing phases of the golf swing and has more freedom of movement toward the medial side, e.g., during the downswing and ball contacting phases of the golf swing.

Still additional golf shoe structures in accordance with at least some examples of this invention will include: (a) an upper defining at least a portion of an interior chamber for receiving a foot (optionally including a foot stabilizer system of the various types described above and described in more detail below); and (b) a sole structure engaged with the upper, wherein the sole structure includes:

(1) a midsole component formed, at least in part, from a polymeric foam material,
(2) a first longitudinal flexion groove defined, at least in part, in the midsole component,
(3) a first transverse flexion groove defined, at least in part, in the midsole component,
(4) a second transverse flexion groove located on a forefoot side of the first transverse flexion groove and defined, at least in part, in the midsole component,
(5) an outsole engaged with the midsole component, wherein the outsole includes at least: (i) a first portion located on a lateral side of the first longitudinal flexion groove between the first transverse flexion groove and the second transverse flexion groove, and (ii) a second portion located on a medial side of the first longitudinal flexion groove between the first transverse flexion groove and the second transverse flexion groove, wherein the second portion of the outsole includes a side wall portion that extends continuously from a bottom surface to a medial side surface of the midsole component. One or more raised rib type traction elements may be provided, e.g., around at least a portion of the perimeter of one or more of these outsole portions (or the other outsole portions described below).

A first cleat element is provided with the first portion of the outsole, and a second cleat element extends from the side wall portion of the second portion of the outsole in an outward or sideways direction. If desired, the first cleat element may be removably attached to the first portion of the outsole and the second cleat element may be integrally formed with the side wall portion of the second portion of the outsole as a unitary, one-piece construction. Also, if desired, the second portion of the outsole may be provided as a completely separate component from the first portion of the outsole.

This example shoe structure (as well as the other shoe structures described above) may include additional cleat elements, including cleat elements that are removably engaged with the various outsole components and/or cleat elements that are integrally formed with the outsole components. The cleats may take on any desired shape or construction, including pyramids, truncated pyramids, conical, spikes, raised or elongated ribs, etc.

The outsole of this example structure further may include a forefoot portion extending forward from the first portion and located forward of the second transverse flexion groove, and a midfoot portion extending rearward from the first portion and located rearward of the first transverse flexion groove, wherein the first portion, the forefoot portion, and the midfoot portion are formed as a unitary, one-piece construction.

As another example, if desired, the outsole may include: (a) a lateral forefoot portion extending forward from the first portion and located forward of the second transverse flexion groove and on the lateral side of the first longitudinal flexion groove, (b) a medial forefoot portion extending from the lateral forefoot portion and located on the medial side of the first longitudinal flexion groove and forward of the second transverse flexion groove, (c) a midfoot portion extending rearward from the first portion and located rearward of the first transverse flexion groove, wherein the midfoot portion extends from a lateral side to a medial side of the sole structure, and (d) a heel portion extending rearward from the midfoot portion, wherein the first portion, the lateral forefoot portion, the medial forefoot portion, the midfoot portion, and the heel portion are formed as a unitary, one-piece construction, and wherein the second portion of the outsole is provided as a completely separate component from the first portion, the lateral forefoot portion, the medial forefoot portion, the midfoot portion, and the heel portion of the outsole. As another potential feature, if desired, the heel portion of the outsole may include a longitudinal elongated central opening therein that divides the heel portion into a lateral heel portion and a medial heel portion.

Given this general description of various aspects and example features of this invention, a more detailed description of more specific example structures according to this invention follows.

II. DETAILED DESCRIPTION OF VARIOUS EXAMPLE FOOTWEAR COMPONENTS AND FOOTWEAR STRUCTURES ACCORDING TO THIS INVENTION

Additionally, while a single article of footwear is shown in the current embodiments, the same principles taught in this detailed description could be applied to a second, complementary article of footwear.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot region to a heel region of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article, including an upper and/or a sole structure.

Figure 3:
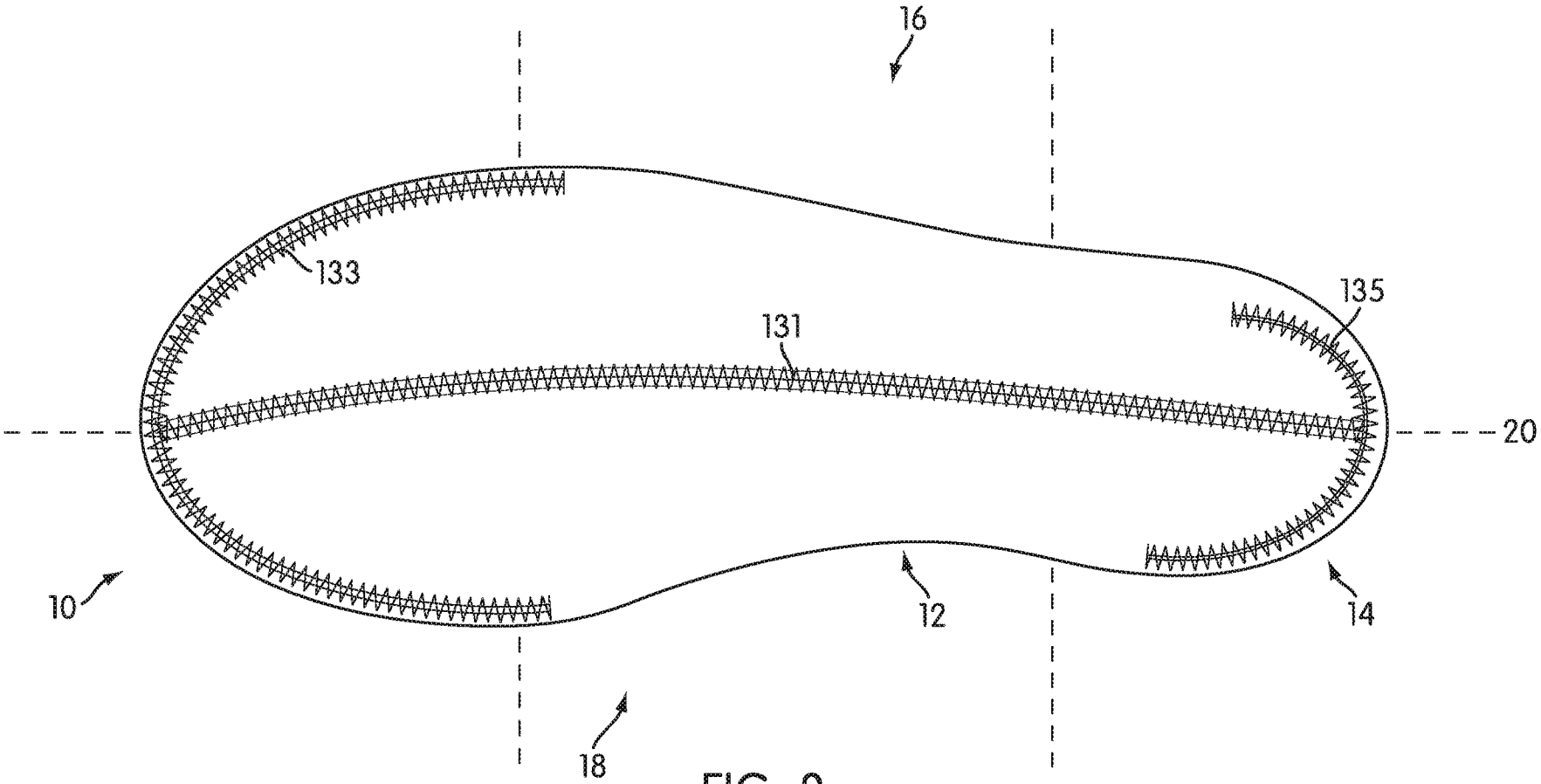
FIG. 3 is a bottom view of an exemplary embodiment of a decoupled foot stabilizer system attached to a base portion.

For purposes of general reference, and as generally depicted in FIG. 3, an article of footwear may be divided into three regions: forefoot region 10, midfoot region 12, and heel region 14. Forefoot region 10 may be generally associated with the toes and joints connecting the metatarsals with the phalanges. Midfoot region 12 may be generally associated with the arch of a foot. Likewise, heel region 14 may be generally associated with the heel of a foot, including the calcaneus bone. In addition, an article of footwear may include lateral side 16 and medial side 18. In particular, lateral side 16 and medial side 18 may be opposing sides of the article. Lateral side 16 and medial side 18 may be located on either side of a longitudinal axis 20 bisecting the article. Furthermore, both lateral side 16 and medial side 18 may extend through forefoot region 10, midfoot region 12, and heel region 14.

It will be understood that forefoot region 10, midfoot region 12, and heel region 14 are only intended for purposes of description and are not intended to demarcate precise regions of an article of footwear. For example, in some cases, one or more of the regions may overlap. Likewise, lateral side 16 and medial side 18 are intended to represent generally two sides, rather than precisely demarcating an article of footwear into two halves. In addition, forefoot region 10, midfoot region 12, and heel region 14, as well as lateral side 16 and medial side 18, may also be applied to individual components of an article of footwear, including a foot stabilizer system, a sole structure, an upper, and/or any other component associated with the article.

FIGS. 1 through 10 illustrate an exemplary embodiment of an article of footwear 100 with a decoupled foot stabilizer system 120. Referring to FIG. 1, article of footwear 100 is shown in an exploded view. In some embodiments, article 100 may include a number of individual components. In addition to the decoupled foot stabilizer system 120, article 100 of this example additionally includes an upper 110 and a sole structure 140. Generally, upper 110 provides a covering for the foot that comfortably receives and securely positions the foot with respect to sole structure 140. Upper 110 may be made from any suitable material, including but not limited to, for example, nylon, natural leather, synthetic leather, natural rubber, or synthetic rubber. In some cases, upper 110 may be made of any suitable knitted, woven or non-woven material.

Sole structure 140 may be generally positioned between a foot of a wearer and the ground. In some embodiments, sole structure 140 may include one or more of an outsole, a midsole, a single piece sole, and/or any number of additional components associated with a conventional sole. In other embodiments, sole structure 140 may include one or more tread elements for engaging with the ground. While FIGS. 1 through 10 illustrate sole structure 140 having one or more tread elements, including a cleat, it should be understood that article 100 may include sole structure 140 as described herein without limitation to any specific type of tread element.

In some embodiments, sole structure 140 may further include a portion associated with a recess or a housing. In an exemplary embodiment, a recess or housing in a portion of sole structure 140 may be provided for receiving an electronic module, e.g., for sensing physical and/or physiological characteristics associated with use of the footwear or other devices.

In some embodiments, article 100 may include a base portion 130. Base portion 130 may be generally positioned between the foot of a wearer and sole structure 140. In some embodiments, base portion 130 may be secured to a lower portion of upper 110 and an upper portion of sole structure 140. In this embodiment, base portion 130 may be secured to a lower portion of upper 110 along an outer periphery 132. Additionally, in this embodiment, base portion 130 may be secured to a top surface 142 of sole structure 140. In different embodiments, base portion 130 may include one or more of a midsole, strobel, and/or a portion of upper 110 that is configured to be attached to sole structure 140.

In some embodiments, base portion 130 may be disposed between foot stabilizer system 120 and sole structure 140. In one embodiment, foot stabilizer system 120 may be secured to base portion 130. In an exemplary embodiment, foot stabilizer system 120 may be secured to base portion 130 in a manner such that foot stabilizer system 120 is selectively decoupled from one or more portions of article 100. As shown in FIG. 1, foot stabilizer system 120 may be selectively decoupled from a midfoot region of article 100 by securing foot stabilizer system 120 to base portion 130 along an attachment area having a narrower width than the width of base portion 130.

In this embodiment, base portion 130 may be associated with a first width W1 at a midfoot region. First width W1 generally corresponds to the width of article 100 at the midfoot region. In this embodiment, foot stabilizer system 120 may be attached to base portion 130 along an attachment area at the midfoot region defined by first attachment portion 134 and a second attachment portion 136. In other embodiments, foot stabilizer system 120 may be secured to base portion 130 at additional attachment portions located in other regions of article 100. In one embodiment, foot stabilizer system 120 optionally may be attached to a forefoot region and/or a heel region of base portion 130.

In one embodiment, first attachment portion 134 and second attachment portion 136 may be associated with a second width W2 at the midfoot region. In an exemplary embodiment, second width W2 is smaller than first width W1. In other embodiments, second width W2 may be substantially smaller than first width W1. By securing foot stabilizer system 120 along an attachment area that is narrower than base portion 130, a foot disposed inside article 100 may move foot stabilizer system 120 relative to the other components of article 100. With this arrangement, foot stabilizer system 120 may be selectively decoupled from one or portions of article 100.

In some embodiments, first attachment portion 134 and second attachment portion 136 may be disposed approximately similar distances from outer periphery 132 of base portion 130 on a medial side and a lateral side. In other embodiments, first attachment portion 134 and/or second attachment portion 136 may be associated with second width W2 disposed at dissimilar distances from outer periphery 132. In some cases, first attachment portion 134 may be located closer to outer periphery 132 on medial side. In other cases, second attachment portion 136 may be located closer to outer periphery 132 on lateral side. With this arrangement, foot stabilizer system 120 may be selectively decoupled in greater degree on a medial side or a lateral side of article 100.

In different embodiments, any one or more of the width of the attachment area and the number and location of attachment portions may be varied to provide different amounts of decoupling to foot stabilizer system 120 relative to base portion 130 and article 100.

Figure 2:
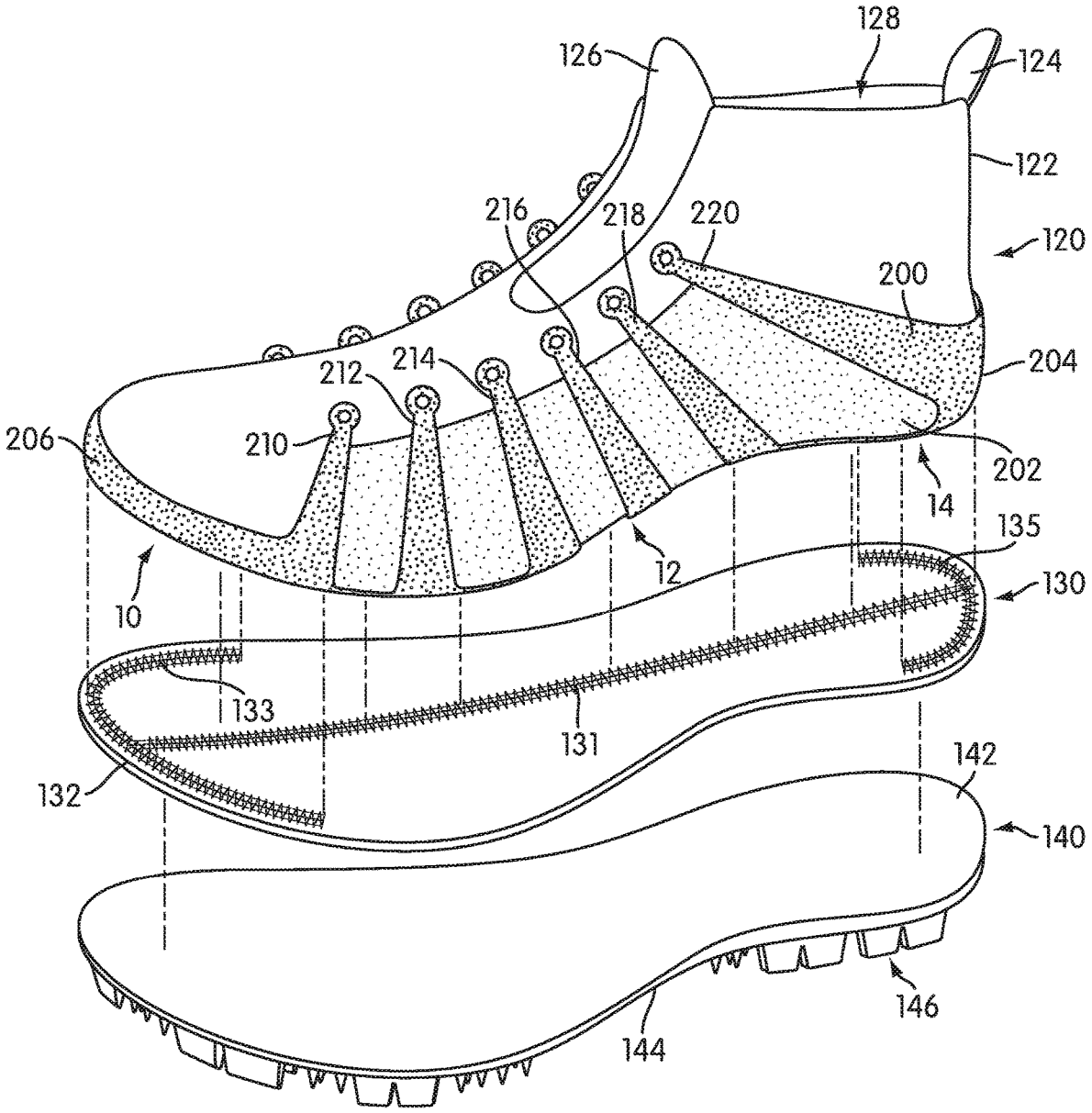
FIG. 2 is an exploded view of an exemplary embodiment of a decoupled foot stabilizer system attached to a base portion.

Referring now to FIG. 2, article 100 is illustrated without upper 110. In some embodiments, foot stabilizer system 120 may include a number of components for providing support and/or stability to a foot of a wearer. In an exemplary embodiment, foot stabilizer system 120 may include a bootie 122. In some embodiments, bootie 122 may include a sleeve for surrounding a foot of a wearer of article of footwear 100. In an exemplary embodiment, bootie 122 may include a throat hole or opening 128 for receiving a foot of a wearer into the interior of foot stabilizer system 120. In some embodiments bootie 122 also may include a heel tab 124 and/or tongue tab 126. Heel tab 124 and/or tongue tab 126 may be used by a wearer to assist with placing a foot into throat opening 128 of bootie 122. In an exemplary embodiment, bootie 122 may be made from an elastic material. In different embodiments, bootie 122 may be made from any one or a combination of elastic or stretchable materials, including, but not limited to: woven synthetic fibers, polyurethane, nylon, cotton, spandex, neoprene, and other natural and synthetic materials.

In some embodiments, foot stabilizer system 120 may include a plurality of strap members 200. In an exemplary embodiment, the plurality of strap members 200 may be configured to provide stability and/or support to foot stabilizer system 120. In an exemplary embodiment, the plurality of strap members 200 may be configured to support a foot of a wearer. In one embodiment, foot stabilizer system 120 may include the plurality of strap members 200 on opposite sides. In an exemplary embodiment, the plurality of strap members 200 may be positioned on a lateral side and a medial side of foot stabilizer system 120. In the embodiment shown in FIG. 2, foot stabilizer system 120 may include the plurality of strap members 200 disposed over an outside surface of bootie 122.

Referring again to FIG. 2, in this embodiment, the plurality of strap members 200 may include a first strap member 210, a second strap member 212, a third strap member 214, a fourth strap member 216, a fifth strap member 218, and a sixth strap member 220 disposed on a lateral side of foot stabilizer system 120. Similarly, the plurality of strap members 200 may include a corresponding number of strap members disposed on the medial side of foot stabilizer system 12. In some cases, the plurality of strap members 200 may be made of a substantially flexible material. In other cases, the plurality of strap members 200 may be made of a substantially rigid material. In still other cases, the plurality of strap members 200 may be made of a material that is inelastic in one direction and elastic in another direction. In different embodiments, the plurality of strap members 200 may be made of any suitable material that provides sufficient support while still allowing some flexibility, including, but not limited to: polymers, rubbers, plastics, elastomeric materials, and other materials.

In some embodiments, one or more portions of foot stabilizer system 120 including one or more strap members 200, may be made of thread structural elements. In some cases, one or more portions of a foot stabilizer system 120, including one or more strap members 200, may be made of the thread structural elements disclosed in copending and commonly owned: (a) U.S. Pat. No. 7,870,681 entitled "Article of Footwear Having An Upper With Thread Structural Elements," and filed on May 25, 2006; (b) U.S. Published Patent Appln. No. 2010/0175276, published Jul. 5, 2010 and entitled "Material Elements Incorporating Tensile Strands," and filed on Jul. 20, 2009; (c) U.S. Published Patent Appln. No. 2010/0037483 entitled "Article Of Footwear Incorporating A Tensile Element," and filed on Aug. 24, 2009; and (d) U.S. Published Patent Appln. No. 2010/0043253, published Feb. 25, 2010 and entitled "Article Of Footwear Having An Upper Incorporating A Tensile Strand With A Cover Layer", and filed on Aug. 24, 2009, all of which are incorporated herein by reference in their entirety.

In some embodiments, foot stabilizer system 120 may include a plurality of strap members 200 associated with one or more of forefoot region 10, midfoot region 12, and heel region 14. In an exemplary embodiment, first strap member 210 and/or second strap member 212 may be associated with forefoot region 10, third strap member 214, fourth strap member 216, and/or fifth strap member 218 may be associated with midfoot region 12, and sixth strap member 220 may be associated with heel region 14. In different embodiments, various numbers of strap members may be associated with each of forefoot region 10, midfoot region 12, and heel region 14. In other embodiments, foot stabilizer system 120 may include more or less strap members. In some cases, the plurality of strap members may be disposed in pairs on opposite sides of foot stabilizer system 120. In other cases, the plurality of strap members may be disposed asymmetrically. In other cases, one or more strap members may be disposed along one side of foot stabilizer system 120.

In some embodiments, the plurality of strap members may be connected to each other using a webbing material. As shown in FIG. 2, a webbing 202 may connect the plurality of strap members 200 along the lateral side of foot stabilizer system 120. In this embodiment, webbing 202 is disposed between first strap member 210, second strap member 212, third strap member 214, fourth strap member 216, fifth strap member 218, and sixth strap member 220. Similarly, foot stabilizer system 120 may include a webbing material for connecting the plurality of strap members along the medial side. In some cases, webbing 202 may be disposed between fewer strap members. In other cases, webbing material may be disposed between two or more strap members on a single side of foot stabilizer system 120. In different embodiments, webbing material may be disposed between two or more strap members associated with one or more of forefoot region 10, midfoot region 12, and heel region 14.

In different embodiments, webbing 202 may be made of any one or a combination of elastic or stretchable materials, including, but not limited to: woven synthetic fibers, polyurethane, nylon, cotton, spandex, neoprene, and other natural and synthetic materials. In some embodiments, webbing 202 may be formed together with one or more portions of foot stabilizer system, including one or more strap members. In some embodiments, webbing 202 may include thread structural elements, as disclosed above. In some cases, one or more portions of an article, including webbing 202, may be made of the textile material disclosed in copending and commonly owned U.S. Published Patent Appln. No. 2010/0199406, published Aug. 12, 2010 and entitled "Thermoplastic Non-Woven Textile Elements", and filed on Feb. 6, 2009, which application is incorporated herein by reference in its entirety.

In some embodiments, foot stabilizer system 120 may include components configured to protect and/or provide stability and support to various portions of a foot of a wearer. In some embodiments, foot stabilizer system 120 may include one or more components associated with the toes of a foot of a wearer. In an exemplary embodiment, the plurality of strap members 200 may include a raised toe portion 206. Raised toe portion 206 may be disposed in an area of forefoot region 10 that generally corresponds to the toes of a wearer. Raised toe portion 206 may be shaped to engage and stabilize the front of the wearer's foot including the toes. In some embodiments, raised toe portion 206 may be sized and dimensioned so as to extend a height and a width sufficient to support the toes of a wearer. Raised toe portion 206 may be formed integrally with one or more strap members located on a lateral side and/or a medial side. In some embodiments, raised toe portion 206 may extend along forefoot region 10 between first strap member 210 and a corresponding strap member on the opposing side. In other embodiments, raised toe portion 206 may extend between more or less of the plurality of strap members 200. In some cases, raised toe portion 206 may extend along a portion of an outer periphery of bootie 122. In other cases, raised toe portion 206 also may extend over a portion of top surface and/or bottom surface of bootie 122 in forefoot region 10.

In some embodiments, foot stabilizer system 120 may include one or more components associated with the heel of a foot of a wearer. In some embodiments, the plurality of strap members 200 may include a heel counter 204. Heel counter 204 may be disposed in an area of heel region 14 that generally corresponds to the heel of a wearer. Heel counter 204 may be shaped to engage and stabilize the heel of the wearer. In some embodiments, heel counter 204 may be sized and dimensioned so as to extend a height and a width sufficient to support a heel of a wearer. Heel counter 204 may be formed integrally with one or more strap members located on a lateral side and/or a medial side. In some embodiments, heel counter 204 may be formed by a pair of strap members disposed on either side of foot stabilizer system 120. In the exemplary embodiment shown in FIG. 2, heel counter 204 may extend along heel region 14 between sixth strap member 220 and a corresponding strap member disposed on the opposing side. In other embodiments, heel counter 204 may extend between more or less of the plurality of strap members. In some cases, heel counter 204 may extend along a portion of an outer periphery of bootie 122. In other cases, heel counter 204 also may extend over a portion of bottom surface of bootie 122 in heel region 14.

Referring again to FIG. 2, the plurality of strap members 200 may be configured to conform to the shape of a foot. In some embodiments, the plurality of strap members 200 may be sized and dimensioned so as to substantially enclose the foot of a wearer. In an exemplary embodiment, the plurality of strap members 200 extend initially laterally away from a longitudinal axis and then curve upward and inward. In other embodiments, the plurality of strap members 200 may be shorter and terminate lower but still be long enough so that adequate lateral support is provided.

In some embodiments, the plurality of strap members 200 may extend to a position that is substantially above the top of the foot. In the exemplary embodiment illustrated in FIG. 2, first strap member 210, second strap member 212, third strap member 214, fourth strap member 216, fifth strap member 218, and sixth strap member 220 terminate at distal ends located above the surface of bootie 122 along the lateral side. The opposite lateral side may include a corresponding arrangement of the plurality of strap members 200. In this way, the plurality of strap members 200 may substantially enclose the foot. In different embodiments, the plurality of strap members 200 may be various combinations of sizes, widths, curvatures, thicknesses, and/or stiffnesses.

In some embodiments, the plurality of strap members 200 may extend to an underside of foot stabilizer system 120, such that a portion of the plurality of strap members 200 will underlie or extend underneath the foot of a wearer when disposed within foot stabilizer system 120. In some embodiments, one or more strap members of the plurality of strap members 200 extending to the underside of foot stabilizer system 120 may be joined to each other at a joined region corresponding approximately to a longitudinal axis. In other embodiments, the plurality of strap members 200 extending to the underside of foot stabilizer system 120 may be integrally formed. In some embodiments, raised toe portion 206 and/or heel counter 204 may be joined and/or integrally formed with one or more strap members on the underside of foot stabilizer system 120.

In some embodiments, the plurality of strap members 200 may be configured to provide support to different regions of a foot of a wearer. In some embodiments, the plurality of strap members 200 may be arranged so as to substantially support the foot of a wearer. In an exemplary embodiment, the plurality of strap members 200 may be configured to support regions of a foot of a wearer generally corresponding to forefoot region 10, midfoot region 12, and heel region 14. In some embodiments, midfoot region 12 may be associated with an arch of the foot. In the exemplary embodiment of FIG. 5, one or more of first strap member 210 and/or second strap member 212 may be configured as a forefoot member to provide support to forefoot region 12 of the wearer's foot. In this embodiment, one or more of third strap member 214, fourth strap member 216, and/or fifth strap member 218 may be configured as an arch member to provide support to midfoot region 12 of the wearer's foot. In some embodiments, an arch member may extend underneath the foot of a wearer to support the arch of the foot. In some embodiments, sixth strap member 220 may be configured as a heel member to provide support to heel region 14 of the wearer's foot.

In some embodiments, foot stabilizer system 120 including the plurality of strap members 200 may be secured to base portion 130. In an exemplary embodiment, foot stabilizer system 120 may be attached to base portion 130 in a manner such that foot stabilizer system 120 may be decoupled from article 100 at one or more portions of midfoot region 12. In one embodiment, portions of foot stabilizer system 120 may be secured to base portion 130 at one or more of toe region 10, midfoot region 12, and/or heel region 14. In an exemplary embodiment, foot stabilizer system 120 may be attached to base portion 130 at an attachment area. In one embodiment, the attachment area may include a central attachment portion 131. In some embodiments, foot stabilizer system 120 additionally may be secured to base portion at attachment areas corresponding to one or more of a forefoot attachment portion 133 and/or a heel attachment portion 135.

Referring now to FIG. 3, in some embodiments, foot stabilizer system 120 may be attached to base portion 130 at one or more attachment areas. In this embodiment, foot stabilizer system 120 may be attached to base portion 130 at a central attachment portion 131 that extends substantially along longitudinal axis 20. In some embodiments, central attachment portion 131 may extend essentially from heel region 14 to forefoot region 10. In some cases, central attachment portion 131 may extend through a portion of midfoot region 12 of base portion 130. In other cases, central attachment portion 131 may not extend through a portion of midfoot region 12.

In some embodiments, foot stabilizer system 120 may be secured to base portion 130 at one or more of toe region 10 and/or heel region 14. With this arrangement, portions of foot stabilizer system 120 associated with the toes and/or heel of a foot of a wearer may be secured to base portion 130 of article 100 while portions of foot stabilizer system 120 associated with midfoot region 12 may be decoupled from base portion 130 and article 100. In some embodiments, foot stabilizer system 120 may be attached to base portion 130 at a forefoot attachment portion 133. Forefoot attachment portion 133 may extend along a portion of base portion 130 near the periphery of forefoot region 10. In some cases, forefoot attachment portion 133 may extend along a portion of forefoot region 10 of base portion 130 associated with lateral side 16 and medial side 18. In other cases, forefoot attachment portion 133 may extend along a portion of forefoot region 10 of base portion 130 associated with only one of lateral side 16 and medial side 18.

In some embodiments, foot stabilizer system 120 may be attached to base portion 130 at a heel attachment portion 135. Heel attachment portion 135 may extend along a portion of base portion 130 near the periphery of heel region 14. In some cases, heel attachment portion 135 may extend along a portion of heel region 14 of base portion 130 associated with lateral side 16 and medial side 18. In other cases, heel attachment portion 135 may extend along a portion of heel region 14 of base portion 130 associated with only one of lateral side 16 and medial side 18. In other embodiments, heel attachment portion 135 and/or forefoot attachment portion 133 also may extend through one or more portions of midfoot region 12 of base portion.

In an exemplary embodiment, central attachment portion 131, forefoot attachment portion 133, and/or heel attachment portion 135 securely attaches foot stabilizer system 120 to base portion 130 using stitching. Generally, any kind of stitching may be used to accomplish the attachment of foot stabilizer system 120 to base portion 130. In some cases, simple stitches may be used. In other cases, more complex stitches may be used. Examples of various stitches that may be used include, but are not limited to: backstitches, basting stitches, blind stitches, buttonhole stitches, chain stitches, cross-stitches, embroidery stitches, feather stitches, hemming stitches, lock stitches, padding stitches, running stitches, slip stitches, stretch stitches, top stitches, whip stitches, zigzag stitches as well as any other types of machine or manual stitches.

In different embodiments, central attachment portion 131, forefoot attachment portion 133, and/or heel attachment portion 135 may include various attachment mechanisms for attaching foot stabilizer system 120 to base portion 130, including, but not limited to: adhesive, stitching, hook and loop fasteners, and other methods of fixed and/or removable attachment. In addition, while central attachment portion 131, forefoot attachment portion 133, and/or heel attachment portion 135 are illustrated as having a width of a single stitch, it should be understood that each attachment portion may include one or more additional attachment portions that define an attachment area of any width less than the width of base portion 130.

In some embodiments, base portion 130 may be associated with sole structure 140. In one embodiment, base portion 130 may be secured to top surface 142 of sole structure 140. Top surface 142 may be configured to attach base portion 130 to sole structure 140. In an exemplary embodiment, base portion 130 may be attached to top surface 142 of sole structure 140 using adhesive. In other embodiments, base portion 130 may be attached to top surface 142 of sole structure 140 using any suitable attachment mechanism, including, but not limited to one or more of adhesive, heat, pressure, stitching, and other methods of attachment.

In some embodiments, sole structure 140 may include one or more components. In one embodiment, sole structure 140 may include an outsole 144. Outsole 144 may be any conventional outsole used with an article of footwear. In an exemplary embodiment, outsole 144 of sole structure 140 may include one or more tread elements 146 for engaging with the ground. Tread elements 146 may be any conventional tread elements used with an article of footwear, including, but not limited to a cleat. In other embodiments, sole structure 140 may not include tread elements 146.

Figure 4:
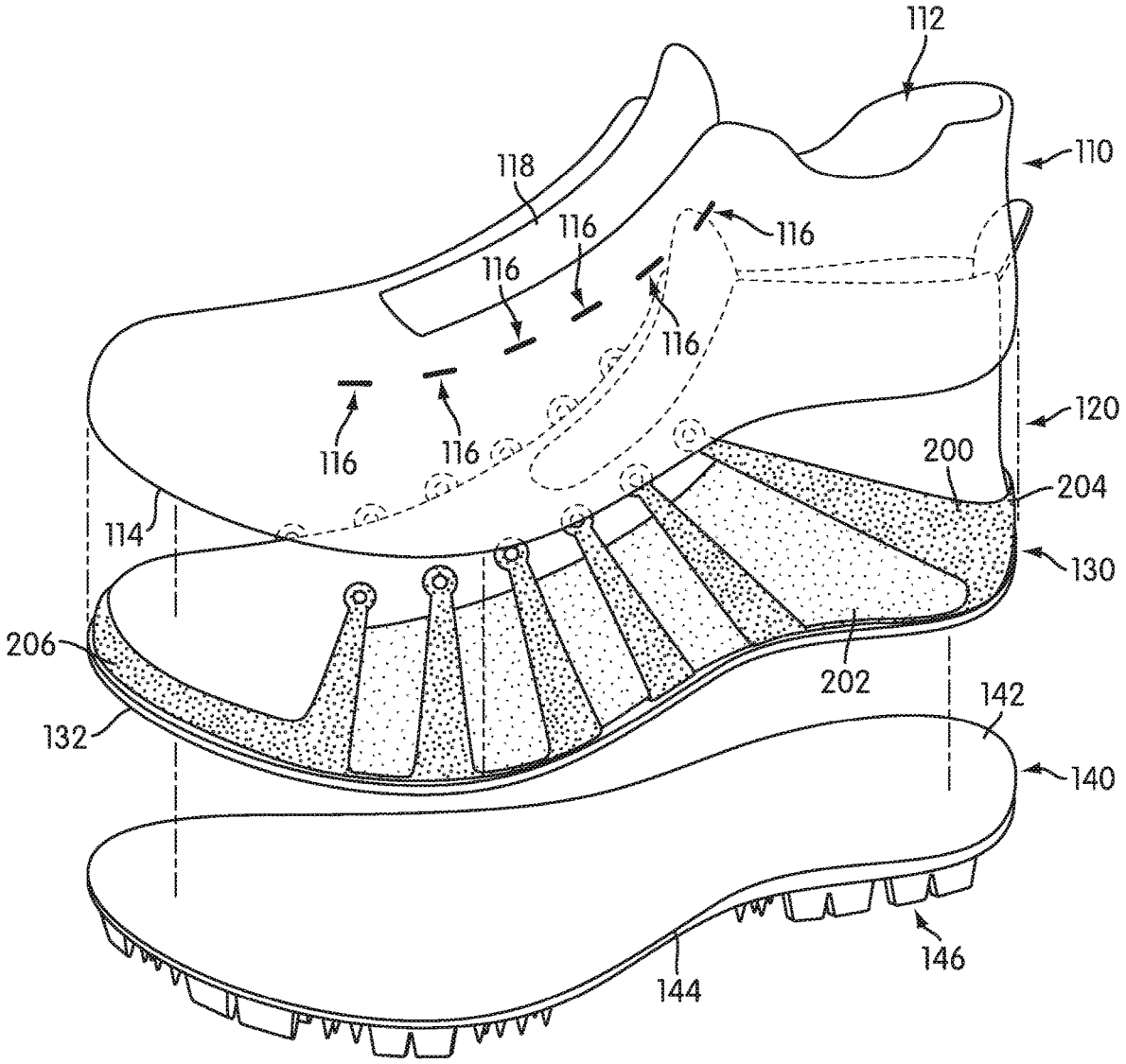
FIG. 4 is an exploded view of an exemplary embodiment of an article of footwear including a decoupled foot stabilizer system attached to a base portion.

FIG. 4 illustrates an exploded view of an exemplary embodiment of article of footwear 100 incorporating foot stabilizer system 120. In this embodiment, upper 110 is illustrated being secured to foot stabilizer system 120 attached to base portion 130. It should be understood that the order of the steps to assemble article 100 are merely exemplary and may be performed in any order. In some embodiments, upper 110 may be secured to base portion 130 prior to foot stabilizer system 120 being attached to base portion 130.

In some embodiments, upper 110 may include one or more components. Typically, upper 110 may be configured to receive a foot of a wearer. In some embodiments, upper 110 may include an entry hole or throat opening 112 configured to receive a foot of a wearer. With this arrangement, entry hole or throat opening 112 may allow a foot to be inserted into an interior article 100.

Referring again to FIG. 4, upper 110 may include a plurality of openings 116 for receiving the distal ends of the plurality of strap members 200. In some embodiments, lacing holes associated with the distal ends of the plurality of strap members 200 of foot stabilizer system 120 may extend out from the interior of article of footwear 100 through the plurality of openings 116 in upper 110. In an exemplary embodiment, the plurality of openings 116 may include slits. In other embodiments, the plurality of openings 116 may be any type of opening in upper 110 that allows the plurality of strap members 200 to extend out from the interior of article 100. In some cases, each of the plurality of openings 116 may be associated with a single strap member of foot stabilizer system 120. In other cases, multiple strap members may be associated with each opening. In some cases, the plurality of openings 116 may be sized and dimensioned so as to allow the distal ends of the plurality of strap members 200 to pass through. In other cases, the plurality of openings 116 may be sized and dimensioned so as to allow movement of the plurality of strap members 200 within openings 116. In some cases, openings 116 may be configured to prevent the distal ends of the plurality of strap members 200 from slipping back into the interior of article of footwear 100.

In an exemplary embodiment, upper 110 also may include a tongue area 118. In this embodiment, tongue area 118 may include a portion of upper 110 that may be tightened around a foot of a wearer. In some embodiments, tongue area 118 may include opposing sides of upper 110 that may be pulled together using laces. In some cases, tongue area 118 may include a tongue and a tongue opening. In other cases, tongue area 118 may include an elastic or stretchable region of upper 110.

In some embodiments, upper 110 may be secured to base portion 130. In this embodiment, upper 110 may be attached to base portion 130 including foot stabilizer system 120 so as to enclose foot stabilizer system 120 in the interior of article 100. In some cases, upper 110 and base portion 130 may be attached by stitching. In one embodiment, a lower periphery 114 of upper 110 may be strobel stitched to outer periphery 132 of base portion 130. In other embodiments, other types of stitching may be used to attach upper 110 and base portion 130. In other cases, upper 110 and base portion 130 may be secured using other attachment mechanisms, including, but not limited to: adhesive, heat bonding, pressure, and any other method of attachment. In other embodiments, more or less of upper 110 may be secured to base portion 130.

In some embodiments, base portion 130 attached to upper 110 and/or foot stabilizer system 120 may be secured to sole structure 140 to assemble article 100. In an exemplary embodiment, top surface 142 may be configured to attach base portion 130 to sole structure 140, as described above. In one embodiment, base portion 130 may be attached to top surface 142 of sole structure 140 using adhesive. In other embodiments, base portion 130 may be attached to top surface 142 of sole structure 140 using any suitable attachment mechanism, including, but not limited to one or more of adhesive, heat, pressure, stitching, and other methods of attachment.

Figure 5:
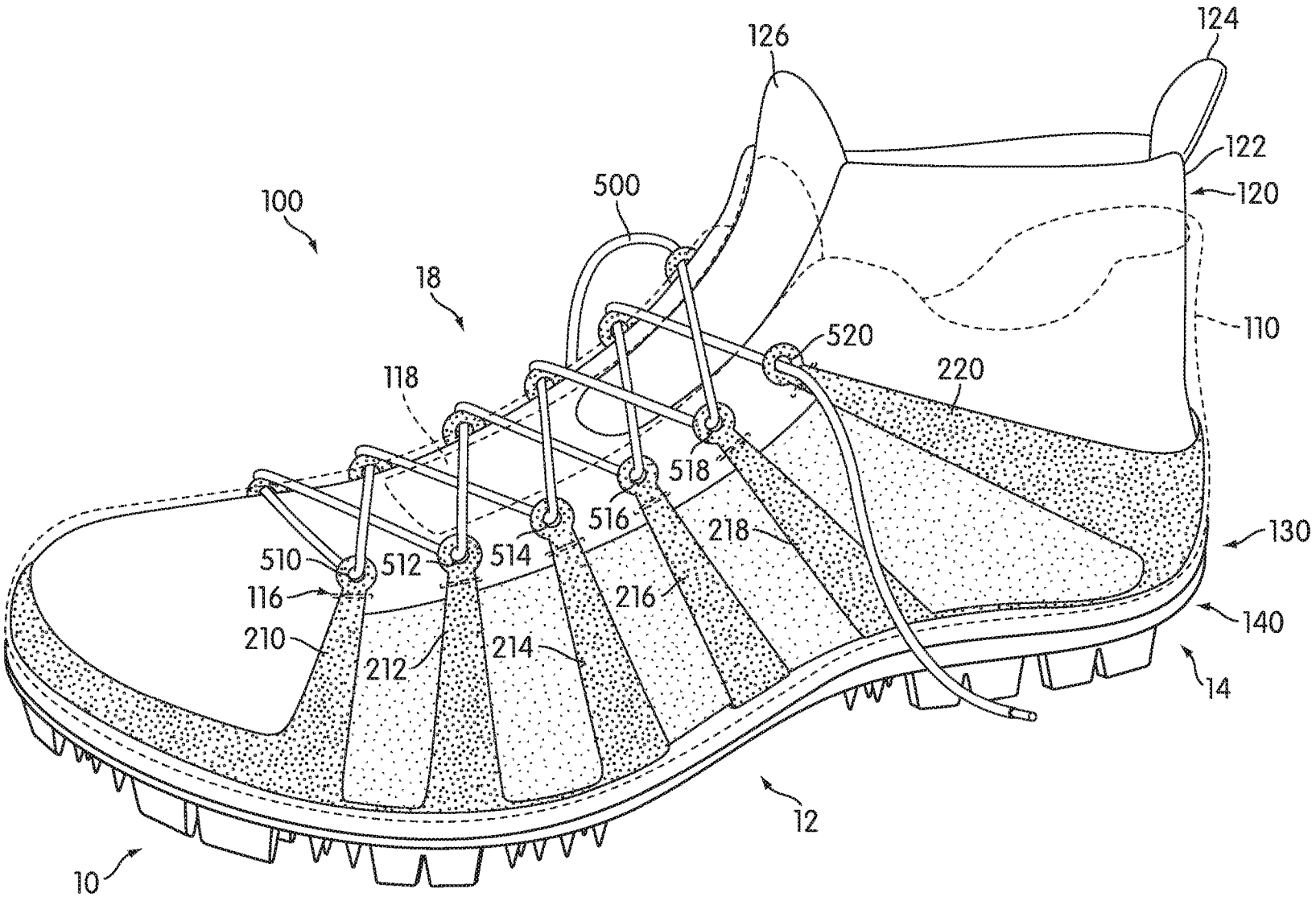
FIG. 5 is an isometric view of an exemplary embodiment of an article of footwear including a decoupled foot stabilizer system.

FIG. 5 illustrates an exemplary embodiment of article 100 including decoupled foot stabilizer system 120. In this embodiment, upper 110 is illustrated in an outline view to reveal the arrangement of foot stabilizer system 120 within the interior of article 100. In some embodiments, foot stabilizer system 120 may be configured with a mechanism for tightening foot stabilizer system 120 around a foot of a wearer. In one embodiment, foot stabilizer system 120 may include one or more portions of the plurality of strap members 200 associated with tongue area 118 of upper 110 that may be tightened around a foot of a wearer. In some cases, the plurality of strap members 200 may extend out from the interior of article 100 to tongue area 118 through openings 116 in upper 110. In other embodiments, upper 110 may include other openings configured to allow the plurality of strap members 200 to extend out to tongue area 118.

In some embodiments, each of the plurality of strap members 200 associated with tongue area 118 of upper 110 may be configured to receive a lace 500. In one embodiment, each of the plurality of strap members 200 may include a lacing hole disposed at the distal end of the strap member. As shown in FIG. 5, a first lacing hole 510 is disposed at a distal end of first strap member 210, and a second lacing hole 512, a third lacing hole 514, a fourth lacing hole 516, a fifth lacing hole 518, and a sixth lacing hole 520 are, respectively, associated with second strap member 212, third strap member 214, fourth strap member 216, fifth strap member 218, and sixth strap member 220. Similarly, one or more lacing holes may be associated with the distal ends of corresponding strap members located on the opposing side of article 100.

In some embodiments, the lacing hole may be an eyelet. In some cases, the lacing hole may be die-cut or stamped in the strap member. In other cases, the lacing hole may include a grommet. In other embodiments, the lacing hole may be a tab formed by attaching a folded over end of a strap member to itself. In different embodiments, the lacing hole may be any opening for receiving a lace or cord.

In some embodiments, article of footwear 100 may include lace 500. In this embodiment, lace 500 runs through the plurality of lacing holes extending out through openings 116 in upper 110. In some embodiments, lace 500 may be disposed in tongue area 118 of upper 110. In some embodiments, lace 500 allows the article of footwear 100 to tighten around the foot of a wearer. In other embodiments, lace 500 allows one or more of the plurality of strap members 200 to conform foot stabilizer system 120 to a portion of the wearer's foot.

In some embodiments, article of footwear 100 may include foot stabilizer system 120 with bootie 122. In the exemplary embodiment of FIG. 5, bootie 122 may extend a height above upper 110. In some embodiments, bootie 122 may be substantially the same height as or shorter than upper 110. In other embodiments, bootie 122 may be sized and dimensioned so as to cover and/or support an ankle of a wearer. As described above, in some embodiments, bootie 122 may include one or more of tongue tab 126 and heel tab 124.

Figure 6:
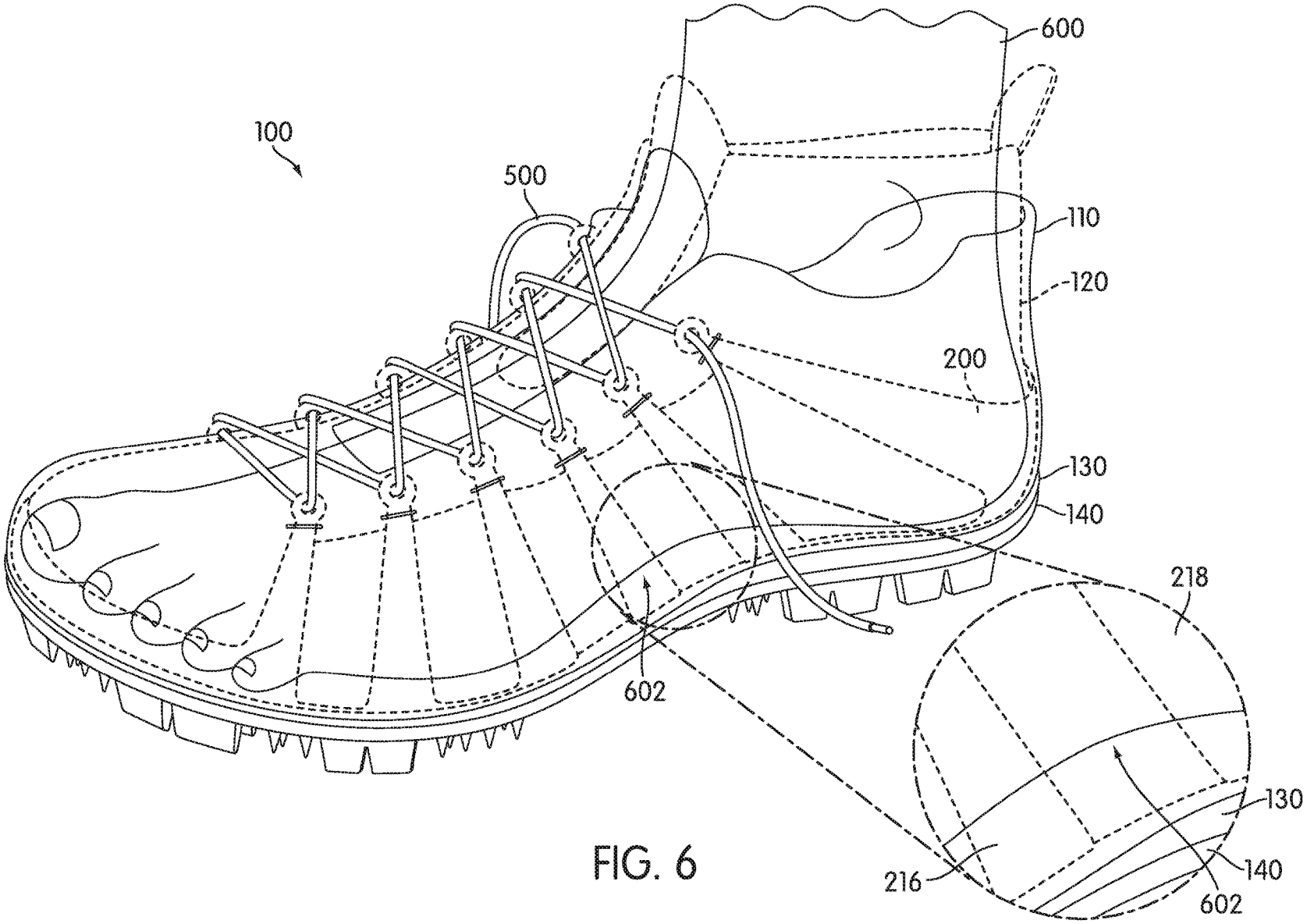
FIG. 6 is an interior view of an exemplary embodiment of an article of footwear including a decoupled foot stabilizer system with a foot.

FIG. 6 illustrates an exemplary embodiment of article of footwear 100 incorporating foot stabilizer system 120 with foot 600 disposed within the interior of article 100. As shown in FIG. 6, foot stabilizer system 120 may be in a loosened position around an arch 602 of foot 600. In some embodiments, the loosened position may correspond generally to resting along a portion of base portion 130 in midfoot region 12. In an exemplary embodiment, foot stabilizer system 120 may be loosely fitted around foot 600 when lace 500 is unfastened. As shown in the close up view illustrated in FIG. 6, a gap or space may be disposed between arch 602 and foot stabilizer system 120 in the loosened position.

Figure 7:
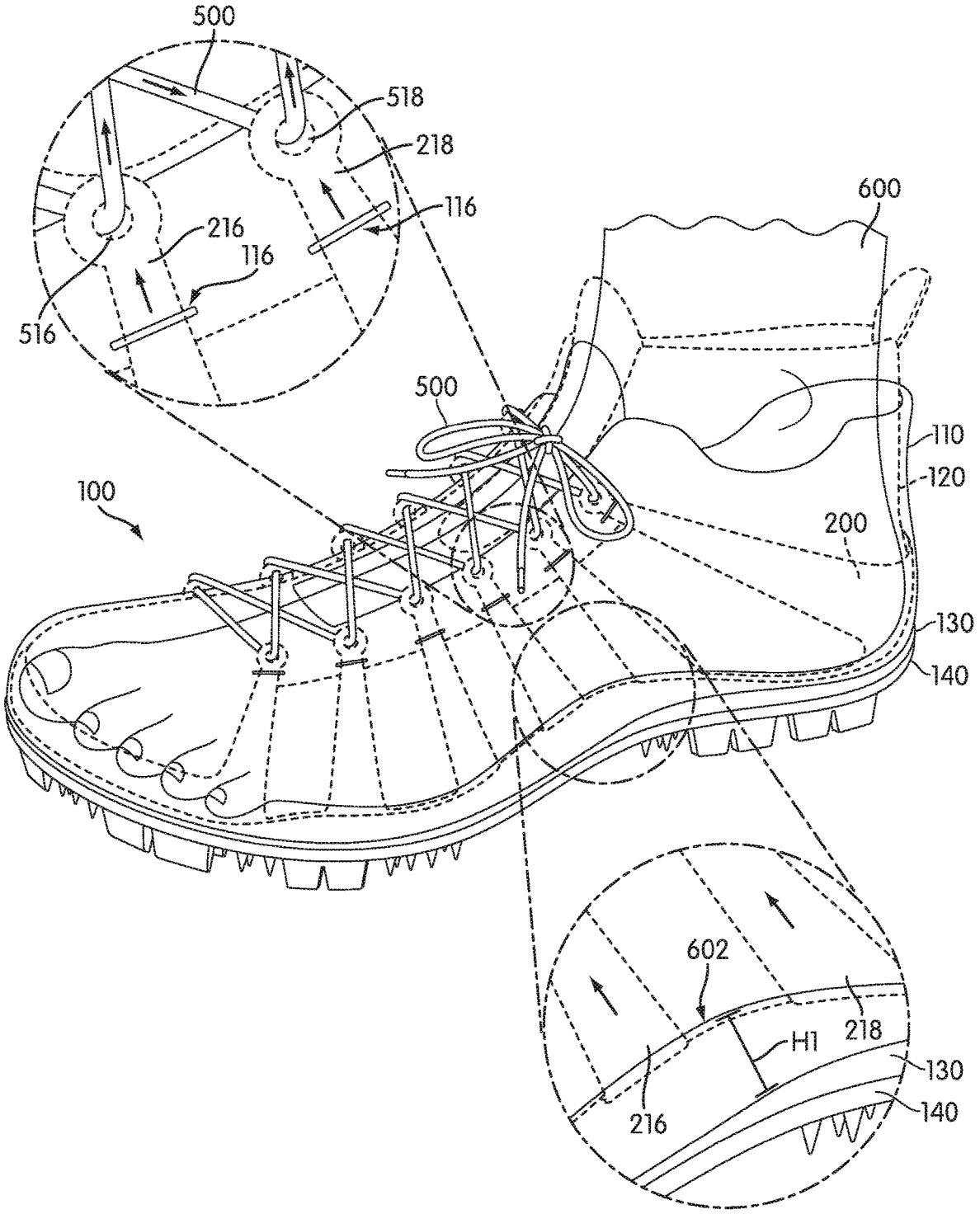
FIG. 7 is a close up and an interior view of an exemplary embodiment of an article of footwear including a decoupled foot stabilizer system conforming to an arch of a foot.

FIG. 7 illustrates an exemplary embodiment of tightening foot stabilizer system 120 to conform to a shape of foot 600 of a wearer. In this embodiment, when lace 500 is pulled tight, including by fastening or tying, foot stabilizer system 120 may tighten around foot 600. In some embodiments, the plurality of strap members 200 may be pulled in an upward direction by lace 500. In one embodiment, lace 500 may be configured to run through one or more lacing holes located at the distal ends of the plurality of strap members 200 to pull the plurality of strap members 200 in an upward direction. As shown in FIG. 7, lace 500 runs through fourth lacing hole 516 at the distal end of fourth strap member 216 and fifth lacing hole 518 at the distal end of fifth strap member 218. In this embodiment, the distal ends including fourth lacing hole 516 and fifth lacing hole 518 may extend out from the interior of article 100 through the plurality of openings 116 in upper 110. In this embodiment, lace 500 may exert an upward force on fourth strap member 216 and fifth strap member 218 when lace 500 is pulled tight.

As shown in FIG. 7, fourth strap member 216 and fifth strap member 218 may move in an upward direction tightening foot stabilizer system 120 against foot 600 and conforming bootie 122 to the shape of foot 600. In this embodiment, the upward force caused by lace 500 as it is pulled tight lifts fourth strap member 216 and fifth strap member 218 and moves foot stabilizer system 120 from the loosened position generally resting along base portion 130 as described above, to a tightened position a height H1 above base portion 130. As shown in FIG. 7, the tightened position of foot stabilizer system 120 corresponds generally to resting along arch 602 of foot 600 at midfoot region 12. With this configuration, a gap or space between arch 602 and foot stabilizer system 120 may be closed by tightening lace 500 and a customized fit may be provided to a wearer. In some embodiments, lace 500 may exert an upward force on one or more of the plurality of strap members 200 associated with forefoot region 10, midfoot region 12, and/or heel region 14. In different embodiments, foot stabilizer system 120 may tighten around and/or conform to the shape of foot 600 at one or portions of foot 600, including forefoot region 10, midfoot region 12, and/or heel region 14. In other embodiments, foot stabilizer system 120 and/or the plurality of strap members 200 may tighten around and/or conform to the shape of foot 600 on one or both of lateral side 16 and medial side 18.

Figure 8:
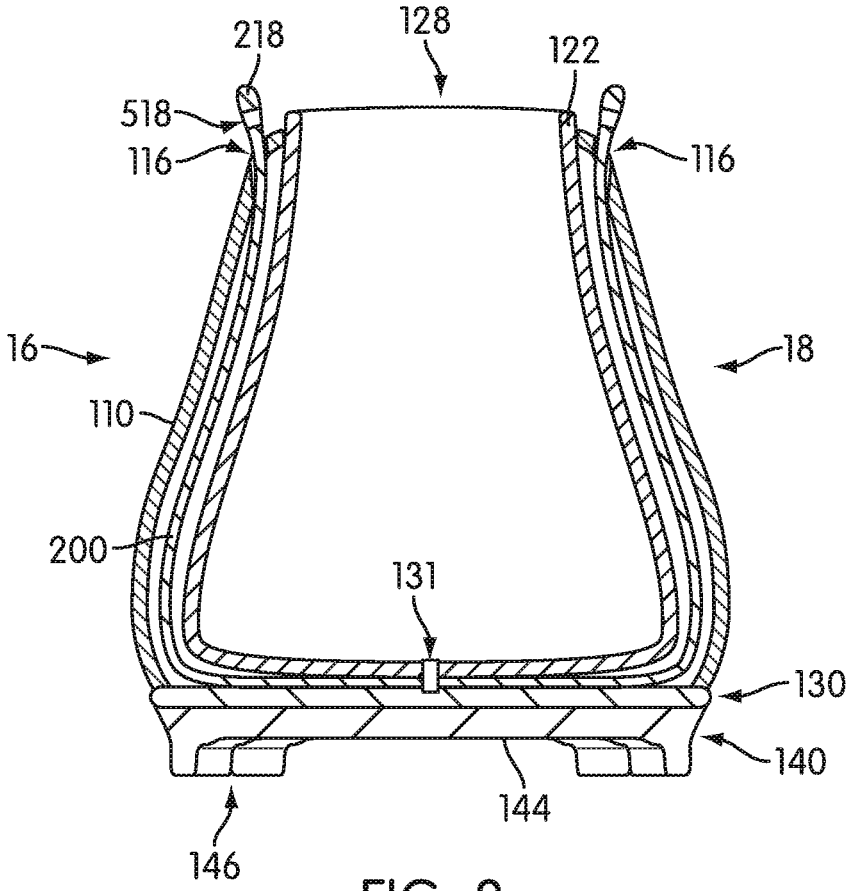
FIG. 8 is a cross-sectional view of an exemplary embodiment of an article of footwear including a decoupled foot stabilizer system.
Figure 9:
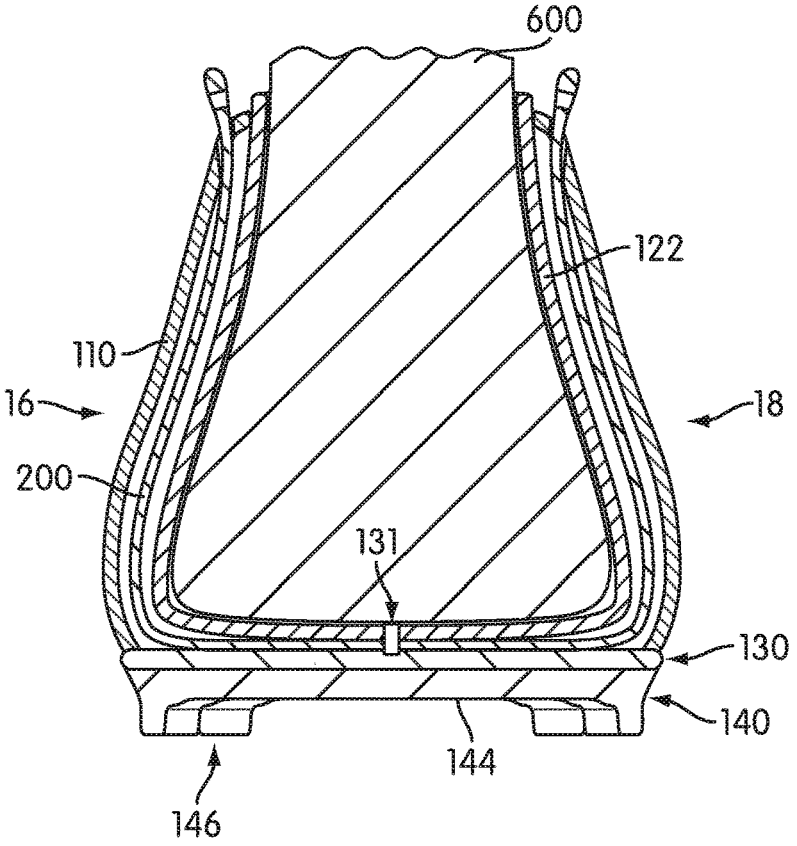
FIG. 9 is a cross-sectional view of an exemplary embodiment of an article of including a decoupled foot stabilizer system with a foot disposed within.
Figure 10:
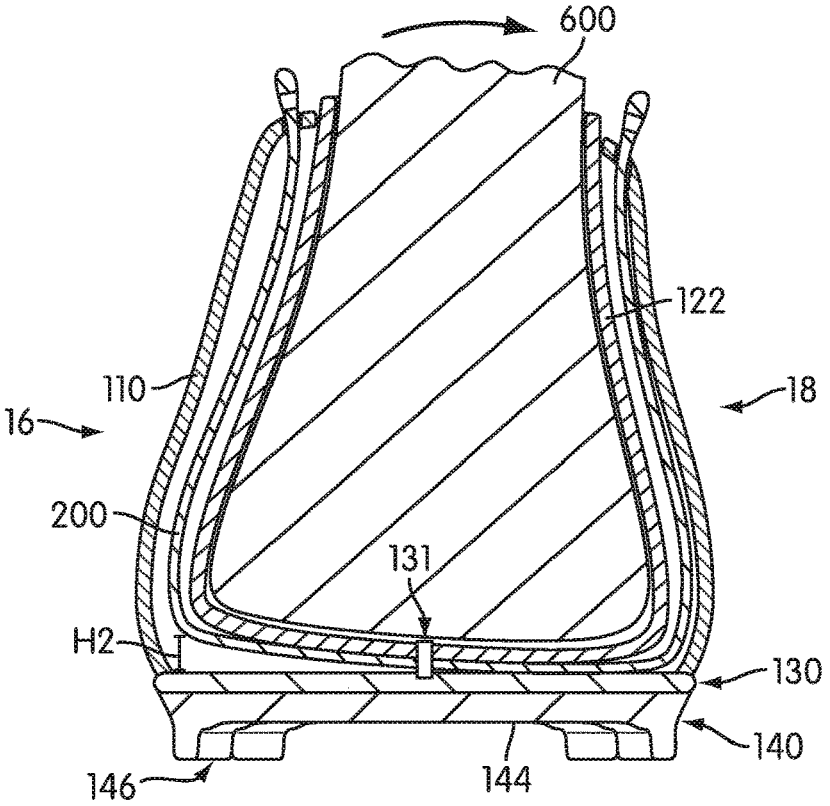
FIG. 10 is a cross-sectional view of an exemplary embodiment of an article of including a decoupled foot stabilizer system with a foot disposed within applying a lateral force.

FIGS. 8 through 10 illustrate cross-sectional views of an exemplary embodiment of article of footwear 100 incorporating decoupled foot stabilizer system 120. As shown in FIG. 8, bootie 122 may be disposed within the interior of upper 110. In this embodiment, fifth strap member 218 and a corresponding strap member on the opposing side are disposed between bootie 122 and upper 110. In some embodiments, strap members may extend out from the interior of upper 110 through one or more openings. As shown in FIG. 8, fifth strap member 218 and the corresponding strap member on the opposing side may extend out from the interior of article 100 through the plurality of openings 116 in upper 110.

In some embodiments, foot stabilizer system 120 may be attached to base portion 130. In this embodiment, foot stabilizer system 120, including bootie 122 and the plurality of strap members 200, may be secured to base portion 130 along central attachment portion 131. In this embodiment, central attachment portion 131 extends through bootie 122, through the plurality of strap members 200, and into or through base portion 130. In different embodiments, other attachment portions may be included to secure foot stabilizer system 120 to base portion 130, as described herein. In one embodiment, upper 110 may be secured to base portion 130. In this embodiment, upper 110 may be attached to base portion 130 along an outer periphery of base portion 130. In an exemplary embodiment, base portion 130 may be secured to sole structure 140. In some cases, sole structure may include one or more of an insole, midsole, and/or outsole.

Referring now to FIG. 9, a cross-sectional view of an exemplary embodiment of article of footwear 100 including decoupled foot stabilizer system 120 is shown with a foot 600 of a wearer disposed within. In some embodiments, bootie 122 may have one or more of the plurality of strap members 200 disposed on an outside surface that together with bootie 122 surround and substantially conform to the shape of foot 600. In an exemplary embodiment, foot stabilizer system 120 may be decoupled from base portion 130 at midfoot region 12. In different embodiments, various portions of foot stabilizer system 120 may be decoupled from base portion 130 in one or more of forefoot region 10, midfoot region 12, and/or heel region 14.

As shown in FIG. 9, the decoupling of foot stabilizer system 120 from base portion 130 at midfoot region 12 may allow foot 600 to have a degree of freedom of motion relative to article 100. In some cases, the decoupling of foot stabilizer system 120 may assist a wearer with a change in the direction of travel, including by "cutting" quickly to one side. For example, a wearer may cut to the right by pushing hard on his left foot.

FIG. 10 illustrates a cross-sectional view of the exemplary embodiment of FIG. 9 in the case where a wearer is making a cutting move. In this exemplary embodiment, foot stabilizer system 120 is decoupled from base portion 130 at midfoot region 12. In this embodiment, bootie 122, fifth strap member 218 and a corresponding strap member on the opposing side may stabilize foot 600 within upper 110 during lateral movements. With this configuration, foot 600 may rotate inward toward medial side 18 when a wearer makes a cut to his right. This same type of action may result from weight transfer on the feet during the course of a golf swing.

As shown in FIG. 10, foot stabilizer system 120 may allow foot 600 to have freedom of motion to rotate toward medial side 18, while keeping sole structure 140 of article 100 in contact with the ground. In an exemplary embodiment, central attachment portion 131 may provide decoupling to foot stabilizer system 120 such that foot stabilizer system 120 may move a second height H2 relative to interior of article 100 when a wearer makes a lateral cutting move. In various embodiments, second height H2 may be larger or smaller in correspondence to the proximity of the attachment area to the outer periphery of article 100. In this embodiment, second height H2 may be larger than other embodiments where central attachment portion 131 has a larger width and/or where wider attachment areas are used to secure foot stabilizer system 120 and base portion 130, including, but not limited to a horseshoe shaped attachment area and/or an hourglass shaped attachment area, described below.

In other embodiments, one or more portions of foot stabilizer system 120 may provide additional stability for making lateral movements. In some cases, raised toe portion 206 and/or heel counter 204 may provide support to foot 600 of a wearer during cutting movements. In other cases, foot stabilizer system 120 and/or one or more of raised toe portion 206 and heel counter 204 may provide stability to foot 600 during other movements, including, but not limited to: moving in a forward or rearward direction, running, jumping and other athletic movements.

Figure 11:
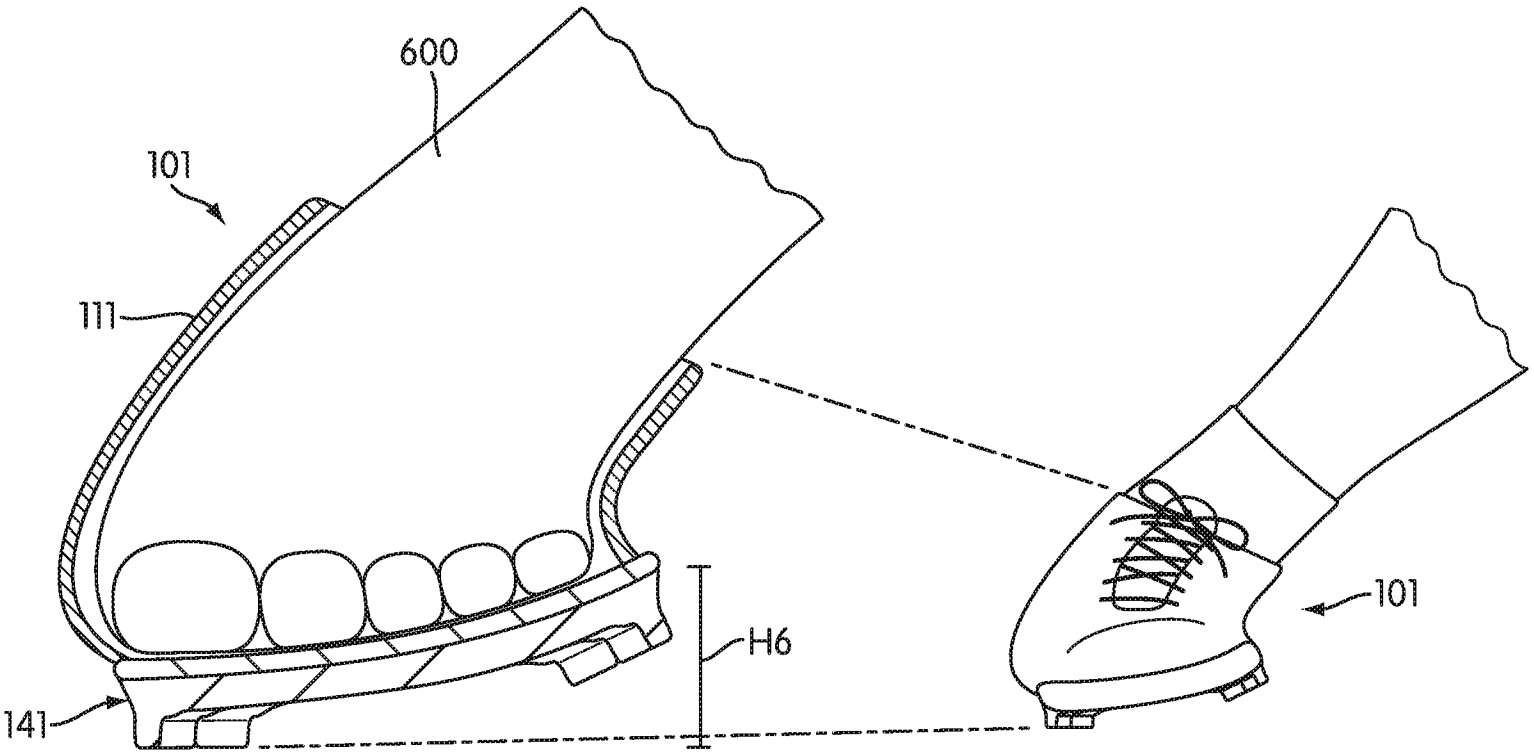
FIG. 11 is a schematic view of a conventional article of footwear during a lateral movement.
Figure 12:
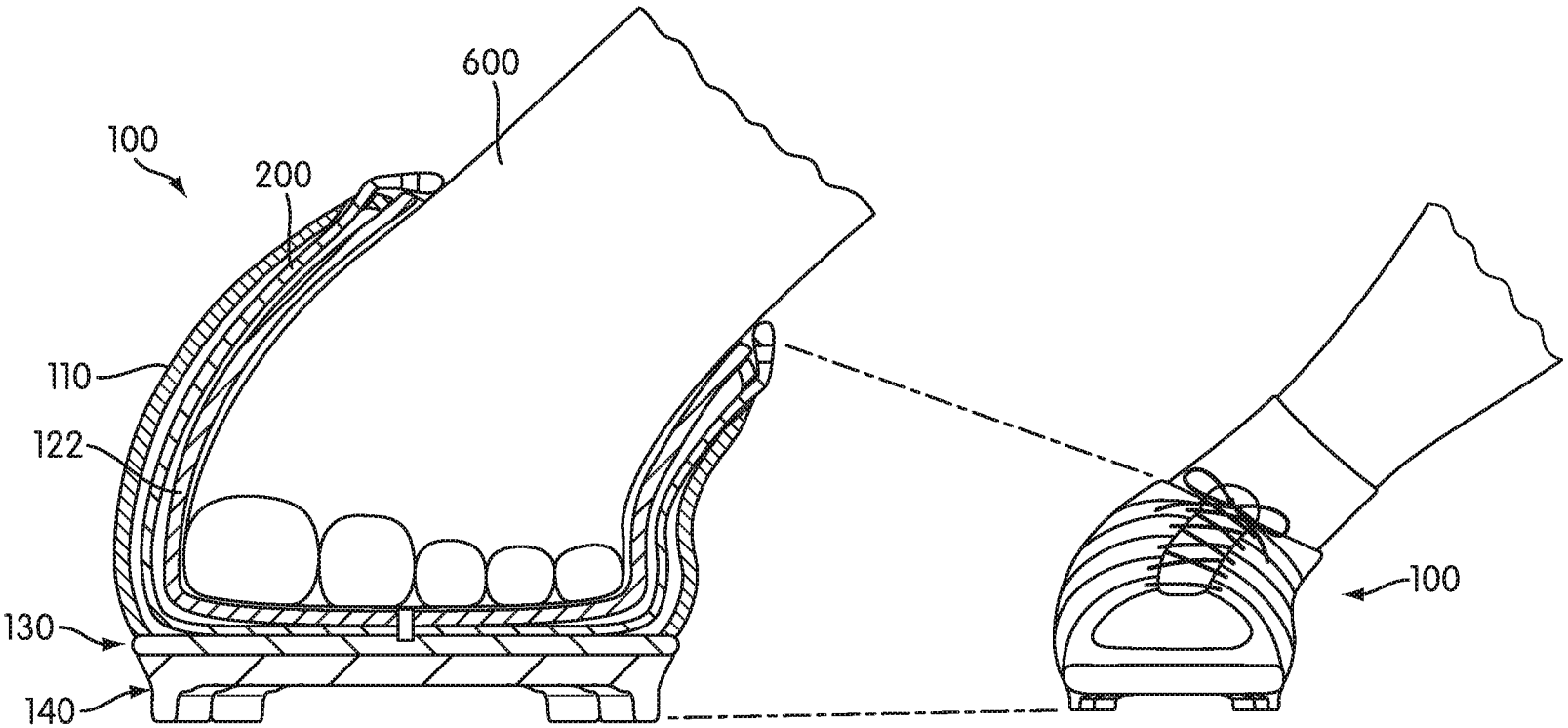
FIG. 12 is a schematic view of an exemplary embodiment of an article of footwear including a foot stabilizer system during a lateral movement.

FIGS. 11 and 12 illustrate comparative views of lateral stability between a conventional article of footwear and an article of footwear with a foot stabilizer system according to the present embodiments described herein. Referring now to FIG. 11, a conventional article of footwear 101 is illustrated being worn on a foot 600 of a wearer. As the wearer makes a lateral movement, foot 600 shifts within conventional article 101, forming a bulge on one side of an upper 111 of conventional article 101. Additionally, the lateral movement by the wearer may cause an outsole 141 of conventional article 101 to become displaced from contact with a ground surface. As shown in FIG. 11, the lateral movement of foot 600 within conventional article 101 may cause outsole 141 to lift a height H6 from the ground surface on one side of conventional article 101. Accordingly, during lateral movements, conventional article 101 may not provide sufficient lateral stability to foot 600 of a wearer.

Referring now to FIG. 12, an exemplary embodiment of an article of footwear 100 including a foot stabilizer system is illustrated on foot 600 of a wearer. In this embodiment, article 100 is the exemplary embodiment shown in FIGS. 1-10 and described above. It should be understood, however, that other exemplary embodiments of articles of footwear including foot stabilizer systems described herein may provide substantially similar lateral stability as illustrated with respect to article 100 in FIG. 12.

In this embodiment, article 100 includes a foot stabilizer system comprising bootie 122 and strap members 200, as described above. Foot 600 of a wearer is supported by bootie 122 and strap members 200 within upper 110 of article 100. Additionally, as described above, the foot stabilizer system is attached to base portion 130 at a central attachment portion. With this arrangement, article 100 may allow foot 600 of a wearer to remain substantially parallel to a ground surface when the wearer is making a lateral movement. As shown in FIG. 12, the foot stabilizer system inside upper 110 provides support and lateral stability to foot 600 to prevent foot 600 from bulging out on one side of article 100. In addition, in contrast with conventional article 101 shown in FIG. 11, the foot stabilizer system of article 100 allows sole structure 140 to remain substantially in contact with the ground surface. As a result, article 100 does not lift above the ground surface to a height H6 as in the case with conventional article 101. With this arrangement, article 100 provides lateral stability to foot 600 of a wearer during lateral movements.

Figure 13:
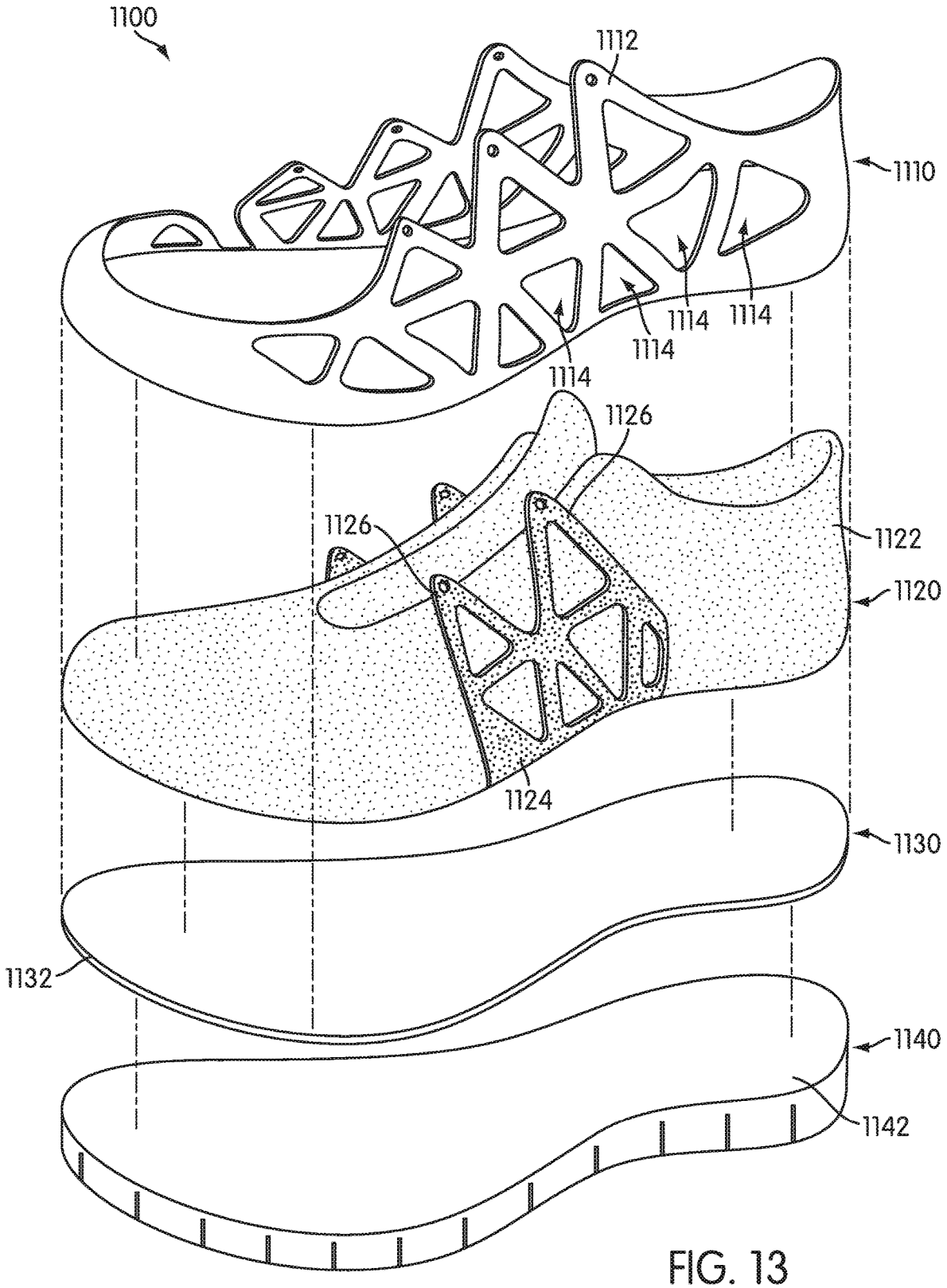
FIG. 13 is an exploded view of an alternate embodiment of an article of footwear including a decoupled foot stabilizer system.

FIGS. 13 through 18 illustrate an alternate exemplary embodiment of an article of footwear including a decoupled foot stabilizer system 120. In some embodiments, one or more components associated with an article of footwear may be configured for various sports and/or activities. In an exemplary embodiment, an article of footwear including a decoupled foot stabilizer system may be configured for running. FIG. 13 illustrates an exploded view of an alternate exemplary embodiment of an article of footwear 1100. In this embodiment, article 1100 may include a decoupled foot stabilizer system 1120. In some embodiments, foot stabilizer system 1120 may include a sock liner 1122. In an exemplary embodiment, sock liner 1122 may be similar to bootie 122 described above. In one embodiment, sock liner 1122 may be configured to extend to a height below an ankle of a wearer. In an exemplary embodiment, sock liner 1122 may be made of a lightweight elastic material. In other embodiments, sock liner 1122 may be made of any suitable material, including any one or more materials described above for bootie 122.

In some embodiments, foot stabilizer system 1120 may include a strap system 1124. In an exemplary embodiment, strap system 1124 may be similar to the plurality of strap members 200 described above. In one embodiment, strap system 1124 may be associated with only midfoot region 12 of article 1100. In other embodiments, strap system 1124 may be associated with additional portions of article 1100, including forefoot region 10 and/or heel region 14. In this embodiment, strap system 1124 may include one or more strap members 1126. In an exemplary embodiment, strap members 1126 may be configured to provide stability and/or support to foot stabilizer system 1120. In some embodiments, strap members 1126 may have a triangular shape. In an exemplary embodiment, strap members 1126 having a triangular shape may be configured to distribute the load associated with supporting a foot of a wearer. In other embodiments, strap members 1126 may have other shapes, including a substantially similar shape as the plurality of strap members 200 described above.

In an exemplary embodiment, strap members 1126 may be configured to support an arch of a foot of a wearer. In one embodiment, strap system 1124 may include a number of strap members 1126 on opposite sides. In an exemplary embodiment, strap members 1126 may be positioned on a lateral side and a medial side of foot stabilizer system 1120. In the embodiment shown in FIG. 13, foot stabilizer system 1120 may include strap system 1124 having four strap members 1126 disposed over an outside surface of sock liner 1122. In other embodiments, foot stabilizer system 1120 may include strap system 1124 having more or less strap members.

In some embodiments, strap members 1126 may be attached to sock liner 1122. In some cases, strap members 1126 may be attached to sock liner 1122 on an underside of sock liner 1122. In other cases, strap members 1126 additionally may be attached to a portion of a side of sock liner 1122. In one embodiment, strap members 1126 may be attached to an underside of sock liner 1122 and unattached on the sides of sock liner 1122 to provide freedom of motion for strap system 1124 relative to sock liner 1122. With this arrangement, foot stabilizer system 1120 may be configured to provide a customized fit to a foot of a wearer. In different embodiments, strap members 1126 may be attached to each other and/or attached to sock liner 1122 using various attachment mechanisms, including, but not limited to: adhesive, stitching, and other methods of fixed attachment. In other embodiments, a removable attachment mechanism may be used, including, but not limited to: hook and loop fasteners and other methods of removable attachment.

In some embodiments, article 1100 may include an upper 1110. Generally, upper 1110 provides a covering for the foot that comfortably receives and securely positions the foot with respect to a sole structure 1140. In some embodiments, upper 1110 may be configured to be lightweight. In one exemplary embodiment, upper 1110 may have material removed from portions of upper to provide a "skeletonized" upper 1110. In the embodiment shown in FIG. 13, upper 1110 may include one or more portions where material has been removed forming gaps or cut-outs 1114. With this arrangement, the plurality of gaps or cut-outs 1114 in upper 1110 may allow upper 1110 to be lightweight. In other embodiments, portions of upper 1110, including one or more of the plurality of gaps or cut-outs 1114 in upper 1110, may include a layer of mesh material or other suitable lightweight and/or elastic material. In some cases, one or more portions of an upper, including one or more gaps or cut-outs, may be made of the material disclosed in copending and commonly owned U.S. Published Patent Appln. No. 2010/0199406 and entitled "Thermoplastic Non-Woven Textile Elements", and filed on Feb. 6, 2009.

In some embodiments, upper 1110 may include one or more lacing strap members 1112. In this embodiment, the plurality of lacing strap members 1112 may be provided on upper 1110 in an area corresponding generally to a lacing area of article 1100. In one embodiment, the distal ends of lacing strap members 1112 may be provided with a mechanism for receiving a lace. With this arrangement, a lace or similar structure may be provided to tighten article 1100 around a foot of a wearer. In an exemplary embodiment, the plurality of lacing strap members 1112 may have a substantially similar shape as strap members 1126 of strap system 1124. In one embodiment, the plurality of lacing strap members 1112 may have a triangular shape. In some cases, the triangular shape of the plurality of lacing strap members 1112 may be configured to assist foot stabilizer system 1120 with distributing the load associated with supporting a foot of a wearer. In other embodiments, the plurality of lacing strap members 1112 may have other shapes, including any shape associated with the plurality of strap members 200 described above.

In some embodiments, article 1100 may include sole structure 1140. Sole structure 1140 may be generally positioned between a foot of a wearer and the ground. In some embodiments, sole structure 1140 may include one or more of an outsole, a midsole, a single piece sole, and/or any number of additional components associated with a conventional sole. In an exemplary embodiment, sole structure 1140 may include an articulated sole structure for engaging with the ground. While FIGS. 13 through 17 illustrate sole structure 1140 having an articulated sole structure, it should be understood that article 1100 may include any conventional type of sole structure 1140. Additionally, sole structure 1140 may optionally include one or more tread elements as described herein or known in the art.

In some embodiments, article 1100 may include a base portion 1130. Base portion 1130 may be generally positioned between the foot of a wearer and sole structure 1140. In some embodiments, base portion 1130 may be secured to a lower portion of upper 1110 and an upper portion of sole structure 1140. In this embodiment, base portion 1130 may be secured to a lower portion of upper 1110 along an outer periphery 1132. Additionally, in this embodiment, base portion 1130 may be secured to a top surface 1142 of sole structure 1140. In different embodiments, base portion 1130 may include one or more of a midsole, strobel, and/or a portion of upper 1110 that is configured to be attached to sole structure 1140.

In some embodiments, base portion 1130 may be disposed between foot stabilizer system 1120 and sole structure 1140. In one embodiment, foot stabilizer system 1120 may be secured to base portion 1130. In an exemplary embodiment, foot stabilizer system 1120 may be secured to base portion 1130 in a manner such that foot stabilizer system 1120 is selectively decoupled from one or more portions of article 1100. In different embodiments, foot stabilizer system 1120 may be decoupled from base portion 1130 using various attachment portions as described herein. In one embodiment, foot stabilizer system 1120 may be attached to base portion 1130 using a similar arrangement as described above in regard to foot stabilizer system 120 and base portion 130. In other embodiments, foot stabilizer system 1120 may be attached to base portion 1130 using a horseshoe or hourglass shaped attachment portion, as more fully described in the embodiments below.

Figure 14:
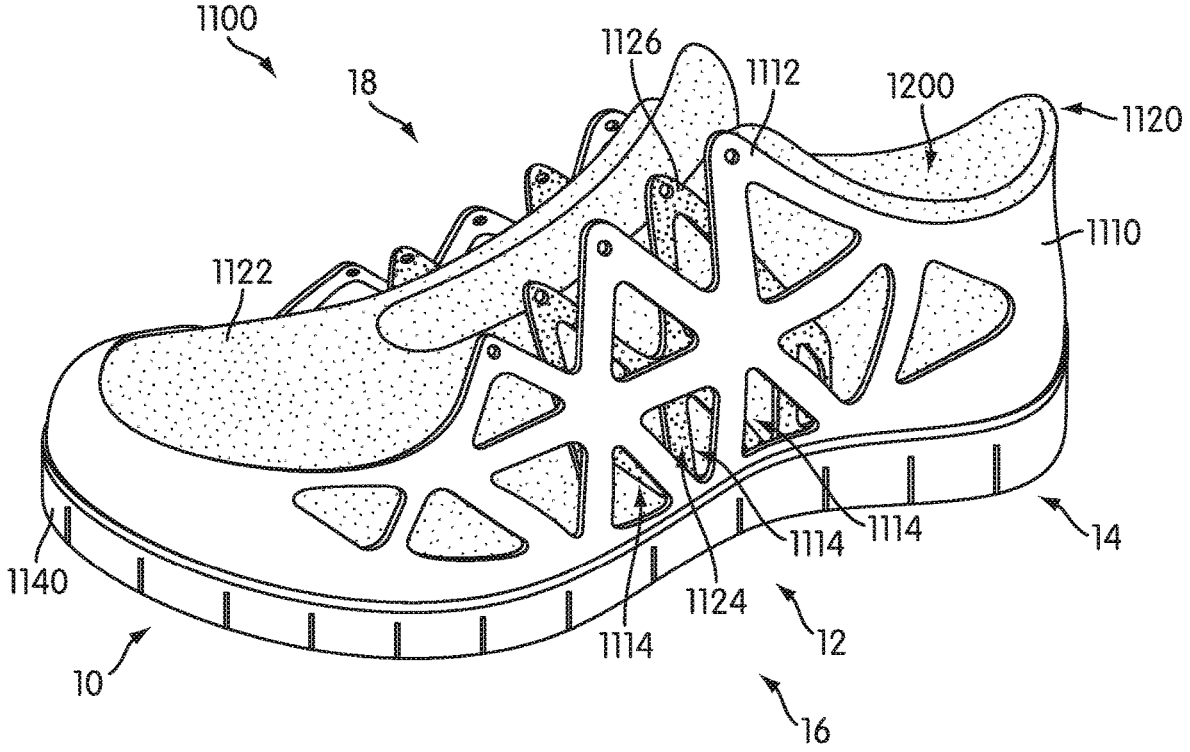
FIG. 14 is an isometric view of an alternate embodiment of an article of footwear including a decoupled foot stabilizer system.

FIG. 14 illustrates alternate exemplary embodiment of article 1100 assembled with decoupled foot stabilizer system 1120. In this embodiment, skeletonized upper 1110 may be disposed over foot stabilizer system 1120, including sock liner 1122 and strap system 1124. As shown in FIG. 14, one or more portions of skeletonized upper 1110 may be removed such that sock liner 1122 is exposed. In one embodiment, a portion of upper 1110 associated with forefoot region 10 and extending over a top of article 1100 into midfoot region 12 may be removed to expose sock liner 1122. Additionally, as shown in this embodiment, upper 1110 may include a number of gaps or cut-outs 1114 disposed on lateral side 16 of article 1100 such that strap system 1124 is exposed. It should be understood that article 1100 may include a similar arrangement on medial side 18 of upper 1110. In other embodiments, gaps or cut-outs 1114 may include a mesh material or other suitable material to provide protection to a foot of a wearer from debris that may enter into interior of article 1100 through gaps or cut-outs 1114.

Figure 15:
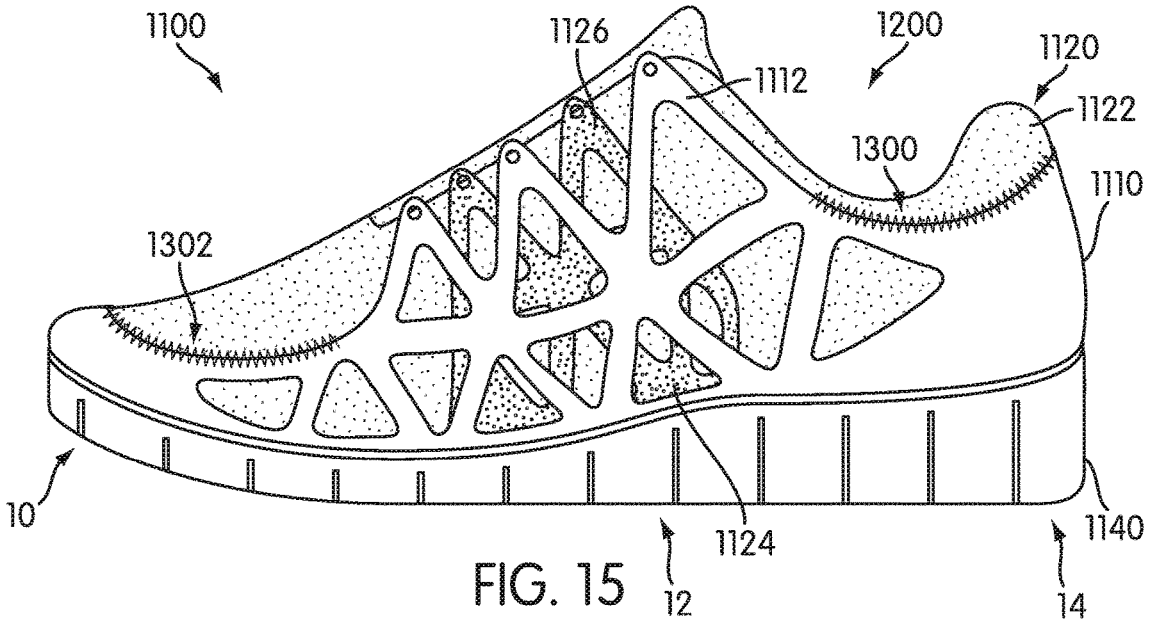
FIG. 15 is a lateral side view of an alternate embodiment of al of footwear including a decoupled foot stabilizer system.

In some embodiments, one or more portions of upper 1110 may be secured to portions of foot stabilizer system 1120. In an exemplary embodiment, portions of upper 1110 and sock liner 1122 may be securely attached at forefoot region 10 and/or heel region 14 of article 1100. In one embodiment, upper 1110 and sock liner 1122 may be attached by stitching at one or more portions located at forefoot region 10 and/or heel region 14 of article 1100. Referring now to FIG. 15, lateral side 16 of article 1100 is illustrated, including upper 1110 and foot stabilizer system 1120. In this embodiment, sock liner 1122 may be attached to upper 1110 at heel region 14 at a first upper heel attachment portion 1300. In some cases, first upper heel attachment portion 1300 may extend a length along a top portion of upper 1110 and sock liner 1122 sufficient to securely attach upper 1110 and sock liner 1122 at an area adjacent to a throat opening 1200 of article 1100. In some embodiments, sock liner 1122 also may be attached to upper 1110 at forefoot region 10 at a first upper forefoot attachment portion 1302. In some cases, first upper forefoot attachment portion 1302 may extend a length along a top portion of upper 1110 and sock liner 1122 sufficient to securely attach upper 1110 and sock liner 1122 at an area corresponding to the toes of a foot of a wearer.

Figure 16:
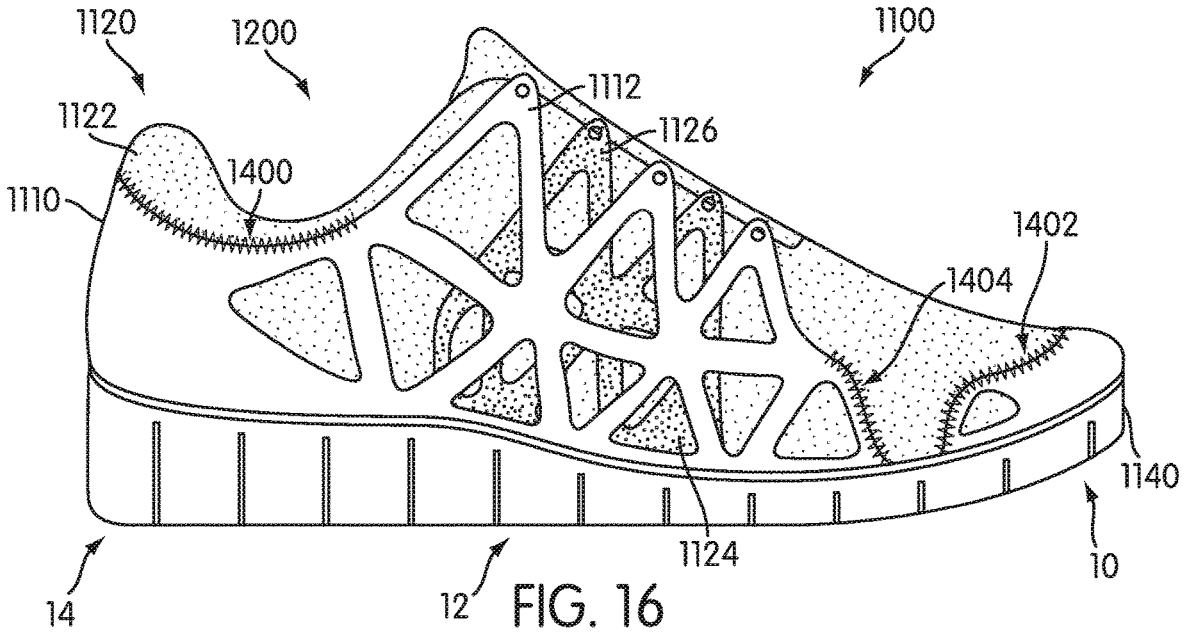
FIG. 16 is a medial side view of an alternate embodiment of an article of footwear including a decoupled foot stabilizer system.

Referring now to FIG. 16, medial side 18 of article 1100 is illustrated, including upper 1110 and foot stabilizer system 1120. In this embodiment, sock liner 1122 may be attached to upper 1110 at heel region 14 at a second upper heel attachment portion 1400. In some cases, second upper heel attachment portion 1400 may extend a length along a top portion of upper 1110 and sock liner 1122 sufficient to securely attach upper 1110 and sock liner 1122 at an area adjacent to a throat opening 1200 of article 1100. In other cases, second upper heel attachment portion 1400 and first upper heel attachment portion 1300 may each extend a length on medial side 18 and lateral side 16, respectively, so as to be substantially continuous around heel region 14.

In some embodiments, sock liner 1122 also may be attached to upper 1110 at forefoot region 10 at a second upper forefoot attachment portion 1402. In some cases, second upper forefoot attachment portion 1402 may extend a length along a top portion of upper 1110 and sock liner 1122 sufficient to securely attach upper 1110 and sock liner 1122 at an area corresponding to the toes of a foot of a wearer. In other cases, second upper forefoot attachment portion 1402 and first upper forefoot attachment portion 1302 may each extend a length on medial side 18 and lateral side 16, respectively, so as to be substantially continuous around forefoot region 10.

In the current embodiment shown in FIG. 16, second upper forefoot attachment portion 1402 may further extend in a downward direction toward sole structure 1140. In some embodiments, upper 1110 may include a discontinuous portion corresponding to an area associated with the toes of a wearer. In this embodiment, second upper forefoot attachment portion 1402 may secure a front edge of the discontinuous portion of upper 1110 to sock liner 1122. In an exemplary embodiment, sock liner 1122 also may be attached to upper 1110 at forefoot region 10 at a third upper forefoot attachment portion 1404. In some cases, third upper forefoot attachment portion 1404 may extend a length along a rear edge of the discontinuous portion of upper 1110 from an area adjacent to sole structure 1140 toward midfoot region 12 of article 1100. In this embodiment, third upper forefoot attachment portion extends a length sufficient to securely attach upper 1110 and sock liner 1122 at an area corresponding to the toes of a foot of a wearer. With this arrangement, discontinuous portion of upper 1110 bounded by second upper forefoot attachment portion 1402 on the front edge and third upper forefoot attachment portion 1404 on the rear edge may be configured to allow greater bending of article 1100 at an area associated with the toes of a wearer. In other embodiments, discontinuous portion of upper 1110 may be omitted and upper 1110 on medial side 18 may be similar to upper 1110 on lateral side 16.

Figure 17:
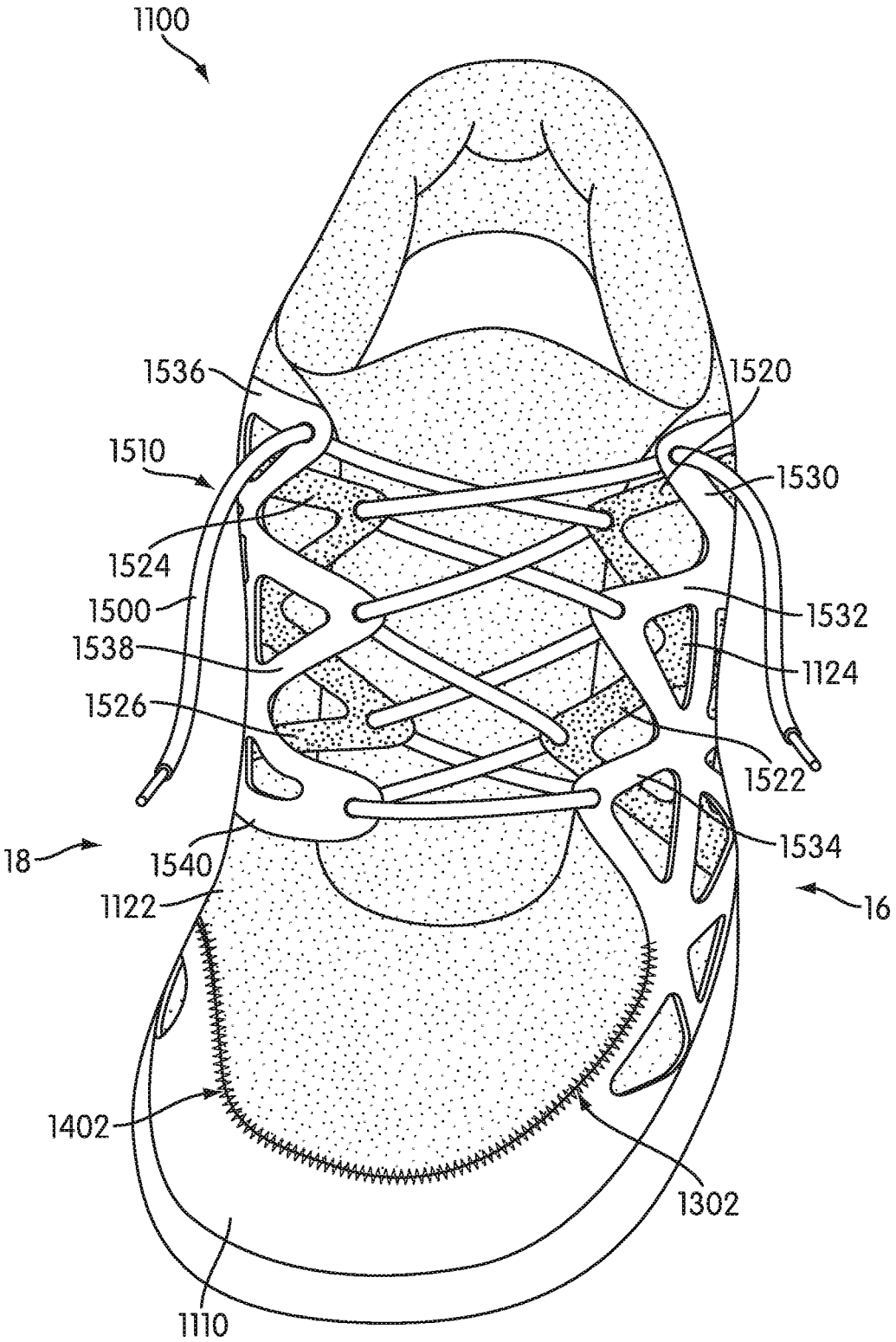
FIG. 17 is a front view of an alternate embodiment of an article of footwear including a decoupled foot stabilizer system.

Referring now to FIG. 17, a front view of alternate exemplary embodiment of article 1100 is illustrated. In some embodiments, one or more portions of foot stabilizer system 1120 and upper 1110 may be releasably attached at one or more regions of article 1100. In one embodiment, portions of foot stabilizer system 1120 and upper 1110 associated with midfoot region 12 of article 1100 may be configured to be releasably attached using a lace 1500. In this embodiment, one or more strap members of strap system 1124 of foot stabilizer system 1120 may be associated with one or more lacing strap members of upper 1110 in a lacing area 1510 of article 1100. With this arrangement, lace 1500 may be run through one or more strap members of strap system 1124 and/or lacing strap members of upper 1110 to releasably attach foot stabilizer system 1120 and upper 1110 at lacing area 1510.

In one embodiment, lacing area 1510 may include alternating strap members associated with each of strap system 1124 and upper 1110. In this embodiment, lacing area 1510 may include a first strap member 1520 and a second strap member 1522 associated with strap system 1124 of foot stabilizer system 1120 on lateral side 16 of article 1100. Lacing area 1510 may also include a first lacing strap member 1530, a second lacing strap member 1532, and/or a third lacing strap member 1534 associated with upper 1110 on lateral side 16 of article 1100. Similarly, medial side 18 may include a third strap member 1524 and a fourth strap member 1526 associated with strap system 1124 of foot stabilizer system 1120 and a fourth lacing strap member 1536, a fifth lacing strap member 1538, and/or a sixth lacing strap member 1540 associated with upper 1110.

Figure 18:
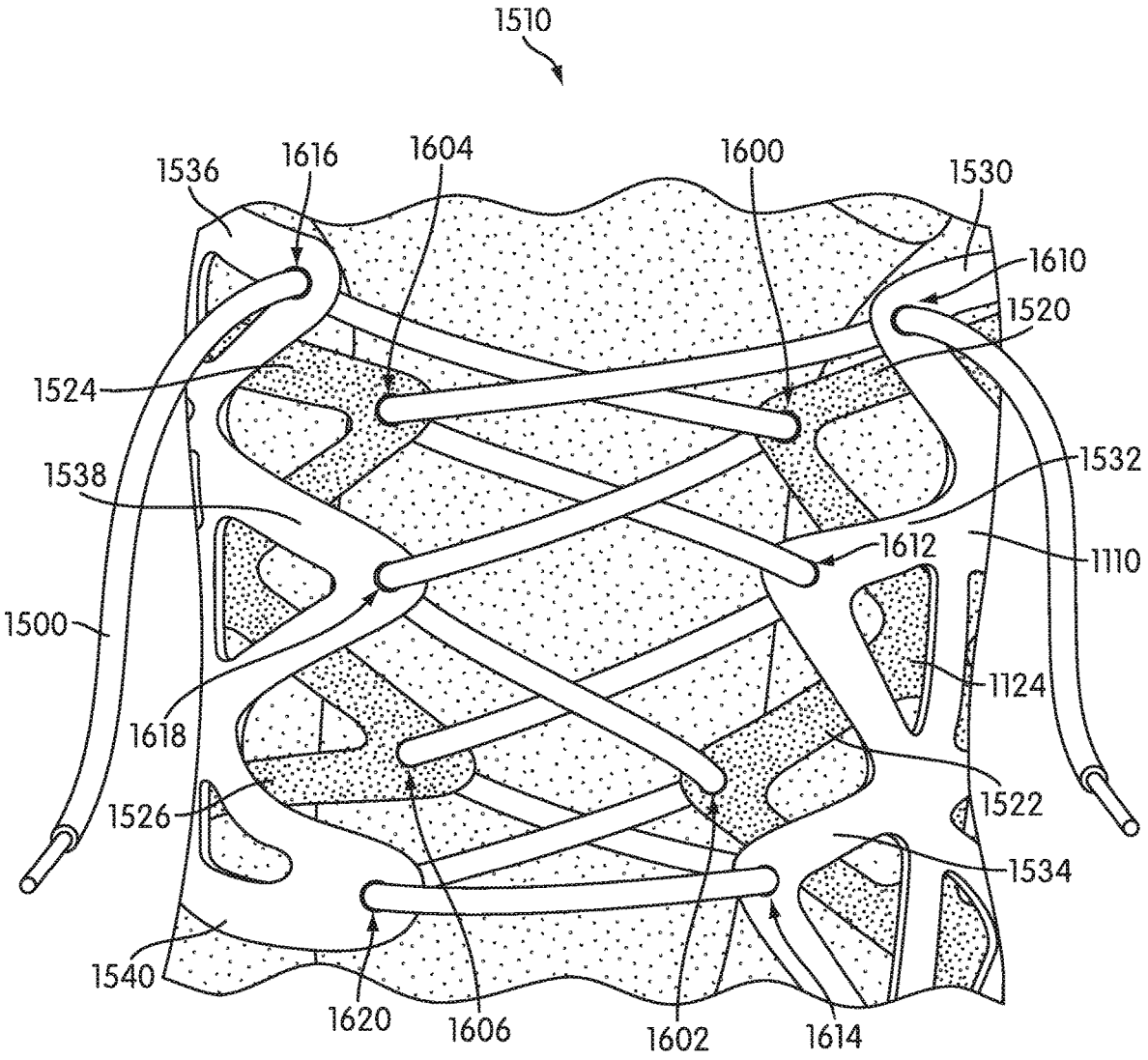
FIG. 18 is a close-up view of a lacing area of an alternate embodiment of an article of footwear including a decoupled foot stabilizer system.

FIG. 18 illustrates a close up view of lacing area 1510. In this embodiment, lace 1500 may be configured to run through lacing holes disposed at the distal ends of the strap members associated with strap system 1124 and the lacing strap members associated with upper 1110. As shown in FIG. 18, first strap member 1520 may include a first lacing hole 1600. Similarly, second strap member 1522, third strap member 1524, and/or fourth strap member 1526 may include, respectively, a second lacing hole 1602, a third lacing hole 1604, and/or a fourth lacing hole 1606. Lacing strap members associated with upper 1110 also may also include a fifth lacing hole 1610 disposed at the distal end of first lacing strap member 1530, a sixth lacing hole 1612 disposed at the distal end of second lacing strap member 1532. In addition, each of third lacing strap member 1534, fourth lacing strap member 1536, fifth lacing strap member 1538, and sixth lacing strap member 1540, may include, respectively, a seventh lacing hole 1614, an eighth lacing hole 1616, a ninth lacing hole 1618, and a tenth lacing hole 1620.

In an exemplary embodiment, foot stabilizer system 1120 may be configured to be releasably attached to upper 1110 at lacing area 1510 by interdigitating lace 1500 through alternating lacing holes associated with each of strap system 1124 and upper 1110. In the current embodiment, starting from the top of lacing area 1510 on medial side 18, lace 1500 alternately runs through eighth lacing hole 1616 associated with fourth lacing strap member 1536, first lacing hole 1600 associated with first strap member 1520, ninth lacing hole 1618 associated with fifth lacing strap member 1538, second lacing hole 1602 associated with second strap member 1522, tenth lacing hole 1620 associated with sixth lacing strap member 1540, and continuing in a similar manner until lace 1500 runs through fifth lacing hole 1610 associated with first lacing strap member 1530 on lateral side 16. It should be understood that the lacing order illustrated in FIG. 18 is merely exemplary and the exact order of alternating lacing holes used to interdigitate foot stabilizer system 1120 and upper 1110 may vary.

Figure 19:
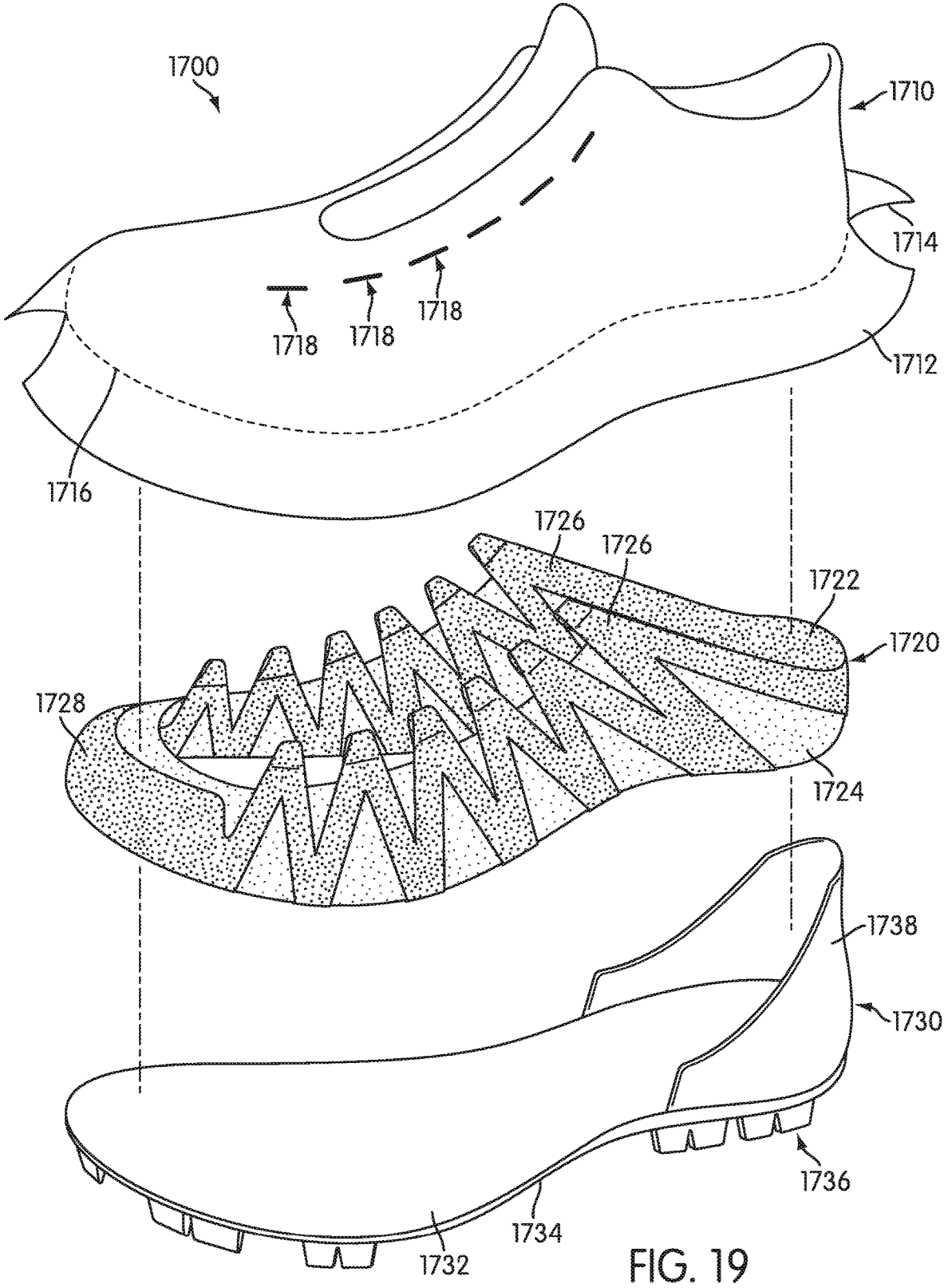
FIG. 19 is an exploded view of an alternate embodiment of an article of footwear including a decoupled foot stabilizer system.

FIGS. 19 through 27 illustrate an alternate exemplary embodiment of an article of footwear including a decoupled foot stabilizer system. In some embodiments, one or more components associated with an article of footwear may be configured for various sports and/or activities. In an exemplary embodiment, an article of footwear including a decoupled foot stabilizer system may be configured for soccer, football, baseball or other sports using footwear with ground-engaging elements. FIG. 19 illustrates an exploded view of an alternate exemplary embodiment of an article of footwear 1700. In this embodiment, article 1700 may include a decoupled foot stabilizer system 1720. In this embodiment, foot stabilizer system 1720 does not include a separate bootie or sock liner component, as included in previous embodiments. It should be understood, however, that foot stabilizer system 1720 may optionally include a bootie and/or sock liner. In one embodiment, foot stabilizer system 1720 may be configured to extend to a height below an ankle of a wearer.

In some embodiments, foot stabilizer system 1720 may include a strap system 1722. In an exemplary embodiment, strap system 1722 may include a plurality of strap members 1726. In an exemplary embodiment, the plurality of strap members 1726 may be configured to provide stability and/or support to foot stabilizer system 1720. In one embodiment, strap members 1726 may have a triangular shape. In an exemplary embodiment, strap members 1726 having a triangular shape may be configured to distribute the load associated with supporting a foot of a wearer. In other embodiments, strap members 1726 may have other shapes, including a substantially similar shape as the plurality of strap members 200 described above.

In an exemplary embodiment, strap members 1726 may be configured to support a foot of a wearer. In one embodiment, strap system 1722 may include a number of the plurality of strap members 1726 on opposite sides. In an exemplary embodiment, the plurality of strap members 1726 may be positioned on a lateral side and a medial side of foot stabilizer system 1720. In the embodiment shown in FIG. 19, foot stabilizer system 1720 may include strap system 1722 having six strap members 1726 disposed on each side of article 1700. In other embodiments, foot stabilizer system 1720 may include strap system 1722 having more or less strap members 1726.

In some embodiments, the plurality of strap members 1726 may be connected to each other using a webbing material 1724. Webbing material 1724 may be substantially similar to webbing 202 described above. As shown in FIG. 19, webbing material 1724 may connect the plurality of strap members 1726 along the sides of foot stabilizer system 1720. In some cases, webbing material 1724 may be disposed between fewer strap members. In other cases, webbing material 1724 may be disposed between two or more strap members on a single side of foot stabilizer system 1720. In different embodiments, webbing material 1724 may be disposed between two or more strap members associated with one or more of forefoot region 10, midfoot region 12, and heel region 14 of article 1700.

In some embodiments, foot stabilizer system 1720 may include components configured to protect and/or provide stability and support to various portions of a foot of a wearer. In some embodiments, foot stabilizer system 1720 may include one or more components associated with the toes of a foot of a wearer. In an exemplary embodiment, strap system 1722 may include a covered toe portion 1728. Covered toe portion 1728 may be disposed in an area of forefoot region 10 that generally corresponds to the toes of a wearer. Covered toe portion 1728 may be shaped to engage and stabilize the front of the wearer's foot including the toes. In some embodiments, covered toe portion 1728 also may be shaped to cover and enclose at least a portion of the wearer's toes. In some embodiments, covered toe portion 1728 may be sized and dimensioned so as to extend a height and a width sufficient to support and/or protect the toes of a wearer. Covered toe portion 1728 may be formed integrally with one or more strap members located on a lateral side and/or a medial side. In some embodiments, covered toe portion 1728 may extend along forefoot region 10 between strap members on opposing sides of strap system 1722. In some cases, covered toe portion 1728 may extend along a portion of an outer periphery of foot stabilizer system 1720. In other cases, covered toe portion 1728 also may extend over a portion of bottom surface of foot stabilizer system 1720 in forefoot region 10.

In some embodiments, foot stabilizer system 1720 may include one or more components associated with the heel of a foot of a wearer. In some embodiments, strap system 1722 may include a heel counter formed by a pair of strap members disposed on either side of foot stabilizer system 1720. In an exemplary embodiment, the heel counter may be substantially similar to heel counter 204 disclosed above.

In some embodiments, article 1700 may include an upper 1710. Generally, upper 1710 provides a covering for the foot that comfortably receives and securely positions the foot with respect to a sole structure 1730. In some embodiments, one or more portions of upper 1710 may be configured to fold under the top of upper 1710 to provide a surface for attaching to sole structure 1730. In exemplary embodiment, upper 1710 may be provided with extra material on a medial side and a lateral side for forming a bottom surface to be secured to sole structure 1730. In one embodiment, upper 1710 may include a first folding portion 1712 and a second folding portion 1714 located at the bottom of opposing sides of upper 1710. In this embodiment, each of first folding portion 1712 and second folding portion 1714 may be folded along an outer periphery 1716 of upper 1710 to form a bottom surface and enclose upper 1710.

In some embodiments, upper 1710 may include a plurality of openings 1718 for receiving the distal ends of the plurality of strap members 1726. In some embodiments, lacing holes associated with the distal ends of the plurality of strap members 1726 of foot stabilizer system 1720 may extend out from the interior of article of footwear 1700 through the plurality of openings 1718 in upper 1710. In an exemplary embodiment, the plurality of openings 1718 may include slits. In other embodiments, the plurality of openings 1718 may be any type of opening in upper 1710 that allows the plurality of strap members 1726 to extend out from the interior of article 1700.

In some embodiments, article 1700 may include sole structure 1730. Sole structure 1730 may be generally positioned between a foot of a wearer and the ground. In some embodiments, sole structure 1730 may include one or more of an outsole, a midsole, a single piece sole, and/or any number of additional components associated with a conventional sole. In other embodiments, sole structure 1730 may include one or more tread elements for engaging with the ground. In some embodiments, sole structure 1730 may include one or more components. In one embodiment, sole structure 1730 may include an outsole 1734. Outsole 1734 may be any conventional outsole used with an article of footwear. In an exemplary embodiment, outsole 1734 of sole structure 1730 may include one or more tread elements 1736 for engaging with the ground. Tread elements 1736 may be any conventional tread elements used with an article of footwear, including, but not limited to a cleat. In other embodiments, sole structure 1730 may not include tread elements 1736. While FIGS. 19 through 27 illustrate sole structure 1730 having one or more tread elements, including a cleat, it should be understood that article 1700 may include sole structure 1730 as described herein without limitation to any specific type of tread element.

In some embodiments, sole structure 1730 may optionally include a heel cup 1738. In an exemplary embodiment, heel cup 1738 may be made of a rigid material to firmly support the heel of a foot of a wearer.

Figure 20:
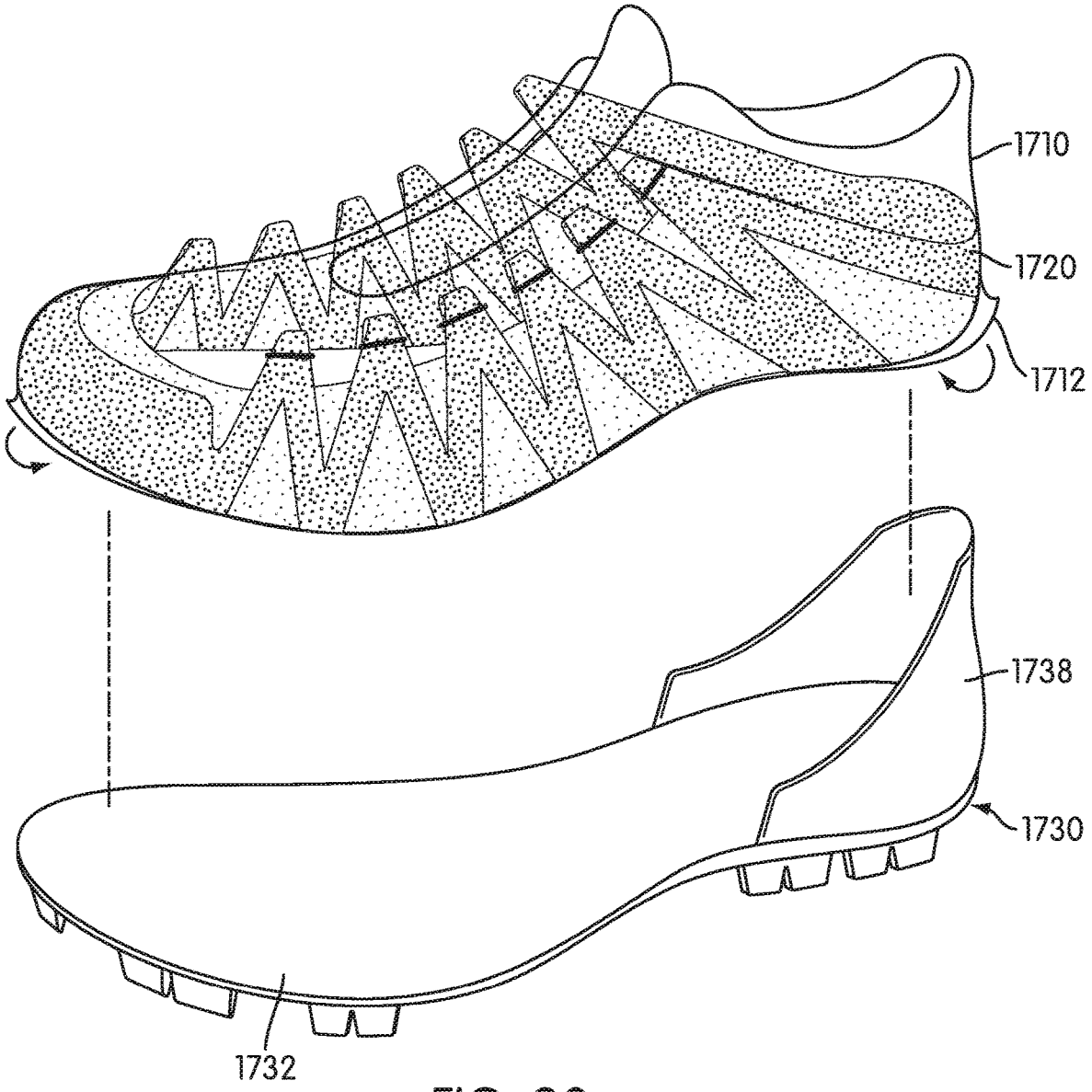
FIG. 20 is an exploded view of an alternate embodiment of an article of footwear including a decoupled foot stabilizer system showing folding of an upper to form a base portion.

Referring now to FIG. 20, in this embodiment, first folding portion 1712 and second folding portion 1714 of upper 1710 may be folded under article 1700 so as to enclose foot stabilizer system 1720 within the interior of upper 1710. In some embodiments, first folding portion 1712 and second folding portion 1714 of upper 1710 may be attached underneath upper 1710 to form a bottom surface. With this arrangement, the bottom surface may serve a substantially similar function as base portion 130 and/or base portion 1130, described above. In an exemplary embodiment, bottom surface formed by first folding portion 1712 and second folding portion 1714 may be secured to a top surface 1732 of sole structure 1730. In different embodiments, bottom surface of upper 1710 may include one or more of a midsole and/or strobel, as described above.

Figure 21:
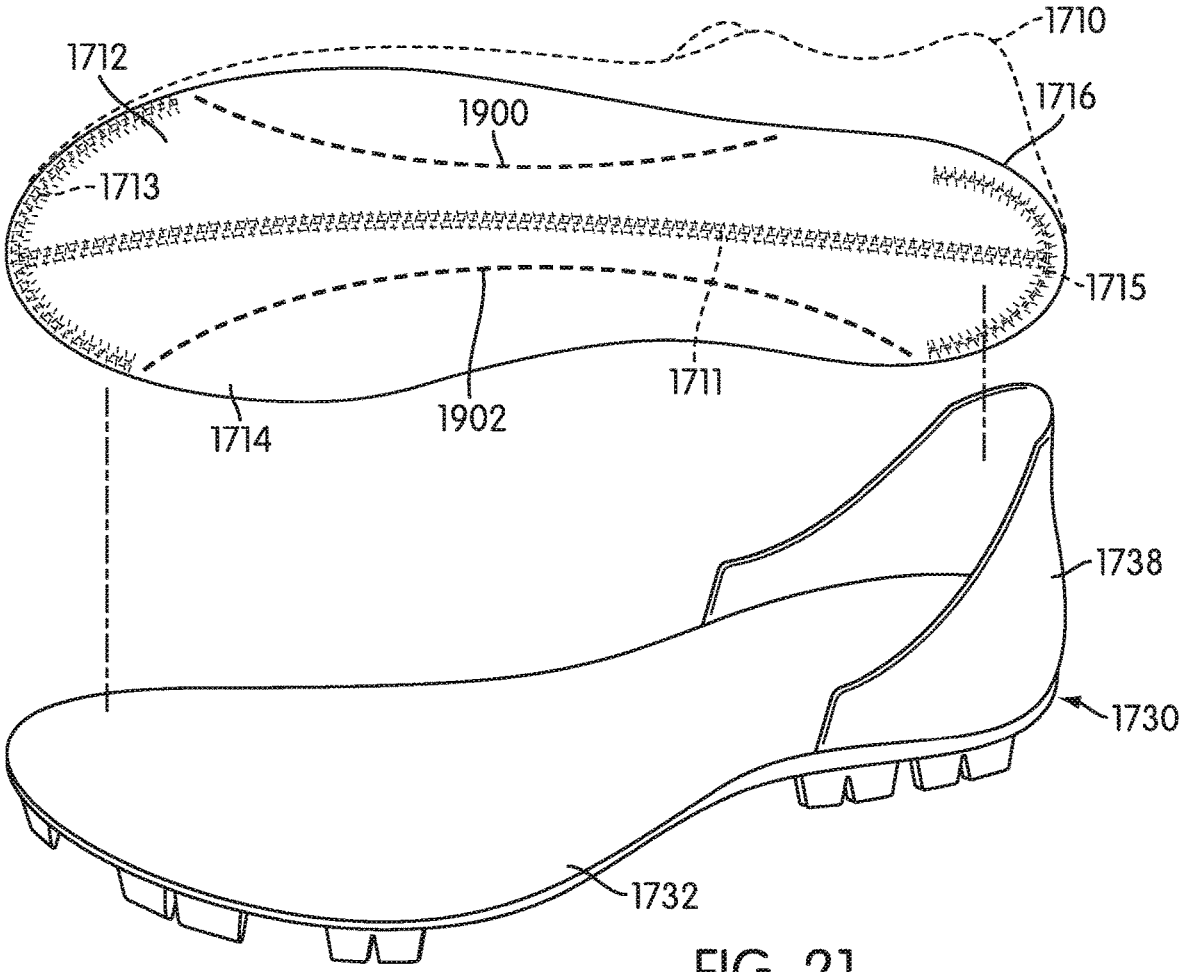
FIG. 21 is an exploded view of an alternate embodiment of a decoupled foot stabilizer system attached to a base portion.

FIG. 21 illustrates an exploded view of the bottom surface of upper 1710. In some embodiments, first folding portion 1712 and second folding portion 1714 of upper 1710 may be joined along a center seam 1711 to form the bottom surface. Similarly, first folding portion 1712 and second folding portion 1714 may also be joined along a toe seam 1713 and a heel seam 1715. Using center seam 1711, toe seam 1713, and/or heel seam 1715, first folding portion 1712 and second folding portion 1714 may enclose upper 1710 around foot stabilizer system 1720. With this arrangement, the bottom surface may serve a substantially similar function as base portion 130 and/or base portion 1130, described above. Bottom surface of upper 1710 may be generally positioned between the foot of a wearer and sole structure 1730. In some embodiments, the bottom surface of upper 1710 may be secured to a top surface 1732 of sole structure 1730.

In some embodiments, bottom surface of upper 1710 may be disposed between foot stabilizer system 1720 and sole structure 1730. In one embodiment, foot stabilizer system 1720 may be secured to bottom surface of upper 1710. In an exemplary embodiment, foot stabilizer system 1720 may be secured to bottom surface of upper 1710 in a manner such that foot stabilizer system 1720 is selectively decoupled from one or more portions of article 1700. In different embodiments, foot stabilizer system 1720 may be decoupled from bottom surface of upper 1710 using various attachment portions as described herein.

In an exemplary embodiment, foot stabilizer system 1720 may be secured to bottom surface of upper 1710 using a horseshoe shaped attachment area. As shown in FIG. 21, a horseshoe shaped attachment area may be defined by a first horseshoe attachment portion 1900 on a lateral side and a second horseshoe attachment portion 1902 on a medial side. In this embodiment, first horseshoe attachment portion 1900 and second horseshoe attachment portion 1902 may selectively decouple portions of foot stabilizer system 1720 from bottom surface of upper 1710. In one embodiment, each of first horseshoe attachment portion 1900 and/or second horseshoe attachment portion 1902 may start and terminate adjacent to outer periphery 1716 of upper 1710. In an exemplary embodiment, first horseshoe attachment portion 1900 and/or second horseshoe attachment portion 1902 may start and terminate adjacent to outer periphery 1716 associated with forefoot region 10 and/or heel region 14. As first horseshoe attachment portion 1900 and/or second horseshoe attachment portion 1902 extends through midfoot region 12, each of first horseshoe attachment portion 1900 and/or second horseshoe attachment portion 1902 is located closer to center seam 1711. With this arrangement, foot stabilizer system 1720 may be selectively decoupled from article 1700 at midfoot region 12.

Figure 22:
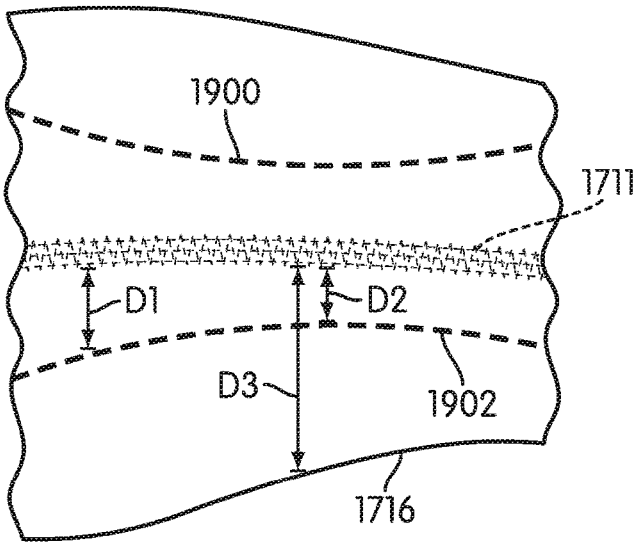
FIG. 22 is a close-up view of a decoupled foot stabilizer system attached to a base portion.

FIG. 22 illustrates a close up view of the horseshoe shaped attachment area of FIG. 21. In this embodiment, second horseshoe attachment portion 1902 may be located a first distance D1 from center seam 1711 at a location adjacent to forefoot region 10. In an exemplary embodiment, second horseshoe attachment portion 1902 at center of midfoot region 12 may be located a second distance D2 from center seam 1711. In this embodiment, second distance D2 may be smaller than first distance D1. Additionally, as shown in this embodiment, outer periphery 1716 may be located a third distance D3 from center seam 1711. In an exemplary embodiment, second distance D2 may be substantially smaller than third distance D3. In one embodiment, first distance D1 also may be substantially smaller than third distance D3. With this arrangement, foot stabilizer system 1720 may be selectively decoupled from article 1700 at widths corresponding to the difference between third distance D3 associated with bottom surface of upper 1711 and each of first distance D1 and second distance D2 associated with the horseshoe shaped attachment area of foot stabilizer system 1720. It should be understood that a corresponding arrangement may be provided with regard to first horseshoe attachment portion 1900.

Figure 23:
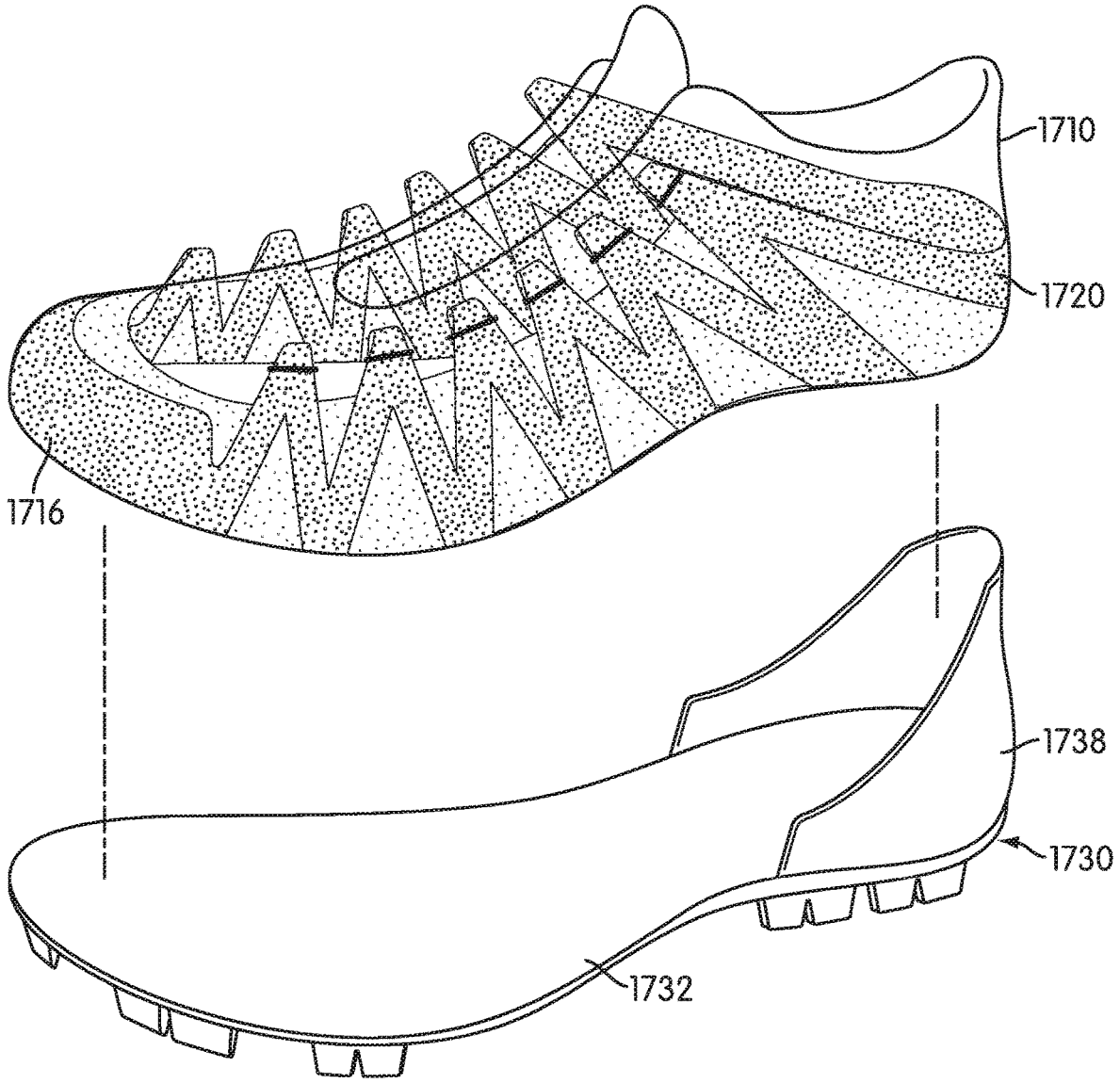
FIG. 23 is an exploded view of an alternate embodiment of an article of footwear including a decoupled foot stabilizer system.

Referring now to FIG. 23, foot stabilizer system 1720 is illustrated selectively decoupled from upper 1710. In some embodiments, bottom surface of upper 1710 may be secured to top surface 1732 of sole structure 1730. Top surface 1732 may be configured to attach bottom surface to sole structure 1730 using adhesive. In other embodiments, bottom surface of upper 1710 may be attached to top surface 1732 of sole structure 1730 using any suitable attachment mechanism, including, but not limited to one or more of adhesive, heat, pressure, stitching, and other methods of attachment.

Figure 24:
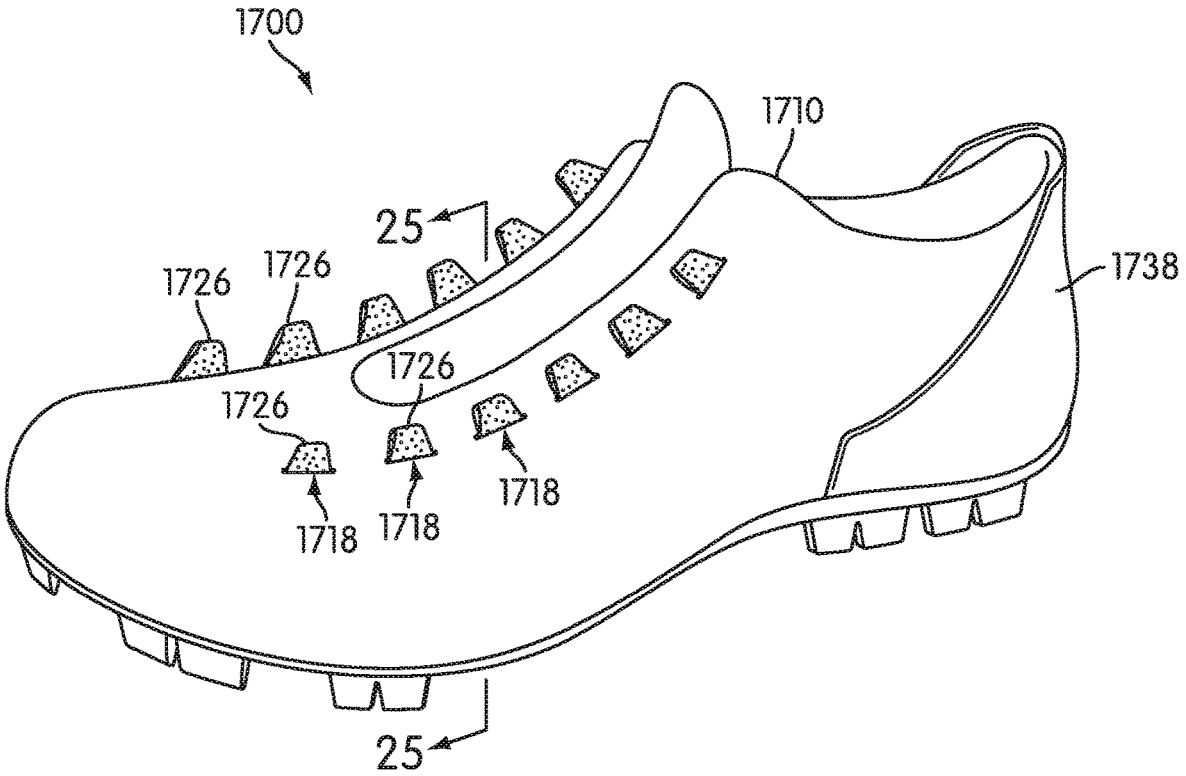
FIG. 24 is an isometric view of an alternate embodiment of an article of footwear including a decoupled foot stabilizer system.

FIG. 24 illustrates an assembled alternate exemplary embodiment of article 1700 including decoupled foot stabilizer system 1720. In this embodiment, the plurality of strap members 1726 may extend out from interior of article 1700 through openings 1718 in upper 1710. In some embodiments, each plurality of strap members 1726 may include a lacing hole at the distal end for receiving a lace. In this exemplary embodiment, the lacing hole is a tab formed by attaching a folded over end of the strap member to itself. In different embodiments, the plurality of strap members may include lacing holes as discussed above.

In some embodiments, article of footwear 1700 may include a lace (not shown). In some embodiments, lace may run through a plurality of tabs at the distal ends of the plurality of strap members 1726 extending out through the openings 1718 in upper 1710. In an exemplary embodiment, the lace allows article of footwear 1700 to tighten around the foot of a wearer. In other embodiments, the lace may allow one or more of the plurality of strap members 1726 to conform foot stabilizer system 1720 to a portion of the wearer's foot. In different embodiments, a lace may be used as described above to tighten foot stabilizer system 1720 against a foot of a wearer.

Figure 25:
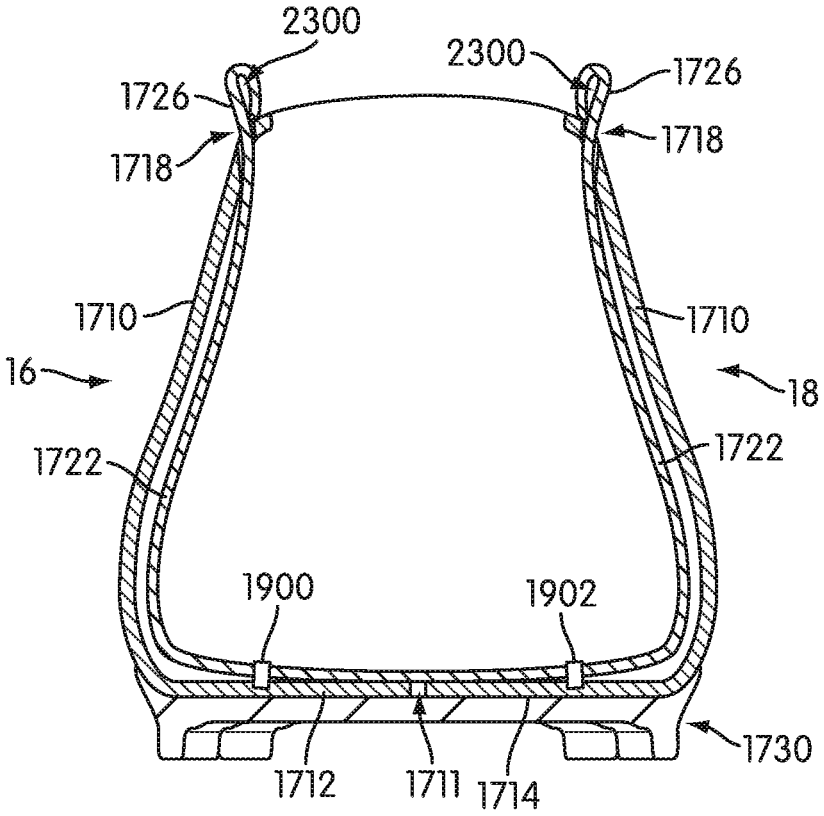
FIG. 25 is a cross-sectional view of an alternate embodiment of an article of footwear including a decoupled foot stabilizer system.
Figure 26:
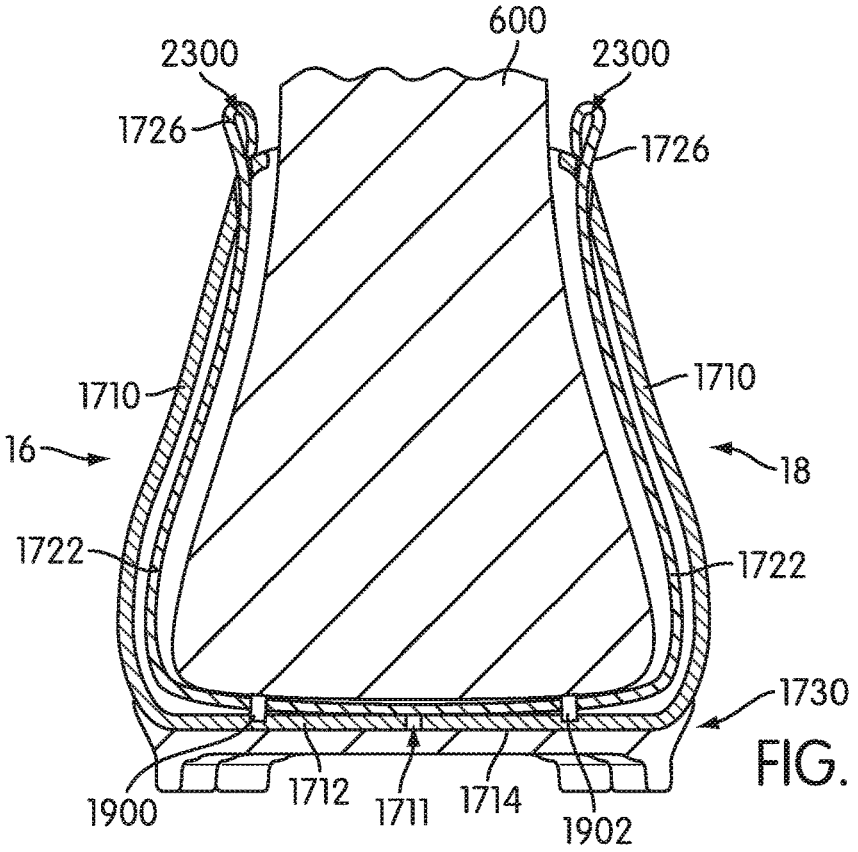
FIG. 26 is a cross-sectional view of an alternate embodiment of an article of including a decoupled foot stabilizer system with a foot disposed within.
Figure 27:
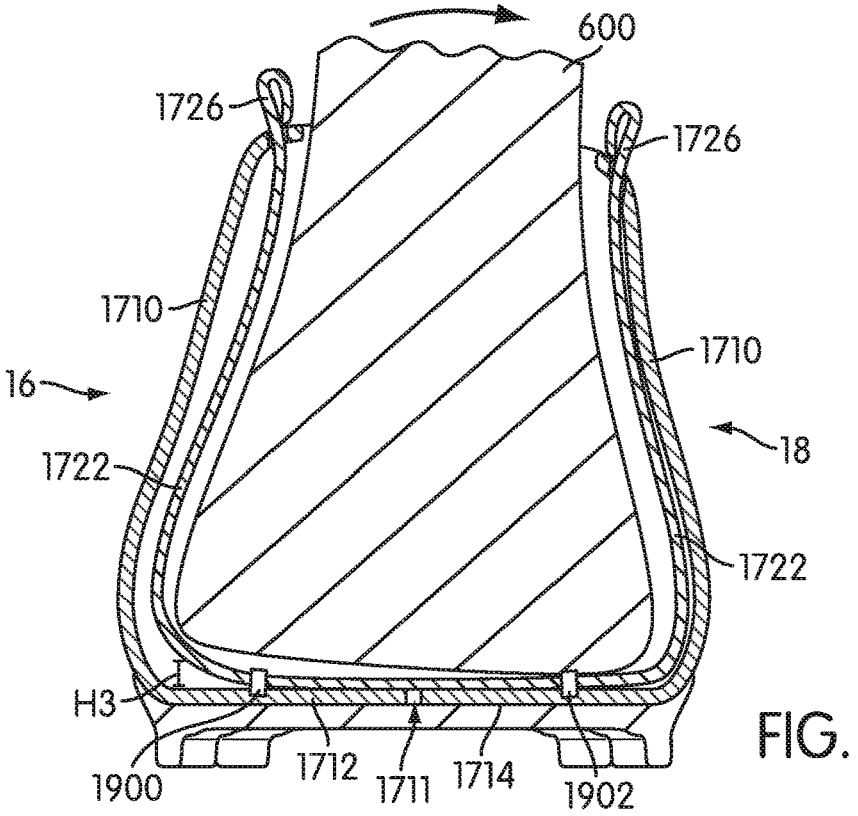
FIG. 27 is a cross-sectional view of an alternate embodiment of an article of including a decoupled foot stabilizer system with a foot disposed within applying a lateral force.

FIGS. 25 through 27 illustrate cross-sectional views of an alternate exemplary embodiment of article of footwear 1700 incorporating decoupled foot stabilizer system 1720. As shown in FIG. 25, strap system 1722 of foot stabilizer system 1720 may be disposed within the interior of upper 1710. In this embodiment, the plurality of strap members 1726 on opposing sides of article 1700 are disposed within the interior of upper 1710. In some embodiments, the plurality of strap members 1726 may extend out from the interior of upper 1710 through openings 1718. Additionally, the distal ends of the plurality of strap members 1726 may be associated with tabs 2300 formed by attaching a folded over end of each of the plurality of strap members 1726 to itself. In an exemplary embodiment, tabs 2300 may be configured to receive a lace for tightening article 1700.

In some embodiments, strap system 1722 of foot stabilizer system 1720 may be attached to a bottom surface formed by first folding portion 1712 and second folding portion 1714 of upper 1710 joined along a center seam 1711. In this embodiment, foot stabilizer system 1720, including strap system 1722 and the plurality of strap members 1726, may be secured to bottom surface along a horseshoe shaped attachment area formed by first horseshoe attachment portion 1900 and second horseshoe attachment portion 1902, as described above. In this embodiment, first horseshoe attachment portion 1900 extends through strap system 1722 and first folding portion 1712 of upper 1710 forming part of bottom surface. Similarly, second horseshoe attachment portion 1902 extends through strap system 1722 and second folding portion 1714 of upper 1710 forming part of bottom surface. In different embodiments, other attachment areas and/or attachment portions may be included to secure foot stabilizer system 1720 to a bottom surface of upper 1710 or a base portion, as described herein. In an exemplary embodiment, bottom surface of upper 1710 may be secured to sole structure 1730. In some cases, sole structure 1730 may include one or more of an insole, midsole, and/or outsole.

Referring now to FIG. 26, a cross-sectional view of an exemplary embodiment of article of footwear 1700 including decoupled foot stabilizer system 1720 is shown with foot 600 of a wearer disposed within. In some embodiments, foot stabilizer system 1720 may have one or more of the plurality of strap members 1726 that surround and substantially conform to the shape of foot 600. In an exemplary embodiment, foot stabilizer system 1720 may be decoupled from bottom surface of upper 1710 at midfoot region 12. In different embodiments, various portions of foot stabilizer system 1720 may be decoupled from bottom surface of upper 1710 in one or more of forefoot region 10, midfoot region 12, and/or heel region 14.

As shown in FIG. 26, the decoupling of foot stabilizer system 1720 from bottom surface of upper 1710 at midfoot region 12 may allow foot 600 to have a degree of freedom of motion relative to article 1700. In some cases, the decoupling of foot stabilizer system 1720 may assist a wearer with a change in the direction of travel, including by "cutting" quickly to one side. For example, a wearer may cut to the right by pushing hard on his left foot.

FIG. 27 illustrates a cross-sectional view of the exemplary embodiment of FIG. 26 in the case where a wearer is making a cutting move. In this exemplary embodiment, foot stabilizer system 1720 is decoupled from bottom surface of upper 1710 at midfoot region 12. In this embodiment, the plurality of strap members 1726 on opposing sides of article 1700 may stabilize foot 600 within upper 1710 during lateral movements. With this configuration, foot 600 may rotate inward toward medial side 18 when a wearer makes a cut to his right. This same type of action may result from weight transfer on the feet during the course of a golf swing.

As shown in FIG. 27, foot stabilizer system 1720 may allow foot 600 to have freedom of motion to rotate toward medial side 18, while keeping sole structure 1730 of article 1700 in contact with the ground. In an exemplary embodiment, horseshoe shaped attachment area formed by first horseshoe attachment portion 1900 and second horseshoe attachment portion 1902 may provide decoupling to foot stabilizer system 1720 such that foot stabilizer system 1720 may move a third height H3 relative to interior of article 1700 when a wearer makes a lateral cutting move. In various embodiments, third height H3 may be larger or smaller in correspondence to the proximity of the attachment area to the outer periphery of article 1700. In this embodiment, third height H3 may be smaller than other embodiments of attachment areas with a narrower width, including central attachment portion 131, as described above. In addition, in some cases, third height H3 may be larger than other embodiments where wider attachment areas are used to secure a foot stabilizer system.

In other embodiments, one or more portions of foot stabilizer system 1720 may provide additional stability for making lateral movements. In some cases, covered toe portion 1728 may provide support to foot 600 of a wearer during cutting movements. In other cases, foot stabilizer system 120 and/or one or more of a raised toe portion and/or a heel counter, as described above, may provide stability to foot 600 during other movements, including, but not limited to: moving in a forward or rearward direction, running, jumping and other athletic movements.

Figure 28:
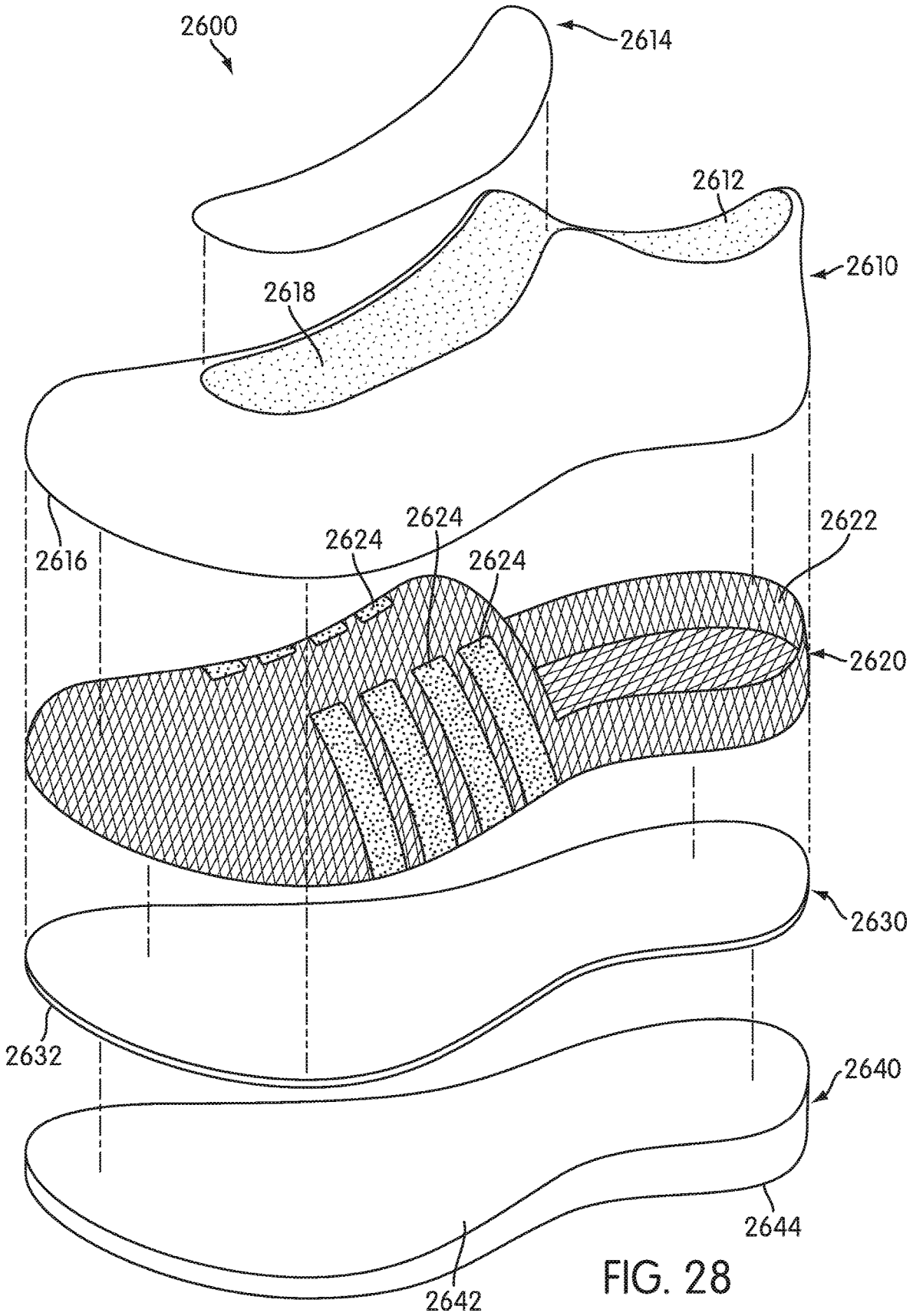
FIG. 28 is an exploded view of an alternate embodiment of an article of footwear including a decoupled foot stabilizer system.

FIGS. 28 through 35 illustrate an alternate exemplary embodiment of an article of footwear including a decoupled foot stabilizer system. In some embodiments, a foot stabilizer system may be configured for various sports and/or activities. In an exemplary embodiment, an article of footwear may include a decoupled foot stabilizer system that may be configured for tennis or other sports involving frequent lateral movements. FIG. 28 illustrates an exploded view of an alternate exemplary embodiment of an article of footwear 2600. In this embodiment, article 2600 may include a decoupled foot stabilizer system 2620. In this embodiment, foot stabilizer system 2620 includes a partial bootie or sock liner 2622. It should be understood, however, that foot stabilizer system 2620 may optionally include a bootie and/or sock liner as described in previous embodiments, or may omit any bootie or sock liner component. In one embodiment, foot stabilizer system 2620 may include a partial bootie 2622 configured to extend over the top of a foot and/or the toes of a wearer, while leaving an ankle of a wearer exposed. In other embodiments, partial bootie 2622 may extend over only a portion of a wearer's foot and may leave exposed one or more of the toes, heel, ankle, and any other part of a wearer's foot.

In an exemplary embodiment, partial bootie 2622 may be made from an elastic mesh material. In one exemplary embodiment, partial bootie 2622 may be made of an opaque or semi-transparent material. In another embodiment, partial bootie 2622 may be made of a lightweight material. In some cases, partial bootie 2622 may be made of a netting material. In different embodiments, partial bootie 2622 may be made from any one or a combination of elastic or stretchable materials, including, but not limited to: woven synthetic fibers, polyurethane, nylon, cotton, spandex, neoprene, and other natural and synthetic materials. In other embodiments, partial bootie 2622 may be made of any material used for any upper, bootie, and/or sock liner described herein.

In some embodiments, foot stabilizer system 2620 may be disposed in any one or more of forefoot region 10, midfoot region 12, and/or heel region 14 of a foot of a wearer. In an exemplary embodiment, foot stabilizer system 2620 may be disposed in only one region and/or a portion of one region. In the current embodiment, foot stabilizer system 2620 may be disposed in midfoot region 12. With this arrangement foot stabilizer system 2620 may be configured to provide support and/or stability to an arch of a foot of a wearer. In some embodiments, foot stabilizer system 2620 may include a strap system. In various embodiments, the strap system may include any strap system described herein. In an exemplary embodiment, the strap system may include a plurality of strap members 2624. In one embodiment, the plurality of strap members 2624 may include woven textile straps. In other embodiments, the plurality of strap members 2624 may include any strap member of a type and/or material described herein. In an exemplary embodiment, the plurality of strap members 2624 may be configured to distribute the load associated with supporting a foot of a wearer.

In an exemplary embodiment, the plurality of strap members 2624 may be configured to support an arch of a foot of a wearer. In one embodiment, the plurality of strap members 2624 may be disposed on opposite sides of partial bootie 2622. In an exemplary embodiment, the plurality of strap members 2624 may be positioned on a lateral side and a medial side of foot stabilizer system 2620. In the embodiment shown in FIG. 28, foot stabilizer system 2620 may include four strap members 2624 disposed on each side of article 2600. In other embodiments, foot stabilizer system 2620 may include foot stabilizer system 2620 having more or less strap members 2624. In addition, while in the current embodiment, the plurality of strap members 2624 are shown without any connecting material between each of the strap members, it should be understood that in other embodiments, the plurality of strap members 2624 may be connected to each other using a webbing material that may be substantially similar to webbing 202 described above.

Additionally, in various embodiments, foot stabilizer system 2620 may optionally include one or more additional components associated with previous embodiments of a foot stabilizer system, including, but not limited to one or more of a raised toe portion, a covered toe portion, and/or a heel counter, as described above.

In some embodiments, article 2600 may include an upper 2610. Generally, upper 2610 provides a covering for the foot that comfortably receives and securely positions the foot with respect to a sole structure 2640. In some embodiments, upper 2610 may include one or more components. Typically, upper 2610 may be configured to receive a foot of a wearer. In some embodiments, upper 2610 may include an entry hole or throat opening configured to receive a foot of a wearer. With this arrangement, entry hole or throat opening may allow a foot to be inserted into an interior of article 2600.

In an exemplary embodiment, upper 2610 also may include a tongue area 2618. In this embodiment, tongue area 2618 may include a portion of upper 2610 that may be tightened around a foot of a wearer. In some embodiments, tongue area 2618 may include opposing sides of upper 2610 that may be pulled together using laces. In some cases, tongue area 2618 may include a tongue 2614. In an exemplary embodiment, tongue 2614 may be attached to upper 2610 at tongue area 2618, as described below. In other embodiments, tongue 2614 may be attached to upper 2610 in a manner as described in previous embodiments. In other cases, tongue area 2618 may include an elastic or stretchable region of upper 2610.

In some embodiments, article 2600 may include sole structure 2640. Sole structure 2640 may be generally positioned between a foot of a wearer and the ground. In some embodiments, sole structure 2640 may include one or more of an outsole, a midsole, a single piece sole, and/or any number of additional components associated with a conventional sole. In an exemplary embodiment, sole structure 2640 may include a cushioned sole structure for engaging with the ground. It should be understood, however, that article 2600 may include any type of sole structure 2640. Additionally, sole structure 2640 may optionally include one or more tread elements as described herein or known in the art.

Figure 29:
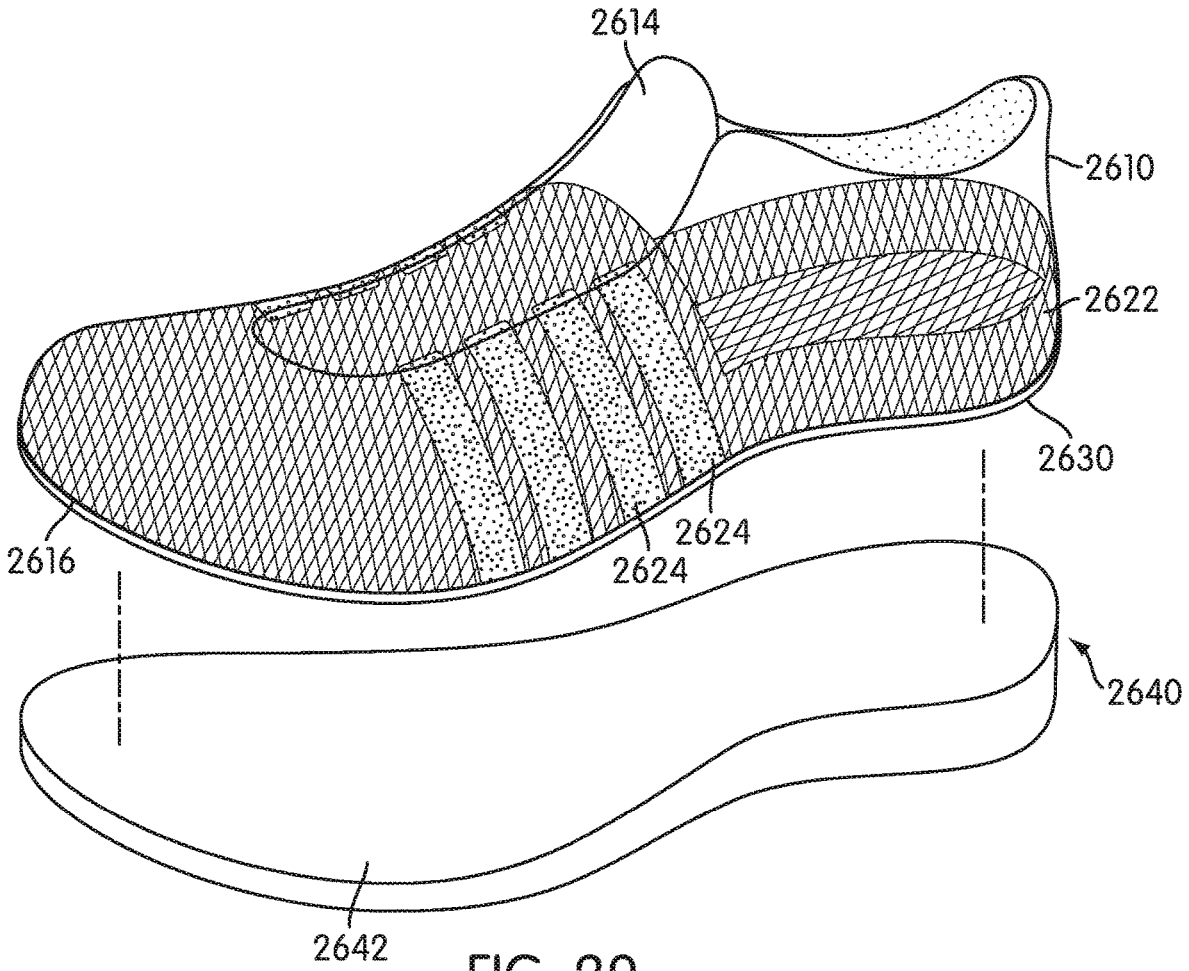
FIG. 29 is an exploded view of an alternate embodiment of an article of footwear including a decoupled foot stabilizer system attached to a base portion.

In some embodiments, article 2600 may include a base portion 2630. Base portion 2630 may be generally positioned between the foot of a wearer and sole structure 2640. In some embodiments, upper 2610 may be configured to be secured to base portion 2630. In an exemplary embodiment, base portion 2630 may be secured to a lower portion of upper 2610. In this embodiment, upper 2610 may be attached to base portion 2630 so as to enclose foot stabilizer system 2620 in the interior of article 2600, as shown in FIG. 29. In some cases, upper 2610 and base portion 2630 may be attached by stitching. In one embodiment, a lower periphery 2616 of upper 2610 may be strobel stitched to an outer periphery 2632 of base portion 2630. In other embodiments, other types of stitching may be used to attach upper 2610 and base portion 2630. In other cases, upper 2610 and base portion 2630 may be secured using other attachment mechanisms, including, but not limited to: adhesive, heat bonding, pressure, and any other method of attachment. In other embodiments, more or less of upper 2610 may be secured to base portion 2630.

In some embodiments, base portion 2630 may be configured to be secured to sole structure 2640. In an exemplary embodiment, base portion 2630 may be secured to an upper portion of sole structure 2640. In this embodiment, base portion 2630 may be secured to a top surface 2642 of sole structure 2640. In different embodiments, base portion 2630 may include one or more of a midsole, strobel, and/or a portion of upper 2610 that is configured to be attached to sole structure 2640. In an exemplary embodiment, top surface 2642 may be configured to attach base portion 2630 to sole structure 2640 using adhesive. In other embodiments, base portion 2630 may be attached to top surface 2642 of sole structure 2640 using any suitable attachment mechanism, including, but not limited to one or more of adhesive, heat, pressure, stitching, and other methods of attachment.

In some embodiments, base portion 2630 may be disposed between foot stabilizer system 2620 and sole structure 2640. As shown in FIG. 29, in one embodiment, foot stabilizer system 2620 may be secured to base portion 2630. In an exemplary embodiment, foot stabilizer system 2620 may be secured to base portion 2630 in a manner such that foot stabilizer system 2620 is selectively decoupled from one or more portions of article 2600. In different embodiments, foot stabilizer system 2620 may be decoupled from base portion 2630 using various attachment portions as described herein. In one embodiment, foot stabilizer system 2620 may be attached to base portion 2630 using an hourglass shaped attachment portion, as described below. In other embodiments, foot stabilizer system 2620 may be attached to base portion 2630 using a similar arrangement as described in any of the previous embodiments.

Figure 30:
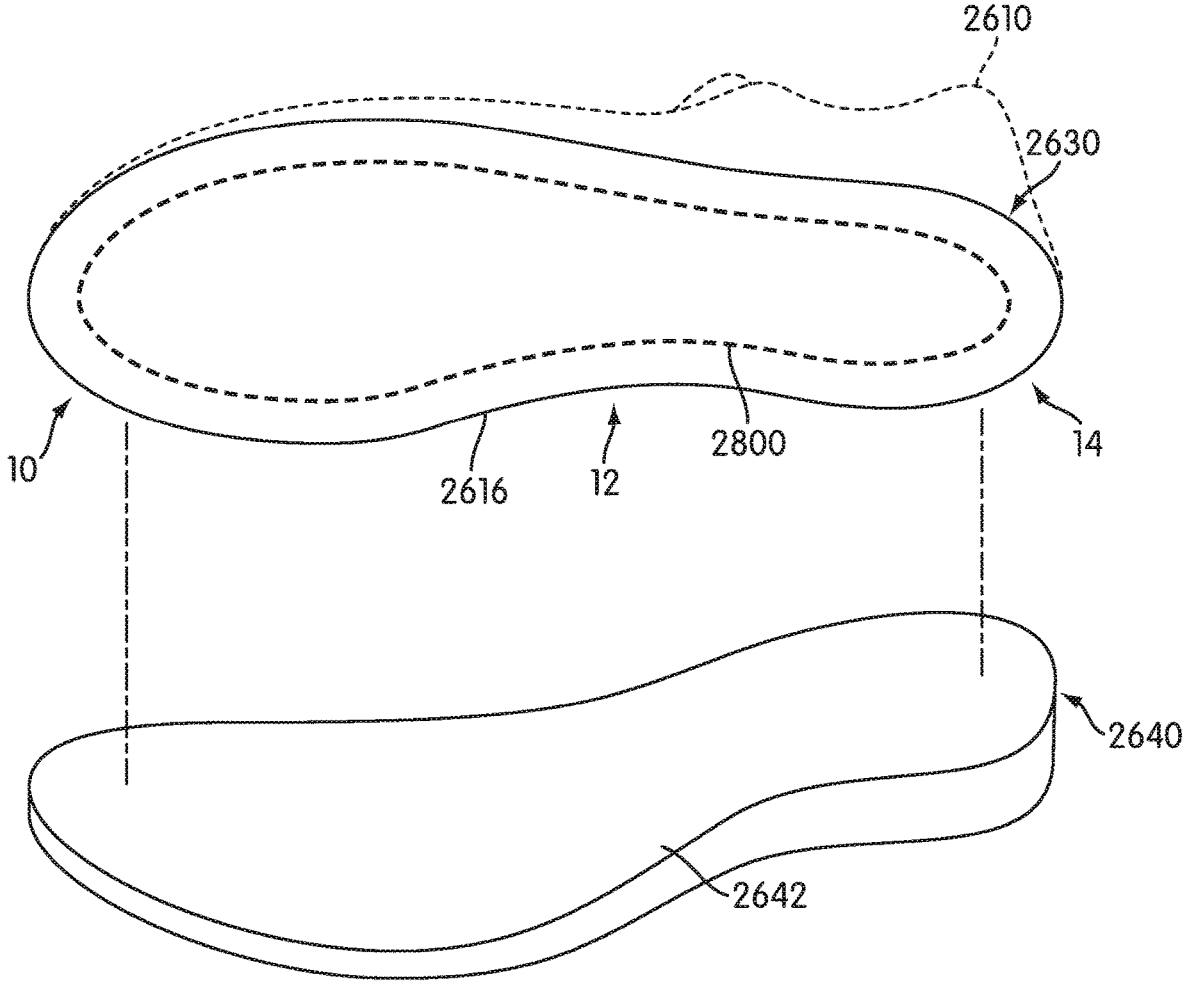
FIG. 30 is an exploded view of an alternate embodiment of a decoupled foot stabilizer system attached to a base portion.

FIG. 30 illustrates an exploded view of article 2600 including an underside of base portion 2630. In some embodiments, foot stabilizer system 2620 may be secured to base portion 2630 in a manner such that foot stabilizer system 2620 is selectively decoupled from one or more portions of article 2600. In different embodiments, foot stabilizer system 2620 may be decoupled from base portion 2630 using various attachment portions as described herein.

In an exemplary embodiment, foot stabilizer system 2620 may be secured to base portion 2630 using an hourglass shaped attachment area. As shown in FIG. 30, an hourglass shaped attachment area may be defined by an hourglass attachment portion 2800 extending around a perimeter of base portion 2300. In this embodiment, hourglass attachment portion 2800 may selectively decouple portions of foot stabilizer system 2620 from base portion 2630. In one embodiment, hourglass attachment portion 2800 may extend around the perimeter of base portion 2630 at a distance less than the outer periphery 2616 of upper 2610. Additionally, hourglass attachment portion 2800 extends through midfoot region 12, hourglass attachment portion 2800 may become narrower, such that in this region hourglass attachment portion 2800 is located farther from outer periphery 2616. With this arrangement, foot stabilizer system 2620 may be selectively decoupled from article 2600 at midfoot region 12.

Figure 31:
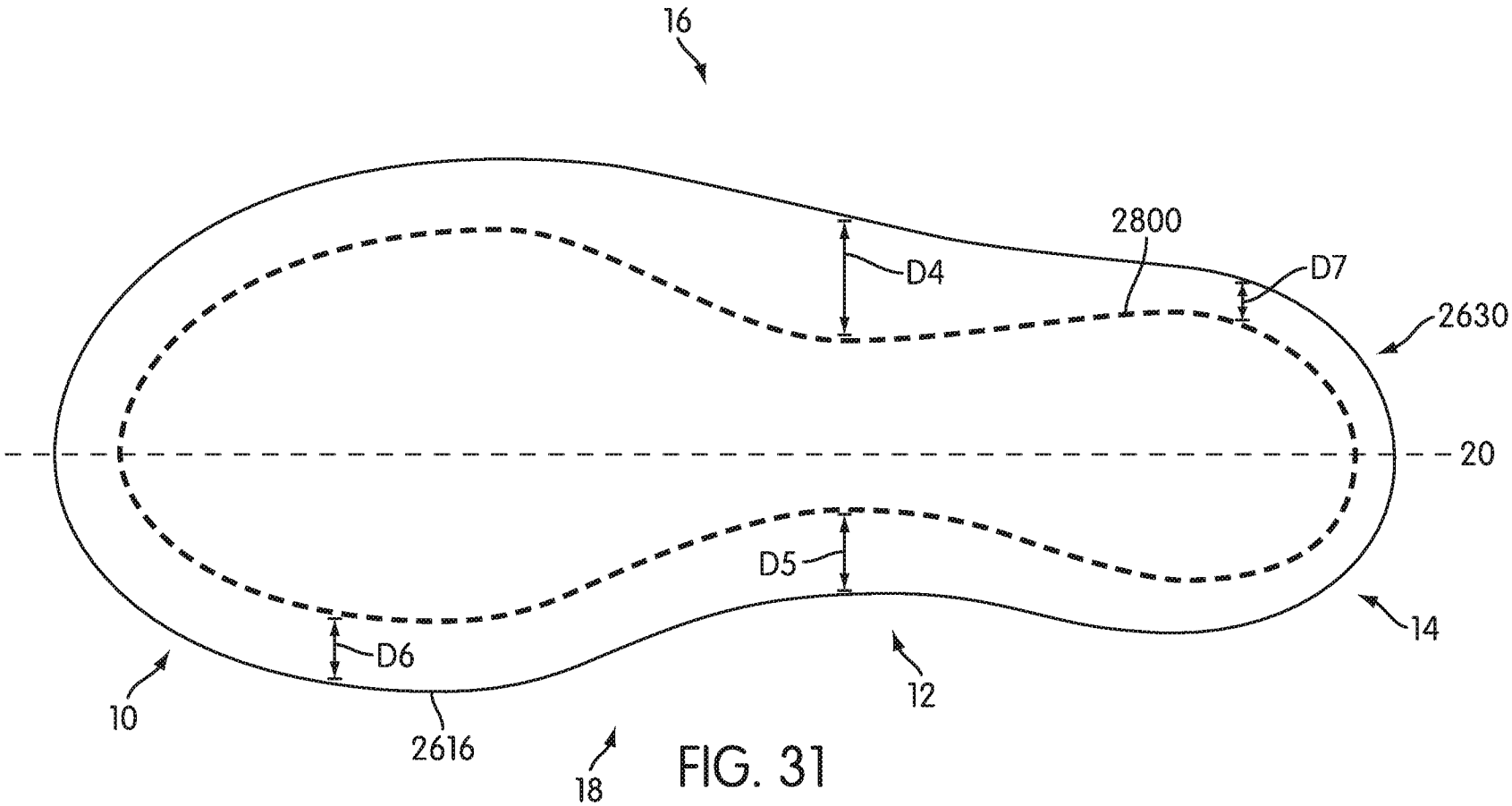
FIG. 31 is a bottom view of a decoupled foot stabilizer system attached to a base portion.

FIG. 31 illustrates a plan view of the hourglass shaped attachment area of FIG. 30. In some embodiments, foot stabilizer system 2620 may be selectively decoupled from a portion of article 2600 in one or more regions using an hourglass attachment area to secure foot stabilizer system 2620 to base portion 2630. In an exemplary embodiment, hourglass attachment portion 2800 may be narrower in midfoot region 12 than forefoot region 10 and/or heel region 14. In this embodiment, hourglass attachment portion 2800 may be located a fourth distance D4 from outer periphery 2616 of upper 2610 on lateral side 16. Similarly, hourglass attachment portion 2800 may be located a fifth distance D5 from outer periphery 2616 on medial side 18.

In some embodiments, fourth distance D4 and fifth distance D5 may be substantially similar. In some cases, fourth distance D4 and/or fifth distance D5 may be larger or smaller, to increase or decrease, respectively, the decoupling of foot stabilizer system 2620 to base portion 2630 and/or article 2600. With this arrangement, foot stabilizer system 2620 may be selectively decoupled at midfoot region 12 of article 2600.

In one embodiment, fourth distance D4 may be larger than fifth distance D5. In other embodiments, fifth distance D5 may be larger than fourth distance D4. By providing hourglass attachment portion 2800 with one of fourth distance D4 and fifth distance D5 that is larger than the other, foot stabilizer system 2620 may be configured to have a greater degree of decoupling on one of lateral side 16 and medial side 18. For example, in the case where fourth distance D4 of hourglass attachment portion 2800 from outer periphery 2616 on lateral side 16 is larger than fifth distance D5 of hourglass attachment portion 2800 from outer periphery on medial side 18, foot stabilizer system 2620 may have a greater degree of decoupling from article 2600 on lateral side 16. With this arrangement, a foot stabilizer system may be configured with a greater degree of decoupling on one of a lateral side and/or medial side for each article in a pair of footwear. In addition, in some embodiments, an article including a foot stabilizer system with a greater degree of decoupling on one of a lateral side and/or medial side may be configured for various sports.

In some embodiments, hourglass attachment portion 2800 may be configured to be located closer to outer periphery 2616 in one of forefoot region 10 and/or heel region 14 than in midfoot region 12. In an exemplary embodiment, hourglass attachment portion 2800 may be located a sixth distance D6 from outer periphery 2616 at forefoot region 10. Similarly, in this embodiment, hourglass attachment portion 2800 may be located a seventh distance D7 from outer periphery 2616 at heel region 14. In some embodiments, each of sixth distance D6 and seventh distance D7 may be smaller than fourth distance D4 and/or fifth distance D5 at midfoot region 12. In an exemplary embodiment, each of sixth distance D6 and seventh distance D7 may be substantially smaller than fourth distance D4 and/or fifth distance D5. Additionally, in some embodiments, sixth distance D6 and seventh distance D7 may be substantially similar. In other embodiments, one of sixth distance D6 and seventh distance D7 may be larger than the other. With this arrangement, the degree of decoupling of foot stabilizer system 2630 from article 2600 in forefoot region 10 and/or heel region 14 may be customized to be greater or smaller in correspondence to the distance of hourglass attachment portion from outer periphery 2616 in the respective regions. Further, hourglass attachment portion 2800 in forefoot region 10 and/or heel region 14 may also be varied in distance between lateral side 16 and medial side 18 to provide a greater or smaller degree of decoupling of foot stabilizer system 2620 from one side of article 2600, as discussed above in regard to midfoot region 12.

Figure 32:
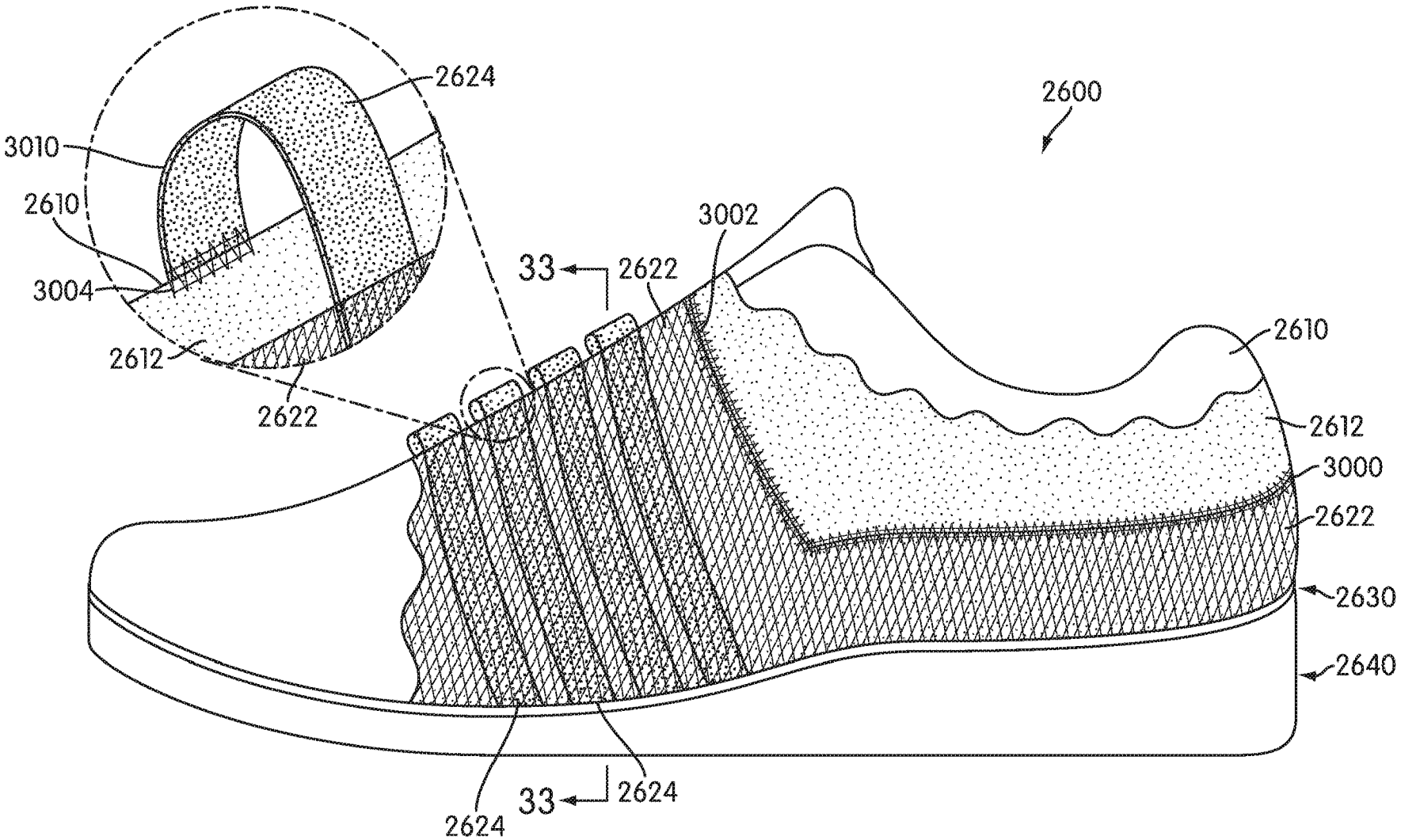
FIG. 32 is an interior view of an alternate embodiment of an article of footwear including a decoupled foot stabilizer system.

Referring now to FIG. 32, a cut-away view of article 2600 including foot stabilizer system 2620 is illustrated. As shown in FIG. 32, foot stabilizer system 2620 may be disposed in the interior of article 2600. In some embodiments, one or more portions of foot stabilizer system 2630 may be secured to upper 2610. In an exemplary embodiment, partial bootie 2622 of foot stabilizer system 2620 may be attached to a portion of upper 2610 located in the interior of article 2610. In one embodiment, upper 2610 may include a liner fabric 2612 or similar material disposed on an interior surface of upper 2610. In an exemplary embodiment, partial bootie 2622 may be attached to liner fabric 2612 at one or more attachment portions. In this embodiment, partial bootie 2622 may be attached to liner fabric 2612 along a first liner attachment portion 3000 extending along a longitudinal direction from heel region 14 toward midfoot region 12. Additionally, partial bootie 2622 may be attached to liner fabric 2612 along a second liner attachment portion 3002 extending along a vertical direction toward the top of article 2600. In other embodiments, first liner attachment portion 3000 and/or second liner attachment portion 3002 may extend more or less distance to attach partial bootie 2622 and liner fabric 2612.

In some embodiments, one or more of the plurality of strap members 2624 may be secured to a portion of upper 2610. In an exemplary embodiment, the plurality of strap members 2624 may extend out from interior of article 2600 and attach to upper 2610. In one embodiment, a distal end 3010 of strap member 2624 may be attached to upper 2610 at a strap attachment portion 3004. In some embodiments, distal end 3010 of strap member 2624 may be folded over and attached to upper 2610 at strap attachment portion 3004 to form a loop. With this arrangement, the plurality of strap members 2624 may be configured to form one or more loops in tongue area 2618 for receiving a lace.

Additionally, in some embodiments, tongue 2616 may be attached to upper 2610 using one or more of the plurality of strap members 2624. In one exemplary embodiment, distal end 3010 of strap member 2624 may pass through a portion of tongue 2616 prior to distal end 3010 being attached to upper 2610 at strap attachment portion 3004. With this arrangement, tongue 2616 may be held in tongue area 2618 by one or more loops formed in the plurality of strap members 2624.

Figure 33:
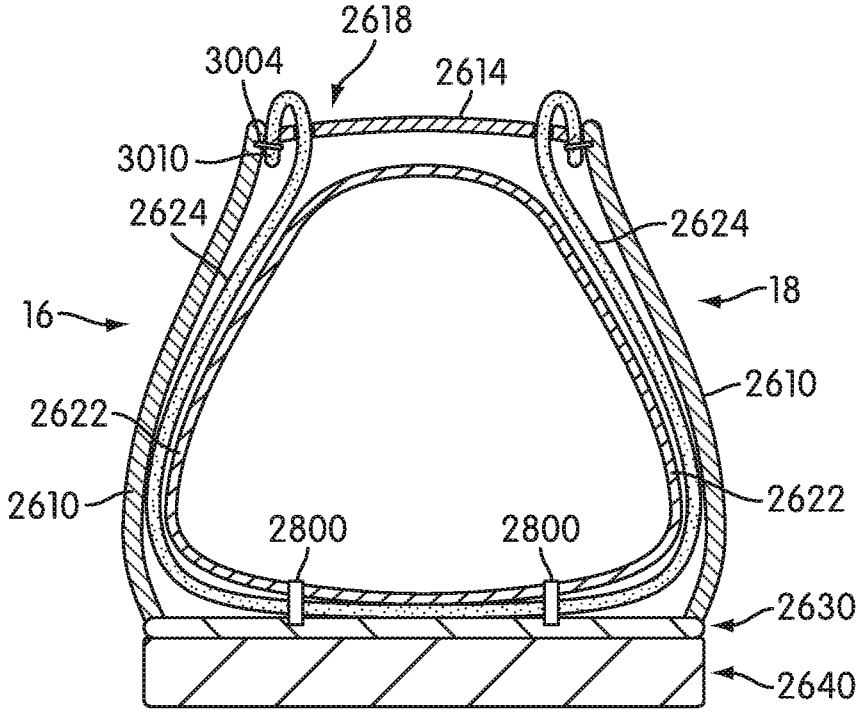
FIG. 33 is a cross-sectional view of an alternate embodiment of an article of footwear including a decoupled foot stabilizer system.
Figure 34:
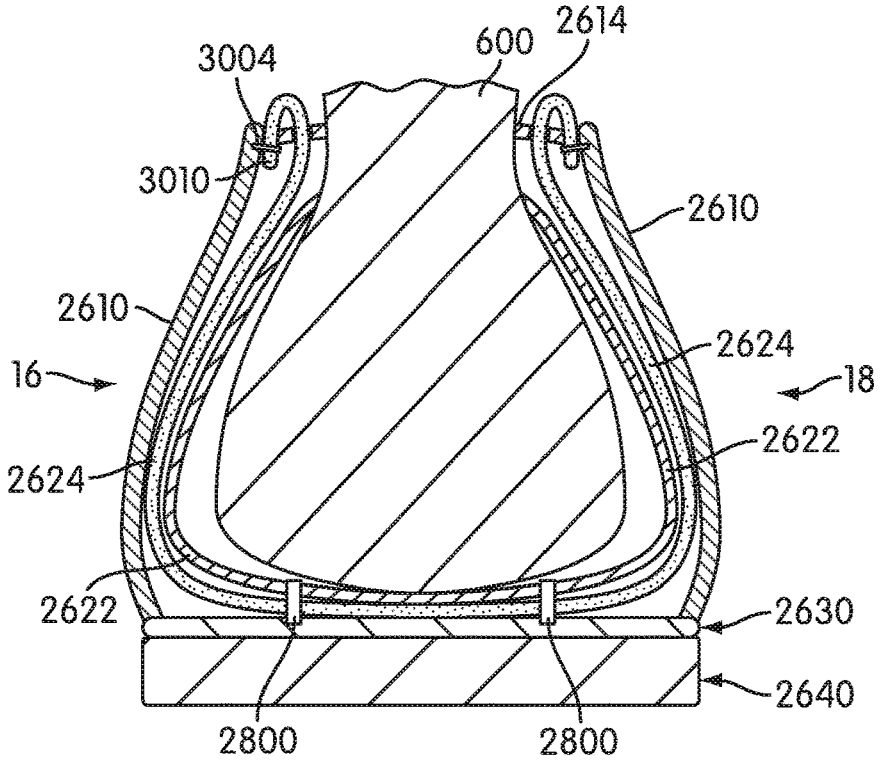
FIG. 34 is a cross-sectional view of an alternate embodiment of an article of including a decoupled foot stabilizer system with a foot disposed within.
Figure 35:
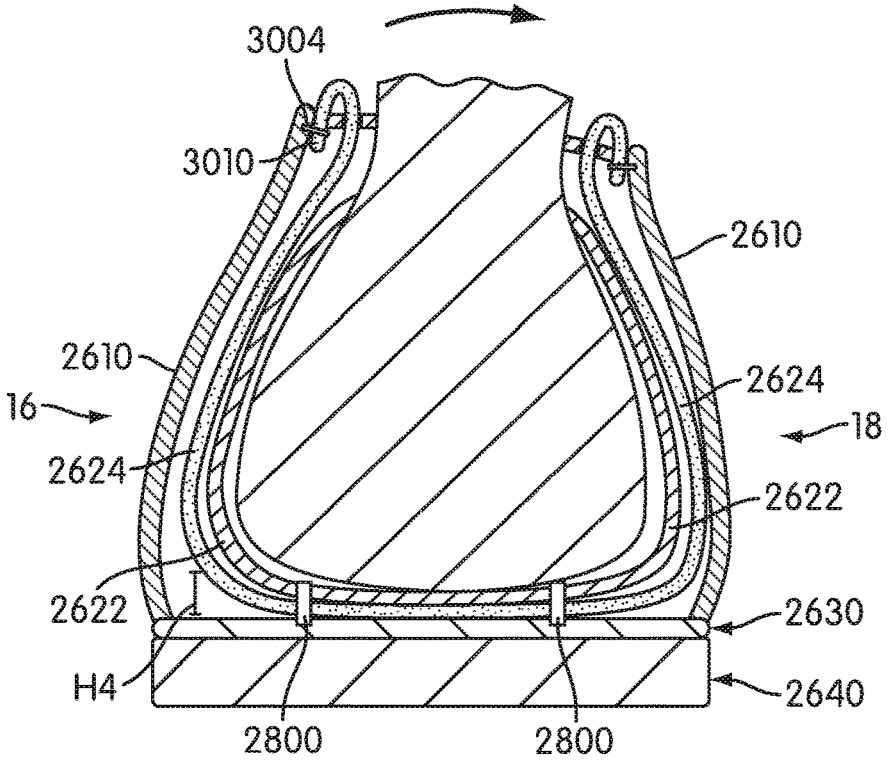
FIG. 35 is a cross-sectional view of an alternate embodiment of an article of including a decoupled foot stabilizer system with a foot disposed within applying a lateral force.

FIGS. 33 through 35 illustrate cross-sectional views of an alternate exemplary embodiment of article of footwear 2600 incorporating decoupled foot stabilizer system 2620. As shown in FIG. 33, partial bootie 2622 may be disposed within the interior of upper 2610. In this embodiment, the plurality of strap members 2624 on opposing sides may be disposed between partial bootie 2622 and upper 2610. In some embodiments, the plurality of strap members 2624 may extend out from the interior of upper 2610 as described above. Additionally, distal end 3010 of strap members 2624 may be associated with loops formed by attaching the folded over distal end 3010 of each of the plurality of strap members 2624 to upper 2610 at strap attachment portion 3004. In an exemplary embodiment, loops formed by distal end 3010 of strap members 2624 may be configured to receive a lace for tightening article 2600. Further, in some embodiments, strap members 2624 may pass through a portion of tongue 2614, as described above, to associate tongue 2614 with tongue area 2618.

In some embodiments, foot stabilizer system 2620 may be attached to base portion 2630, as described above. In this embodiment, foot stabilizer system 2620, including partial bootie 2622 and the plurality of strap members 2624, may be secured to base portion 2630 along an hourglass shaped attachment area formed by hourglass attachment portion 2800, as described above. In different embodiments, other attachment areas and/or attachment portions may be included to secure foot stabilizer system 2620 to base portion 2630 or a portion of upper 2610, as described herein. In one embodiment, upper 2610 also may be secured to base portion 2630. In this embodiment, upper 2610 may be attached to base portion 2630 along an outer periphery of base portion 2630. In an exemplary embodiment, base portion 2630 may be secured to sole structure 2640. In some cases, sole structure 2640 may include one or more of an insole, midsole, and/or outsole.

Referring now to FIG. 34, a cross-sectional view of an exemplary embodiment of article of footwear 2600 including decoupled foot stabilizer system 2620 is shown with foot 600 of a wearer disposed within. In some embodiments, foot stabilizer system 2620 may have one or more of the plurality of strap members 2624 and/or partial bootie 2622 that surround and substantially conform to the shape of foot 600. In an exemplary embodiment, foot stabilizer system 2620 may be decoupled from base portion 2630 at midfoot region 12. In different embodiments, various portions of foot stabilizer system 2620 may be decoupled from base portion 2630 in one or more of forefoot region 10, midfoot region 12, and/or heel region 14.

As shown in FIG. 34, the decoupling of foot stabilizer system 2620 from base portion 2630 at midfoot region 12 may allow foot 600 to have a degree of freedom of motion relative to article 2600. In some cases, the decoupling of foot stabilizer system 2620 may assist a wearer with a change in the direction of travel, including by "cutting" quickly to one side. For example, a wearer may cut to the right by pushing hard on his left foot.

FIG. 35 illustrates a cross-sectional view of the exemplary embodiment of FIG. 34 in the case where a wearer is making a cutting move. In this exemplary embodiment, foot stabilizer system 2620 is decoupled from base portion 2630 at midfoot region 12. In this embodiment, the plurality of strap members 2624 on opposing sides of article 2600 may stabilize foot 600 within upper 2610 during lateral movements. With this configuration, foot 600 may rotate inward toward medial side 18 when a wearer makes a cut to his right. This same type of action may result from weight transfer on the feet during the course of a golf swing.

As shown in FIG. 35, foot stabilizer system 2620 may allow foot 600 to have freedom of motion to rotate toward medial side 18, while keeping sole structure 2640 of article 2600 in contact with the ground. In an exemplary embodiment, an hourglass shaped attachment area formed by hourglass attachment portion 2800 may provide decoupling to foot stabilizer system 2620 such that foot stabilizer system 2620 may move a fourth height H4 relative to interior of article 2600 when a wearer makes a lateral cutting move. In various embodiments, fourth height H4 may be larger or smaller in correspondence to the proximity of the attachment area to the outer periphery of article 2600. In this embodiment, fourth height H4 may be smaller than other embodiments of attachment areas with a narrower width, including central attachment portion 131, as described above. In addition, in some cases, fourth height H4 may be larger than other embodiments where wider attachment areas are used to secure a foot stabilizer system, including a horseshoe attachment area, as described above.

Figure 36:
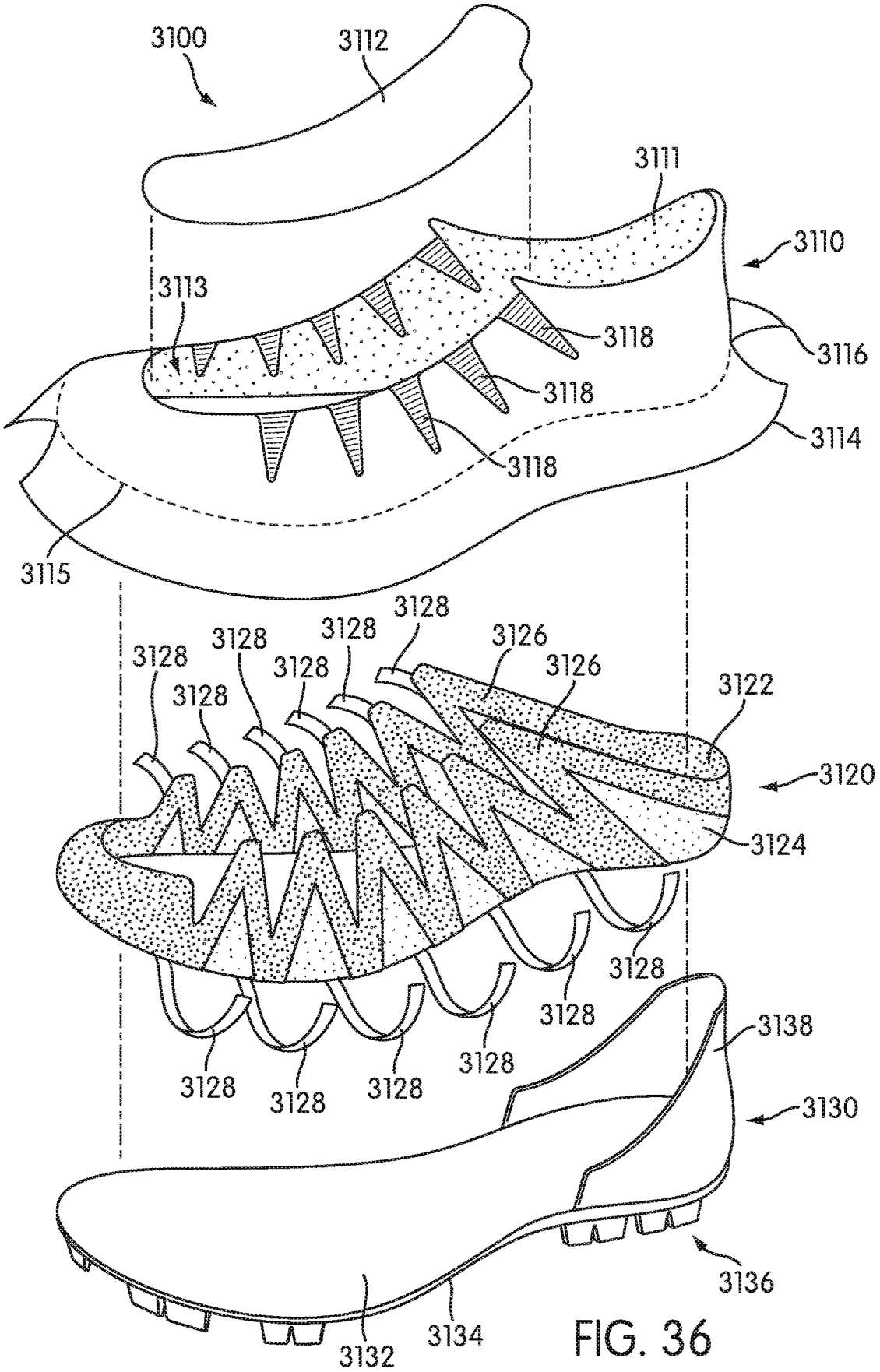
FIG. 36 is an exploded view of an alternate embodiment of an article of footwear including a decoupled foot stabilizer system.

FIGS. 36 through 44 illustrate an alternate exemplary embodiment of an article of footwear including a decoupled foot stabilizer system. In some embodiments, a foot stabilizer system may be associated with a portion of an upper of an article of footwear. FIG. 36 illustrates an exploded view of an alternate exemplary embodiment of an article of footwear 3100. In some embodiments, article 3100 may include an upper 3110. Generally, upper 3110 provides a covering for the foot that comfortably receives and securely positions the foot with respect to a sole structure 3130. In some embodiments, one or more portions of upper 3110 may be configured to fold under the top of upper 3110 to provide a surface for attaching to sole structure 3130. In this exemplary embodiment, upper 3110 may be provided with extra material on a medial side and a lateral side for forming a bottom surface to be secured to sole structure 3130. In one embodiment, upper 3110 may include a first folding portion 3114 and a second folding portion 3116 located at the bottom of opposing sides of upper 3110. In this embodiment, each of first folding portion 3114 and second folding portion 3116 may be folded along an outer periphery 3115 of upper 3110 to form a bottom surface and enclose upper 3110.

In some embodiments, upper 3110 may include a tongue opening 3113. In this embodiment, tongue opening 3113 may include a portion of upper 3110 that may be tightened around a foot of a wearer. In some embodiments, tongue opening 3113 may include opposing sides of upper 3110 that may be pulled together using laces. In some cases, tongue opening 3113 may be associated with a tongue 3112. In other cases, tongue opening 3113 may include an elastic or stretchable region of upper 3110.

In some embodiments, upper 3110 may be comprised of one or more materials. In an exemplary embodiment, upper 3110 may include a plurality of articulated regions 3118. In one embodiment, articulated regions 3118 may be comprised of a different material than the material used for the remaining portion of upper 3110. In an exemplary embodiment, articulated regions 3118 may be made of a material that is configured to stretch in one direction and remain substantially inflexible in another direction. In this embodiment, articulated regions 3118 may be made from a material that remains substantially inflexible in a direction along the longitudinal axis of article 3100, but that is configured to stretch in a direction along the lateral and/or vertical axes.

In some cases, articulated regions 3118 of upper 3110 may be made from elastic or stretchable materials, including, but not limited to any one or a combination of: woven synthetic fibers, polyurethane, nylon, cotton, spandex, neoprene, and other natural and synthetic materials. In other cases, articulated regions 3118 may be made from any material used to make upper 3110, including but not limited to any one or a combination of: nylon, natural leather, synthetic leather, natural rubber, or synthetic rubber, or any suitable knitted, woven or nonwoven material.

In some embodiments, articulated regions 3118 in upper 3110 may provide flexibility to article 3100. In this embodiment, articulated regions 3118 are arranged within triangular cut-outs or slits on upper 3110. With this arrangement, upper 3110 may be configured to bend to a greater degree than an upper without articulated regions 3118. In other embodiments, articulated regions 3118 may be any type of opening in upper 3110 that allows a greater degree of bending or flexibility to article 3100. In still other embodiments, articulated regions 3118 may be a portion of upper 3110 that is substantially free of any material.

In this embodiment, article 3100 may include an upper 3110 with articulated regions 3118 that are associated with a foot stabilizer system 3120. In this embodiment, foot stabilizer system 3120 does not include a separate bootie or sock liner component, as included in some previous embodiments. It should be understood, however, that foot stabilizer system 3120 may optionally include a bootie and/or sock liner. In one embodiment, foot stabilizer system 3120 may be configured to extend to a height below an ankle of a wearer.

In some embodiments, foot stabilizer system 3120 may include a strap system 3122. In an exemplary embodiment, strap system 3122 may include a plurality of strap members 3126. In an exemplary embodiment, the plurality of strap members 3126 may be configured to provide stability and/or support to foot stabilizer system 3120. In one embodiment, strap members 3126 may have a triangular shape. In an exemplary embodiment, the strap members 3126 having a triangular shape may be configured to distribute the load associated with supporting a foot of a wearer. In other embodiments, strap members 3126 may have other shapes, including a substantially similar shape as the plurality of strap members 200 described above.

In an exemplary embodiment, strap members 3126 may be configured to support a foot of a wearer. In one embodiment, strap system 3122 may include a number of the plurality of strap members 3126 on opposite sides. In an exemplary embodiment, the plurality of strap members 3126 may be positioned on a lateral side and a medial side of foot stabilizer system 3120. In the embodiment shown in FIG. 36, foot stabilizer system 3120 may include strap system 3122 having six strap members 3126 disposed on each side of article 3100. In other embodiments, foot stabilizer system 3120 may include strap system 3122 having more or less strap members 3126.

In some embodiments, the plurality of strap members 3126 may be connected to each other using a webbing material 3124. Webbing material 3124 may be substantially similar to webbing 202 described above. As shown in FIG.

36, webbing material 3124 may connect the plurality of strap members 3126 along the sides of foot stabilizer system 3120. In some cases, webbing material 3124 may be disposed between fewer strap members. In other cases, webbing material 3124 may be disposed between two or more strap members on a single side of foot stabilizer system 3120. In different embodiments, webbing material 3124 may be disposed between two or more strap members associated with one or more of forefoot region 10, midfoot region 12, and heel region 14 of article 3100.

In some embodiments, article 3100 may also include provisions to associate foot stabilizer system 3120 and upper 3110. In an exemplary embodiment, article 3100 may include one or more support members 3128 that are associated with upper 3110 and foot stabilizer system 3120. In this embodiment, a plurality of support members 3128 may be disposed underneath a foot stabilizer system 3120. As shown in FIG. 36, support members 3128 extend under foot stabilizer system 3120 from the lateral side to the medial side. In some cases, an individual support member 3128 may be associated with each pair of strap members 3126 on foot stabilizer system 3120. With this arrangement, support members 3128 may be associated with strap members 3126 of strap system 3122 to provide additional support to foot stabilizer system 3120 of article 3100. In other cases, more or less support members 3128 may be provided to associate one or more portions of foot stabilizer system 3120 with portions of upper 3110. In different embodiments, support members 3128 need not be associated with strap members 3126 and may instead be associated with other portions of foot stabilizer system 3120.

In some embodiments, foot stabilizer system 3120 may include additional components configured to protect and/or provide stability and support to various portions of a foot of a wearer, including the toes and/or heel of a wearer as discussed above in previous embodiments.

In some embodiments, article 3100 may include sole structure 3130. Sole structure 3130 may be generally positioned between a foot of a wearer and the ground. In some embodiments, sole structure 3130 may include one or more of an outsole, a midsole, a single piece sole, and/or any number of additional components associated with a conventional sole. In other embodiments, sole structure 3130 may include one or more tread elements for engaging with the ground. In some embodiments, sole structure 3130 may include one or more components. In some embodiments, sole structure 3130 includes a top surface 3132. Top surface 3132 may be provided to attach bottom surface of upper 3110 to sole structure 3130.

In some embodiments, sole structure 3130 may include an outsole 3134. Outsole 3134 may be any conventional outsole used with an article of footwear. In an exemplary embodiment, outsole 3134 of sole structure 3130 may include one or more tread elements 3136 for engaging with the ground. Tread elements 3136 may be any conventional tread elements used with an article of footwear, including, but not limited to a cleat. In other embodiments, sole structure 3130 may not include tread elements 3136. While FIGS. 36 through 44 illustrate sole structure 3130 having one or more tread elements, including a cleat, it should be understood that article 3100 may include sole structure 3130 as described herein without limitation to any specific type of tread element.

In some embodiments, sole structure 3130 may optionally include a heel cup 3138. In an exemplary embodiment, heel cup 3138 may be made of a rigid material to firmly support the heel of a foot of a wearer.

Figure 37:
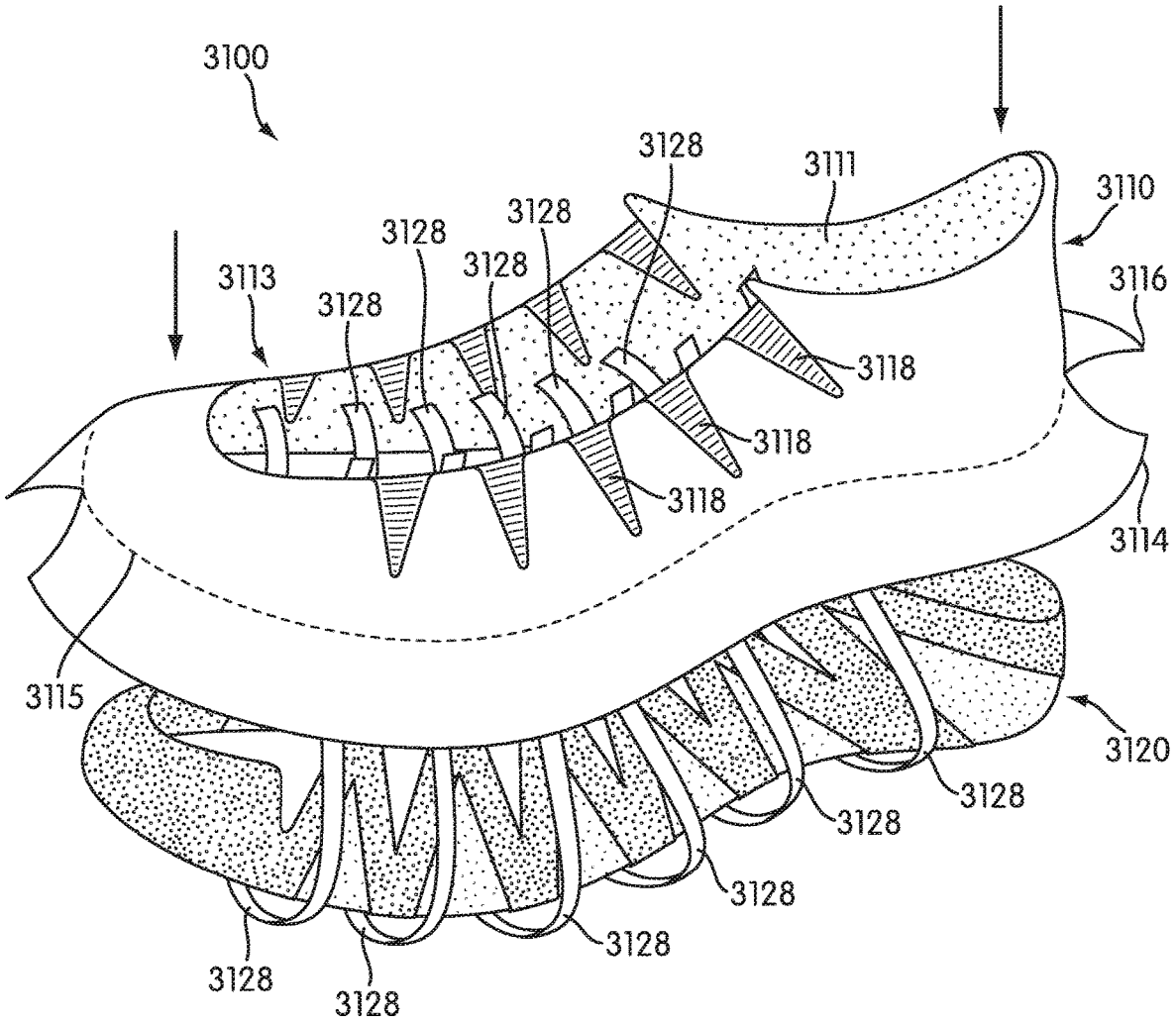
FIG. 37 is an exploded view of an alternate embodiment of an article of footwear including a decoupled foot stabilizer system showing assembly of the foot stabilizer system within an upper.

Referring now to FIG. 37, foot stabilizer system 3120 is illustrated being enclosed within upper 3110. In some embodiments, the plurality of support members 3128 are arranged to pass under foot stabilizer system 3120 and to extend out of upper 3110. In an exemplary embodiment, the ends of support members 3128 may pass through tongue opening 3113 of upper 3110. With this arrangement, the plurality of support members 3128 may be disposed underneath foot stabilizer system 3120 within interior 3111 of upper 3110.

In some embodiments, first folding portion 3114 and second folding portion 3116 of upper 3110 may be folded under article 3100 so as to enclose foot stabilizer system 3120 within interior 3111 of upper 3110. In some embodiments, first folding portion 3114 and second folding portion 3116 of upper 3110 may be attached underneath upper 3110 to form a bottom surface. With this arrangement, bottom surface may serve a substantially similar function as base portion 130 and/or base portion 1130, described above. In an exemplary embodiment, the bottom surface formed by first folding portion 3114 and second folding portion 3116 may be secured to top surface 3132 of sole structure 3130.

In different embodiments, the bottom surface of upper 3110 may include one or more of a midsole and/or strobel, as described above.

Figure 38:
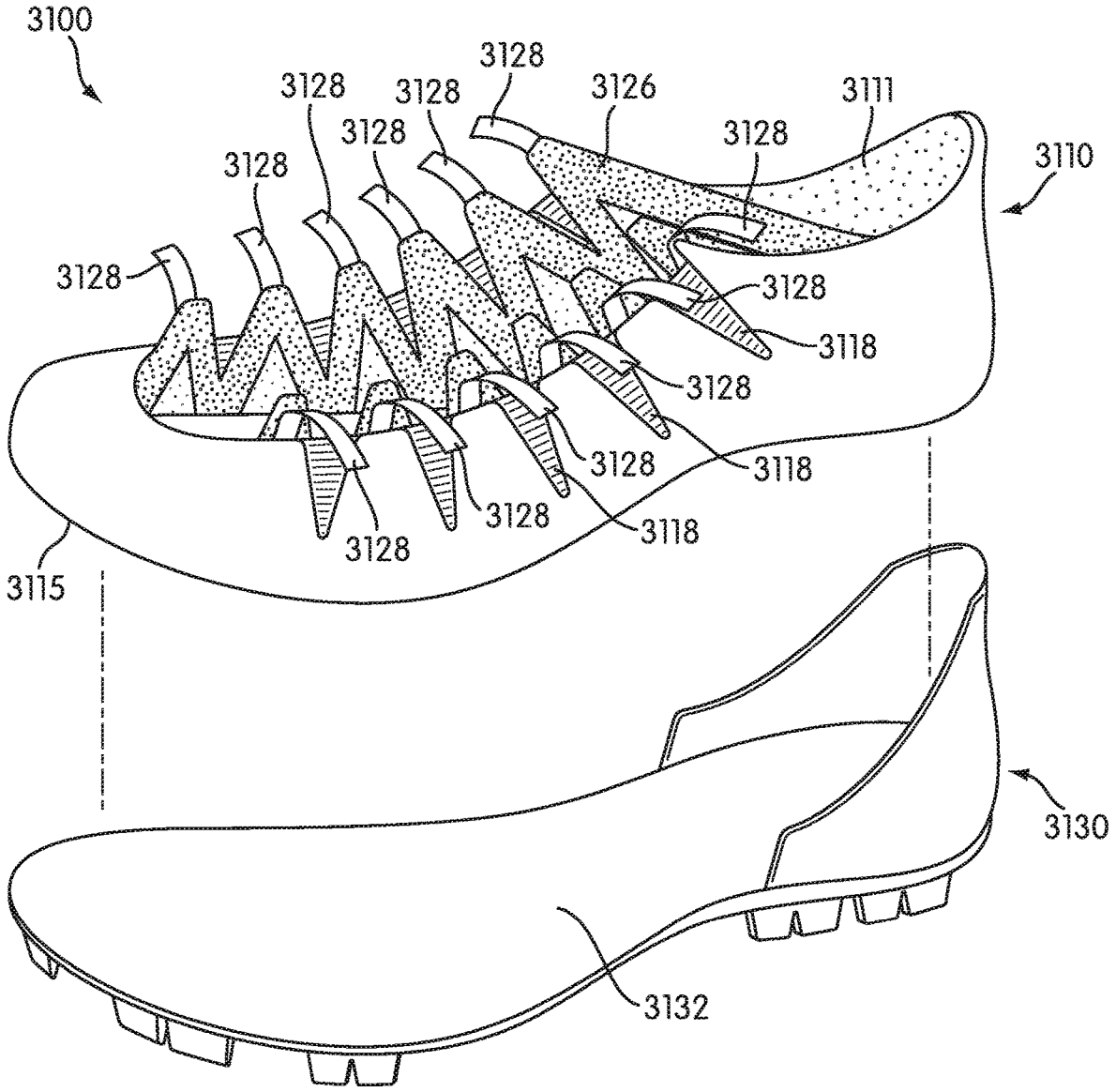
FIG. 38 is an exploded view of an alternate embodiment of an article of footwear including a decoupled foot stabilizer system being attached to a sole structure.

Referring now to FIG. 38, foot stabilizer system 3120 is shown enclosed with interior 3111 of upper 3110. In this embodiment, a plurality of support members 3128 extend out from interior 3111 of upper 3110 through tongue opening 3113. In one embodiment, foot stabilizer system 3120 may be secured to bottom surface of upper 3110. In an exemplary embodiment, foot stabilizer system 3120 may be secured to bottom surface of upper 3110 in a manner such that foot stabilizer system 3120 is selectively decoupled from one or more portions of article 3100. In different embodiments, foot stabilizer system 3120 may be decoupled from bottom surface of upper 3110 using various attachment portions as described herein.

In some embodiments, upper 3110 including foot stabilizer system 3120 and the plurality of support members 3128 disposed within interior 3111 may be secured to sole structure 3130. In some embodiments, the bottom surface of upper 3110 may be disposed between foot stabilizer system 3120 and sole structure 3130. In one embodiment, the bottom surface of upper 3110 may be attached to the top surface 3132 of sole structure 3130 using adhesive. In other embodiments, the bottom surface of upper 3110 may be attached to the top surface 3132 of sole structure 3130 using any suitable attachment mechanism, including, but not limited to one or more of adhesive, heat, pressure, stitching, and other methods of attachment.

Figure 39:
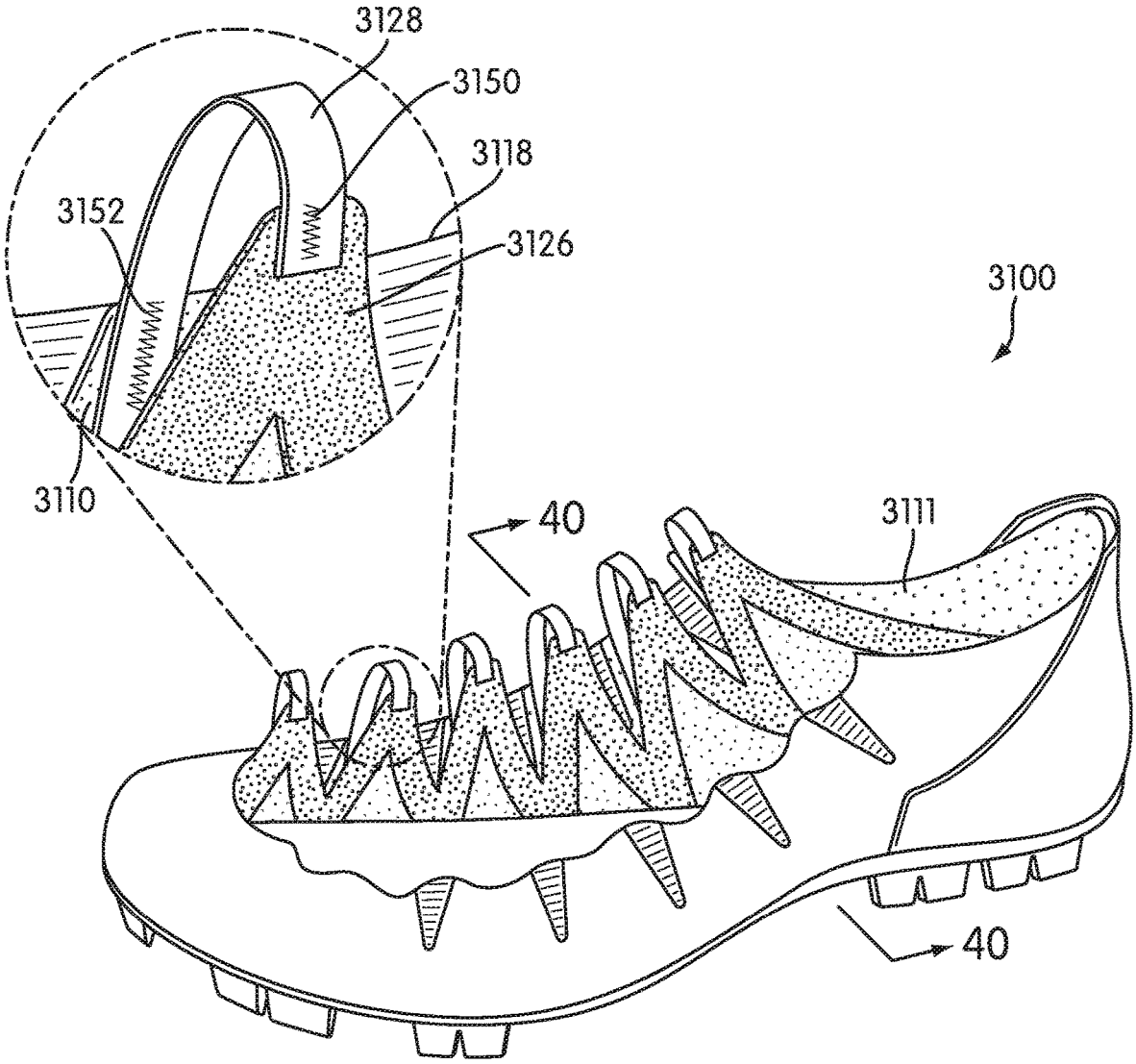
FIG. 39 is a cut away view of an interior of an alternate embodiment of an article of footwear showing a decoupled foot stabilizer system including support members attached to an upper.

Referring now to FIG. 39, a cut-away view of an assembled alternate exemplary embodiment of article 3100 including foot stabilizer system 3120 associated with upper 3110 is shown. In this embodiment, the plurality of support members 3128 may be secured to portions of foot stabilizer system 3120 and upper 3110. As shown in the close-up view in FIG. 39, support member 3128 may extend out of interior 3111 of upper 3110. In some embodiments, support member 3128 may be attached to upper 3110 and/or portions of foot stabilizer system 3120.

In one embodiment, one or more support members 3128 may be attached to both upper 3110 and portions of foot stabilizer system 3120. In this embodiment, support member 3128 is attached to strap member 3126 of foot stabilizer system 3120 at a first attachment point 3150. Similarly, in this embodiment, support member 3128 may also be attached to upper 3110 at a second attachment point 3152. As shown in this embodiment, support member 3128 may form a loop spanning between first attachment point 3150 on strap member 3126 and second attachment point 3152 on upper 3110. In some cases, first attachment point 3150 and second attachment point 3152 may be a stitch or stitching. In other cases, other attachment mechanisms may be used to secure support member 3128 to portions of foot stabilizer system 3120 and/or upper 3110.

While the present embodiment illustrates first attachment point 3150 and second attachment point 3152 for attaching support member 3128 to, respectively, strap member 3126 and upper 3110, additional attachment points may be provided on foot stabilizer system 3120 and/or upper 3110 to provide a secure connection with support member 3128. Additionally, one or more support members 3128 may be attached to foot stabilizer system 3120 and/or upper 3110 in a similar manner on lateral side and medial side of article 3100. In other embodiments, one or more support members 3128 may be secured to other portions of upper 3110, including articulated regions 3118.

Figure 40:
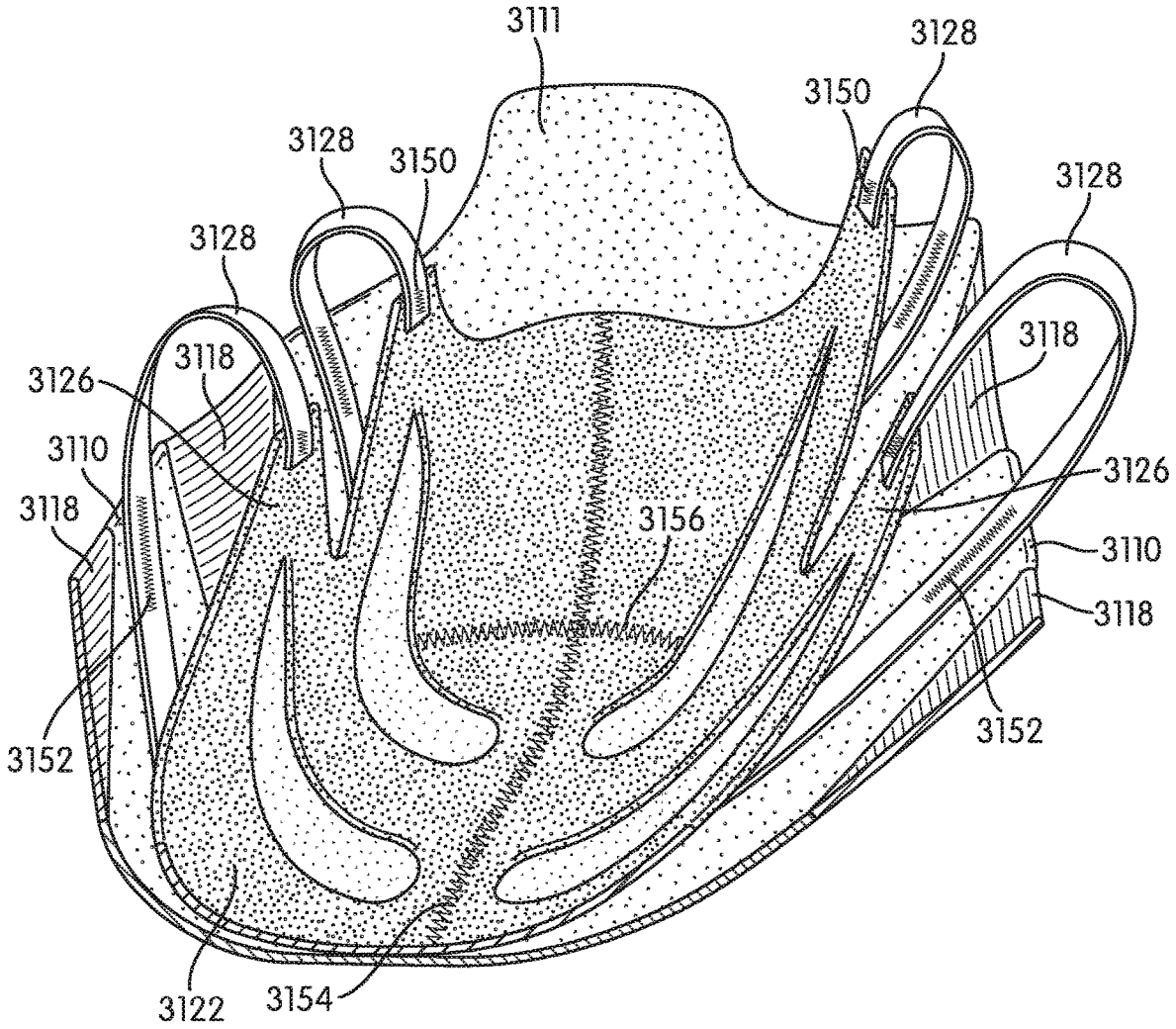
FIG. 40 is a cross-sectional view of an alternate embodiment of an article including a foot stabilizer system with support members.

FIG. 40 illustrates a cross-sectional view of foot stabilizer system 3120 and upper 3110 associated with each other by one or more support members 3128. In this embodiment, it should be understood that article 3100 may include a number of other components typically associated with an article of footwear, including sole structure 3130, that have not been included in this view for the purposes of illustration.

In this embodiment, strap system 3122 of foot stabilizer system 3120 is shown disposed within interior 3111 of upper 3110. A plurality of support members 3128 may be disposed beneath strap system 3122 between foot stabilizer system 3120 and interior 3111 of upper 3110. In this embodiment, the plurality of support members 3128 may be attached to the plurality of strap members 3126 of strap system 3122 at a number of first attachment points 3150. Similarly, the plurality of support members 3128 also may be attached to upper 3110 at a number of second attachment points 3152. Additionally, in this embodiment, foot stabilizer system 3120 may be secured to a bottom surface of upper 3110 at a central attachment portion 3154 and at a heel attachment portion 3156. With this arrangement, lateral and medial portions of foot stabilizer system 3120 may be decoupled from upper 3110 at areas other than along central attachment portion 3154. In some embodiments, foot stabilizer system 3120 may additionally be attached to bottom surface of upper 3110 at a forefoot attachment portion (not shown). In different embodiments, foot stabilizer system 3120 may be attached to a portion of upper 3110 and/or a base portion using any attachment area to provide selective decoupling as discussed herein.

Figure 41:
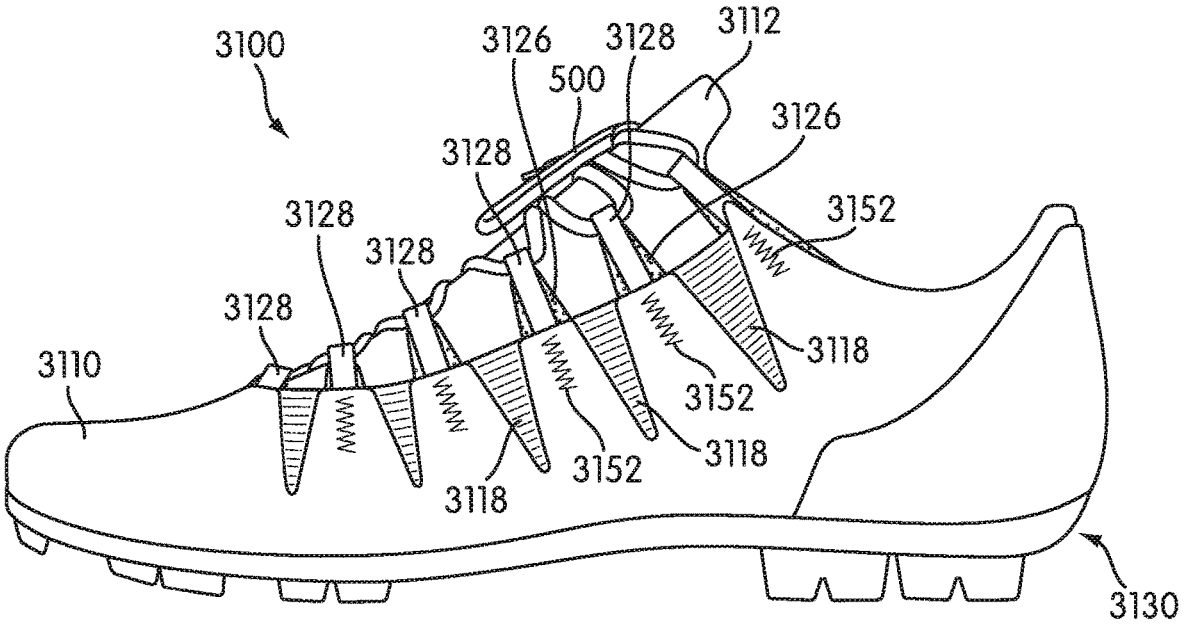
FIG. 41 is a side view of an alternate embodiment of an article of footwear including a decoupled foot stabilizer system with an articulated upper.
Figure 42:
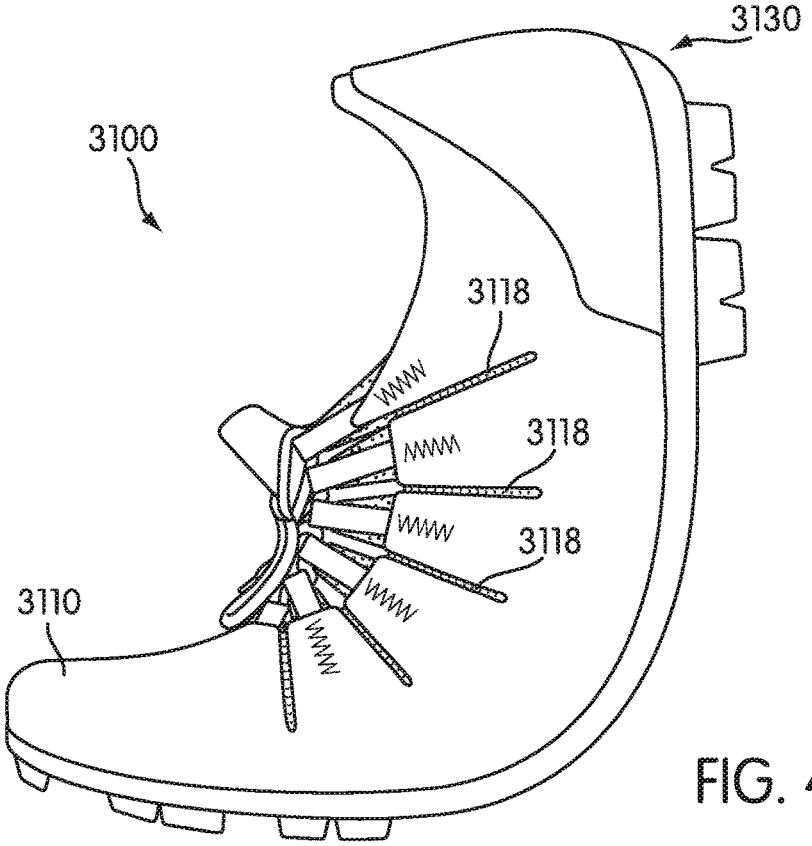
FIG. 42 is a side view of an alternate embodiment of an article of footwear including a decoupled foot stabilizer system showing bending of an articulated upper.

FIGS. 41 and 42 illustrate an assembled embodiment of article 3100 including upper 3110 with articulated regions 3118. In this embodiment, the plurality of support members 3128 associate foot stabilizer system 3120 and upper 3110 with articulate regions 3118. In an exemplary embodiment, support members 3128 may be attached to strap members 3126 and to upper 3110 at second connection point 3152. In some embodiments, article 3100 may include tongue 3112. In some embodiments, tongue 3112 may be secured to one or more portions of upper 3110 and/or foot stabilizer system 3120. In an exemplary embodiment, article 3100 further includes a lace 500. In some embodiments, lace 500 may run through loops formed by the attachment of support members 3128 between upper 3110 and foot stabilizer system 3120. Additionally, in some embodiments, lace 500 run through loops formed by support members 3128 and may assist in securing tongue 3112 to article 3100. In other embodiments, lace 500 may run through one or more lacing holes, as described above, disposed in portions of support members 3128, strap members 3126, and/or portions of upper 3110.

Referring now to FIG. 42, as described above, articulated regions 3118 disposed in upper 3110 may be configured to allow article 3100 to have a greater degree of flexibility or bending. In this embodiment, article 3100 is shown undergoing bending associated with articulated regions 3118 of upper 3110. As shown in FIG. 42, articulated regions 3118 arranged within cut-outs or slits of upper 3110 may allow upper 3110 to bend. With this arrangement, bending of article 3100 closes the gap in the cut-outs in upper 3110 corresponding to articulated regions 3118. As a result, the gap in upper 3110 becomes smaller and allows greater flexibility to article 3100. In some embodiments, articulated regions 3118 include elastic or stretchable materials, as described above, that are configured to provide bending of upper 3110 at articulated regions 3118. Additionally, in some embodiments, article 3100 may include other components that provide a greater degree of flexibility or bending, including, for example, an articulated sole associated with sole structure 3130.

Figure 43:
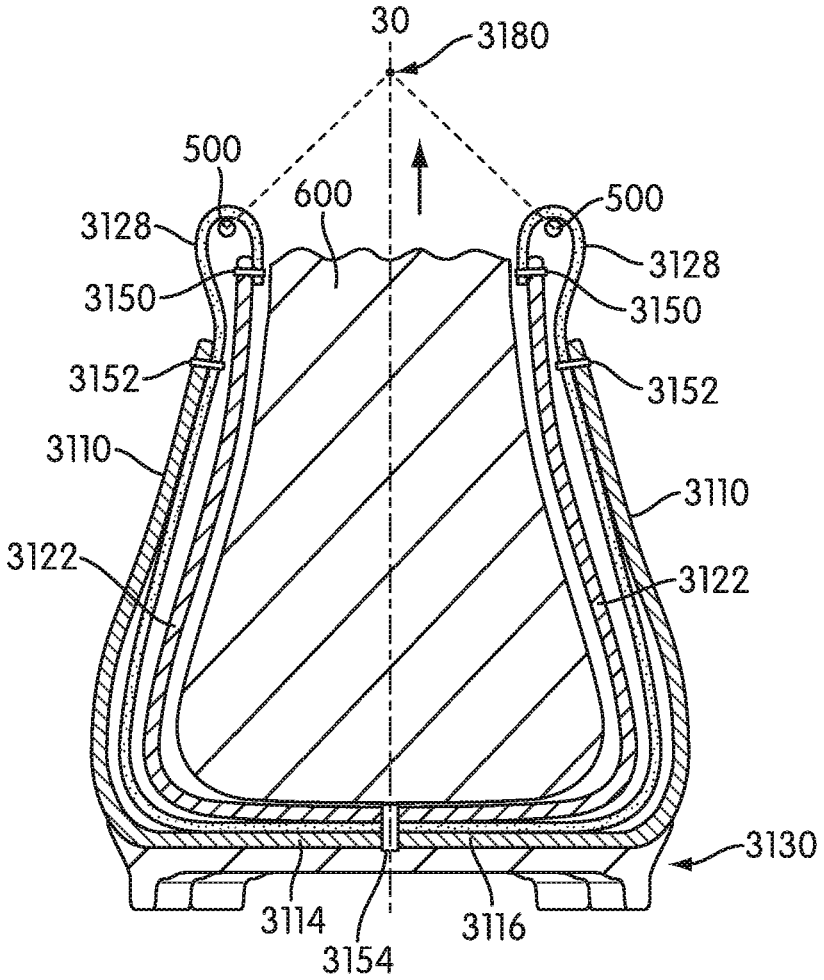
FIG. 43 is a cross-sectional view of an alternate embodiment of an article of footwear including a decoupled foot stabilizer system with an articulated upper.
Figure 44:
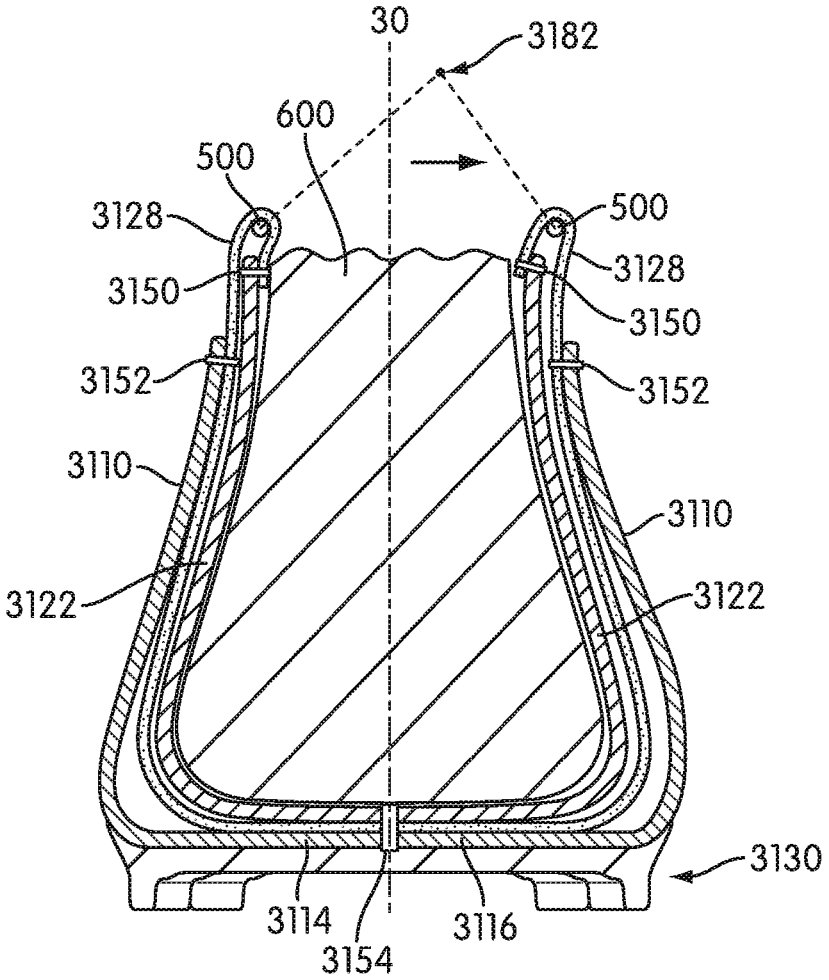
FIG. 44 is a cross-sectional view of an alternate embodiment of an article of footwear illustrating cinching of a foot stabilizer system of FIG. 43.

FIGS. 43 and 44 illustrate cross-sectional views of article 3100 with foot stabilizer system 3120 and upper 3110 associated with each other by one or more support members 3128. In this embodiment, foot 600 is disposed within interior 3111 of upper 3110. As shown in the cross-sectional views, strap system 3122 of foot stabilizer system 3120 may be attached to a bottom surface of upper 3110 formed by first folding portion 3114 and second folding portion 3116 at central attachment portion 3154. Also shown in this view is first connection point 3150 attaching support member 3128 to strap member 3126 and second connection point 3152 attaching support member 3128 to upper 3110.

In some embodiments, lace 500 may be disposed through loops formed by support members 3128 attached between upper 3110 and foot stabilizer system 3120. In an exemplary embodiment, lace 500 disposed through loops formed by support members 3128 may be pulled to tighten or cinch foot stabilizer system 3120 to foot 600. As shown in FIG. 43, a wearer may pull up on lace 500 in a vertical direction along vertical axis 30 from a point 3180 above article 3100. With this arrangement, lace 500 may be used to provide a customized or improved fit to foot 600 of a wearer within article 3100. Additionally, by associating foot stabilizer system 3120 and upper 3110 with support members 3128, a load may be distributed more evenly between upper 3110 and strap members 3126.

Similarly, as shown in FIG. 44, a wearer may pull up on lace 500 in a direction to one side of vertical axis 30 from an offset point 3182. In this embodiment, lace 500 disposed through loops formed by support members 3128 may be pulled in a direction corresponding to offset point 3182 to tighten or cinch foot stabilizer system 3120 to foot 600. With this arrangement, a greater amount of support and/or stability may be provided to foot 600 within article 3100 by foot stabilizer system 3120 conforming to the shapes and/or contours of foot 600. In other embodiments, lace 500 may be pulled in other directions to tighten or cinch foot stabilizer system 3120 to foot 600.

In different embodiments, an attachment area that attaches a foot stabilizer system to a base portion and/or a portion of an upper may be arranged with various configurations to provide a greater or smaller degree of decoupling to the foot stabilizer system relative to an article of footwear. FIGS. 45 through 48 illustrate various alternate exemplary embodiments of attachment configurations including different types and/or arrangements of attachment areas used to provide a decoupled foot stabilizer system relative to one or more portions of an article.

Figure 45:
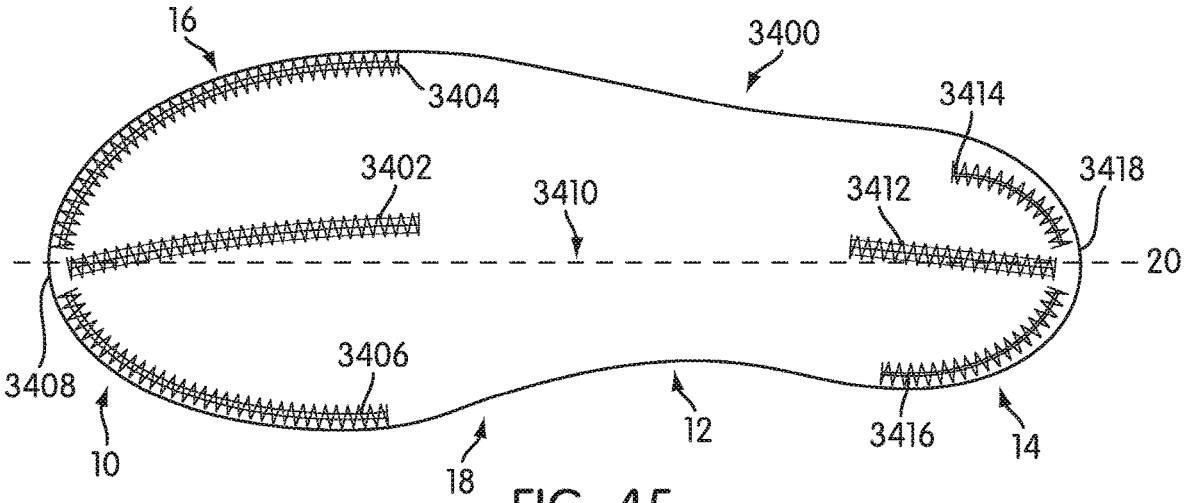
FIG. 45 is a schematic view of various attachment mechanisms for attaching a decoupled foot stabilizer system to a base portion.

Referring now to FIG. 45, in this embodiment, an attachment area 3400 using one or more central attachment portions may secure a foot stabilizer system to a base portion and/or a portion of an upper. In some embodiments, a foot stabilizer system may be attached to a base portion at a central attachment portion that extends substantially along longitudinal axis 20. In one embodiment, a central attachment portion may be substantially similar to central attachment portion 131, as discussed above. In other embodiments, the central attachment portion may extend essentially from heel region 14 to forefoot region 10. In an exemplary embodiment, the central attachment portion may include a forefoot central attachment portion 3402. Forefoot central attachment portion 3402 may extend a distance from a location adjacent to front edge 3408 in forefoot region 10 toward midfoot region 12. Similarly, the central attachment portion may include a heel central attachment portion 3412. Heel central attachment portion 3412 may extend a distance from a location adjacent to rear edge 3418 in heel region 14 toward midfoot region 12. In some cases, forefoot central attachment portion 3402 and/or heel central attachment portion 3412 may extend through a portion of midfoot region. In other cases, the central attachment portion may be completely decoupled at a center portion 3410 of the midfoot region 12.

In some embodiments, attachment area 3400 may attach a foot stabilizer system to a base portion at one or more portions of near a periphery of the base portion in forefoot region 10. In an exemplary embodiment, attachment area 3400 may include a forefoot attachment portion. In one embodiment, a lateral forefoot attachment portion 3404 may extend along a portion of forefoot region 10 of the base portion associated with lateral side 16. Similarly, a medial forefoot attachment portion 3406 may extend along a portion of forefoot region 10 of the base portion associated with medial side 18. In some cases, lateral forefoot attachment portion 3404 and medial forefoot attachment portion 3406 may extend from one side to join with the other around front edge 3408 of the base portion near the periphery of forefoot region 10. In other cases, the forefoot attachment portion may include only one of lateral forefoot attachment portion 3404 and medial forefoot attachment portion 3406, associated, respectively, with lateral side 16 and medial side 18.

In some embodiments, attachment area 3400 may attach a foot stabilizer system to a base portion at one or more portions of near a periphery of the base portion in heel region 14. In an exemplary embodiment, attachment area 3400 may include a heel attachment portion. In one embodiment, a lateral heel attachment portion 3414 may extend along a portion of heel region 14 of the base portion associated with lateral side 16. Similarly, a medial heel attachment portion 3416 may extend along a portion of heel region 14 of the base portion associated with medial side 18. In some cases, lateral heel attachment portion 3414 and medial heel attachment portion 3416 may extend from one side to join with the other around rear edge 3418 of the base portion near the periphery of heel region 14. In other cases, the heel attachment portion may include only one of lateral heel attachment portion 3414 and medial heel attachment portion 3416, associated, respectively, with lateral side 16 and medial side 18.

Using various attachment portions associated with attachment area 3400, one or more of forefoot central attachment portion 3402, lateral forefoot attachment portion 3404, medial forefoot attachment portion 3406, heel central attachment portion 3412, lateral heel attachment portion 3414, and/or medial heel attachment portion 3416, as well as an optional central attachment portion corresponding to center portion 3410, may allow the foot stabilizer system to conform to the shape of and/or provide freedom of motion to the wearer's foot along lateral side 16 and/or medial side 18.

Figure 46:
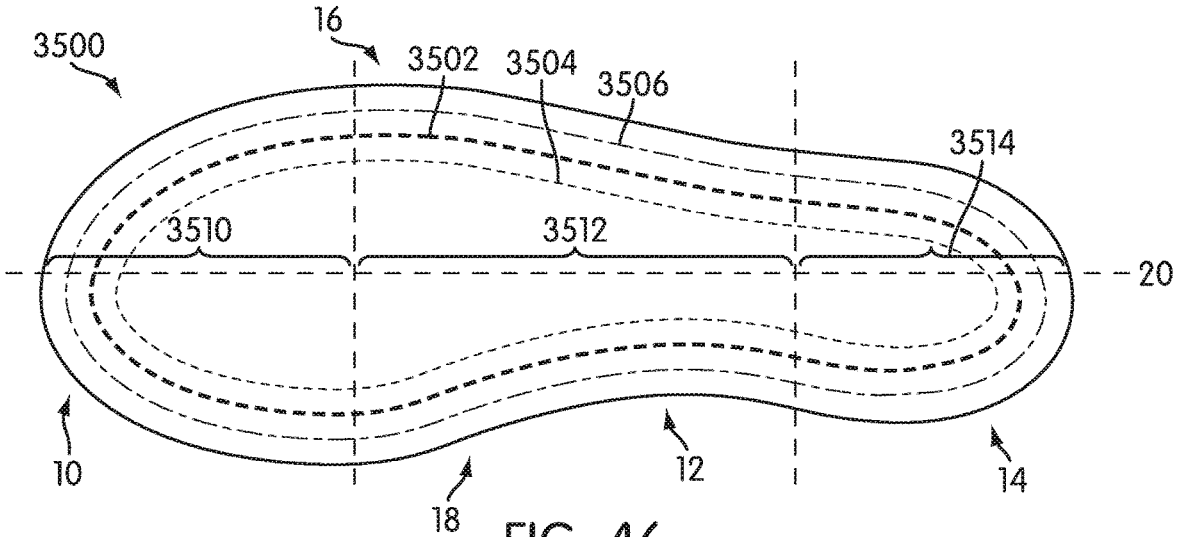
FIG. 46 is a schematic view of various attachment mechanisms for attaching a decoupled foot stabilizer system to a base portion.

Referring now to FIG. 46, an attachment area 3500 for securing a foot stabilizer system to a base portion and/or a portion of an upper may be associated with an hourglass shape. In some embodiments, hourglass shaped attachment area 3500 may be defined by various hourglass attachment portions. In some embodiments, a first hourglass attachment portion 3502 may extend around a perimeter of a base portion. In this embodiment, first hourglass attachment portion 3502 may selectively decouple portions of a foot stabilizer system from a base portion of an article. In one embodiment, first hourglass attachment portion 3502 may extend around the perimeter at a distance away from the outer periphery of the base portion of the article. In an exemplary embodiment, first hourglass attachment portion 3502 may be substantially similar to hourglass attachment portion 2800, as described above.

In some embodiments, hourglass shaped attachment area 3500 may include an hourglass attachment portion that may be disposed at a distance that is closer or farther from the outer periphery of the base portion of the article than first hourglass attachment portion 3502. In one embodiment, a second hourglass attachment portion 3504 may extend around a perimeter of the base portion of an article at a distance that is farther from the outer periphery than first hourglass attachment portion 3502. In this embodiment, second hourglass attachment portion 3504 may define a narrower width for attachment area 3500. With this arrangement, second hourglass attachment portion 3504 may be configured to increase the degree of decoupling provided between a foot stabilizer system and an article.

In another embodiment, a third hourglass attachment portion 3506 may extend around a perimeter of the base portion of article at a distance that is closer to the outer periphery than first hourglass attachment portion 3502. In this embodiment, third hourglass attachment portion 3506 may define a wider width for attachment area 3500. With this arrangement, third hourglass attachment portion 3506 may be configured to decrease the degree of decoupling provided between a foot stabilizer system and an article.

In some embodiments, hourglass shaped attachment area 3500 may be configured to vary between any one or more regions of an article, including forefoot region 10, midfoot region 12, and/or heel region 14. In one embodiment, a combination of first hourglass attachment portion 3502, second hourglass attachment portion 3504, and/or third hourglass attachment portion 3506 may be used in any one or more of forefoot region 10, midfoot region 12, and/or heel region 14. For example, in an exemplary embodiment, a forefoot hourglass attachment area 3510 may be associated with third hourglass attachment portion 3506 in forefoot region 10, while a midfoot hourglass attachment area 3512 may be associated with a different hourglass attachment portion, including first hourglass attachment portion 3502 or second hourglass attachment portion 3504. Similarly, a heel hourglass attachment area 3514 may be associated with any one of first hourglass attachment portion 3502, second hourglass attachment portion 3504, and/or third hourglass attachment portion 3506, which may be different from the hourglass attachment portion associated with forefoot hourglass attachment area 3510 and/or midfoot hourglass attachment area 3512. With this arrangement, the degree of decoupling of the foot stabilizer system from the article may be customized across one or more regions of the article.

Additionally, in some embodiments, hourglass shaped attachment area 3500 may be configured to vary between lateral side 16 and medial side 18 of an article. In an exemplary embodiment, a combination of first hourglass attachment portion 3502, second hourglass attachment portion 3504, and/or third hourglass attachment portion 3506 may be used in any one or more of forefoot region 10, midfoot region 12, and/or heel region 14 on lateral side 16 and/or medial side 18 of an article. With this arrangement, a foot stabilizer system may be selectively decoupled from an article in greater or smaller degree across various regions and/or sides of the article. In various embodiments, using different variations of hourglass shaped attachment area 3500, a foot stabilizer system may be configured for various sports and activities with different amounts of support and/or stability.

Figure 47:
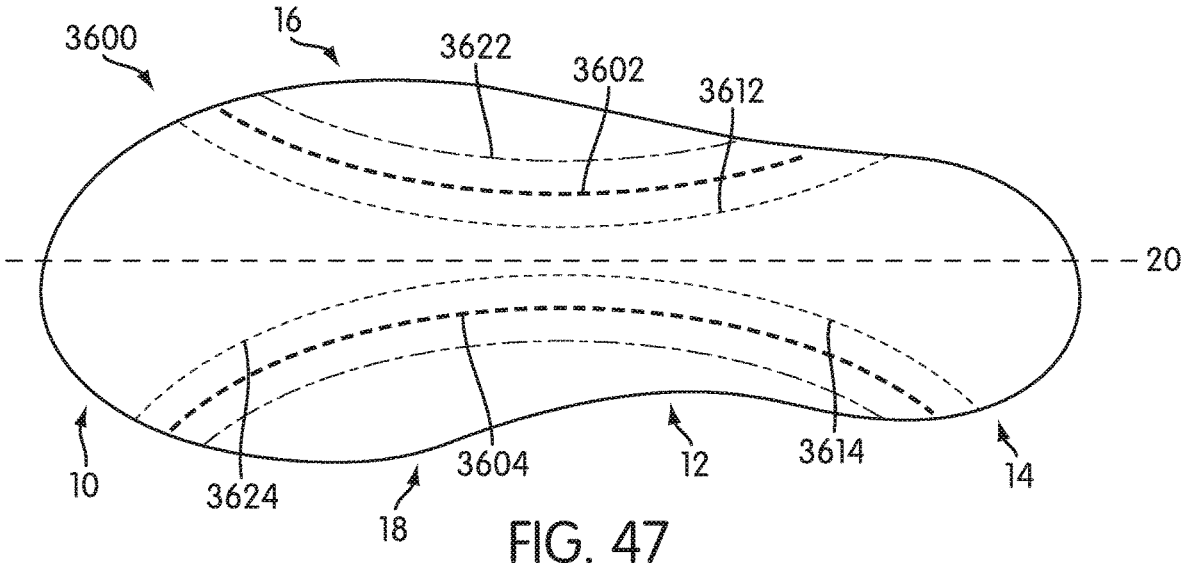
FIG. 47 is a schematic view of various attachment mechanisms for attaching a decoupled foot stabilizer system to a base portion.

Referring now to FIG. 47, an attachment area 3600 for securing a foot stabilizer system to a base portion and/or a portion of an upper may be associated with a horseshoe shape. In some embodiments, horseshoe shaped attachment area 3600 may be defined by various horseshoe attachment portions. In some embodiments, horseshoe shaped attachment area 3600 may be defined by a first horseshoe attachment portion 3602 on lateral side 16 and a second horseshoe attachment portion 3604 on medial side 18. In this embodiment, first horseshoe attachment portion 3602 and second horseshoe attachment portion 3604 may selectively decouple portions of a foot stabilizer system from a base portion and/or a portion of an upper.

In one embodiment, each of first horseshoe attachment portion 3602 and/or second horseshoe attachment portion 3604 may start and terminate adjacent to an outer periphery of the base portion at forefoot region 10 and heel region 14, respectively. As first horseshoe attachment portion 3602 and/or second horseshoe attachment portion 3604 extend through midfoot region 12, each of first horseshoe attachment portion 3602 and/or second horseshoe attachment portion 3604 is located closer to the center of the base portion. With this arrangement, a foot stabilizer system may be selectively decoupled from an article at midfoot region 12. In an exemplary embodiment, first horseshoe attachment portion 3602 and second horseshoe attachment portion 3604 may be substantially similar, respectively, to first horseshoe attachment portion 1900 and second horseshoe attachment portion 1902, as described above.

In some embodiments, horseshoe shaped attachment area 3600 may include one or more horseshoe attachment portions on lateral side 16 and/or medial side 18 that may be disposed at a distance that is closer or farther from the outer periphery of the base portion of the article than first horseshoe attachment portion 3602 and/or second horseshoe attachment portion 3604. In one embodiment, a third horseshoe attachment portion 3612 may extend through midfoot region 12 of the base portion at a distance that is farther from the outer periphery than first horseshoe attachment portion 3602. Similarly, a fourth horseshoe attachment portion 3614 may extend through midfoot region 12 of the base portion at a distance that is farther from the outer periphery than second horseshoe attachment portion 3604. In this embodiment, third horseshoe attachment portion 3612 and fourth horseshoe attachment portion 3614 may define a narrower width for attachment area 3600. With this arrangement, third horseshoe attachment portion 3612 and/or fourth horseshoe attachment portion 3614 may be configured to increase the degree of decoupling provided between a foot stabilizer system and an article.

In another embodiment, a fifth horseshoe attachment portion 3622 may extend through midfoot region 12 of the base portion at a distance that is closer to the outer periphery than first horseshoe attachment portion 3602. Similarly, a sixth horseshoe attachment portion 3624 may extend through midfoot region 12 of the base portion at a distance that is closer to the outer periphery than second horseshoe attachment portion 3604. In this embodiment, fifth horseshoe attachment portion 3622 and sixth horseshoe attachment portion 3624 may define a wider width for attachment area 3600. With this arrangement, fifth horseshoe attachment portion 3622 and/or sixth horseshoe attachment portion 3624 may be configured to decrease the degree of decoupling provided between a foot stabilizer system and an article.

In some embodiments, horseshoe shaped attachment area 3600 may be configured to vary between lateral side 16 and medial side 18 of an article. In an exemplary embodiment, a combination of any one or more of first horseshoe attachment portion 3602, second horseshoe attachment portion 3604, third horseshoe attachment portion 3612, fourth horseshoe attachment portion 3614, fifth horseshoe attachment portion 3622, and/or sixth horseshoe attachment portion 3624 may be used in any one or more of forefoot region 10, midfoot region 12, and/or heel region 14 on lateral side 16 and/or medial side 18 of an article. With this arrangement, a foot stabilizer system may be selectively decoupled from an article in greater or smaller degree across various regions and/or sides of the article. In various embodiments, using different variations of horseshoe shaped attachment area 3600, a foot stabilizer system may be configured for various sports and activities with different amounts of support and/or stability.

In different embodiments, the arrangement of various attachment areas, including any one or more of attachment area 3400, hourglass shaped attachment area 3500, and/or horseshoe shaped attachment area 3600, as described in the previous embodiments, on lateral side 16 and/or medial side 18 in forefoot region 10, midfoot region 12, and/or heel region 14, as well as the intentional decoupling of portions of a foot stabilizer system from a base portion and/or a portion of an upper, may be designed for particular performance parameters associated with different athletic movements. For example, midfoot region 12 of the foot stabilizer may be decoupled from the base portion in articles of footwear used in sports with frequent lateral movements. In other cases, a pair of footwear may have different arrangements of attachment areas for the foot stabilizer system on each of the left and right articles of footwear.

Figure 48:
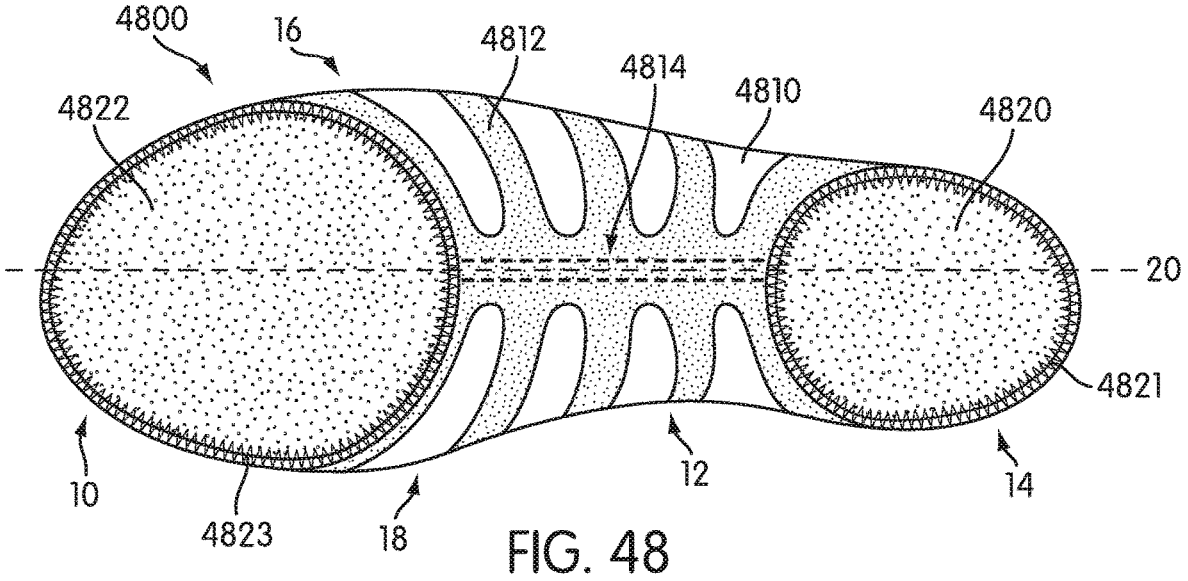
FIG. 48 is a schematic view of an alternate embodiment of a base portion for attaching a foot stabilizer system.

In some embodiments, attachment areas may be provided for securing a foot stabilizer system to a combination of different types of base portions. Referring now to FIG. 48, in this embodiment, pod attachment area 4800 may include attachment portions associated with one or more base portions, as described in the various embodiments above. In this embodiment, one base portion including a bottom surface 4810 formed by folded over portions of an upper may be provided substantially in midfoot region 12. Additionally, one or more base portions, including a heel base portion 4820 and/or a forefoot base portion 4822 may be provided, respectively, at heel region 14 and forefoot region 10.

In some embodiments, pod attachment area 4800 may include a first center attachment portion 4814 attaching a foot stabilizer system 4812 to bottom surface 4810 substantially along longitudinal axis 20 at midfoot region 12. In an exemplary embodiment, pod attachment area 4800 may include a heel pod attachment portion 4821 attaching foot stabilizer system 4812 to heel base portion 4820 at heel region 14. Similarly, pod attachment area 4800 may include a forefoot pod attachment portion 4823 attaching foot stabilizer system 4812 to forefoot base portion 4822 at forefoot region 10. In an exemplary embodiment, first center attachment portion 4814, heel pod attachment portion 4821, and/or forefoot pod attachment portion 4823 may be attached using any type of stitching, as described above, or other attachment mechanisms described herein.

In this embodiment, heel base portion 4820 and/or forefoot base portion 4822 may be a strobel, as discussed above. Bottom surface 4810 may be a portion of an upper that has been folded under, as discussed above. With this arrangement, foot stabilizer system 4812 may be attached to heel base portion 4820 and/or forefoot base portion 4822 in regions of an article where no decoupling is to be provided, but may be attached to bottom surface 4810 in a specific region or portion of a region in a manner so as to provide selective decoupling in the desired region of the article. In different embodiments, any of the attachment areas described herein may include one or more combinations of base portions and/or portions of an upper arranged in a pod arrangement corresponding to different regions of article, as shown in FIG. 48.

In different embodiments, pod attachment area 4800 may be attached to a sole structure using any attachment mechanism described herein. In one embodiment, heel base portion 4820 and/or forefoot base portion 4822 may be attached to a sole structure by using adhesive along substantially all of heel base portion 4820 and/or forefoot base portion 4822 to attach the foot stabilizer system to heel region 14 and/or forefoot region 10 of the article. In one embodiment, bottom surface 4810 may be attached to a sole structure by using adhesive along a narrow center portion or strip along longitudinal axis 20 to selectively decouple the foot stabilizer system at midfoot region 12 of the article. In various embodiments, one or more portions of pod attachment area 4800 may be attached to a sole structure along forefoot region 10, midfoot region 12, heel region 14, as well as lateral side and medial side to selectively decouple different portions of a foot stabilizer system from an article as described herein.

In different embodiments, one or more strap members of a foot stabilizer system may be arranged with various configurations for being associated with a component for fastening an article of footwear. In some embodiments, one or more distal ends of strap members may be configured to receive a lace. FIGS. 49 through 52 illustrate various alternate exemplary embodiments of different types and/or arrangements of distal ends of strap members that may be configured to receive a lace or similar fastening component.

Figure 49:
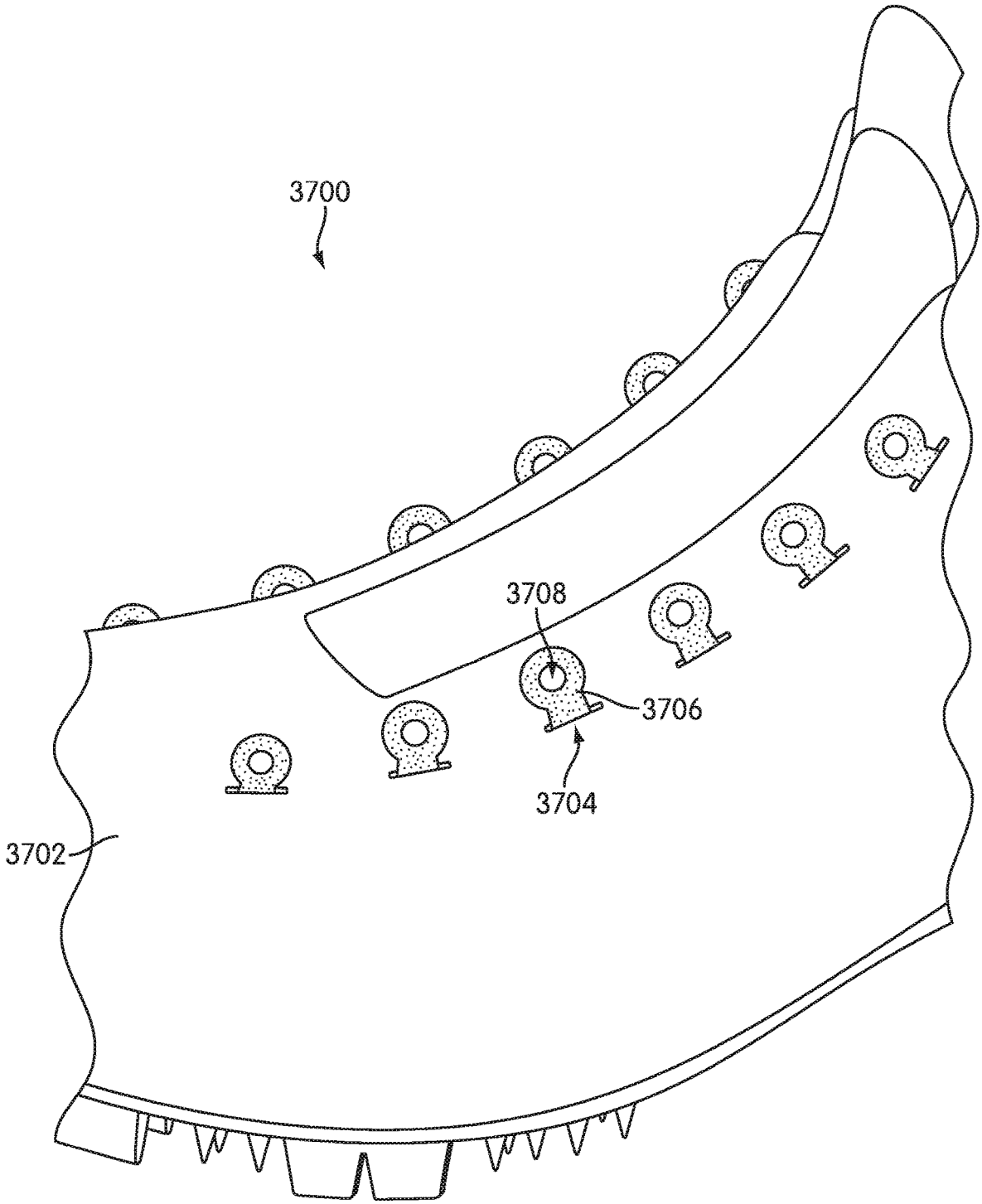
FIG. 49 is a close-up isometric view of an exemplary embodiment of strap members disposed through an upper.

Referring now to FIG. 49, in this embodiment, an upper 3702 includes a plurality of openings, which may be represented by a first opening 3704. First opening 3704 may include any opening in an upper, including openings discussed above, including the plurality of openings 116. In some embodiments, a first fastening arrangement 3700 may be provided at the distal ends of strap members of a foot stabilizer system. In this embodiment, first fastening arrangement 3700 may include a plurality of strap members, which may be represented by first strap member 3706. Each of the plurality of strap members may have a lacing hole, which may be represented by first lacing hole 3708 disposed at the distal end of first strap member 3706. In some embodiments, first lacing hole 3708 may be an eyelet. In some cases, first lacing hole 3708 may be die-cut or stamped in the strap member. In other cases, first lacing hole 3708 may include a grommet. In this embodiment, first lacing hole 3708 associated with first strap member 3706 may extend out through first opening 3704 in upper 3702 from the interior of the article.

Figure 50:
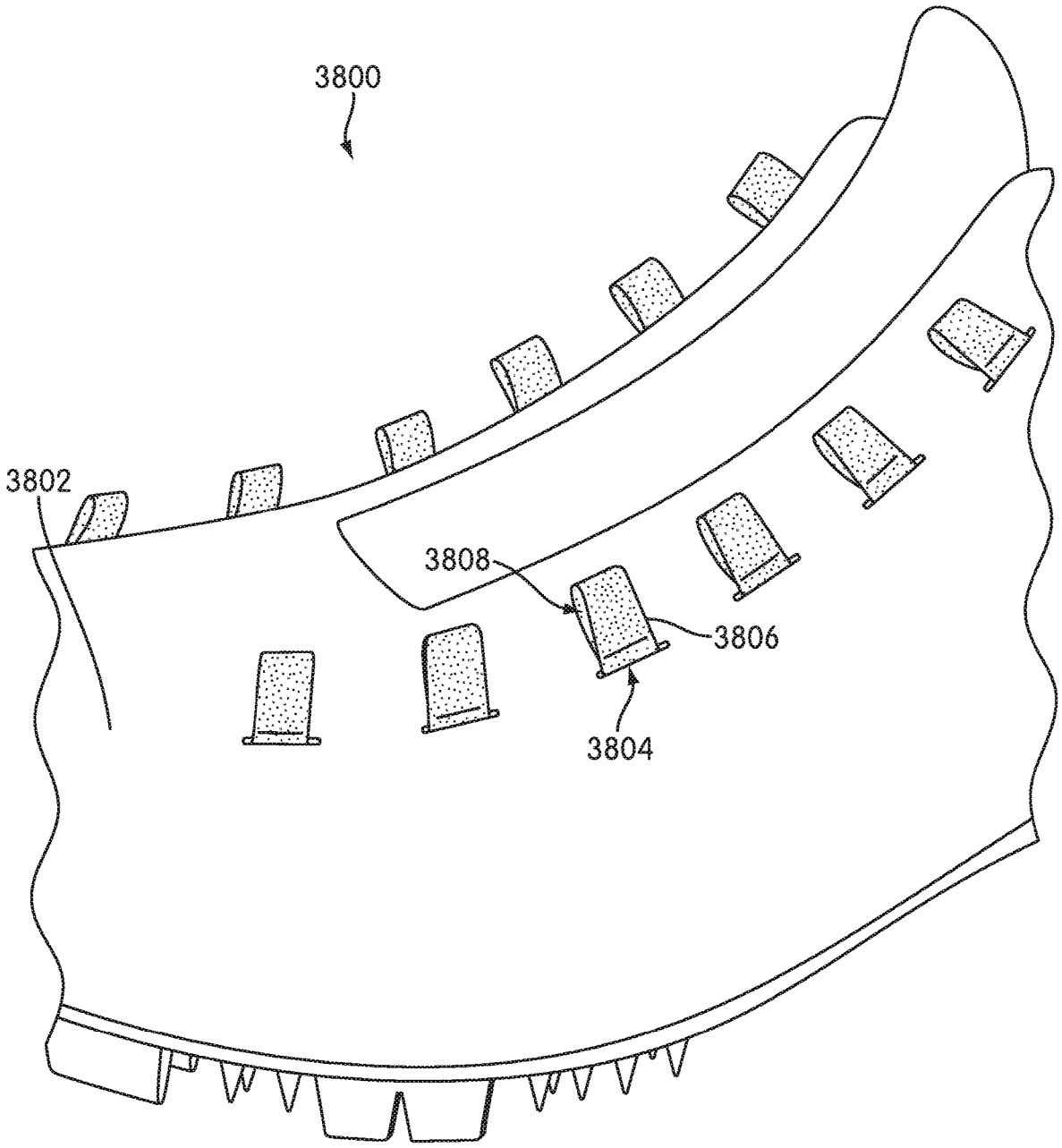
FIG. 50 is a close-up isometric view of an alternate embodiment of strap members disposed through an upper.

Referring now to FIG. 50, in this embodiment, an upper 3802 includes a plurality of openings, which may be represented by a first opening 3804. First opening 3804 may include any opening in an upper, including openings discussed above, including the plurality of openings 116. In some embodiments, a second fastening arrangement 3800 may be provided at the distal ends of strap members of a foot stabilizer system. In this embodiment, second fastening arrangement 3800 may include a plurality of strap members, which may be represented by first strap member 3806. Each of the plurality of strap members may have a lacing hole, which may be represented by first lacing hole 3808 disposed at the distal end of first strap member 3806. In this exemplary embodiment, lacing hole 3808 may be a tab formed by attaching a folded over end of first strap member 3806 to itself.

Figure 51:
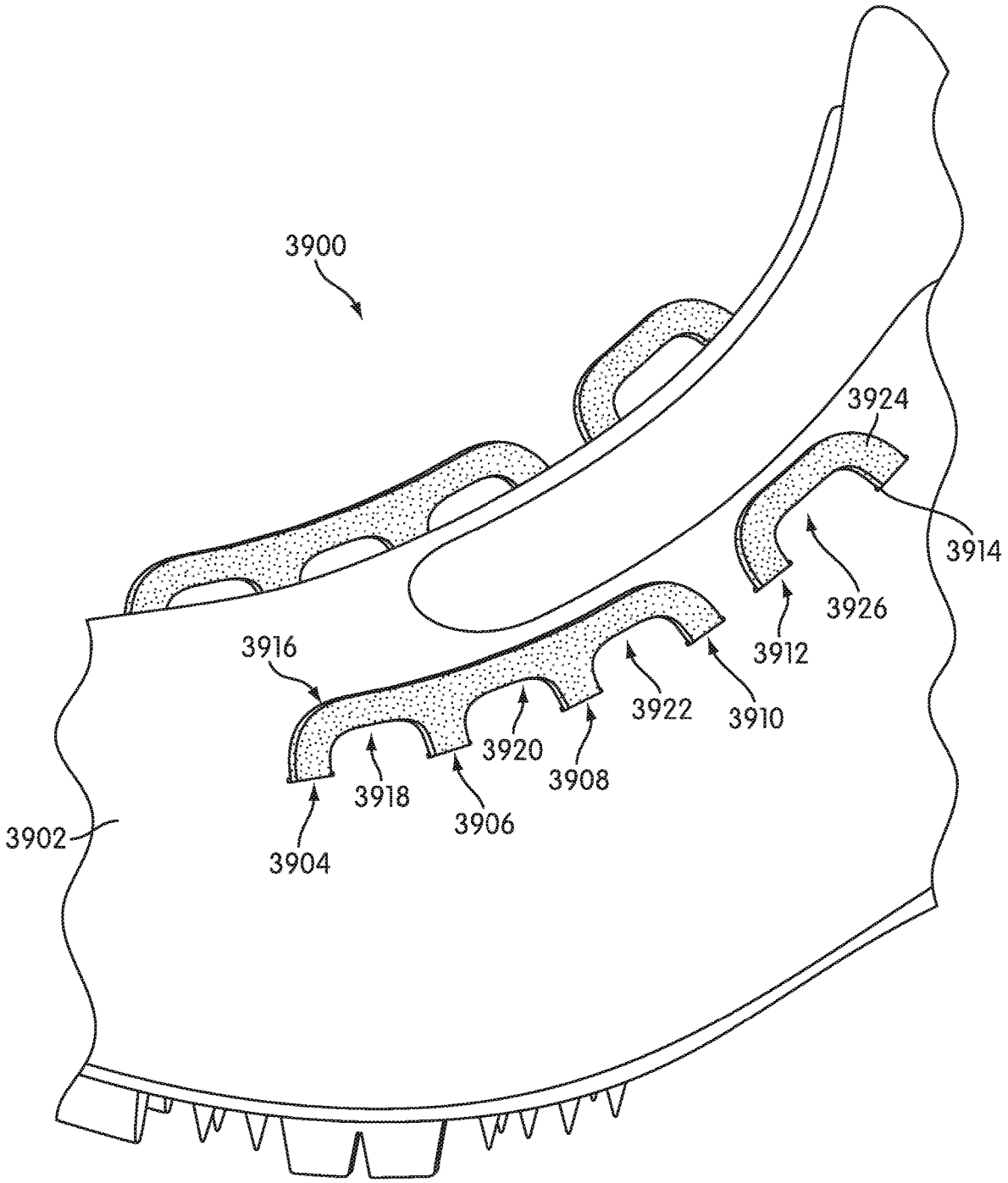
FIG. 51 is a close-up isometric view of an exemplary embodiment of joined strap members disposed through an upper.
Figure 52:
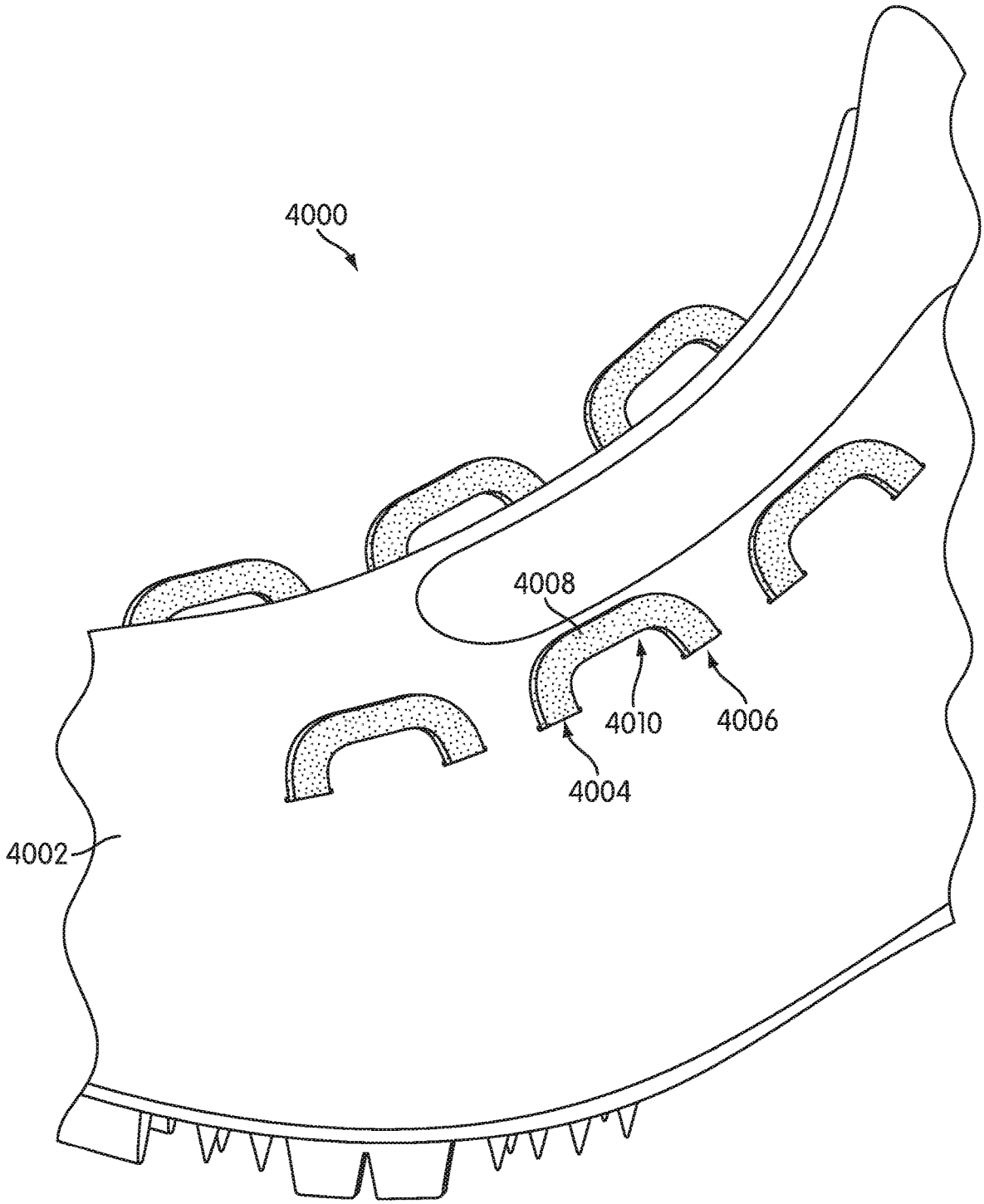
FIG. 52 is a close-up isometric view of an alternate embodiment of joined strap members disposed through an upper.

FIGS. 51 and 52 illustrate alternate exemplary embodiments of distal ends of a plurality of strap members where one or more strap members may be coupled together to form a joined member. Referring now to FIG. 51, in this embodiment, a third fastening arrangement 3900 may include one or more groups of joined strap members. In one embodiment, third fastening arrangement 3900 may include a first joined member 3916 formed by the joined distal ends of a plurality of strap members extending out through a plurality of openings in upper 3902. In this embodiment, upper 3902 includes a first opening 3904, a second opening 3906, a third opening 3908, and a fourth opening 3910 for allowing the individual strap members forming first joined member 3916 to pass through the outer surface of the article. In some embodiments, third fastening arrangement 3900 may include a second joined member 3924. In this embodiment, second joined member 3924 may be formed by the distal ends of strap members extending out through a fifth opening 3912 and a sixth opening 3914 in upper 3902. Similarly, a plurality of corresponding strap members may form additional joined members on the opposing side of the article.

In some cases, first joined member 3916 may be associated with a first number of strap members and second joined member 3924 may be associated with a second number of strap members. In this embodiment, first joined member 3916 may be formed by coupling four individual strap members and second joined member 3924 may be formed by coupling two individual strap members. In different embodiments, each of first joined member 3916 and second joined member 3924 may be associated with various numbers of individual strap members coupled together to form a joined strap member.

In some embodiments, one or more joined members may receive a lace in the hollows between each of the plurality of individual strap members that extend out from openings in upper 3900. In this embodiment, first joined member 3916 may include a first hollow 3918, a second hollow 3920, and a third hollow 3922 disposed between the strap members forming first joined member 3916. Similarly, second joined member 3924 may include a fourth hollow 3926 disposed between the strap members forming second joined member 3924. In an exemplary embodiment, a lace may be run through one or more of first hollow 3918, second hollow 3920, third hollow 3922, and/or fourth hollow 3926, as well as corresponding hollows on the opposing side of the article. With this arrangement, a lace may fasten an article around a foot of a wearer. In other embodiments, the joined members and/or each of the strap members may include one or more lacing holes for receiving a lace. In different embodiments, the joined members and/or each of the strap members may include lacing holes as discussed in various embodiments above.

Referring now to FIG. 52, in this embodiment, a fourth fastening arrangement 4000 may include one or more groups of joined pairs of strap members. In this embodiment, the distal ends of a pair of strap members extend out through openings in upper 4002 to form a first joined member 4008. In this embodiment, upper 4002 includes a first opening 4004 and a second opening 4006 for allowing the individual strap members forming first joined member 4008 to pass through the outer surface of the article. Similarly, distal ends of additional pairs of strap members may extend out through corresponding openings in upper 4002 to form additional joined strap members. In this embodiment, first joined strap member 4008 may include a hollow 4010 for receiving a lace, as described above. In other embodiments, first joined member and/or each of the individual strap members may include one or more lacing holes for receiving a lace, as discussed in various embodiments above.

In some embodiments, one or more joined members may be associated with strap members located in different regions of the article of footwear, including, but not limited to a forefoot region, a midfoot region, and/or a heel region. In some embodiments, one or more joined members on the lateral side and medial side of the article may correspond to the same regions of the article. In other embodiments, one or more joined members on the lateral side and medial side of the article may correspond to different regions of the article.

Referring to FIGS. 51 and 52, in some embodiments, joined members may be formed by coupling a plurality of strap members together. In some cases, the plurality of strap members may be attached to each other to form a joined member. In other cases, the plurality of strap members may be integrally formed together to form a joined member. In one exemplary embodiment, the plurality of strap members may be attached by stitching to form a joined member. In another exemplary embodiment, the plurality of strap members may include additional material used to join together the individual strap members to form a joined strap member.

Figure 53:
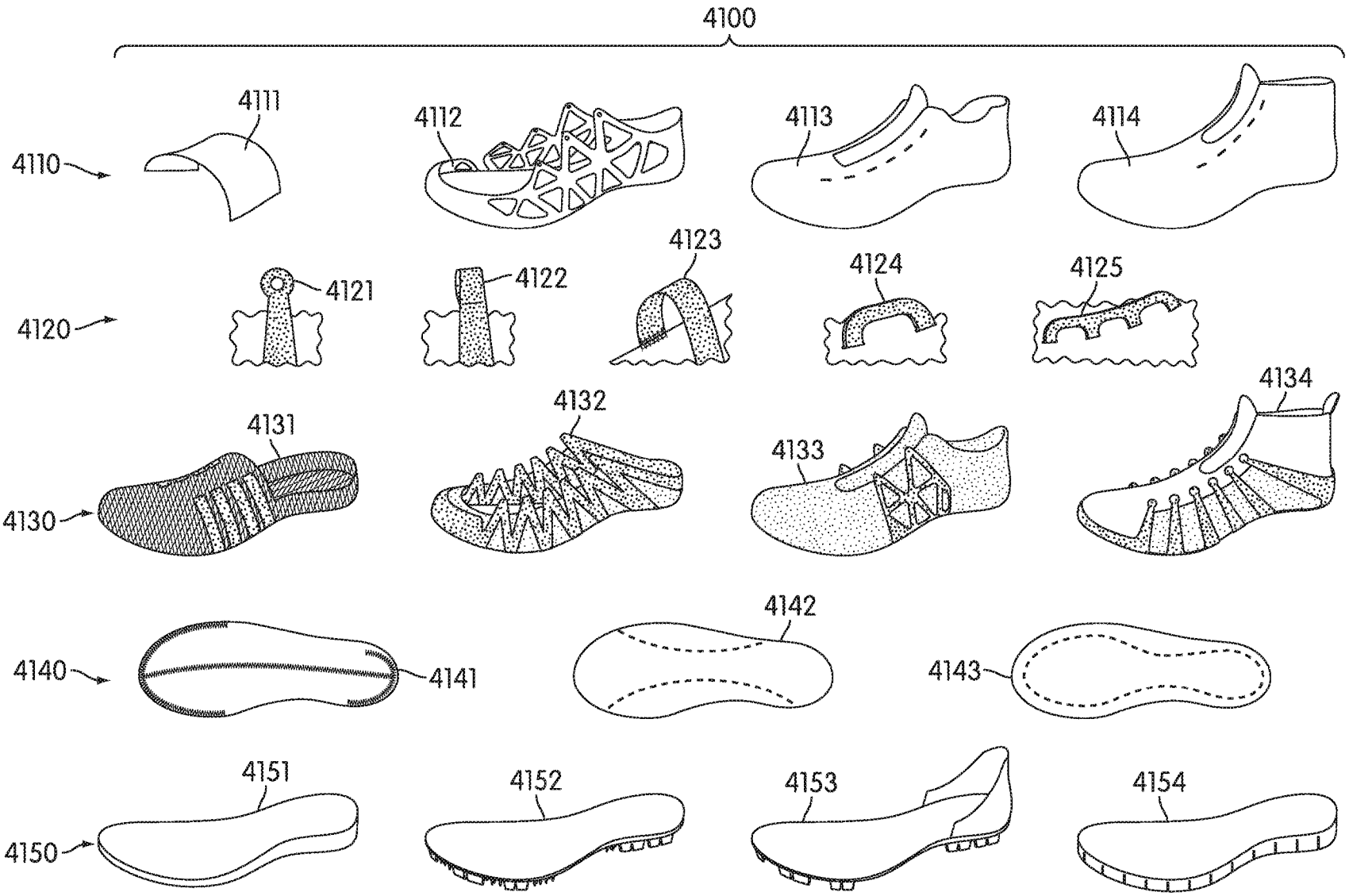
FIG. 53 is a schematic view of various components for assembling an article of footwear with a decoupled foot stabilizer system.

While various embodiments of the invention have been described, it should be understood that any of the features of the various embodiments may be used in combination with any of the other embodiments to assemble different articles of footwear with a decoupled foot stabilizer system. FIG. 53 illustrates a schematic view of various components 4100 for assembling an article of footwear with a decoupled foot stabilizer system. In this embodiment, a number of options may be available for each of the various components 4100. In an exemplary embodiment, one or more types of uppers 4110 may be provided. In this embodiment, types of uppers 4110 may include a sandal upper 4111, a skeletonized upper 4112, a low-top upper 4113, and/or a high-top upper 4114. Types of uppers 4110 may include one or more embodiments of uppers described herein, including, but not limited to: upper 110, upper 1110, upper 1710, and/or upper 2610, as well as any other type of conventional upper used for an article of footwear.

In an exemplary embodiment, various components 4100 may include one or more types of lacing arrangements 4120 for a foot stabilizer system. In this embodiment, types of lacing arrangements 4120 may include an eyelet 4121, a tab 4122, a loop 4123, a hollow 4124, and/or multiple hollows 4125. Types of lacing arrangements 4120 may include one or more embodiments of lacing arrangements described herein, including, but not limited to: distal end 3010 described in FIG. 32, first lacing arrangement 3700, second lacing arrangement 3800, third lacing arrangement 3900, and/or fourth lacing arrangement 4000, as well as any other type of conventional lacing arrangement used for an article of footwear.

In an exemplary embodiment, various components 4100 also may include one or more types of foot stabilizer systems 4130. In this embodiment, types of foot stabilizer systems 4130 may include a partial bootie with a midfoot strap system 4131, a triangular shaped strap system without a bootie 4132, a low-top sock liner with a midfoot triangular shaped strap system 4133, and/or an ankle-length bootie with strap system 4134. Types of foot stabilizer systems 4130 may include one or more embodiments of foot stabilizer systems described herein, including, but not limited to: foot stabilizer system 120, foot stabilizer system 1120, foot stabilizer system 1720, foot stabilizer system 2620, as well as any combination of individual booties and/or strap systems described in any of the various embodiments.

In an exemplary embodiment, various components 4100 may include one or more types of attachment areas 4140 for securing a foot stabilizer system to a base portion and/or a portion of an upper to selectively decouple the foot stabilizer system from an article. In this embodiment, types of attachment areas 4140 may include a central attachment area 4141, a horseshoe shaped attachment area 4142, and/or an hourglass shaped attachment area 4143. Types of attachment areas 4140 may include one or more embodiments of attachment areas described herein, including, but not limited to: attachment area 3400, hourglass shaped attachment area 3500, and/or horseshoe shaped attachment area 3600, as well as any other type of attachment area and/or combination of attachment areas described in any of the various embodiments.

In an exemplary embodiment, various components 4100 may include one or more types of sole structures 4150 for an article of footwear including a decoupled foot stabilizer system. In this embodiment, types of sole structures 4150 may include a conventional sole 4151, a cleated sole 4152, a cleated sole with a heel cup 4153, and/or an articulated sole 4154. Types of sole structures 4150 may include one or more embodiments of sole structures described herein, including, but not limited to: sole structure 140, sole structure 1140, sole structure 1730, and/or sole structure 2640, as well as any other type of conventional sole structure used for an article of footwear.

Additionally, an article of footwear may include one or more components described in the various embodiments herein or included in conventional footwear.

With this arrangement, various components 4100 may be combined with different choices of one or more of types of uppers 4110, types of lacing arrangements 4120, types of foot stabilizer systems 4130, types of attachment areas 4140, and/or types of sole structures 4150, as well as choice of a base portion and any other additional components, to assemble an article of footwear with a decoupled foot stabilizer system.

Figure 54:
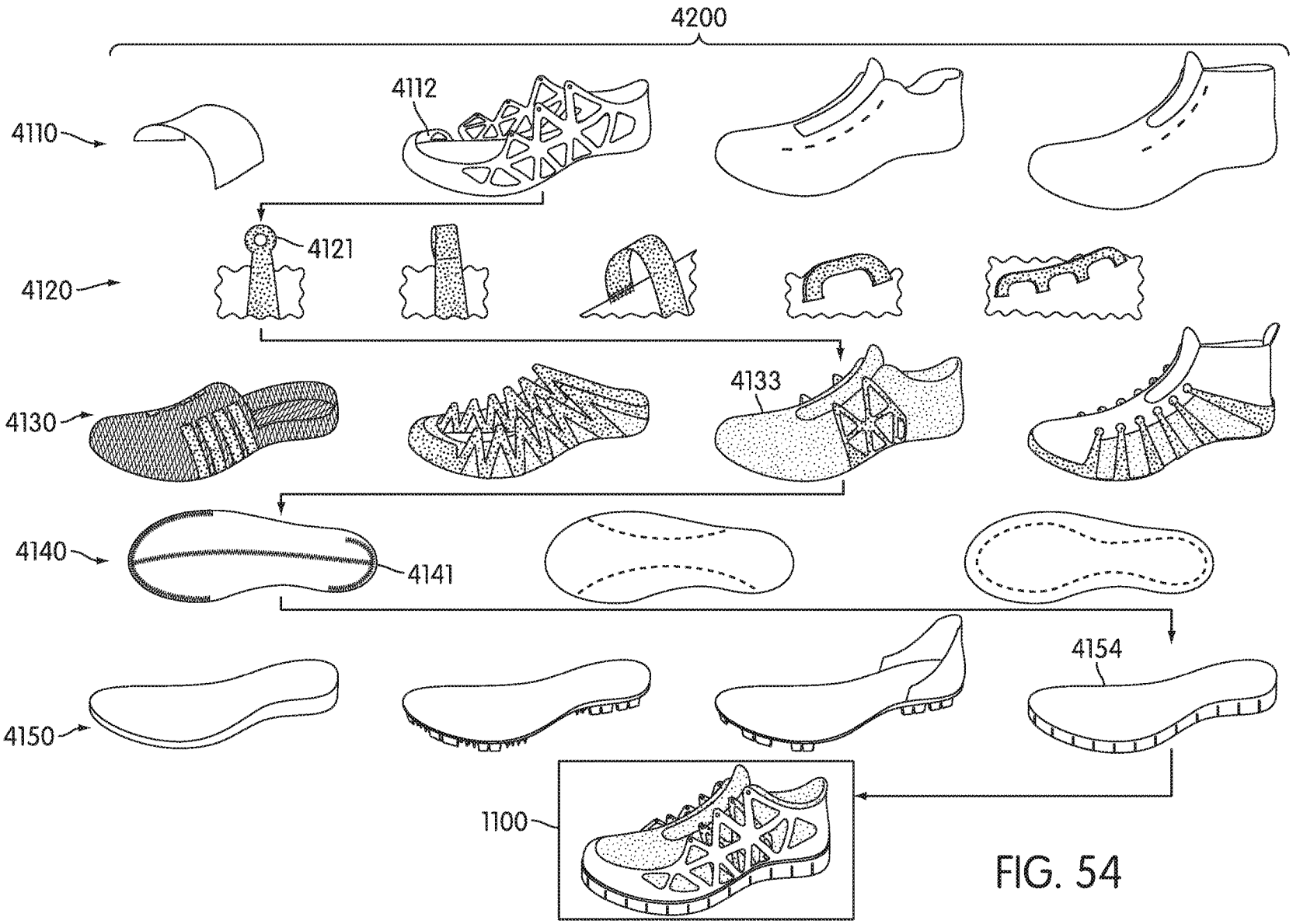
FIG. 54 is a schematic view of an exemplary embodiment of assembling components to form the alternate embodiment of an article of footwear including a decoupled foot stabilizer system of FIG. 13.

Referring now to FIG. 54, a schematic view of a choice of components 4200 is illustrated to assemble alternate exemplary embodiment of an article of footwear 1100, as described above. In this embodiment, skeletonized upper 4112 may be combined with an eyelet 4121 lacing arrangement, a low-top sock liner with a midfoot triangular shaped strap system 4133, a central attachment area 4141, and an articulated sole 4154 to form article 1100.

Figure 55:
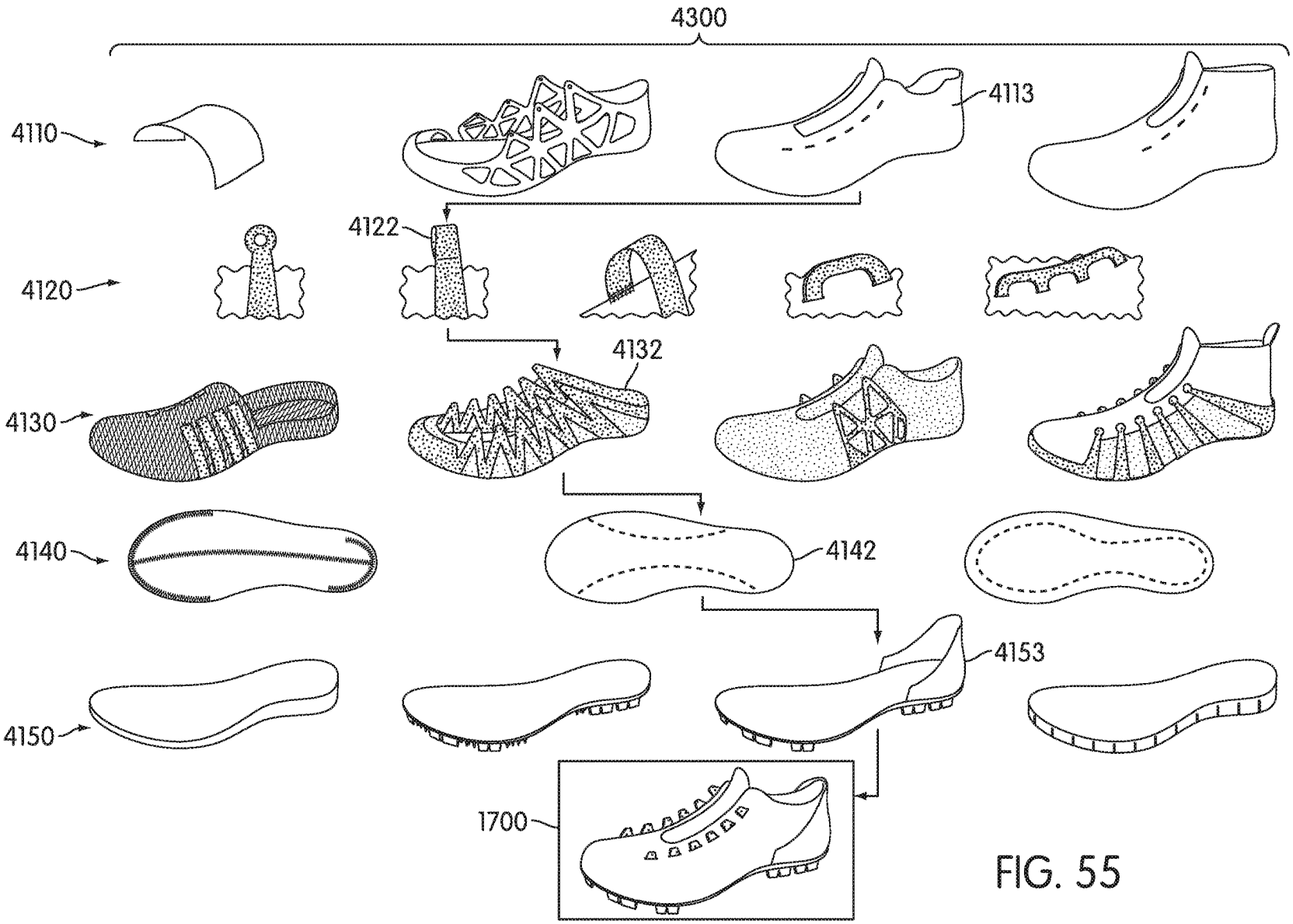
FIG. 55 is a schematic view of an exemplary embodiment of assembling components to form the alternate embodiment of an article of footwear including a decoupled foot stabilizer system of FIG. 19.

In a similar manner, FIG. 55 illustrates a schematic view of a choice of components 4300 to assemble alternate exemplary embodiment of an article of footwear 1700, as described above. In this embodiment, low-top upper 4113 may be combined with a tab 4122 lacing arrangement, a triangular shaped strap system without a bootie 4132, a horseshoe shaped attachment area 4142, and a cleated sole with a heel cup 4153 to form article 1700.

Figure 56:
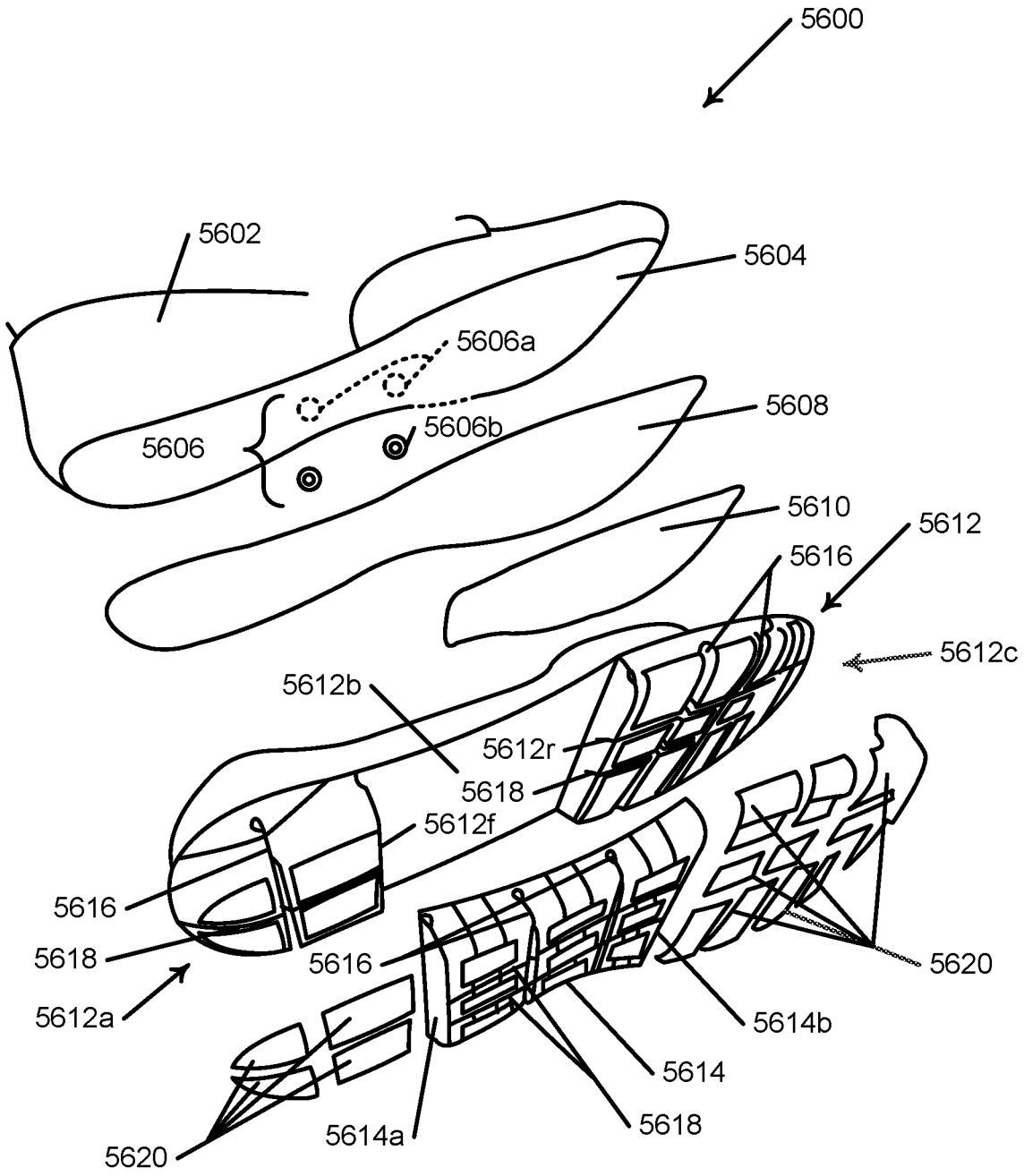
FIG. 56 is a view showing various components of an example golf shoe in accordance with some aspects of this invention.

Foot stabilizer systems of the various types described above also may be used in conjunction with golf shoes. FIG. 56 provides an exploded view of one example golf shoe construction 5600 in accordance with some aspects of this invention. As shown, this example golf shoe 5600 includes an upper 5602 (a portion of which is shown in FIG. 56) that may be made from any desired materials without departing from this invention, including, for example, polyesters or other fabric or polymeric materials, natural leathers, synthetic leathers, fabrics, polyurethane coated fabrics, and the like. The upper 5602 may be made from any number of individual parts and/or any desired constructions, including from conventional parts and conventional constructions as are known and used in the art. As noted above, the upper 5602 (or other portions of the shoe 5600) may include or may be used in conjunction with foot stabilizer systems, e.g., of the various types described above in conjunction with FIGS. 1 through 55, to provide a customized and/or well supported fit to the user's foot (the stabilizer systems are not shown in FIG. 56 to prevent obscuring the various components to be discussed in more detail). In at least some aspects of this invention, the upper 5602 will be constructed to be quick drying, hydrophobic, lightweight, and abrasion resistant, e.g., including a polyester woven material, optionally with synthetic leather overlays at various areas (which may provide a comfortable feel, quick drying features, lightweight construction, abrasion resistance, and durability).

In this illustrated example construction, the bottom of the upper 5602 is connected to an anatomical sockliner 5604, e.g., by sewing or stitching, by cements or adhesives, by mechanical connectors, etc. This sockliner 5604, which may be made from any desired material(s) or parts (including conventional materials and parts as are known and used in the art, such as fabrics, foams, etc.), may be flexible so as to move comfortably with the foot while adding support and impact force attenuation properties. Further, as shown in FIG. 56, the sockliner 5604 may include one or more ventilation zones 5606 that allow the foot to breathe and that provide drainage when the shoe interior becomes wet. While any desired type of ventilation or drainage system may be provided without departing from this invention, in this illustrated example, the ventilation zones 5606 include one or more openings 5606*a* in the base surface of the sockliner 5604 and eyelets 5606*b* or other structures (e.g., grommets) that help keep the openings 5606*a* open and prevent tearing. If desired, a one way membrane (e.g., GORE-TEX® (available from W.L. Gore & Associates, Inc.) or other material) may be provided to help prevent water from entering the shoe interior through the openings 5606*a* from the outside.

The sockliner 5604 in this example structure 5600 is covered by a footbed member 5608. While the footbed member 5608 may be made from any desired materials and/or constructions without departing from this invention (including conventional materials and constructions as are known and used in the art), in this illustrated example, the footbed member 5608 is made from a leather material (e.g., natural or synthetic leather), optionally with a KEVLAR® barrier material (available from W.L. Gore & Associates, Inc.) provided with it. With this construction, the footbed 5608 is flexible and conforming to the user's foot (and foot motions), while still being lightweight and extremely durable.

Optionally, if desired, as illustrated in FIG. 56, the sole structure also may include a forefoot shield member 5610. This forefoot shield member 5610 may be made from any desired materials and/or constructions without departing from this invention, and in this illustrated example, the forefoot shield member 5610 is made from a thermoplastic material (e.g., a stock sheet plate TPU material) that is puncture and laceration resistant while still being lightweight and flexible. The forefoot shield member 5610 may help moderate the feel of the cleats and cleat mounting structures (to be discussed in more detail below), help moderate the feel of sharp objects on the ground (e.g., stones, sticks, etc.), and help provide a more comfortable feel or ride. While the shield member 5610 could extend the entire length of the shoe (or substantially the entire length), the midsole member 5612 (discussed next) typically is thicker in the heel area and thus provides adequate moderation of the cleat structures and other sharp objects at the heel. Thus, the shield member 5610 may be limited to the general forefoot area, if desired (which helps reduce overall weight of the sole and maintain better flexibility). Any desired material may be used for the forefoot shield member 5610, including nylons, PEBAX® plastic materials (available from Arkema France Corporation), TPUs, etc. Also, if desired, the forefoot shield member 5610 may be fit into a recess defined in the major surface of the footbed 5608 and/or the midsole member 5612 (to provide a smoother junction and/or feel).

The next element of this example sole structure constitutes a natural motion based midsole member 5612, which is a major impact force attenuating component of this example sole structure. The top surface of the midsole member 5612 may be contoured so as to comfortably support the foot. The bottom of this example midsole member 5612 is divided into three main segments, namely, a heel segment 5612*a*, a midfoot segment 5612*b*, and a forefoot segment 5612*c*. While the midsole member 5612 may be made from any desired materials without departing from this invention, in at least some example footwear items according to this aspect of the invention, the midsole member 5612 will be made from polyurethane foam, ethylvinylacetate ("EVA") foams, PHYLON (an EVA foam material), PHYLITE® (an EVA foam/rubber combination (trademark owned by NIKE, Inc. of Beaverton, Oreg.)), or any other desired lightweight materials that provide adequate support and excellent flexibility. Additionally or alternatively, if desired, the midsole 5612 may include a fluid-filled bladder through some or all of its construction.

This example sole structure further includes an articulated mid-foot component 5614 that fits into the recessed area provided in the midfoot segment 5612*b* of the midsole member 5612. This midfoot component 5614 may be made from a foam material like those described above for midsole member 5612, optionally a somewhat harder or more durable foam. Alternatively, the midfoot component 5614 may be made from another polymeric material. Fitting the midfoot component 5614 into the midfoot area 5612*b* may be accomplished so as to leave: (a) a space or deep flex groove between the rear surface 5614*a* of the midfoot component 5614 and the front surface 5612*f* of the heel segment 5612*a* and (b) a space or deep flex groove between the front surface 5614*b* of the midfoot component 5614 and the rear surface 5612*r* of the forefoot segment 5612*c*. These spaces or flex grooves, optionally along with other deep, transverse (medial side-to-lateral side) flex grooves 5616 (e.g., provided in the heel segment 5612*a*, in the midfoot component 5614, and/or in the forefoot segment 5612*c*), help provide smooth, supportive, weight transfer in the heel-to-toe direction (both forward and rearward) and help provide a more natural motion or feel to the wearer of the shoe (e.g., a feel more akin to being barefoot). Alternatively, if desired, the midfoot component 5614 may be formed integrally with the midsole component 5612 as a unitary construction, and the flex grooves between the midfoot component 5614 and the other midsole regions 5612*a* and 5612*c* may be provided in other manners, e.g., by molding them into the construction, by cutting them into the formed foam materials (hot knife or laser), etc.

Optionally, if desired, flex grooves 5618 also may be provided in the longitudinal (front-to-rear) direction, which help provide smooth, supportive weight transfer in the side-to-side directions and help provide a more natural motion or feel to the wearer of the shoe (e.g., a feel more akin to being barefoot). These flex grooves 5618 also may be provided in any desired manner, e.g., including the various manners mentioned above.

The sole structure further may include one or more outsole elements 5620, e.g., provided to cover area of the bottom of midsole member 5612, e.g., to provide durability. The outsole elements 5620, which are provided in the heel region and the forefoot region in this illustrated example, may be engaged with the midsole member 5612 by adhesives or cements, mechanical connectors, etc. Additionally, outsole elements 5620 also may be provided at one or more locations on the midfoot component 5614. If desired, the outsole elements 5620 also may include traction elements, or the like, including directionally oriented traction elements (e.g., to provide resistance to motion in a certain direction, to provide traction when moving uphill or downhill, to prevent undesired movement in the lateral or medial directions, to prevent rotation of the shoe clockwise or counterclockwise, etc.) e.g., as are conventionally known and used in the art. As another option, one or more areas of the midsole 5612 and/or the midfoot component 5614 may include cleat elements for golf shoes (e.g., removable or permanent), as are known and used in this art. While the outsole elements 5620 may be made from any desired materials, in some example constructions they will be made from traction enhancing rubber or other polymeric materials.

The various parts of the shoe 5600 and/or sole structure shown in FIG. 56 may be connected together in any desired manner without departing from this invention, including in conventional manners as are known and used in the art. Examples of such connections include: stitched or sewn connections; cement or adhesive connections; and mechanical connectors.

Figure 57A:
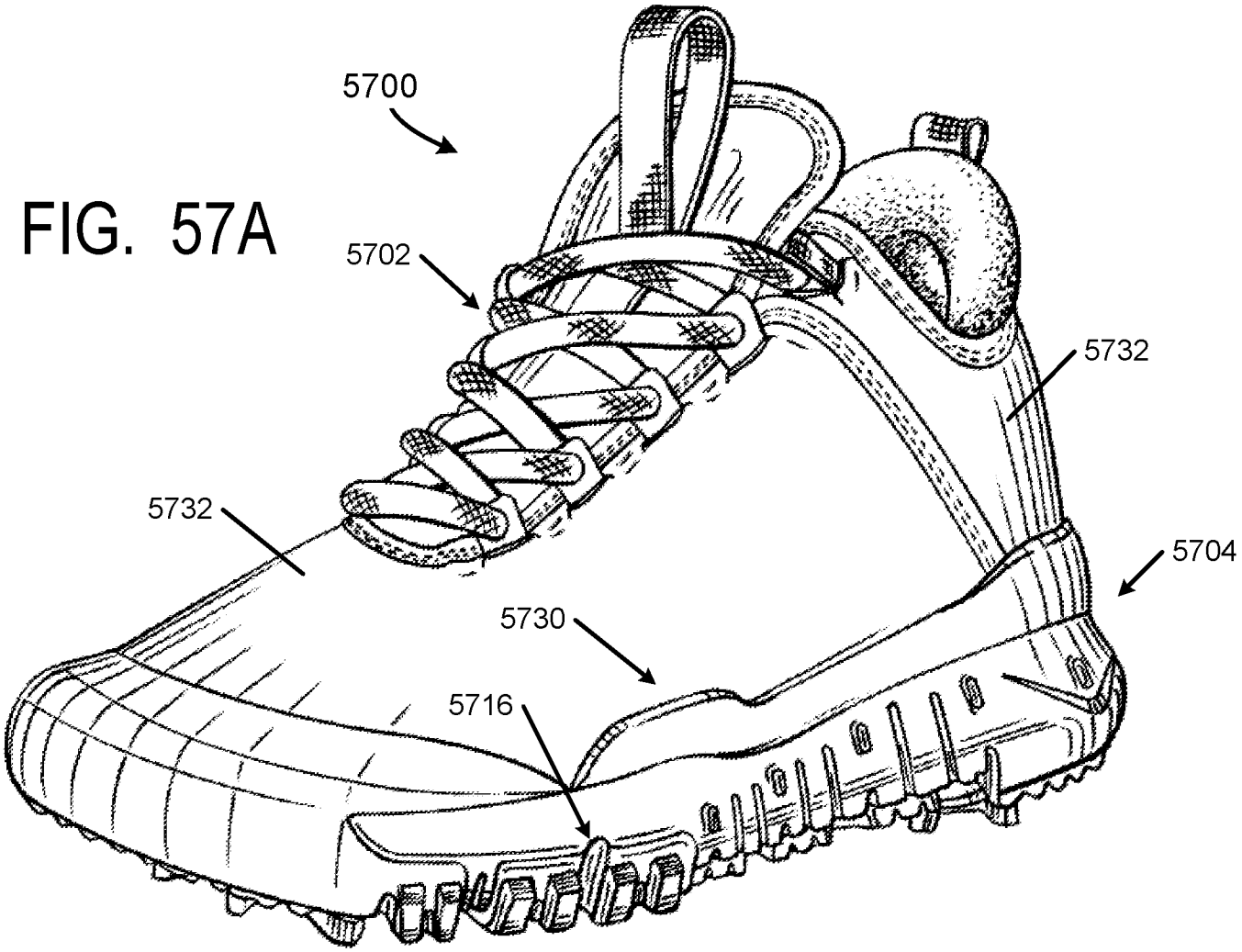
FIGS. 57A through 57C show additional views of an example golf shoe in accordance with some aspects of this invention.
Figure 57B:
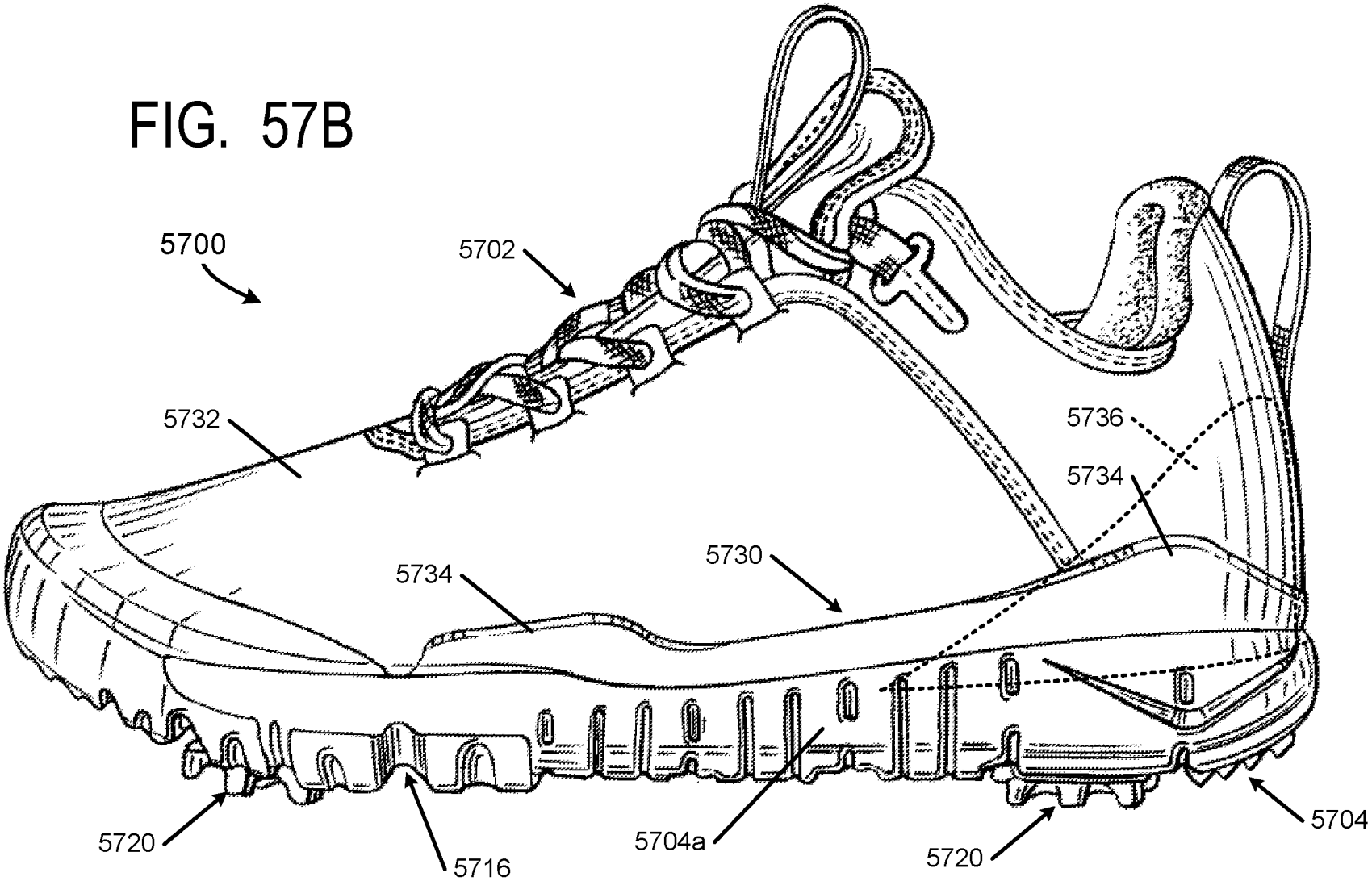
Figure 57C:
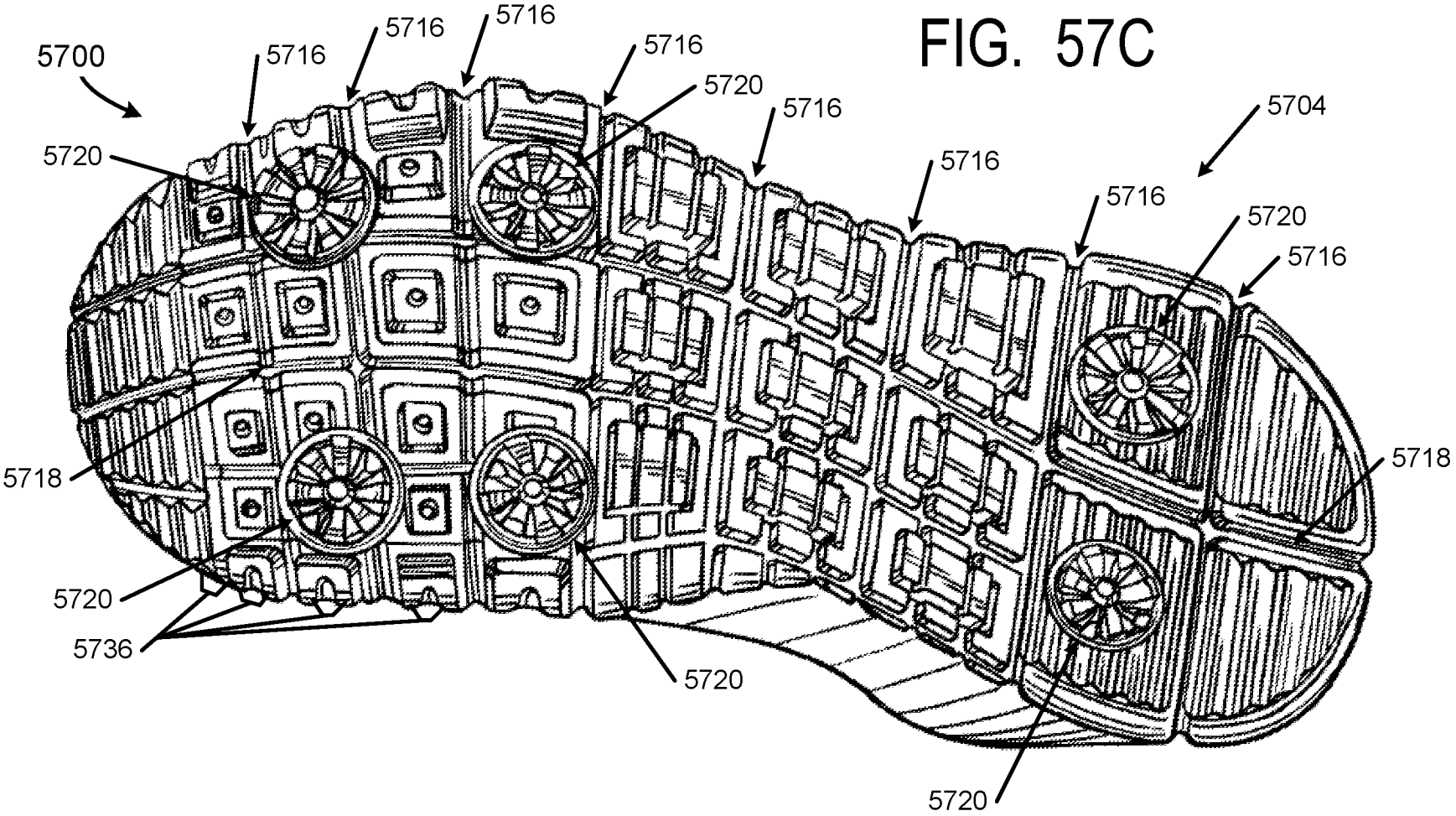

FIGS. 57A through 57C illustrate another example golf shoe 5700 in accordance with aspects of this invention. This example golf shoe 5700 may include a sole structure generally like that described above in conjunction with FIG. 56, although that construction is not a requirement and/or variations on that construction may be provided without departing from this invention. As shown in these figures, this example golf shoe 5700 includes a lacing system 5702 that interacts with a foot stabilizer system, e.g., which may be of the types described above in conjunction with FIGS. 1 through 55 (not shown in detail in FIGS. 57A through 57C). In some example structures according to the invention, the foot stabilizer system will extend and wrap around the rear of the heel and tighten while cupping the rear of the heel, to provide stable containment and feel in the heel. While the upper 5732 of this shoe 5700 may have any desired construction without departing from this invention, in some examples, at least some portion of the upper 5732 will include a polyurethane material, including a stretch fabric material coated with a polyurethane material.

Also, the sole structure 5704 of this example shoe 5700 includes at least one transverse flex groove 5716 (and several are shown in these figures) to provide flexibility in the front-to-rear direction, to provide easy weight transfer in the front-to-rear direction, and to provide a more natural motion and feel for the wearer of the shoe. The transverse flex grooves 5716 may extend completely across the shoe 5700 or across a portion of the shoe 5700 in the side-to-side direction, and the grooves 5716 may be straight or curved.

The sole structure 5704 of this example shoe 5700 further includes at least one longitudinal flex groove 5718 to provide flexibility in the medial side-to-lateral side direction, to provide easy weight transfer in the side-to-side directions, and to provide a more natural motion and feel for the wearer of the shoe. Two main longitudinal flex grooves 5718 are shown in these figures. The main longitudinal flex groove 5718 on the lateral side (outside) of the shoe 5700 includes a double curve (e.g., an "S-shaped" curve) and extends from the forefoot region to the rear, heel region of the shoe 5700. While not absolutely necessary, this groove 5718 is relatively deep throughout its length, but it may be deep through only a portion of its length, if desired, e.g., in any one or more of the forefoot region, the midfoot region, and/or the heel region. The main longitudinal flex groove 5718 on the medial side (inside) of the shoe 5700, in this illustrated example structure, is generally curved and relatively deep at least in the forefoot portion of the shoe 5700, relatively shallow in the midfoot portion of the shoe 5700, and terminates in the heel region of the shoe 5700 before it reaches the rear of the shoe 5700. "Relatively deep" grooves, as that term is used in this specification, means that at least some portion of the groove (e.g., 5716 and/or 5718) has a depth of at least 15% of a thickness of the material into which the groove is made. The flex grooves also may extend through at least 25%, at least 40%, or even at least 50% of the material thickness, in some examples. In some example structures, the flex grooves will be at least % inch deep, and in some examples, at least ⅜ inch deep, or even ½ inch deep.

FIG. 57C further illustrates that this shoe structure 5700 includes removable golf cleat elements 5720 at various locations around the sole bottom surface. Any type of removable cleat element 5720 construction may be used without departing from this invention, including conventional removable cleat elements as are known and used in the art (e.g., with threaded connections, with locking connections, etc.). While other cleat arrangements are possible, this illustrated example shoe 5700 includes four forefoot cleats 5720 (two on the medial side and two on the lateral side) and two rearfoot cleats 5720 (one each on the medial and lateral sides). The cleats 5720 may be provided at locations that do not interfere with the flexibility and/or natural motion feel of the sole 5704 provided by the various flex grooves 5716 and 5718. For example, the cleats 5720 may be provided within the individual "pods" of sole material (e.g., foam material) provided between the flex lines (e.g., between the longitudinal flex lines 5718 and the edges of the shoe, between adjacent transverse flex lines 5716, etc.).

Notably, in the illustrated example, the sole structure 5704 does not include a cleat element directly under the free end of the big toe of the wearer, as is typically the case with conventional golf cleats. Because of the enhanced natural motion aspects of this article of footwear (as will be described in more detail below), the absence of a cleat element under the free end of the big toe provides better ground feel, particularly for the rear foot of the golfer during a downswing phase of the golf swing. The lack of the cleat element directly under the big toe, however, can cause some loss of traction, particularly as the weight on the rear foot moves toward the big toe area at the end of the swing (e.g., at about the time of ball contact). Therefore, if necessary or desired, one or more smaller traction elements 5736 may be provided in the medial, forefoot area of the sole structure, at or near the big toe area, even up on to the medial, forefoot side wall of the sole. These traction elements 5736 may be one or more static, permanent, small nubs, knobbies, teeth, pyramids, or other traction elements 5736 extending from the bottom and/or side wall of the sole at the big toe area of the medial forefoot area (examples shown in FIG. 57C). Other types of traction elements, including small, removable traction elements, may be provided, if desired, without departing from this invention. These additional traction elements 5736 help maintain solid contact with the ground, particularly for the rear foot of the golfer during the downswing and ball contact phases of the golf swing.

The shoe structure 5700 of FIGS. 57A through 57C further includes a side support structure 5730 at least on the lateral side of each shoe 5700. In this illustrated example, the side support structure 5730 extends approximately ⅔ of the way along the lateral side of the shoe 5700 (e.g., from about the little toe area to the central rear heel, and optionally around to the medial side of the heel). This side support structure 5730 provides support for the lateral side of the wearer's foot during a golf swing and helps reduce excessive sinking and supination (e.g., due to over-compression or collapse of the foam material of the midsole), particularly on the forward foot during the golfer's downswing (e.g., at about the time of ball contact and later). This side support 5730 may be made from a foam material, and optionally, it may be integrally formed with other portions of the midsole 5704*a* foam structure. As shown in these figures, the side support 5730 may be somewhat taller at the forward end (e.g., in the midfoot/forefoot region) and at the heel side (the taller areas designated by reference number 5734), with a shallower intermediate area. Alternatively, if desired, the intermediate area could be omitted, and the side support 5730 may constitute a multi-part construction (e.g., a forefoot component and a rearfoot component). This support 5730 (which is also shown in FIG. 56 as part of midsole element 5612) extends generally from the rear heel along the lateral side of the shoe.

FIG. 57B illustrates another feature that may be provided in golf shoes in accordance with at least some examples of this invention. More specifically, FIG. 57B shows a lateral "half" heel counter 5736 that extends from the central, rear heel (at about the foot vertical midline) and along the lateral side of the shoe 5700, in this illustrated example, approximately to the front of the heel or to the beginning of the arch area (e.g., to about the longitudinal distance of the first or second lace engaging eyelet). The lateral half heel counter 5736 is shown in broken lines in FIG. 57B because it is located inside the shoe 5700 and/or between layers of the upper material 5732. This lateral half heel counter 5736 provides additional lateral support for the lateral sides of the feet of the golfer during the course of the golf swing, particularly for the golfer's forward foot on the downswing and rear foot on the backswing. If desired, the half heel counter 5736 could have a flange that extends at least partially under the foot, although it may terminate at the side or edge of the shoe (e.g., and be sewn into the upper), if desired. While this illustrated asymmetric lateral half heel counter 5736 does not extend around the medial side of the heel to any significant degree, a more conventional and symmetrical heel counter could be used, if desired (with some resultant loss of flexibility and/or natural feel). The lateral half heel counter 5736 may be made of any desired material, including materials conventionally used in the art for heel counters, such as nylon, PEBAX® plastic materials (available from Arkema France Corporation), TPU, other polymers, etc.

FIGS. 58A through 58M illustrate various views of another example golf shoe structure 5800 in accordance with some aspects of this invention. FIGS. 58A through 58E show perspective, top, medial side, lateral side, and bottom views, respectively, of this example shoe 5800. The shoe 5800 includes an upper 5802 and a sole structure 5804 engaged with the upper 5802, e.g., in any desired manner, including in conventional manners as are known and used in the art (e.g., through cements or adhesives, through fusing techniques, through mechanical connectors, etc.). The upper 5802 may be made from any desired materials and from any desired construction, including conventional materials and constructions as are known and used in the art. In some shoe structures 5800, the upper 5802 may be made at least in part from one or more of: natural leathers, synthetic leathers, polymeric materials, fabric or textile materials, spacer meshes, etc. The shoe 5800 includes an ankle opening 5806 for receiving a foot (providing access to a foot-receiving chamber of the shoe 5800) and a tongue member 5808 that modulates the feel of the lacing system 5810 on the wearer's foot. The tongue member 5808 may be integrally formed with another part of the upper 5802 as a unitary, one piece construction, or it may be a separate part engaged with the upper 5802 (e.g., by stitching or sewing, by fusing techniques, etc.). As another option, the tongue member 5808 may be replaced in whole or in part by an internal bootie provided within the foot-receiving chamber of the shoe 5800.

The footwear upper 5802 of this shoe 5800 may include a foot stabilizer system, e.g., of any of the types described above with respect to FIGS. 1 through 55. In this specific illustrated example, the upper 5802 includes a foot stabilizer system 5812 (shown, in part, in broken lines in FIGS. 58C and 58D because many of the parts are located inside the shoe 5800) that wraps around at least a midfoot and heel area of the wearer's foot. This example foot stabilizer system 5812 includes a first plurality of strap portions 5812*a* defining first securing system engagement components (e.g., lace engaging components) along a first side (e.g., the medial side) of an instep portion of the upper 5802 and a second plurality of strap portions 5812*b* defining second securing system engagement components along a second side (e.g., the lateral side) of the instep portion of the upper 5802. The foot stabilizer system 5812 and its engagement with the upper 5802 will be described in more detail below in conjunction with FIGS. 58H through 58M.

The upper 5802 of this example structure 5800 further includes a reinforced area 5814, e.g., around the instep opening of the shoe 5800. As will become more apparent from the description below, this reinforced area 5814 (which may include a single, contiguous area or multiple, separated areas) helps support the foot stabilizer system 5812 and the lacing system 5810 (e.g., helps prevent stretching and/or tearing of the upper material as the lacing system 5810 is tightened). This reinforced area 5814 may be made of a separate piece of material applied to the upper 5802 (e.g., leather, polymeric material, fabric or textile material, etc.), or it may simply constitute a thickened area of the same material as the upper 5802. Additionally or alternatively, if desired, the toe area of the shoe 5800 may include a similar toe reinforced area 5816 in a similar manner, e.g., to prevent wear or abrasion in the toe area). Any desired type of reinforcements may be used, if necessary or desired, without departing from this invention, and the materials of these reinforced areas 5814 and 5816 may be applied to the upper 5802 (if necessary) in any desired manner, including through the use of adhesives or cements, through fusing techniques (e.g., hot melt application using pressure and heat), through mechanical connectors, and the like.

The upper 5802 of this example golf shoe structure 5800 further includes side perimeter supports 5818, e.g., to help support the lateral and medial sides of the foot. These perimeter side supports 5818 extend around the heel area and along both the side heel and midfoot areas of the shoe 5800, and optionally into the forefoot area of the shoe 5800. These perimeter side supports 5818 (which may be made from one or more parts) may be made of polymeric foam or other polymeric materials. A single perimeter side support 5818 extending from the lateral forefoot area, around the heel, and to the medial midfoot or forefoot area, is shown in the example structure 5800 of FIGS. 58A through 58D.

The sole structure 5804 of this example shoe 5800 now will be described in more detail. In this illustrated example, the sole structure 5804 includes a midsole member 5820, e.g., made from rubber or a foam material such as polyurethane foam, ethylvinylacetate (EVA) foam, PHYLON (an EVA foam material), PHYLITE® (an EVA foam/rubber combination (trademark owned by NIKE, Inc. of Beaverton, Oreg.)), or the like. The midsole 5820 may be made of conventional materials in conventional manners (e.g., blow molding, injection molding, compression molding, etc.), and it may be engaged with the upper 5802 in convention manners, e.g., using adhesives or cements, using fusing techniques, using mechanical connectors, etc. If desired, the midsole 5820 may constitute a single, unitary, one piece construction with the perimeter side supports 5818 described above, or it may be engaged with the side support 5818, e.g., by adhesives or cements. Also, if desired, the midsole 5820 may include one or more fluid-filled bladders (e.g., at least partially within the foam midsole, etc.).

Figure 58A:
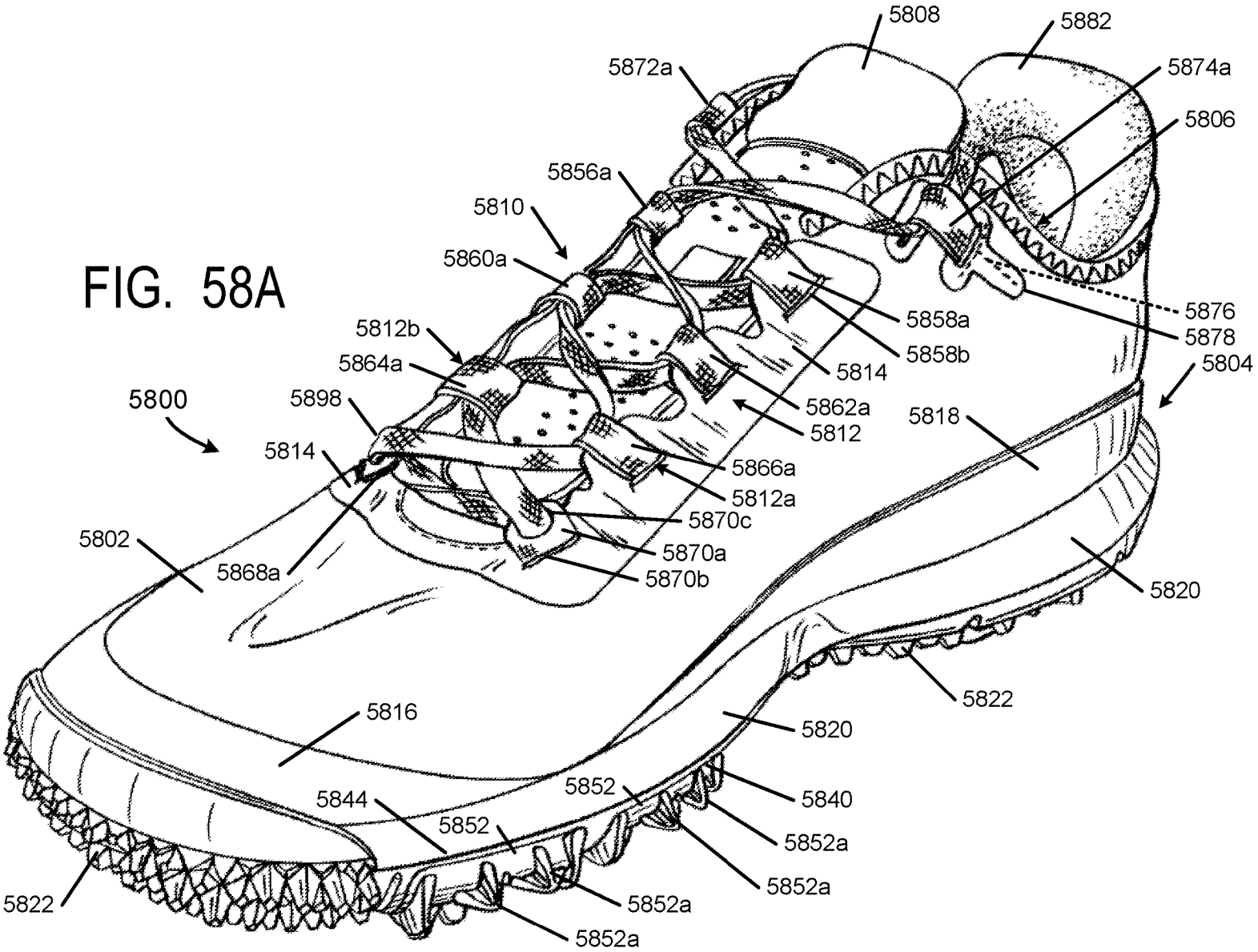
Figure 58B:
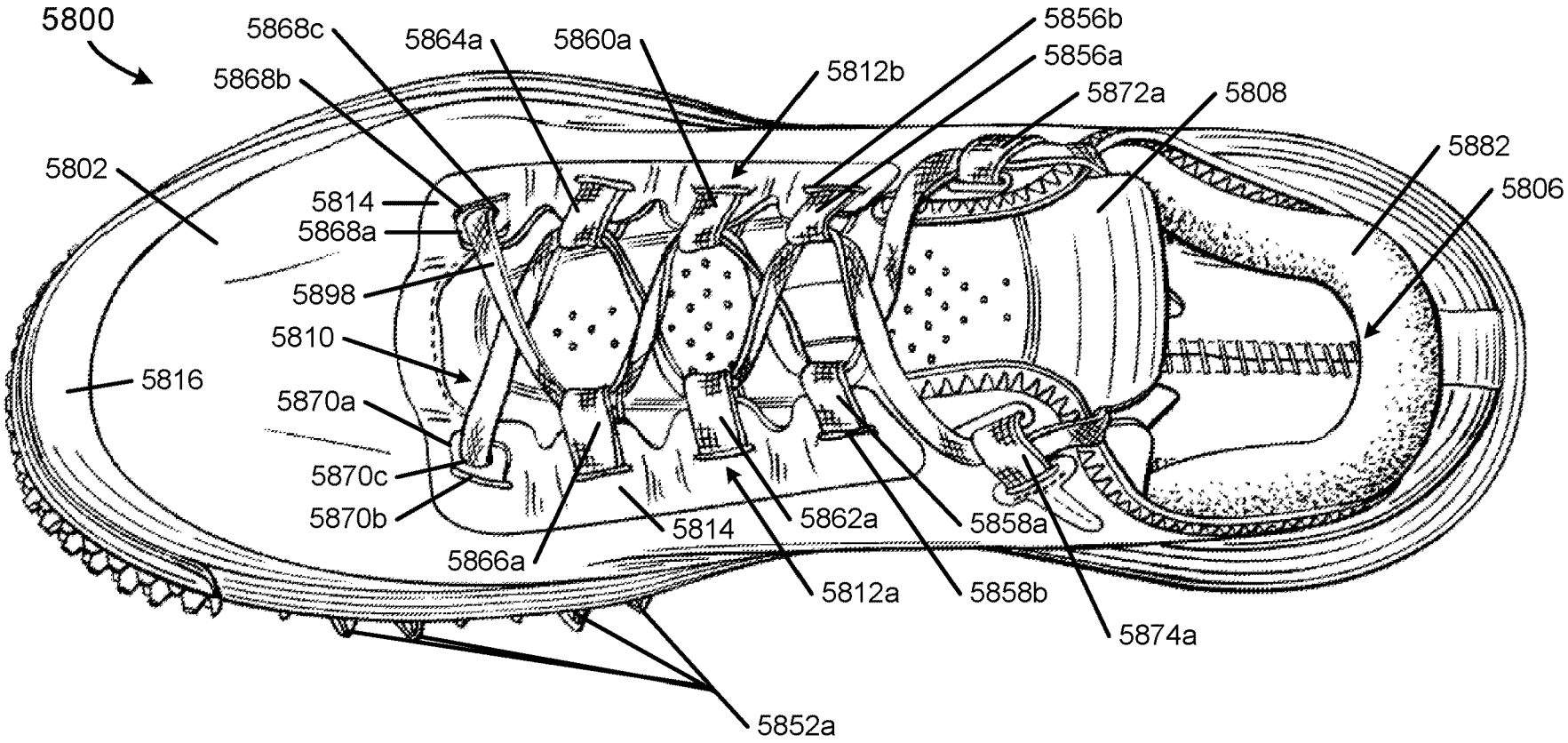
Figure 58C:
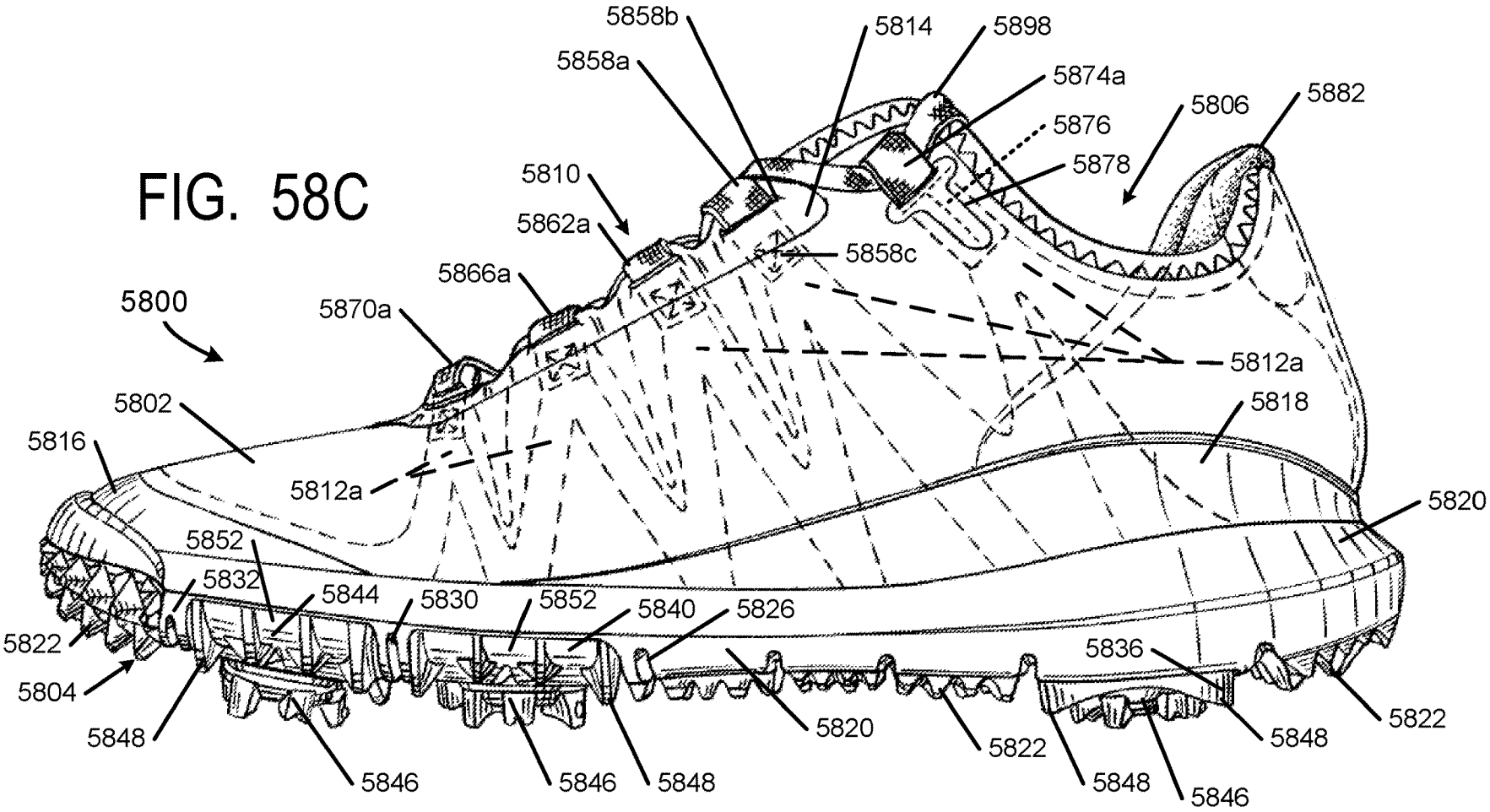
Figure 58D:
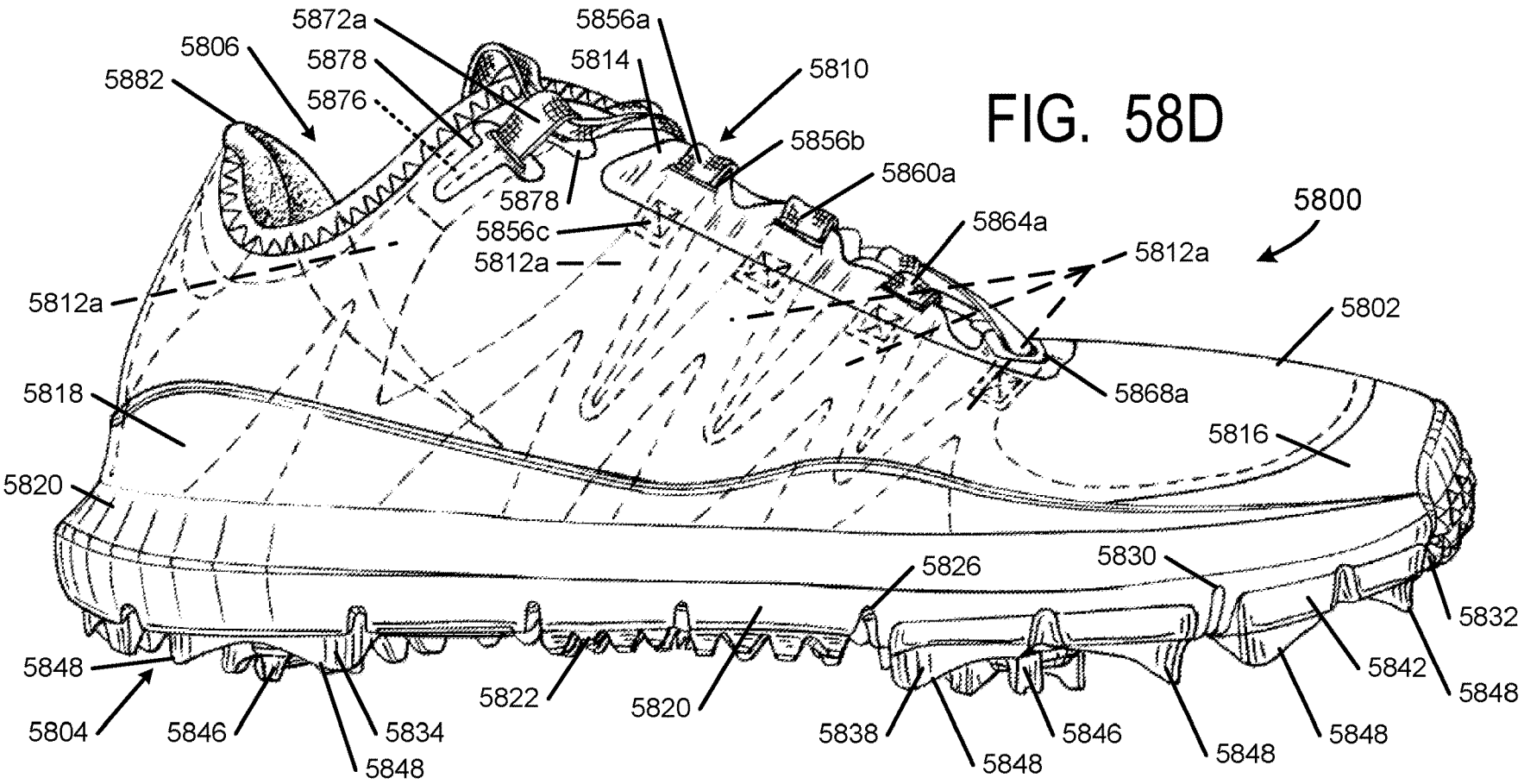
Figure 58E:
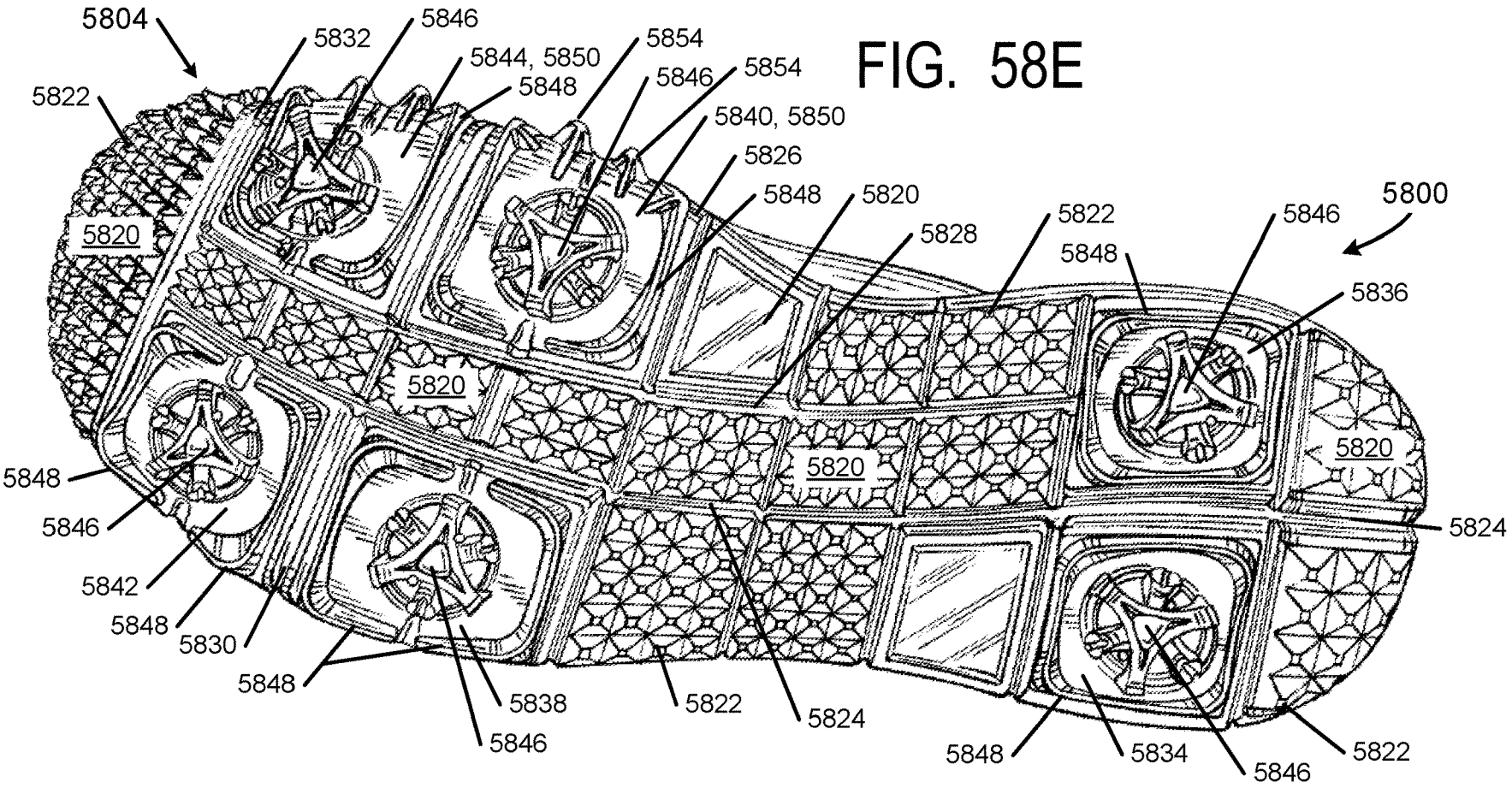

In some example structures 5800 according to this invention, the midsole 5820 will form at least a portion of the exterior surface of the bottom of the sole structure 5804. As shown in FIG. 58E (as well as other figures), the bottom surface of the midsole 5820 may be molded (and/or otherwise shaped) to include pyramids, ridges, ribs, or other traction elements 5822 formed therein. These traction elements 5822 provide secondary traction in this illustrated sole structure 5804. FIG. 58E shows these types of secondary traction elements 5822 at several different areas of the exposed bottom of the midsole 5820, e.g., at most areas between the outsole component pods that support the primary traction elements, which will be described in more detail below.

By using the midsole component 5820 for much of the exterior sole structure 5804 of the shoe 5800, a lighter and/or more flexible overall sole structure 5804 is provided. These features can help enhance more natural flexibility and/or movement of the sole structure 5804 as the golfer walks or shifts his/her weight when swinging a golf club. More natural flexibility and sole movement also may be enhanced by providing groove structures in the midsole member 5820. In the illustrated example of FIG. 58E (as well as other examples described above), the midsole member 5820 includes: (a) a first longitudinal flexion groove 5824 extending from a forefoot region to a rear heel region of the sole structure 5804 and (b) a first transverse flexion groove 5826 extending from a medial side to a lateral side of the sole structure 5804 (e.g., in the midfoot or forefoot area). Additionally, if desired, the midsole member 5820 further may include one or more of: (a) a second longitudinal flexion groove 5828 extending at least in a forefoot region of the sole structure 5804 (e.g., extending from the forefoot region to the heel area of the sole structure 5804 but not all the way to the rear heel), (b) a second transverse flexion groove 5830 extending from the medial side to the lateral side of the sole structure 5804 (e.g., forward of the first transverse flexion groove 5826), and (c) a third transverse flexion groove 5832 extending from the medial side to the lateral side of the sole structure 5804 (e.g., forward of the second transverse flexion groove 5830).

Notably, as shown in the figures, the longitudinal flexion grooves 5824 and/or 5828 may be located at positions with respect to the foot to promote, support, and enhance natural motion of the foot in a side-to-side direction (e.g., as a user's weight shifts on the foot from side to side during a golf swing and/or during a step). Similarly, the transverse flexion grooves 5826, 5830, and/or 5832 may be located at positions with respect to the foot to promote, support, and enhance natural motion of the foot in a front-to-back direction (e.g., as a user's weight shifts on the foot from front to back during a golf swing and/or during a step). Still additional flexion grooves may be provided in the sole structure 5804, if desired, e.g., in the heel area, in other areas to promote natural bending or motion of the foot, in any desired directions or orientations, etc.

The flexion grooves may be provided in any desired manner without departing from this invention. In the illustrated example, the flexion grooves are provided by forming the midsole member 5820 thinner at the region of the groove as compared to the areas immediately around the groove. As some more specific examples, the midsole member 5820 may be formed such that at least a portion of one or more of the flexion grooves extend through at least 15% of a thickness of the midsole member 5820 (e.g., over some portion of the groove, the midsole member thickness in the groove is at least 15% less than the midsole member thickness at areas immediately surrounding the groove). As some further examples, at least some portion of one or more of the flexion grooves may extend through at least 25%, at least 30%, at least 40%, or even at least 50% of the midsole member thickness (e.g., over some portion of the groove, the midsole member thickness in the groove is at least 25%, at least 30%, at least 40%, or even at least 50% less than the midsole member thickness at areas immediately surrounding the groove). The flexion grooves may be formed in the midsole member 5820 during molding of the midsole member 5820, by cutting them into a midsole member (e.g., using a blade (e.g., hot knife cutting) or a laser), or in any other desired manner without departing from this invention.

As noted above, in this example footwear structure 5800, a large portion of the bottom surface of the sole structure 5804 is exposed midsole member 5820. This helps provide a flexible and/or lightweight sole structure 5804. The midsole member 5820, however, may not have adequate strength, durability, and/or wear resistance to function as the complete bottom surface of the sole structure 5804, particularly in view of the forces and loads generated during athletic activities, such as golf (e.g., ground contact with rough, varying terrain and/or surface conditions, twisting or torsional forces, etc.). Accordingly, this example sole structure 5804 includes a plurality of separate outsole components engaged with the midsole member 5820, e.g., at various locations. The outsole components (which will be described in more detail below) may be engaged with the midsole member 5820 in any desired manner, including through the use of cements or adhesives. In this illustrated example, the midsole member 5820 is formed to include "receptacles" (e.g., recessed walls or edges at various predetermined locations) shaped to receive the various outsole components (which are cemented in place within these "receptacles" formed in the midsole member 5820).

The example sole structure 5804 of FIG. 58E includes six separate outsole components (also referred to herein as outsole "pods") engaged with the midsole member 5820 as follows: (a) a first outsole component 5834 located at a lateral heel area of the sole structure 5804 on a lateral side of the longitudinal flexion groove 5824; (b) a second outsole component 5836 located at a medial heel area of the sole structure 5804 on a medial side of the longitudinal flexion groove 5824; (c) a third outsole component 5838 located at a lateral forefoot region of the sole structure 5804 (on the lateral side of the longitudinal flexion groove 5824 and between transverse flexion grooves 5826 and 5830); (d) a fourth outsole component 5840 located at a medial forefoot region of the sole structure 5804 (on the medial side of longitudinal flexion groove 5828 and between transverse flexion grooves 5826 and 5830); (e) a fifth outsole component 5842 located at the lateral forefoot region of the sole structure 5804 (on the lateral side of the longitudinal flexion groove 5824 and on a forefoot side of the transverse flexion groove 5830, between transverse flexion grooves 5830 and 5832); and (f) a sixth outsole component 5844 located at the medial forefoot region of the sole structure 5804 (on the medial side of the longitudinal flexion groove 5828 and on the forefoot side of the transverse flexion groove 5830, between transverse flexion grooves 5830 and 5832). The outsole components 5834 through 5844 may be made from any desired materials, including relative hard, durable, and abrasion resistant materials, such as thermoplastic polyurethanes, thermoplastic rubbers, carbon fiber, PEBAX® plastic materials (available from Arkema France Corporation), and/or other outsole materials as are conventionally known and used in the footwear arts.

Each outsole component 5834 through 5844 of this example sole structure 5804 forms a base on which a primary traction element 5846 is provided. In this illustrated example, the outsole components 5834 through 5844 form a base on which one primary traction element 5846 is provided. The primary traction elements 5846 in this example structure are cleat elements that are releasably engaged with their respective outsole component 5834 through 5844, although permanent mounting and/or integral cleat formation may be used, if desired, without departing from this invention. When releasably engaged, the primary traction elements 5846 may be engaged in any desired manner, including in conventional manners as are known and used in the art, such as threaded connections, cam type connections, etc. In this illustrated example, the sole structure 5804 includes exactly six primary traction elements (cleat elements), two in the heel and four in the forefoot (two on each side).

If desired, and as shown in the example structure 5800 of FIGS. 58A through 58E, each outsole component 5834 through 5844 may be a separate component that is engaged with the midsole component 5820 without contacting or overlapping with another outsole element. Midsole material 5820 may be exposed in the gaps and areas between adjacent outsole components 5834 through 5844, and the flexion grooves of the midsole component 5820 may be provided within these gaps or areas. Maintaining gaps between outsole components 5834 through 5844 can help define the location of the flexion areas to help provide the natural motion characteristics described above.

If necessary or desired, at least some of the outsole components 5834 through 5844 may be provided with additional traction elements. In this illustrated example, additional traction elements are provided in the form of "fin" type cleats or raised ridges 5848 extending around a majority (and optionally all) of the perimeter of the outsole components 5834 through 5844. These secondary ridge or "fin" type cleats 5848 may be provided in any desired manner, and in this illustrated example, they are integrally formed from the material of the outsole components 5834 through 5844 as a unitary, one-piece construction, e.g., during molding or other formation of the outsole components 5834 through 5844.

In some example footwear structures 5800 in accordance with this invention, the outsole components (or pods) need not all be made from the same material and/or have the same characteristics. For example, in some footwear structures 5800 in accordance with this invention, at least one of the lateral forefoot outsole components 5838 and/or 5842 (including their "fin" type cleat elements 5848, if any) will be made from a different material (or from the same material but having a different hardness) than the material of the adjacent medial forefoot outsole components 5840 and/or 5844 (including their "fin" type cleat elements 5848, if any). In the example structure 5800 illustrated in FIGS. 58A through 58E, one or both of the lateral side outsole components 5838 and/or 5842 is made from a harder and/or more rigid material than that of one or both of the medial side outsole component 5840 and/or 5844. As yet another more specific example, one or both of the lateral side outsole components 5838 and/or 5842 may be made from thermoplastic polyurethane materials and one or both of the medial side outsole components 5840 and/or 5844 may be made from thermoplastic rubber materials.

By making the lateral side outsole components 5838 and/or 5842 from a harder, sturdier material, the lateral side outsole components 5838 and/or 5842 of the rear foot provide excellent support particularly during the back swing phase and the beginning of the down swing phase of a golf swing, when a substantial amount of force is applied to the lateral side of the golfer's rear foot. Also, the harder, sturdier material of the lateral side outsole components 5838 and/or 5842 provides a sturdy base at the outside of the front foot as the swing progresses through the ball strike and beyond (as force is applied to the outside of the golfer's front foot). The softer, more pliable and conforming material of the medial side outsole components 5840 and/or 5844 allow the inside of the rear foot to compress into and engage the ground better during the down swing phase of the golf swing (as the weight and force transfers from the outside to the inside of the rear foot).

No specific hardnesses for the lateral and medial side outsole components and/or differences in hardness are required. Nonetheless, in some example structures according to this invention, the lateral outsole components (which may be formed of thermoplastic polyurethane materials) may have a hardness, for example, within the range of 65 Shore A to 80 Shore D. The softer, medial outsole components (which may be formed of thermoplastic rubber materials) may have a hardness, for example, within the range of 20 to 90 Shore A. If desired, in accordance with at least some examples of this invention, the material of at least one forefoot, lateral side outsole component may have a hardness of at least 10 points higher on the Shore D scale than the material of at least one forefoot, medial side outsole component (and in some examples, at least 15 Shore D points higher, or even at least 20 or 25 Shore D points higher).

Figure 58F:
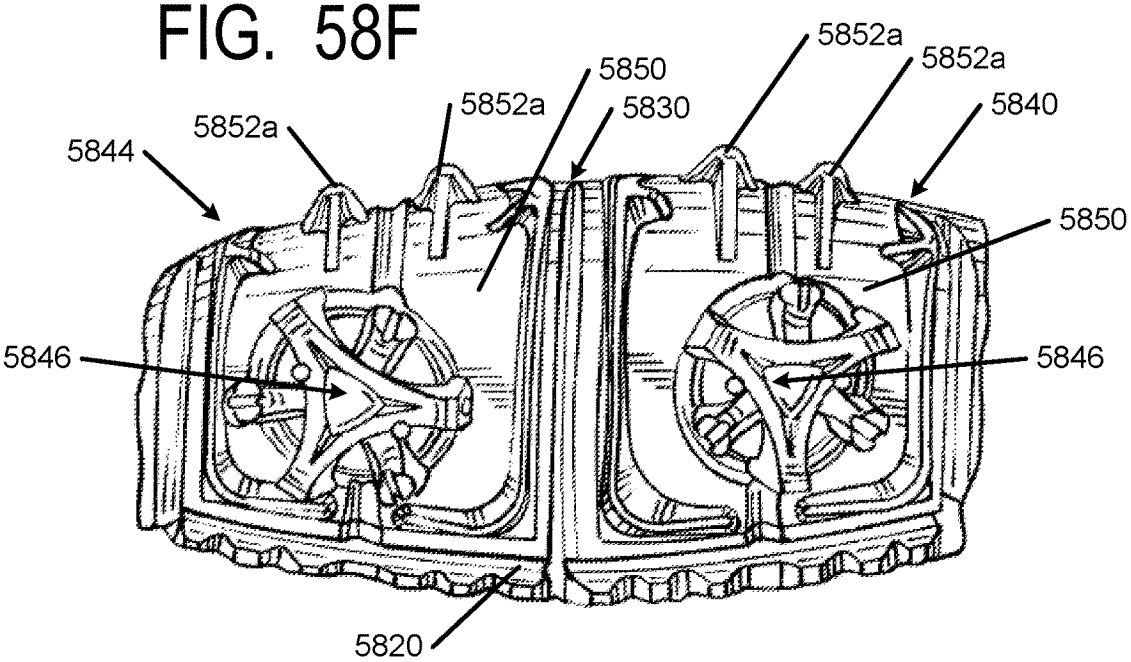
Figure 58G:
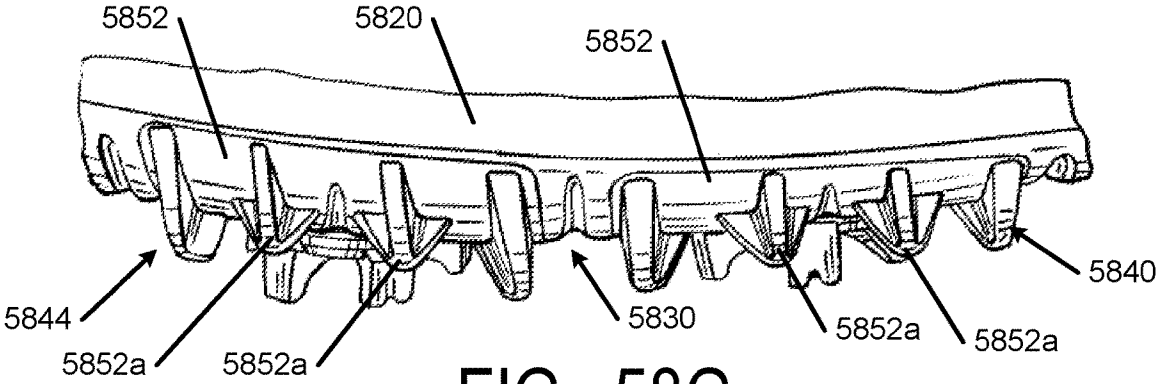

FIGS. 58A through 58C and 58E, along with FIGS. 58F and 58G, illustrate additional features that may be provided in footwear structures 5800 in accordance with at least some examples of this invention. As shown in these figures, each of the medial side outsole components 5840 and 5844 includes a bottom wall portion 5850 and a side wall portion 5852 that extends continuously from the bottom wall portion 5850 to a medial side surface of the midsole member 5820. In other words, the medial, forefoot, outsole components 5840 and 5844 include a side wall 5852 that wraps around and along a portion of the side wall of the midsole member 5820 to provide a side wall on these medial, forefoot outsole components 5840 and 5844. One or more cleat (or other traction enhancing) elements 5852*a* may be provided on the side wall portions 5852. These side wall cleat elements 5852*a*, which may extend away from the shoe in at least a partially sideways direction (and optionally in a slanted downward and sideways direction), provide additional traction on the downswing phase of a golf swing, particularly on the rear foot as the player's weight shifts from the outside of the foot to the inside of the foot. These features can provide improved ground contact and engagement during the golf swing, which can improve the player's power and control.

Figure 58H:
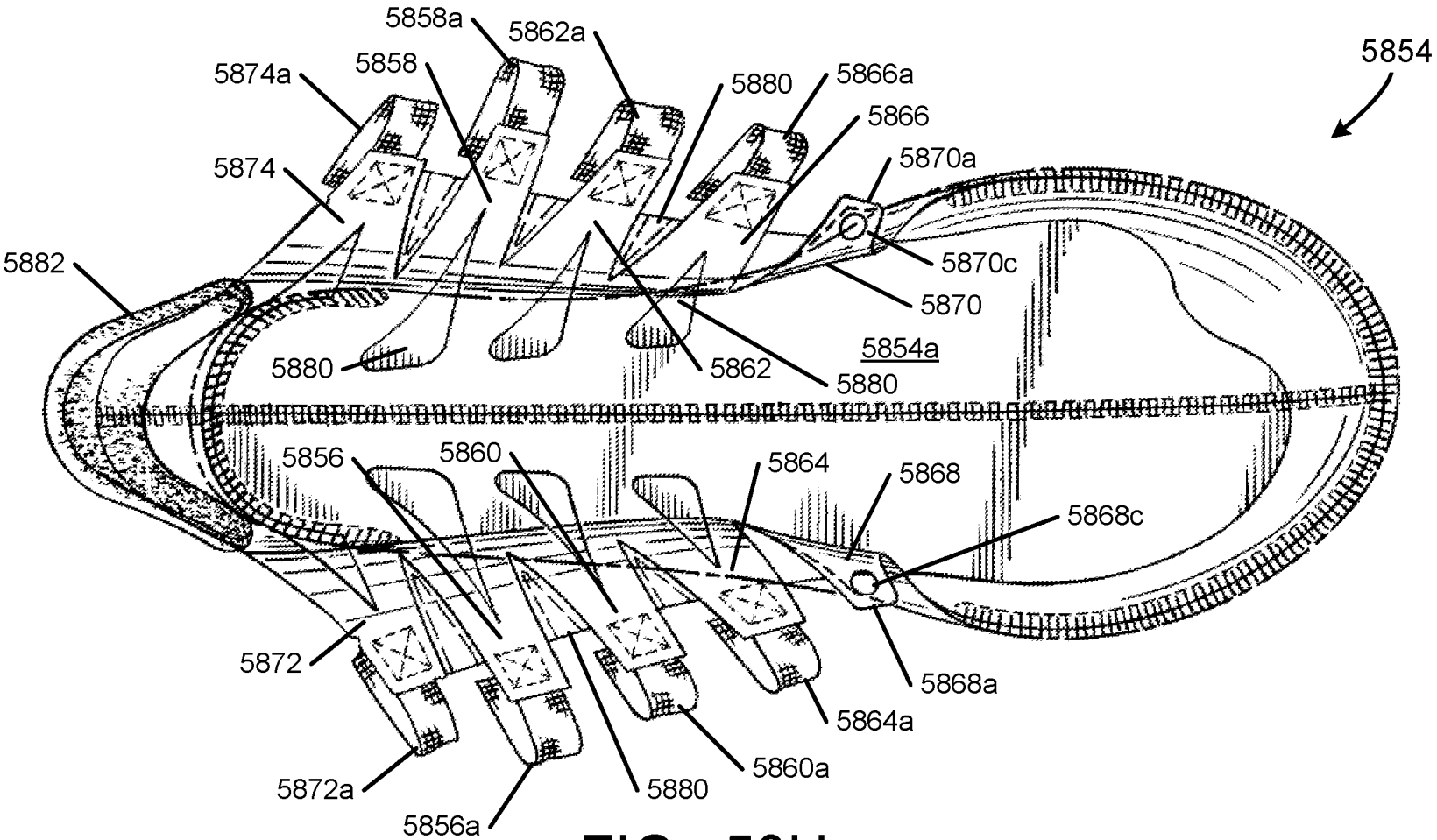
Figure 58K:
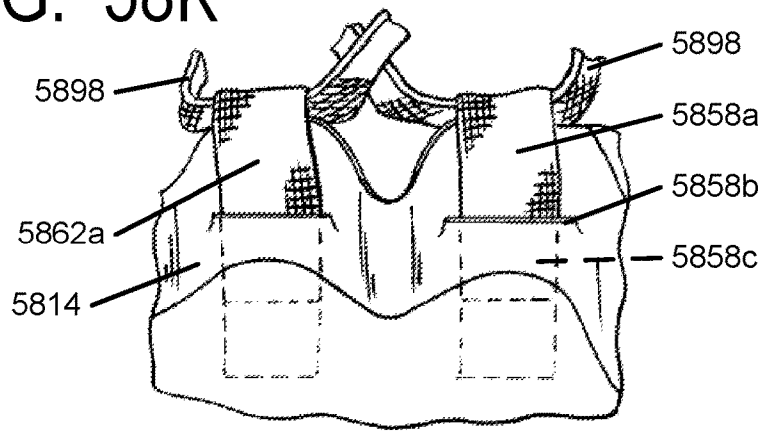
Figure 58M:
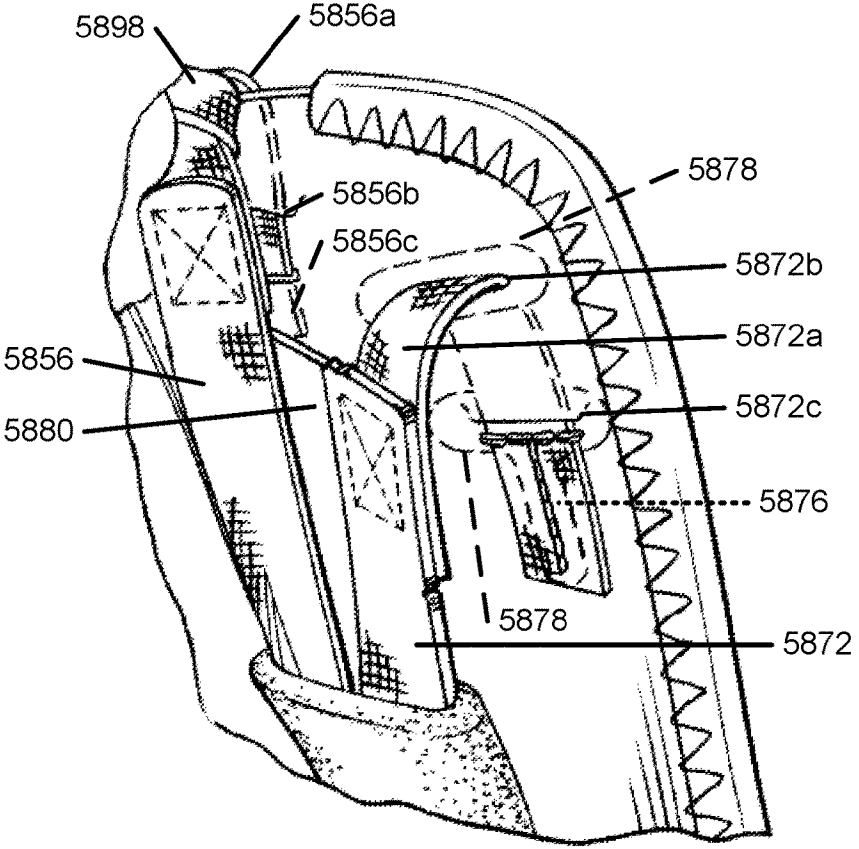
Figure 58L:
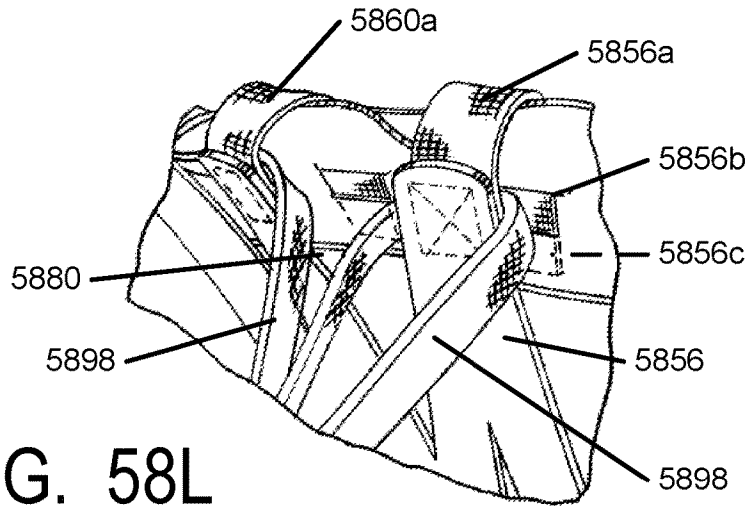

As noted above, the upper 5802 and/or sole structure 5804 described above in conjunction with FIGS. 58A through 58D may be utilized in combination with any desired type of foot stabilizer system, including any of the more specific examples described above in conjunction with FIGS. 1 through 55. More specific examples of suitable foot stabilizer systems 5854 and their engagement with a golf shoe structure 5800 are described below in conjunction with FIGS. 58H through 58M. FIG. 58H generally illustrates an example foot stabilizer system 5854 separated from the upper 5802; FIG. 58I shows an internal view of a portion of the foot-receiving chamber; FIG. 58J shows the heel pad member; FIG. 58K shows an exterior view of some lace engaging loops of the foot stabilizer system 5854; FIG. 58L shows an interior view of some lace engaging loops of the foot stabilizer system 5854; and FIG. 58M shows an interior view of other lace engaging loops of the foot stabilizer system 5854. Portions of this example foot stabilizer system 5854 also are shown in FIGS. 58C and 58D in broken lines, because those portions of the foot stabilizer system 5854 are not visible in the views of FIGS. 58C and 58D.

As shown in FIG. 58H, this example foot stabilizer system 5854 includes portions that wrap around at least a midfoot area and a heel area of a wearer's foot. In fact, this example foot stabilizer system 5854 includes a bottom base portion 5854*a* that supports the entire plantar surface of the wearer's foot. In this illustrated example, the foot stabilizer system 5854 further includes a first strap portion 5856 including a first free end 5856*a* defining a first securing system engagement component (e.g., providing a loop for receiving a shoe lace 5898). This first free end 5856*a* extends from within the foot-receiving chamber, around a lateral side of an instep opening portion of the upper 5802, and into a first opening 5856*b* defined in the upper 5802 (e.g., a slit in the upper 5802). See also FIGS. 58B, 58D, 58I, 58L, and 58M. The first free end 5856*a* is engaged with the upper 5802 (e.g., by stitching or by fusing techniques, as generally shown by reference number 5856*c* in FIGS. 58D, 58L, and 58M). If desired, the opening 5856*b* may extend through the reinforcing material 5814 (if any), to help prevent undesired tearing or enlargement of the opening 5856*b* (e.g., when the lace 5898 pulls on the loop created by the free end 5856*a*).

The medial side of the instep opening portion of upper 5802 includes a similar strap portion 5858 (e.g., which may be generally aligned with and considered as part of a pair with strap portion 5856). With a similar structure to that of strap portion 5856, this second strap portion 5858 includes a second free end 5858*a* defining a second securing system engagement component (e.g., providing a loop for receiving shoe lace 5898). Again, the second free end 5858*a* extends from within the foot-receiving chamber, around the medial instep opening portion of the upper 5802, and into another opening 5858*b* defined in the upper 5802 (e.g., a second slit in the upper 5802). See FIGS. 58A through 58C, 58H, and 58K. The second free end 5858*a* is engaged with the upper 5802, e.g., by stitching or fusing techniques, as generally shown by reference number 5858*c* in FIGS. 58C and 58K.

In a similar manner, the foot stabilizer system 5854 may include additional strap portions 5860, 5862, 5864, and 5866 including free ends 5860*a*, 5862*a*, 5864*a*, and 5866*a*, respectively, located along the instep opening of the upper 5802 to further wrap around the longitudinal length of the foot and provide additional lace engaging loops. Because the connections of these free ends 5860*a*, 5862*a*, 5864*a*, and 5866*a* of this illustrated example structure 5854 are the same as those of free ends 5856*a* and 5858*a* described above, these attachment features are not described again in detail. Of course, if desired, other types of engagements or connections may be used without departing from this invention, including the various connections described above in conjunction with FIGS. 1 through 55. As shown in the structure of FIG. 58H, the various strap portions 5856 through 5866 may be joined together as an overall, unitary, one-piece structure (e.g., to form at least some of the bottom portion 5854*a* of the stabilizer 5854).

The example foot stabilizer structure 5854 of FIGS. 58A through 58M has different types of free end portions for the pair of bottommost (or forward-most) securing system (e.g., lace) engaging elements. More specifically, as shown in FIGS. 58A through 58D and 58H, the foot stabilizer system 5854 further includes: (a) a lateral side bottommost strap portion 5868 including a free end 5868*a* defining another securing system engagement component and (b) a medial side bottommost strap portion 5870 including a free end 5870*a* defining another securing system engagement component. The free ends 5868*a* and 5870*a* extend from within the foot-receiving chamber (e.g., through slits 5868*b* and 5870*b* in upper 5802 (optionally through reinforcing element 5814) and include lace receiving openings 5868*c* and 5870*c* defined through them. Unlike free ends 5856*a* through 5866*a*, however, free ends 5868*a* and 5870*a* of this example structure 5854 do not wrap around the instep opening and/or extend back into the interior chamber of the upper 5802. Rather, these free ends 5868*a* and 5870*a* remain unattached outside the upper 5802 and provide openings 5868*c* and 5870*c* for engaging lace 5898.

The example foot stabilizer structure 5854 of FIGS. 58A through 58M also has different free end portions for the pair of topmost (or rearward-most) securing system (e.g., lace) engaging elements. More specifically, as shown in FIGS.

58A through 58D, 58I, and 58M, the foot stabilizer system 5854 further includes: (a) a lateral side topmost strap portion 5872 including a free end 5872*a* defining a securing system engagement component (e.g., a lace engaging component) and (b) a medial side topmost strap portion 5874 including a free end 5874*a* defining another securing system engagement component. These free ends 5872*a* and 5874*a* extend from within the foot-receiving chamber, through first openings 5872*b* and 5874*b* defined in the upper 5802, along an exterior surface of the upper 5802, and through second openings 5872*c* and 5874*c* defined in the upper 5802. The strap free ends 5872*a* and 5874*a* change directions as they wrap around openings 5872*b* and 5874*b* and extend outside the upper 5802. Once back inside the upper 5802, the free ends 5872*a* and 5874*a* are engaged with the upper 5802 (e.g., by stitching or fusing techniques, shown generally in FIGS. 58A, 58C, 58D, 58I, and 58M by reference number 5876). The exposed portions of the strap portions 5872 and 5874 that extend along the exterior surface of the upper 5802 define loops for engaging a footwear securing element (e.g., lace 5989). If necessary or desired, reinforcement elements 5878 may be provided around one or more of the openings 5872*b*, 5874*b*, 5872*c*, and 5874*c*, e.g., to prevent undesired tearing or expansion of the respective openings. These rearward-most straps 5872 and 5874 extend around the rear heel area of the foot-receiving chamber.

The strap portions 5856 through 5874 of the foot stabilizer system 5854 may be made from any desired materials without departing from this invention, including, for example, any of the various materials described above. The strap portions 5856 through 5874 may be made from or may include supports to make them relatively unstretchable (e.g., by incorporating elongated, unstretchable fiber, wire, or other tensile elements or strands into a fabric, as described above). The areas between the individual strap portions 5856 through 5874 may be interconnected with one another, e.g., through the use of one or more pieces of fabric material 5880, to provide a continuous sheet for wrapping the heel, sides, and plantar surface of the foot. If desired, the foot stabilizer system 5854 may be mounted on a fabric sheet. The intermediate fabric 5880 may be more stretchable than the strap portions 5856 through 5874, if desired. Also, if desired, more or fewer lace engaging loops may be provided in a foot stabilizer structure 5854 without departing from this invention. As another alternative, if desired, not every lace engaging element in the footwear structure needs to connect with the foot stabilizer system.

While it is not a requirement, in the structures illustrated in FIGS. 58A through 58M, the free ends and the strap portions of the foot stabilizer system 5854 are separate elements that are engaged with one another, e.g., by sewing or stitching, by fusing techniques, by mechanical connectors, or the like. Other arrangements are possible without departing from this invention, including varying the length of the free ends and/or their engagement position with the main strap portion. As another example, if desired, the free ends could be integrally formed with the remainder of the strap portions, e.g., as unitary, one-piece structures. Other variations in size, shape, and orientation and the strap portions and/or their free ends also are possible without departing from this invention.

The foot stabilizer system 5854 extends from the footbed to the eyelets for engaging the lace and from the rear heel to at least the midfoot or forefoot area (and optionally along the entire longitudinal length of the foot). When the lace 5898 is tightened, this stabilizer 5854 wraps around the foot to provide a 360°, adaptive, locked down, and customized fit.

Several figures also show that the interior chamber of this example shoe 5800 includes a heel pad component 5882 engaged with the upper 5802 and around a heel portion of the foot stabilizer 5854. The heel pad component 5882 lies in front of the heel portion of the foot stabilizer 5854 to provide an exposed surface in the heel area of the foot-receiving chamber for contacting a wearer's heel. The heel pad component 5882 may include a foam, fabric, or other comfortable material, to provide a soft, comfortable, and non-abrasive structure for engaging the wearer's heel, and it may be engaged with the upper 5802 and/or foot stabilizer 5854 in any desired manner, including through the use of stitching or sewing. Alternatively, if desired, an interior bootie element may be provided within the foot-receiving chamber to cover any desired proportion of the foot stabilizer 5854 (including all of the foot stabilizer 5854), to reduce or eliminate direct contact between the foot stabilizer 5854 and the wearer's foot. This heel pad component 5882 can be particularly advantageous for use when the foot stabilizer system 5854 is tightly engaged with a user's foot.

Shoe structures 5800 of the types described above may include other features, if desired. For example, the shoe 5800 may include a forefoot moderator plate located between a footbed of the upper and an upper surface of the midsole member. This forefoot moderator plate (e.g., as described above in conjunction with FIG. 56) covers the forefoot cleat elements and modulates the feel of these cleat elements to the wearer's foot. As another example, if desired, the shoe structure 5800 may include a heel counter of conventional design, or a half heel counter (e.g., a lateral side heel counter) of the types described above in conjunction with FIGS. 57A through 57C. As noted above in conjunction with FIGS. 57A through 57C, articles of footwear according to some examples of this invention may include a heel counter that has a greater height on a lateral heel side of the heel area than on a medial heel side of the heel area. Optionally, if desired, the heel counter need not even extend around to the medial side area of the heel. Other desired components or features described above also may be incorporated into the shoe structure 5800, if desired.

As described above, the sole structure 5804 of FIGS. 58A through 58G includes six independent outsole pods 5834 through 5844 that are separate and independent from one another and separated at the bottom of the sole structure 5804 by exposed portions of the midsole component 5820. This structure, along with other features described above, promotes the natural motion characteristics of the sole structure 5804 due to the relative flexibility of the midsole component 5820 between the outsole pods 5834 through 5844. Not all outsole pods, however, need to be completely separated from one another. For example, if desired, two or more adjacent outsole pods 5834 through 5844 may be connected together as unitary, one piece structures, e.g., through outsole material extending between the pods.

Figure 59A:
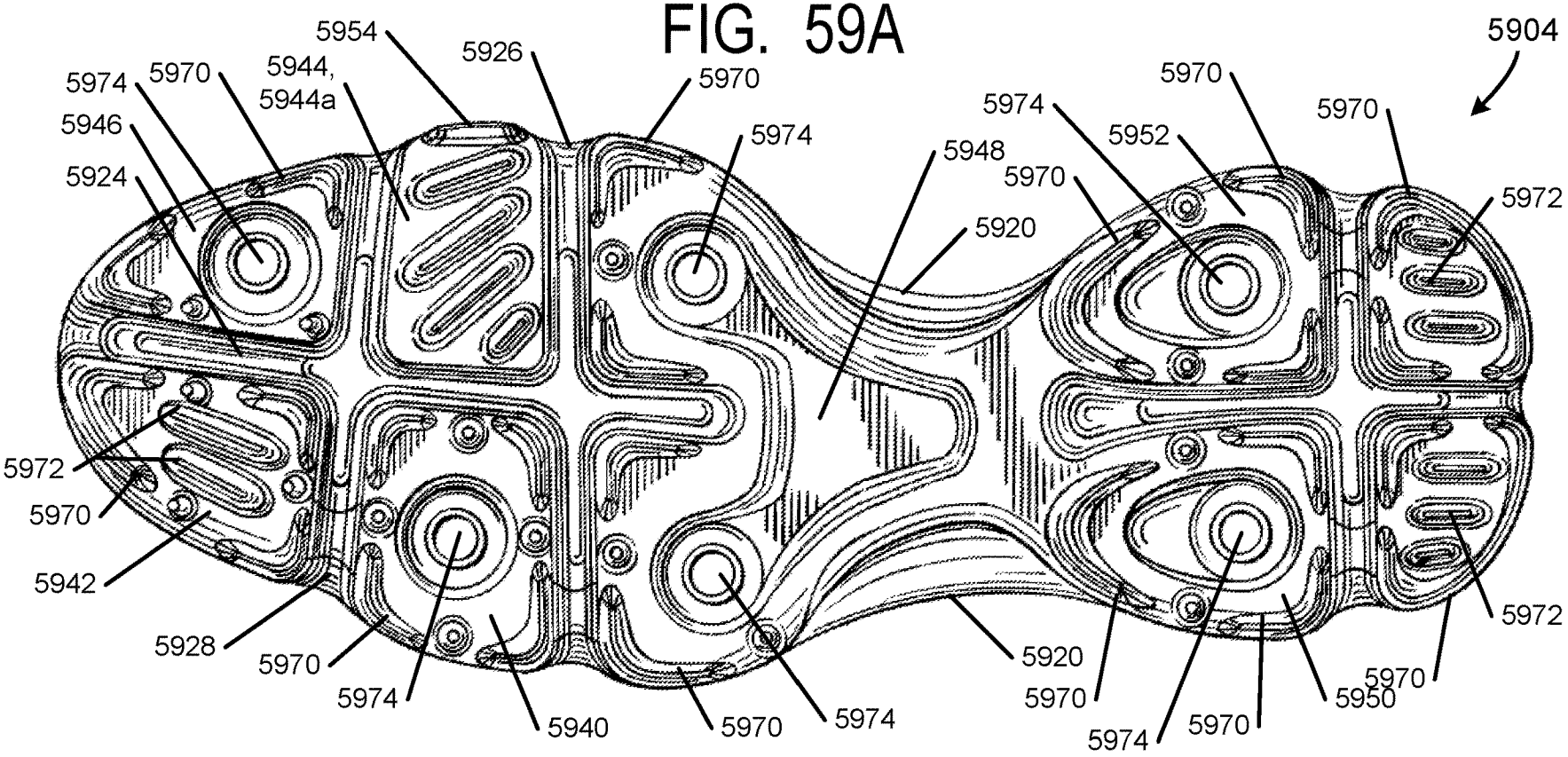
FIGS. 59A through 59C show additional views of another example golf shoe sole structure in accordance with at least some aspects of this invention.
Figure 59B:
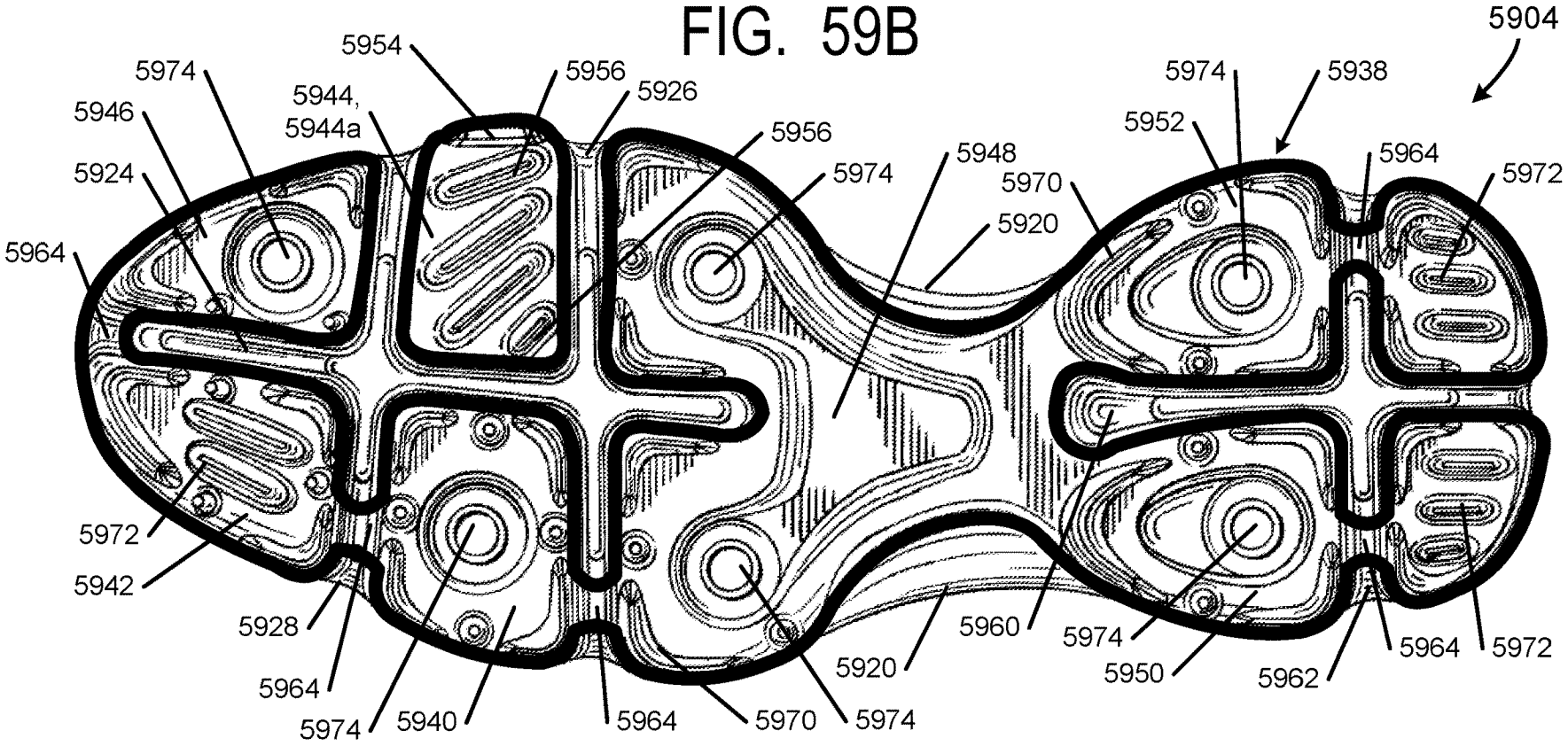

FIGS. 59A and 59B illustrate one example of such a sole structure 5904. FIG. 59A shows a bottom view of the sole structure 5904, and FIG. 59B is a similar view but with the perimeter edges of the outsole members shown in heavy lines to better highlight their shapes and constructions. This sole structure 5904 may be used in conjunction with any desired type of upper and/or foot stabilizing member, including any of the various structures and options for these components described above. This example sole structure 5904 will be described in more detail below.

The example sole structure 5904 of FIGS. 59A and 59B includes a midsole component 5920 formed, at least in part, from a polymeric foam material or any other desired material, including materials that are conventionally known and used in the footwear art. If desired, this midsole component 5920 may include one or more fluid-filled bladders (e.g., at least partially embedded or contained in a foam material). This midsole component 5920 includes: (a) a first longitudinal flexion groove 5924 defined in a forefoot area of the midsole component 5920, (b) a first transverse flexion groove 5926 defined in a midfoot or forefoot area of the midsole component 5920, and (c) a second transverse flexion groove 5928 located on a forefoot side of the first transverse flexion groove 5926 in the forefoot area of the midsole component 5920. In this illustrated example, the first longitudinal flexion groove 5924 extends from a front toe area to a midfoot area of the sole structure 5904, and the two transverse flexion grooves 5926 and 5928 extend essentially the entire width of the sole structure 5904, from the medial side edge to the lateral side edge.

At least one outsole component (and in this illustrated example, two separate outsole components 5938 and 5944) are engaged with the midsole component 5920. If desired, the midsole component 5920 may be formed, e.g., during a molding process, to include recesses or other structures into which the outsole component(s) is (are) fit and secured (e.g., using adhesives or cements, fusing techniques, etc.). The outsole component(s) may be made of rigid materials, including PEBAX® plastic materials (available from Arkema France Corporation), thermoplastic polyurethanes, thermoplastic rubbers, carbon fiber, or the like, including the various materials described above for the outsole component.

In this illustrated example, the overall outsole includes at least: (a) a first outsole component 5938 located at least on a lateral side of the first longitudinal flexion groove 5924 between the first and second transverse flexion grooves 5926 and 5928, and (b) a second outsole component 5944 located at least on a medial side of the first longitudinal flexion groove 5924 and between the first and second transverse flexion grooves 5926 and 5928. In this illustrated example, the second outsole component 5944 is located beneath the first metatarsal head (e.g., at the metatarsophalangeal joint of the big toe). As best shown by the close up view in FIG. 59C, this second outsole component 5944 includes a side wall portion 5944*b* that extends continuously from a bottom surface 5944*a* of the outsole component 5944 to wrap around a portion of the medial side surface of the midsole component 5920. As further shown in FIGS. 59A through 59C, one or more side wall cleat elements 5954 are provided projecting outward from the side wall portion 5944*b* of outsole component 5944. The sidewall cleat element(s) 5954 provide better engagement, contact, and traction with the ground, particularly with the rear foot on a downswing phase of a golf swing. While the sidewall cleat element 5954 may take on any desired shape, in this illustrated example the side wall cleat element 5954 is an elongated raised rib type cleat element that is permanently fixed with the side wall 5944*b* (as a unitary, one-piece structure), optionally formed in a molding process with the outsole component 5944. One or more removable cleats also could be used as the sidewall cleat(s), if desired, without departing from the invention.

Figure 59C:
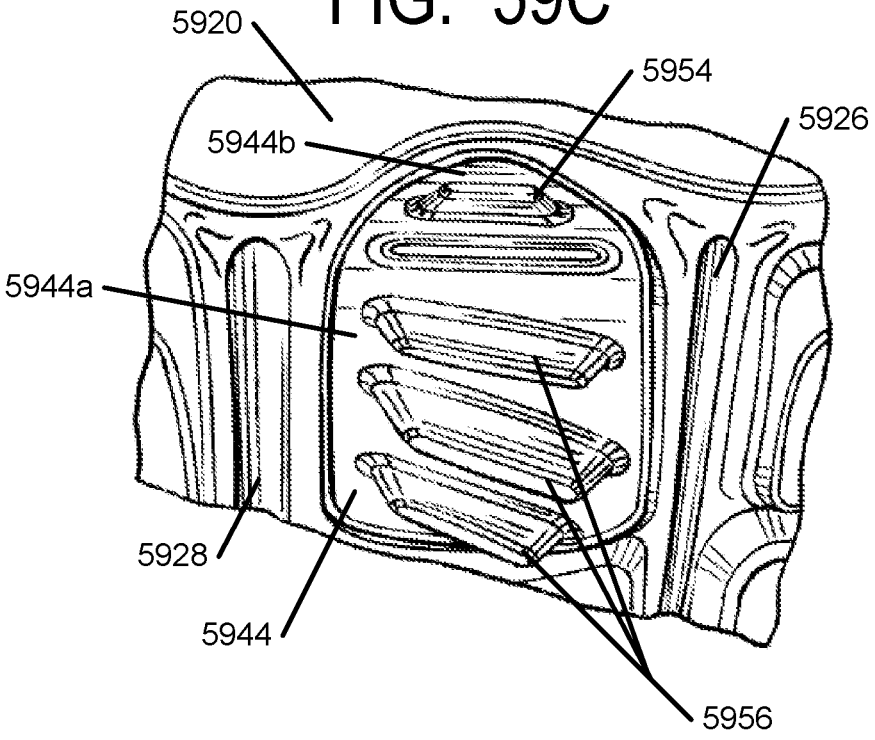

In the example sole structure 5904 shown in FIGS. 59A through 59C, the second outsole component 5944 includes addition cleats in the form of integrally molded cleat elements. More specifically, as shown, the bottom surface 5944*a* of the second outsole component 5944 includes a plurality of integrally formed, elongated raised rib cleat elements 5956. As shown, the elongated rib cleats 5956 on the bottom surface 5944*a* of outsole component 5944 of this example structure 5904 are arranged such that the ribs are not parallel to one another. For example, the interior-most rib cleat 5956 has the most transverse (side-to-side) orientation, with the ribs becoming more longitudinally oriented moving toward the outside of the sole structure 5904. This arrangement provides good contact and engagement with the ground during the downswing and ball contact phases of a golf swing (particularly for the back foot of the player). Nonetheless, other types of cleat elements and/or arrangements thereof could be provided on this bottom surface 5944*a*, if desired, without departing from this invention, including removable cleats as are conventionally known and used in the art.

As best shown in FIG. 59B, the second outsole component 5944 of this example sole structure 5904 is relatively small and discreet, located solely beneath the metatarsophalangeal joint of the big toe. The first outsole component 5938 of this example sole structure, however, is substantially larger. In addition to supporting the medial, forefoot side of the foot (the region marked by reference number 5940), the first outsole component 5938 of this example further includes, as a unitary, one-piece construction, one or more of: (a) a lateral forefoot portion 5942 extending forward from region 5940 and located forward of the second transverse flexion groove 5928 and on the lateral side of the first longitudinal flexion groove 5924; (b) a medial forefoot portion 5946 extending from the lateral forefoot portion 5942 and located on the medial side of the first longitudinal flexion groove 5924 and forward of the second transverse flexion groove 5928; (c) a midfoot portion 5948 extending rearward from the first, lateral side supporting portion 5940 and located rearward of the first transverse flexion groove 5926 (in this illustrated example, the midfoot portion 5948 extends from a lateral side to a medial side of the sole structure 5904 and expands over the entire arch region of the foot); (d) a lateral heel portion 5950 extending rearward from the midfoot portion 5948; and (e) a medial heel portion 5952 extending rearward from the midfoot portion 5948. If desired, as further shown in FIGS. 59A and 59B, the lateral heel portion 5950 and the medial heel portion 5952 may be separated from one another by an opening or groove (e.g., second longitudinal flexion line 5960) defined through the outsole component 5938 (and through which a bottom surface of the midsole component 5920 is exposed). The flexion line 5960 may extend completely or substantially through the heel area of the sole structure 5904. As yet another option or alternative, if desired, each of the lateral heel portion 5950 and the medial heel portion 5952 may be separated into two portions by another transverse opening or groove (e.g., third transverse flexion line 5962) defined through the outsole component 5938 (and through which a bottom surface of the midsole component 5920 is exposed). This transverse flexion line 5962 may extend completely across the sole structure 5904, from the medial side edge to the lateral side edge thereof.

As shown in FIG. 59B, the various pods or portions of the outsole component 5938 may be interconnected through relatively small, thin bands of outsole material 5964 that bridge the gaps between the pods. These bands 5964 of outsole material may be sized and shaped to fit within the various flexion grooves and may be made from a relatively flexible material such that the overall flexibility of the sole structure 5904 is not significantly reduced due to the presence of these bands 5964 in at least some of the flexion grooves.

As some additional options, if desired, the first and second longitudinal flexion lines 5924 and 5960 could be extended, and optionally, could be joined together to form a single, longer transverse flexion line (e.g., extending through the arch area). Other numbers of outsole component parts and/or interconnection structures also may be used without departing from this invention, including other breaks or divisions in the overall outsole component 5938.

FIGS. 59A and 59B show other traction enhancing elements on the outsole component 5938, including various integrally formed, fin-type traction elements 5970 (that help define the various portions or pods of this outsole component 5938) and/or raised rib type traction elements 5972. Also, while no actual removable cleats are illustrated in FIGS. 59A and 59B, general receptacles for receiving such cleats are shown in these figures at reference number 5974. The receptacles 5974 may have any desired cleat engaging technology, including threaded holes, cam or turnbuckle type engagements, or the like. Notably, this sole structure 5904 also has receptacles 5974 for engaging exactly six removable cleats, but the arrangement in this sole structure 5904 is somewhat different from those described above. More specifically, in this example structure 5904, the forefoot cleats are staggered with one removable cleat element located in the area directly under the end of the big toe (on the medial side of flexion line 5924) and not directly adjacent the forward-most lateral forefoot removable cleat element.

The example golf shoe constructions of FIGS. 56 through 59C may provide a well-balanced, natural motion and/or feel for the wearer, akin to the natural motion provided by various NIKE "FREE" type footwear and akin to the feel provided by the sole structures described in the following patents and published patent applications owned by NIKE, Inc. of Beaverton, Oreg.: U.S. Pat. Nos. 6,990,755; 7,171,767; 7,290,357; 7,392,605; 7,607,241; and U.S. Published Patent Application No. 2006/0061012. Each of these patents and the published application is entirely incorporated herein by reference. Any of the various features and structures described in these documents may be used to provide a sole structure for a golf shoe, e.g., as described above, having a more natural motion or feel for the user.

In addition to providing good and natural support and feel for the wearer, golf shoes of the types described above can provide additional benefits useful to players during the play of golf. For example, the flex grooves (transverse and longitudinal) allow the shoe to flex more naturally under the user's weight and against the terrain to give the golfer a better feel for the slope of the terrain. This can help a golfer better determine the type of lie for his/her ball and/or assist with reading the slope on the greens (e.g., better "feeling" the slope through the soles of the shoes). The natural feel and motion also helps the foot to move during the various phases of the swing, e.g., to maintain better contact with the ground, provide better traction, etc., particularly as compared to conventional golf shoes with relatively stiff platforms and supports. The natural feel and motion elements in these golf shoes allow greater movement, particularly for the front of the foot, increasing stability with mobility. These shoes provide greater stability at address, and the freedom of movement that the natural motion technology delivers allows more power to be released through the swing rather than through the body (e.g., due to better, more stable, or prolonged contact with the ground, e.g., at the forefoot area), which can happen when one's feet are too static.

III. CONCLUSION

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

The invention claimed is:

1. A golf shoe, comprising:

an upper defining at least a portion of an interior chamber for receiving a foot; and a sole structure engaged with the upper, wherein the sole structure includes:

a midsole component formed, at least in part, from a polymeric foam material, a first longitudinal flexion groove defined, at least in part, in the midsole component, a first transverse flexion groove defined, at least in part, in the midsole component, a second transverse flexion groove located on a forefoot side of the first transverse flexion groove and defined, at least in part, in the midsole component, an outsole engaged with the midsole component, wherein the outsole includes at least: (a) a first portion located on a lateral side of the first longitudinal flexion groove between the first transverse flexion groove and the second transverse flexion groove, and (b) a second portion located on a medial side of the first longitudinal flexion groove between the first transverse flexion groove and the second transverse flexion groove, wherein the second portion of the outsole includes a side wall portion that extends continuously from a bottom surface to a medial side surface of the midsole component, a first cleat element provided with the first portion of the outsole, and a second cleat element extending outward from the side wall portion of the second portion of the outsole in a sideways direction.

2. The golf shoe according to claim 1, wherein the second portion of the outsole is provided as a completely separate component from the first portion of the outsole.

3. The golf shoe according to claim 1, wherein the first cleat element is removably attached to the first portion of the outsole, and wherein the second cleat element is integrally formed with the side wall portion of the second portion of the outsole as a unitary, one-piece construction.

4. The golf shoe according to claim 1, wherein a bottom surface of the second portion of the outsole further includes a third cleat element.

5. The golf shoe according to claim 1, wherein a bottom surface of the second portion of the outsole includes a plurality of elongated raised rib cleat elements.

6. The golf shoe according to claim 1, wherein the outsole further includes:

a forefoot portion extending forward from the first portion and located forward of the second transverse flexion groove, and a midfoot portion extending rearward from the first portion and located rearward of the first transverse flexion groove, wherein the first portion, the forefoot portion, and the midfoot portion are formed as a unitary, one-piece construction.

7. The golf shoe according to claim 1, wherein the outsole further includes:

a lateral forefoot portion extending forward from the first portion and located forward of the second transverse flexion groove and on the lateral side of the first longitudinal flexion groove, a medial forefoot portion extending from the lateral forefoot portion and located on the medial side of the first longitudinal flexion groove and forward of the second transverse flexion groove, a midfoot portion extending rearward from the first portion and located rearward of the first transverse flexion groove, wherein the midfoot portion extends from a lateral side to a medial side of the sole structure, and a heel portion extending rearward from the midfoot portion, wherein the first portion, the lateral forefoot portion, the medial forefoot portion, the midfoot portion, and the heel portion are formed as a unitary, one-piece construction, and wherein the second portion of the outsole is provided as a completely separate component from the first portion, the lateral forefoot portion, the medial forefoot portion, the midfoot portion, and the heel portion of the outsole.

8. The golf shoe according to claim 7, wherein the heel portion of the outsole includes a longitudinal elongated central opening therein that divides the heel portion into a lateral heel portion and a medial heel portion.

9. The golf shoe according to claim 1, wherein the outsole further includes:

a lateral forefoot portion extending forward from the first portion and located forward of the second transverse flexion groove and on the lateral side of the first longitudinal flexion groove, a medial forefoot portion extending from the lateral forefoot portion and located on the medial side of the first longitudinal flexion groove and forward of the second transverse flexion groove, a midfoot portion extending rearward from the first portion and located rearward of the first transverse flexion groove, wherein the midfoot portion extends from a lateral side to a medial side of the sole structure, a lateral heel portion extending rearward from the midfoot portion, and a medial heel portion extending rearward from the midfoot portion, wherein the lateral heel portion and the medial heel portion are separated by an opening or groove in the outsole through which a bottom surface of the midsole component is exposed, wherein the first portion, the lateral forefoot portion, the medial forefoot portion, the midfoot portion, the lateral heel portion, and the medial heel portion are formed as a unitary, one-piece construction, and wherein the second portion of the outsole is provided as a completely separate component from the unitary, one-piece construction.

10. The golf shoe according to claim 9, wherein the first cleat element is removably attached to the first portion of the outsole, wherein the second cleat element is integrally formed with the side wall portion of the second portion of the outsole as a unitary, one-piece construction, wherein a bottom surface of the second portion of the outsole includes a first series of elongated raised rib cleat elements, and wherein the golf shoe further comprises:

a third cleat element removably engaged with a lateral side of the midfoot portion of the outsole, a fourth cleat element removably engaged with a medial side of the midfoot portion of the outsole, a fifth cleat element removably engaged with the lateral heel portion of the outsole, a sixth cleat element removably engaged with the medial heel portion of the outsole, a seventh cleat element removably engaged with the medial forefoot portion of the outsole, and at least one elongated raised rib cleat integrally formed with the lateral forefoot portion of the outsole as a unitary, one-piece construction.

11. The golf shoe according to claim 1, wherein the second portion of the outsole additionally includes a bottom surface that extends along the bottom surface of the midsole component, and wherein the side wall portion of the second portion of the outsole extends continuously from the bottom surface of the second portion of the outsole and wraps around a portion of the medial side surface of the midsole component.

12. A golf shoe, comprising:

an upper defining at least a portion of an interior chamber for receiving a foot;

a sole structure engaged with the upper, wherein the sole structure includes:

a midsole component formed, at least in part, from a polymeric foam material, and an outsole engaged with the midsole component, wherein the outsole includes at least: (a) a first portion located at least at a lateral forefoot area of the sole structure and (b) a second portion located at a medial forefoot area of the sole structure, wherein the second portion of the outsole includes a side wall portion that extends continuously from a bottom surface to a medial side surface of the midsole component, wherein the first portion of the outsole is a completely separate component from the second portion of the outsole and is separated from the second portion of the outsole by a longitudinally extending line of the midsole component that is exposed at a bottom of the sole structure;

a first clear element provided with the first portion of the outsole; and a second cleat element extending outward from the side wall portion of the second portion of the outsole in a sideways direction.

13. The golf shoe according to claim 12, wherein the second portion of the outsole additionally includes a bottom surface that extends along the bottom surface of the midsole component, and wherein the side wall portion of the second portion of the outsole extends continuously from the bottom surface of the second portion of the outsole and wraps around a portion of the medial side surface of the midsole component.

14. The golf shoe according to claim 12, wherein the outsole further includes:

a forefoot portion extending forward from the first portion and located at a forward toe area of the sole structure; and a midfoot portion extending rearward from the first portion, wherein the first portion, the forefoot portion, and the midfoot portion are formed as a unitary, one-piece construction.

15. The golf shoe according to claim 12, wherein the outsole further includes:

a lateral forefoot portion extending forward from the first portion and located at a lateral toe area of the sole structure, a medial forefoot portion extending from the lateral forefoot portion and located at a medial toe area of the sole structure and forward of the second portion of the outsole, wherein the medial forefoot portion of the outsole is completely separated from the second portion of the outsole by a first transversely extending line of the midsole component that is exposed at a bottom of the sole structure, a midfoot portion extending rearward from the first portion, wherein the midfoot portion of the outsole is completely separated from the second portion of the outsole by a second transversely extending line of the midsole component that is exposed at a bottom of the sole structure, and wherein the midfoot portion extends from a lateral side to a medial side of the sole structure, and a heel portion extending rearward from the midfoot portion, wherein the first portion, the lateral forefoot portion, the medial forefoot portion, the midfoot portion, and the heel portion are formed as a unitary, one-piece construction, and wherein the second portion of the outsole is provided as a completely separate component from the first portion, the lateral forefoot portion, the medial forefoot portion, the midfoot portion, and the heel portion of the outsole.

16. The golf shoe according to claim 15, wherein the heel portion of the outsole includes a longitudinal elongated central opening therein that divides the heel portion into a lateral heel portion and a medial heel portion.

17. A golf shoe, comprising:

an upper defining at least a portion of an interior chamber for receiving a foot; and a sole structure including an outsole and a midsole component, wherein the midsole component is formed, at least in part, from a polymeric foam material and is engaged with the upper, and wherein the outsole is engaged with the midsole component, wherein the outsole includes:

(a) a first portion located at a lateral forefoot area of the sole structure, (b) a lateral forefoot portion located at a lateral toe area of the sole structure, wherein a first gap in the outsole partially separates the first portion and the lateral forefoot portion, and wherein a first bridge of outsole material extends across the first gap and joins the first portion and the lateral forefoot portion of the outsole together, (c) a medial forefoot portion located at a medial toe area of the sole structure, wherein a second gap in the outsole partially separates the lateral forefoot portion and the medial forefoot portion, and wherein a second bridge of the outsole material extends across the second gap and joins the lateral forefoot portion and the medial forefoot portion of the outsole together, (d) a midfoot portion located rearward from the first portion, wherein a third gap in the outsole partially separates the first portion and the midfoot portion, and wherein a third bridge of the outsole material extends across the third gap and joins the first portion and the midfoot portion of the outsole together, and (e) a second portion located at a medial forefoot area of the sole structure, wherein the second portion includes a side wall portion that extends continuously from a bottom surface to a medial side surface of the midsole component, and wherein a cleat element extends outward and in a sideways direction from the side wall portion, wherein a first longitudinal flexion line separates the first portion and the second portion, wherein a first transverse flexion line separates the second portion and the medial forefoot portion, wherein a second transverse flexion line separates the second portion and the midfoot portion, and wherein the second portion is a separate component from the first portion, the lateral forefoot portion, the medial forefoot portion, and the midfoot portion.

18. The golf shoe according to claim 17, wherein the second portion of the outsole additionally includes a bottom surface that extends along a bottom surface of the midsole component, wherein the side wall portion of the second portion extends continuously from the bottom surface of the outsole and wraps around a portion of the medial side surface of the midsole component, and wherein the cleat element is an elongated raised rib cleat element.

19. The golf shoe according to claim 18, wherein the bottom surface of the second portion of the outsole includes a plurality of elongated raised rib cleat elements.

20. The golf shoe according to claim 17, wherein the outsole further includes:

a heel portion extending rearward from the midfoot portion, wherein the first portion, the lateral forefoot portion, the medial forefoot portion, the midfoot portion, and the heel portion are formed as a unitary, one-piece construction that extends from a forward toe area to a rear heel area of the outsole, and wherein the heel portion of the outsole includes a longitudinal elongated central opening therein that divides the heel portion into a lateral heel portion and a medial heel portion.

* * * * *